US007300144B2

(12) United States Patent
Katayama et al.

(10) Patent No.: US 7,300,144 B2
(45) Date of Patent: Nov. 27, 2007

(54) INK CARTRIDGE

(75) Inventors: Naoki Katayama, Kariya (JP); Toyonori Sasaki, Anjo (JP); Tomohiro Kanbe, Bisai (JP); Katsunori Nishida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/605,954

(22) Filed: Nov. 30, 2006

(65) Prior Publication Data

US 2007/0091154 A1 Apr. 26, 2007

Related U.S. Application Data

(63) Continuation of application No. 11/391,644, filed on Mar. 29, 2006, now Pat. No. 7,178,911, which is a continuation-in-part of application No. 11/024,624, filed on Dec. 30, 2004, and a continuation-in-part of application No. 10/938,840, filed on Sep. 13, 2004, which is a continuation-in-part of application No. 10/255,604, filed on Sep. 27, 2002, now Pat. No. 7,137,689, said application No. 11/391,644 is a continuation-in-part of application No. 11/101,447, filed on Apr. 8, 2005, now Pat. No. 7,033,011, which is a continuation of application No. 10/614,126, filed on Jul. 8, 2003, now Pat. No. 6,893,118, which is a continuation of application No. 10/108,394, filed on Mar. 29, 2002, now Pat. No. 6,616,255.

(30) Foreign Application Priority Data

| | | |
|---|---|---|
| Mar. 30, 2001 | (JP) | 2001-102423 |
| Mar. 28, 2002 | (JP) | 2002-090322 |
| Jul. 10, 2002 | (JP) | 2002-018535 |
| Jul. 10, 2002 | (JP) | 2002-018536 |
| Jul. 10, 2002 | (JP) | 2002-018537 |
| Jul. 10, 2002 | (JP) | 2002-018538 |
| Jul. 10, 2002 | (JP) | 2002-018539 |
| Jul. 10, 2002 | (JP) | 2002-018540 |
| Jul. 10, 2002 | (JP) | 2002-018541 |
| Jul. 10, 2002 | (JP) | 2002-018542 |
| Jul. 10, 2002 | (JP) | 2002-018543 |
| Jul. 10, 2002 | (JP) | 2002-018544 |
| Jul. 23, 2002 | (JP) | 2002-019748 |
| Jul. 23, 2002 | (JP) | 2002-019749 |
| Jul. 23, 2002 | (JP) | 2002-019750 |
| Jul. 23, 2002 | (JP) | 2002-019751 |
| Jul. 23, 2002 | (JP) | 2002-019752 |
| Jul. 23, 2002 | (JP) | 2002-019753 |
| Jul. 23, 2002 | (JP) | 2002-019754 |
| Jul. 23, 2002 | (JP) | 2002-019755 |
| Jul. 23, 2002 | (JP) | 2002-019756 |
| Jul. 23, 2002 | (JP) | 2002-019757 |
| Jul. 23, 2002 | (JP) | 2002-019758 |
| Jul. 23, 2002 | (JP) | 2002-019759 |
| Jul. 23, 2002 | (JP) | 2002-019760 |
| Jul. 23, 2002 | (JP) | 2002-019761 |
| Jul. 23, 2002 | (JP) | 2002-019762 |
| Jul. 23, 2002 | (JP) | 2002-019763 |
| Jul. 23, 2002 | (JP) | 2002-214079 |
| Jul. 26, 2002 | (JP) | 2002-218192 |
| Aug. 1, 2002 | (JP) | 2002-225295 |
| Sep. 30, 2003 | (JP) | 2003-340284 |
| Mar. 16, 2004 | (JP) | 2004-074508 |
| Mar. 17, 2004 | (JP) | 2004-076627 |
| Mar. 17, 2004 | (JP) | 2004-076628 |
| Nov. 28, 2005 | (JP) | 2005-342686 |

(51) Int. Cl.
*B41J 2/175* (2006.01)
*B41J 2/195* (2006.01)

(52) U.S. Cl. ..... 347/86; 347/7

(58) Field of Classification Search ..... 347/7, 347/85, 86, 87; 73/293, 334; 137/558
See application file for complete search history.

(56) References Cited

U.S. PATENT DOCUMENTS 4,074,284 A 2/1978 Dexter et al.

| | | | | |
|---|---|---|---|---|
| 4,183,031 | A | | 1/1980 | Kyser et al. |
| 4,342,042 | A | | 7/1982 | Cruz-Uribe et al. |
| 4,509,062 | A | | 4/1985 | Low et al. |
| 4,604,633 | A | | 8/1986 | Kimura et al. |
| 4,673,955 | A | | 6/1987 | Ameyama et al. |
| 4,777,497 | A | | 10/1988 | Nozu et al. |
| 5,283,593 | A | | 2/1994 | Wehl |
| 5,473,350 | A | | 12/1995 | Mader et al. |
| 5,526,026 | A | * | 6/1996 | Bowers ..... 347/6 |
| 5,623,290 | A | | 4/1997 | Iida et al. |
| 5,719,609 | A | | 2/1998 | Hauck et al. |
| 5,729,256 | A | | 3/1998 | Yamanaka et al. |
| 5,736,992 | A | | 4/1998 | Pawlowski, Jr. et al. |
| 5,777,647 | A | | 7/1998 | Pawlowski, Jr. et al. |
| 5,842,800 | A | * | 12/1998 | Bailey et al. ..... 400/703 |
| 5,896,151 | A | | 4/1999 | Miyazawa et al. |
| 5,936,645 | A | | 8/1999 | Niikura et al. |
| 6,116,723 | A | | 9/2000 | Childers |
| 6,142,617 | A | | 11/2000 | Barinaga et al. |
| 6,168,262 | B1 | | 1/2001 | Clark et al. |
| 6,170,937 | B1 | | 1/2001 | Childers et al. |
| 6,270,207 | B1 | | 8/2001 | Sasaki |
| 6,338,552 | B1 | | 1/2002 | Sato et al. |
| 6,422,674 | B1 | | 7/2002 | Hinami et al. |
| 6,481,837 | B1 | | 11/2002 | Askren et al. |
| 6,521,311 | B2 | | 2/2003 | Ito et al. |
| 6,554,402 | B2 | | 4/2003 | Trafton et al. |
| 6,609,461 | B2 | | 8/2003 | Horii et al. |
| 6,616,255 | B2 | | 9/2003 | Murakami et al. |
| 6,796,627 | B2 | * | 9/2004 | Kimura et al. ..... 347/7 |
| 6,830,322 | B2 | | 12/2004 | Shihon et al. |
| 6,893,118 | B2 | | 5/2005 | Murakami et al. |
| 6,899,418 | B2 | | 5/2005 | Sasaki et al. |
| 2001/0024226 | A1 | | 9/2001 | Sasaki |
| 2002/0047882 | A1 | | 4/2002 | Karlinski et al. |
| 2003/0030707 | A1 | | 2/2003 | Sasaki |
| 2003/0048339 | A1 | | 3/2003 | Sasaki |

FOREIGN PATENT DOCUMENTS

| | | | |
|---|---|---|---|
| CN | 1189415 | A | 8/1998 |
| DE | GM 80 23 471 | | 11/1980 |
| EP | 0 626 267 | | 11/1994 |
| EP | 0 689 936 | | 1/1996 |
| EP | 0 742 102 | | 11/1996 |
| EP | 0 834 402 | | 4/1998 |
| EP | 1 142 713 | A2 | 10/2001 |
| JP | A 58 53473 | | 3/1983 |
| JP | A-59-143646 | | 8/1984 |
| JP | A 59 192573 | | 10/1984 |
| JP | 59 204564 | | 11/1984 |
| JP | A 59 204566 | | 11/1984 |
| JP | A-59-209878 | | 11/1984 |
| JP | A 61 054942 | | 3/1986 |
| JP | A-61-158460 | | 7/1986 |
| JP | A-61-277459 | | 12/1986 |
| JP | A-61-277460 | | 12/1986 |
| JP | 63 207652 | | 8/1988 |
| JP | A-10-20149 | | 1/1989 |
| JP | 02 102062 | | 4/1990 |
| JP | A 3 184873 | | 8/1991 |
| JP | A 3 213349 | | 9/1991 |
| JP | B2 3 60670 | | 9/1991 |
| JP | A 3 505999 | | 12/1991 |
| JP | A-03-506000 | | 12/1991 |
| JP | 04 344250 | | 11/1992 |
| JP | A-05-261935 | | 10/1993 |
| JP | 06 024001 | | 2/1994 |
| JP | 06 099588 | | 4/1994 |
| JP | 06 115089 | | 4/1994 |
| JP | A-07-214791 | | 8/1995 |
| JP | 07 314716 | | 12/1995 |
| JP | 07-314716 | | 12/1995 |
| JP | A-08-230204 | | 9/1996 |
| JP | A 9 1819 | | 1/1997 |
| JP | A-09-20014 | | 1/1997 |
| JP | 10 202896 | | 4/1998 |
| JP | B2 2768817 | | 4/1998 |
| JP | 10 232157 | | 9/1998 |
| JP | 11 058783 | | 3/1999 |
| JP | A 2000 071472 | | 3/2000 |
| JP | 2002 086753 | | 3/2002 |
| JP | A 2000 297320 | | 10/2005 |
| WO | WO 90/08564 | | 8/1990 |

OTHER PUBLICATIONS

U.S. Appl. No. 10/758,098, filed Jan. 16, 2004, Sasaki et al.
U.S. Appl. No. 10/255,617, filed Sep. 27, 2002, Sasaki et al.
U.S. Appl. No. 10/255,606, filed Sep. 27, 2002, Sasaki et al.
U.S. Appl. No. 10/255,646, filed Sep. 27, 2002, Sasaki et al.
U.S. Appl. No. 10/255,618, filed Sep. 27, 2002, Sasaki et al.
U.S. Appl. No. 11/101,447, filed Apr. 8, 2005, Murakami et al.

* cited by examiner

*Primary Examiner*—Anh T. N. Vo
(74) *Attorney, Agent, or Firm*—Oliff & Berridge, PLC

(57) ABSTRACT

An ink cartridge includes a cartridge case; an ink chamber situated within the cartridge case; an ink supply opening formed in the cartridge case for supplying ink from the ink chamber to an exterior of the cartridge; and a lever mechanism provided in the ink chamber, the lever mechanism including a light blocking member at a first end of the lever mechanism, the lever mechanism being rotatable about a rotation point on the lever mechanism, and the light blocking member being movable in association with rotation of the lever mechanism.

17 Claims, 60 Drawing Sheets

(a)

(b)

(b)

(a)

INK CARTRIDGE

CROSS-REFERENCE TO RELATED APPLICATIONS

This application claims priority from JP 2001-102423, filed Mar. 30, 2001; JP 2002-090322, filed Mar. 28, 2002; JP 2002-218192, filed Jul. 26, 2002; JP 2002-225295, filed Aug. 1, 2002; JP 2002-214079, filed Jul. 23, 2002; JP 2002-018535, JP 2002-018536, JP 2002-018537, JP 2002-018538, JP 2002-018539, JP 2002-018540, JP 2002-018541, JP 2002-018542, JP 2002-018543, JP 2002-018544, each filed Jul. 10, 2002; JP 2002-019748, JP 2002-019749, JP 2002-019750, JP 2002-019751, JP 2002-019752, JP 2002-019753, JP 2002-019754, JP 2002-019755, JP 2002-019756, JP 2002-019757, JP 2002-019758, JP 2002-019759, JP 2002-019760, JP 2002-019761, JP 2002-019762, JP 2002-019763, each filed Jul. 23, 2002; JP 2003-340284, filed Sep. 30, 2003; JP 2004-074508, filed Mar. 16, 2004; JP 2004-076627, JP 2004-076628, each filed Mar. 17, 2004; and JP 2005-342686, filed Nov. 28, 2005; the disclosures of which are incorporated herein by reference in their entireties.

This application is a continuation-in-part of: U.S. patent application Ser. No. 11/024,624, filed Dec. 30, 2004 (which is a continuation-in-part of U.S. patent application Ser. No. 10/255,604, filed Sep. 27, 2002 now U.S. Pat. No. 7,137,689 and U.S. patent application Ser. No. 10/938,840, filed Sep. 13, 2004) and U.S. patent application Ser. No. 11/101,447, filed Apr. 8, 2005 now U.S. Pat. No. 7,033,011 (which is a continuation of U.S. patent application Ser. No. 10/614,126, filed Jul. 8, 2003, now U.S. Pat. No. 6,893,118 which, in turn, is a continuation of U.S. patent application Ser. No. 10/108,394, filed Mar. 29, 2002) now U.S. Pat. No. 6,616,255, the disclosures of which are incorporated herein by reference in their entireties.

BACKGROUND

Ink cartridges for supplying ink to recording devices are broadly used. One type has a case that holds a porous member impregnated with ink. Another type includes a flexible bag filled with ink. A variety of configurations have been provided in the ink cartridges to enable detection of the amount of ink remaining in the ink cartridge.

JP-B-3-60670 discloses an ink cartridge with a plate-shaped member that abuts the outer surface of a flexible bag that is filled with ink. Movement of the member is detected to detect the amount of residual ink in the bag.

JP-A-3-505999 discloses an ink cartridge including a case with one open surface. The open end of the case is covered with a flexible film. Ink is contained in the space between the case and the flexible film. An electric contact is disposed at the bottom of an opening in the case. The film moves toward the electric contact as ink is used up during printing operations. When the film contacts the electric contact, the electric contact is activated to indicate that ink has run out.

An ink-jet printer is known, in which ink is discharged from nozzles to recording paper to perform printing. Such an inkjet printer is generally provided with a detachable ink cartridge. When an inkjet head is driven to perform the discharge operation in a state in which the ink cartridge is empty, air sometimes invades the inkjet head. An inkjet head into which the air has been introduced may be damaged so as to be inoperable. Therefore, it is necessary to detect the amount of the ink stored in an ink cartridge. A method for detecting the amount of the ink is known in which an amount of the ink is detected by estimating and accumulating amounts of the ink used each time printing is performed. However, errors tend to arise in such calculations. Therefore, it is prudent to stop the use of the ink cartridge before actually necessary. As a result, ink is wasted.

An alternative technique has been proposed (see, e.g., JP-A-9-001819, FIG. 7). That is, a float, which has a specific gravity smaller than that of ink, is arranged on the ink contained in the ink cartridge. The height of the float floating on the ink is detected from the outside to detect the amount of the ink contained in the ink cartridge.

However, according to the technique disclosed in JP-A-9-001819, the float sometimes sticks to the wall surface. That is, the float does not descend due to disturbances such as surface tension of ink adhered to an inner wall surface of the ink cartridge. Therefore, it is impossible to indicate the correct amount of the ink contained in the ink cartridge.

SUMMARY

Various exemplary embodiments of ink cartridges according to the present invention address shortcomings of the ink cartridges and ink detection techniques described above.

In various exemplary embodiments, an ink cartridge includes a cartridge case; an ink chamber situated within the cartridge case; an ink supply opening formed in the cartridge case for supplying ink from the ink chamber to an exterior of the cartridge; and a lever mechanism provided in the ink chamber, the lever mechanism including a light blocking member at a first end of the lever mechanism, the lever mechanism being rotatable about a rotation point on the lever mechanism, and the light blocking member being movable in association with rotation of the lever mechanism.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein:

FIG. 42 shows the ink cartridge depicted in FIG. 41, wherein

FIGS. 49A and 49B are sectional views illustrating the ink supply valve in FIG. 44, wherein FIG. 49A shows a valve-closed state and FIG. 49B shows a valve-open state;

FIG. 62(*b*) is a cross sectional view of the cap shown in FIG. 62(*a*);

FIG. 64(*b*) is a cross sectional view of an exemplary ink cartridge and an exemplary inkjet printer according to the present invention during mounting of the ink cartridge;

FIG. 64(*c*) is a cross sectional view of an exemplary ink cartridge and an exemplary inkjet printer according to the present invention after mounting of the ink cartridge;

FIG. 65(*b*) is a cross sectional view of an exemplary ink cartridge and an exemplary inkjet printer according to the present invention during dismounting of the ink cartridge;

FIG. 65(*c*) is a cross sectional view of an exemplary ink cartridge and an exemplary inkjet printer according to the present invention after dismounting of the ink cartridge;

FIG. 66(*b*) is a front view of a frame of an exemplary ink cartridge according to the present invention emptied of ink;

FIG. 67(*b*) is a cross sectional view of the ink detection projection shown in FIG. 67(*a*);

FIG. 67(*c*) is a cross sectional view of the ink detection projection shown in FIG. 67(*a*);

FIG. 68(*b*) is an end view of a detector of an exemplary ink cartridge according to the present invention.

DETAILED DESCRIPTION OF EMBODIMENTS

An exemplary ink cartridge 200 and an exemplary multifunction device 1 that uses the ink cartridge 200 will be described with reference to FIGS. 1 to 36. It should be appreciated that, while reference is made throughout this application to multifunction devices, the cartridges, machine features and methods described herein are equally applicable to uni-functional image forming devices, such as printers, copiers and facsimile machines.

Figure 1:
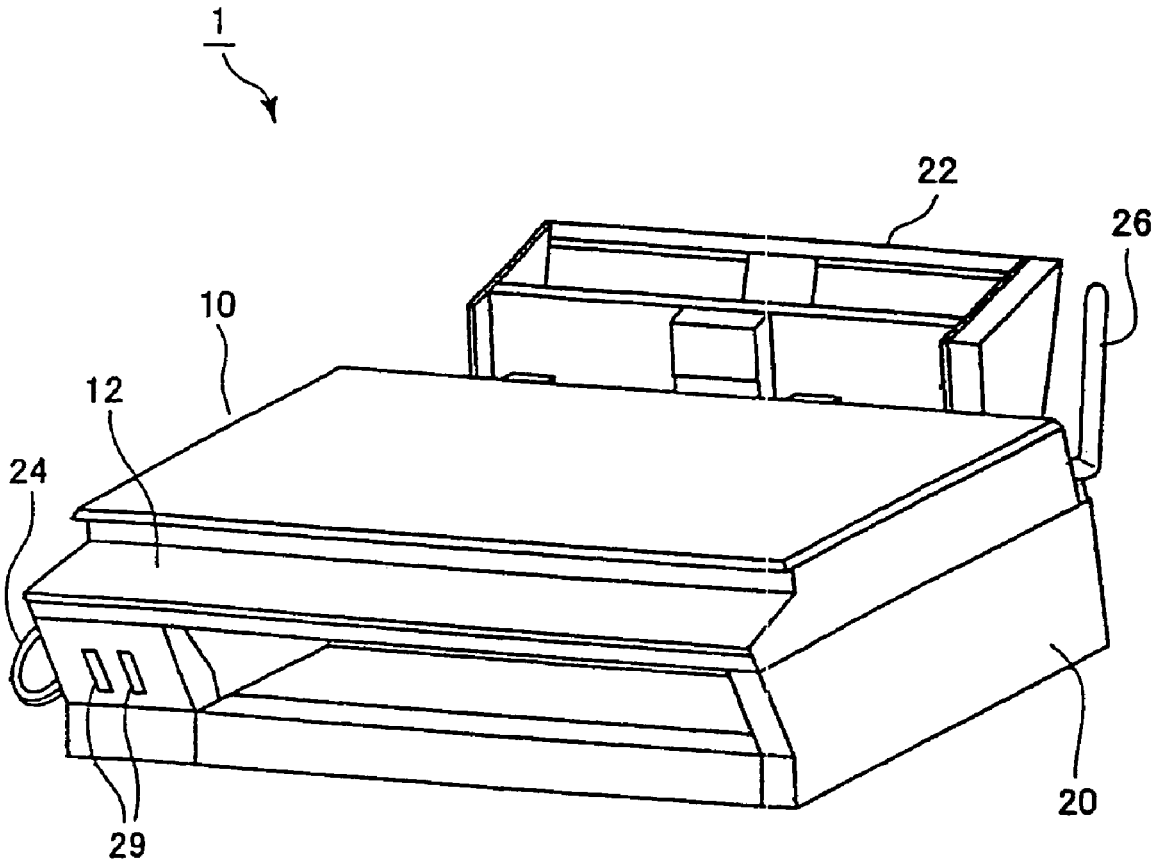
FIG. 1 is a perspective view showing overall configuration of an exemplary multifunction device mounted with an exemplary ink cartridge.

FIG. 1 shows an exemplary multifunction device 1. The multifunction device 1 includes a scanner function, a copy function, and a facsimile function. The multifunction device 1 has a slim and compact configuration including a retrieval unit 10 and an ink jet recording unit 20. The ink jet recording unit 20 is disposed on the retrieval unit 10. A control panel 12 is provided on the retrieval unit 10. The ink jet recording unit 20 is provided with a sheet-supply tray 22. The multifunction device 1 is provided with a telephone 24 and an antenna 26. The telephone 24 is capable of wireless transmission with a cordless handset (not shown) using the antennae 26. The telephone 24 is capable of connecting with a public telephone circuit and serving as a transfer point for the cordless handset (not shown) while the cordless handset is used for a telephone call.

Figure 7:
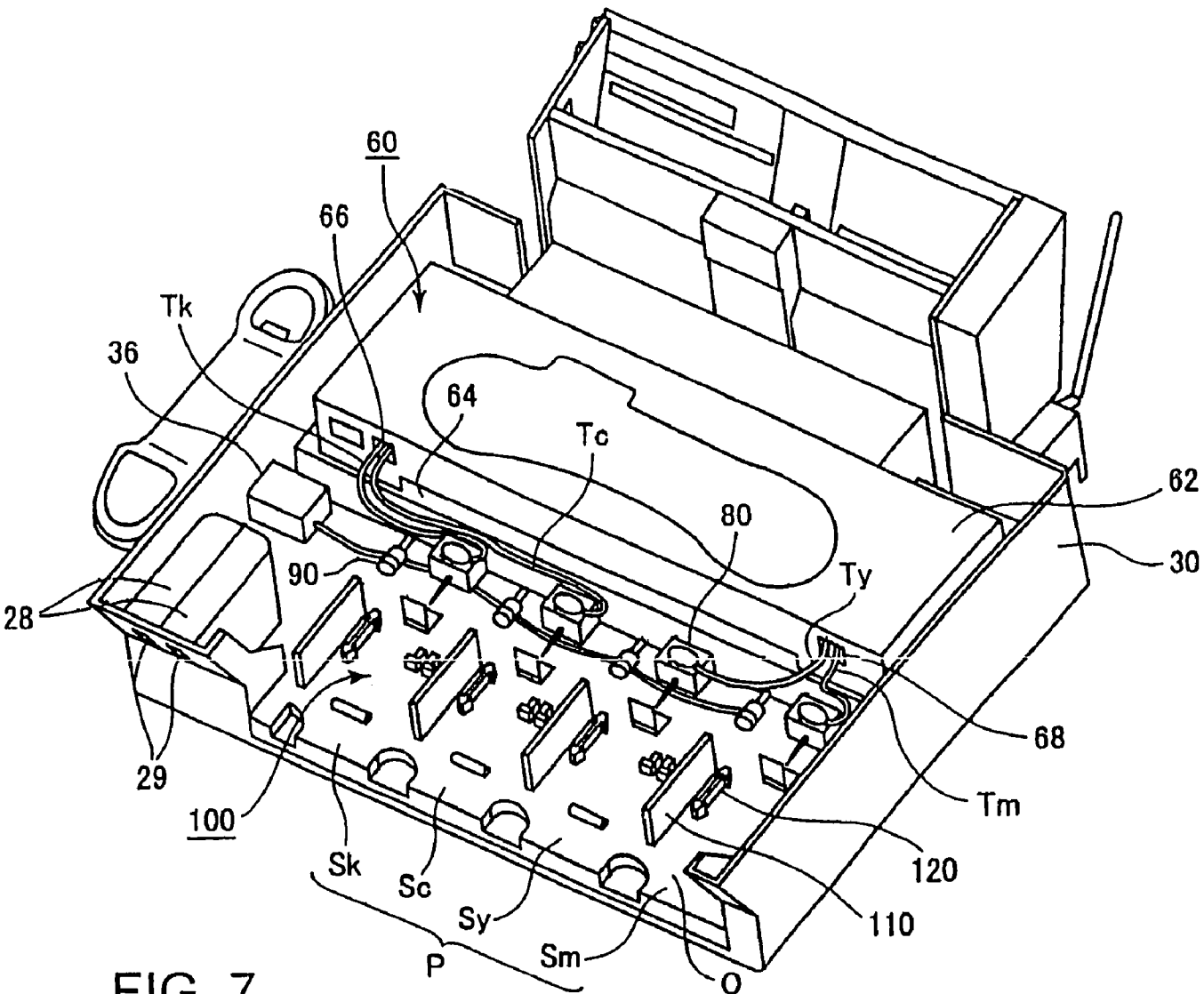
FIG. 7 is a perspective view of an exemplary multifunction device without a flat bed type retrieval unit or a cover body.

It should be noted that a power source, a main substrate, an NCU substrate, and two media board devices 28 shown in FIG. 7 are provided in the ink jet recording unit 20 in addition to recording mechanisms for performing recording operations. The main substrate is for controlling operations of the multifunction device 1. The NCU substrate is for controlling connection with the public telephone circuit for the facsimile function and the telephone function. Two media slots 29 are provided at the front surface of the ink jet recording unit 20. By inserting an external memory medium into either of the media slots 29, the external medium can be freely detachably mounted in the corresponding one of the media board devices 28. The media board devices 28 retrieve data, such as data taken by a digital camera, from the external memory medium, whereupon the data is used for printing and the like.

Figure 2:
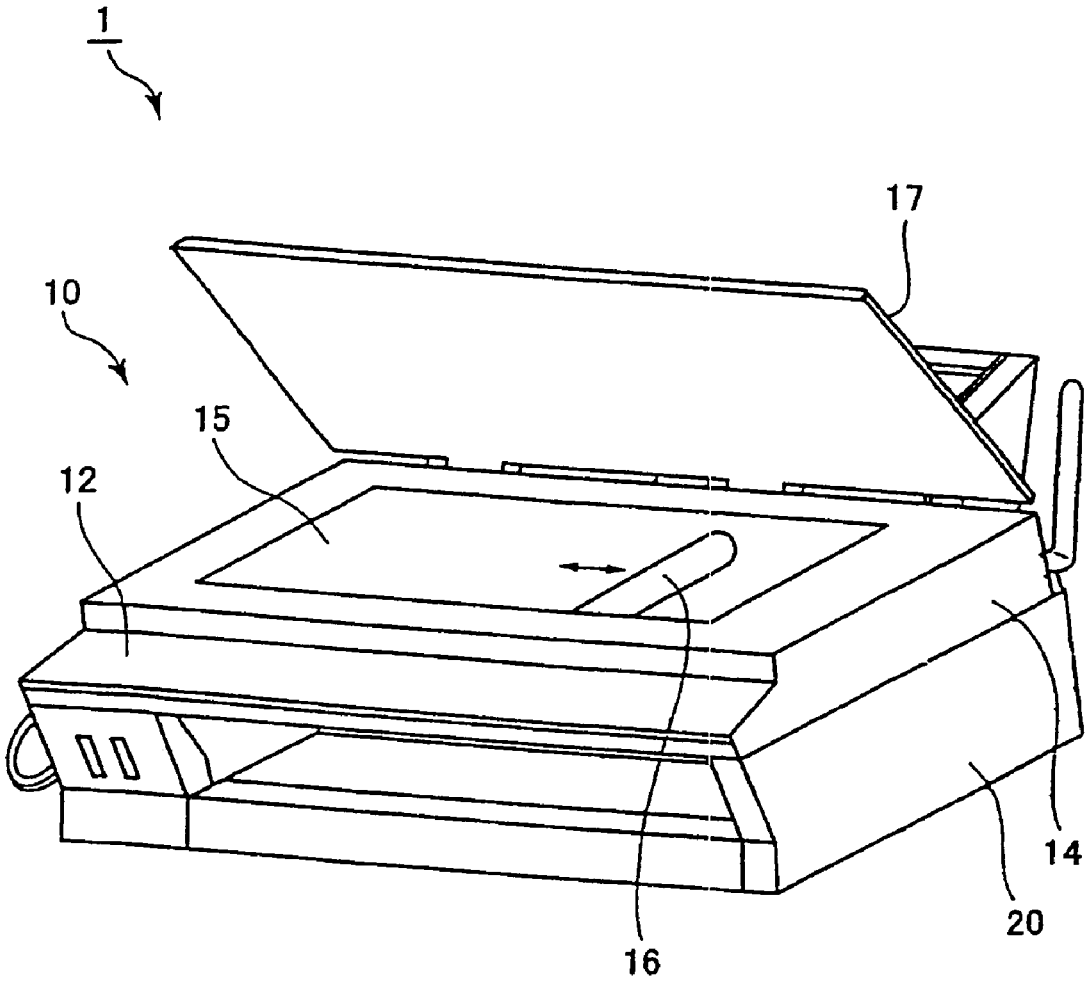
FIG. 2 is a perspective view of the multifunction device in FIG. 1 with an upper cover of a flat bed type retrieval device open.

As shown in FIG. 2, the retrieval unit 10 is a flat head type retrieval unit and includes a retrieval unit case 14. The retrieval unit case 14 includes a document glass 15 on which a document to be scanned is placed. A contact image sensor 16 is disposed below the document glass 15. A configuration is provided for generating scanning movements of the contact image sensor 16. An upper cover 17 for covering the upper surface of the document glass 15 is provided openable and closable with respect to the retrieval unit case 14.

The control panel 12 is provided on the upper surface to the front of the retrieval unit case 14. An operator inputs commands for operations, such as a copy operation, a facsimile operation, or a scanner operation, of the multifunction device 1 through the control panel 12.

It should be noted that an attachment means (not shown) is provided for enabling the flat head type retrieval unit 10 to be disconnected from the ink jet recording unit 20.

Figure 3:
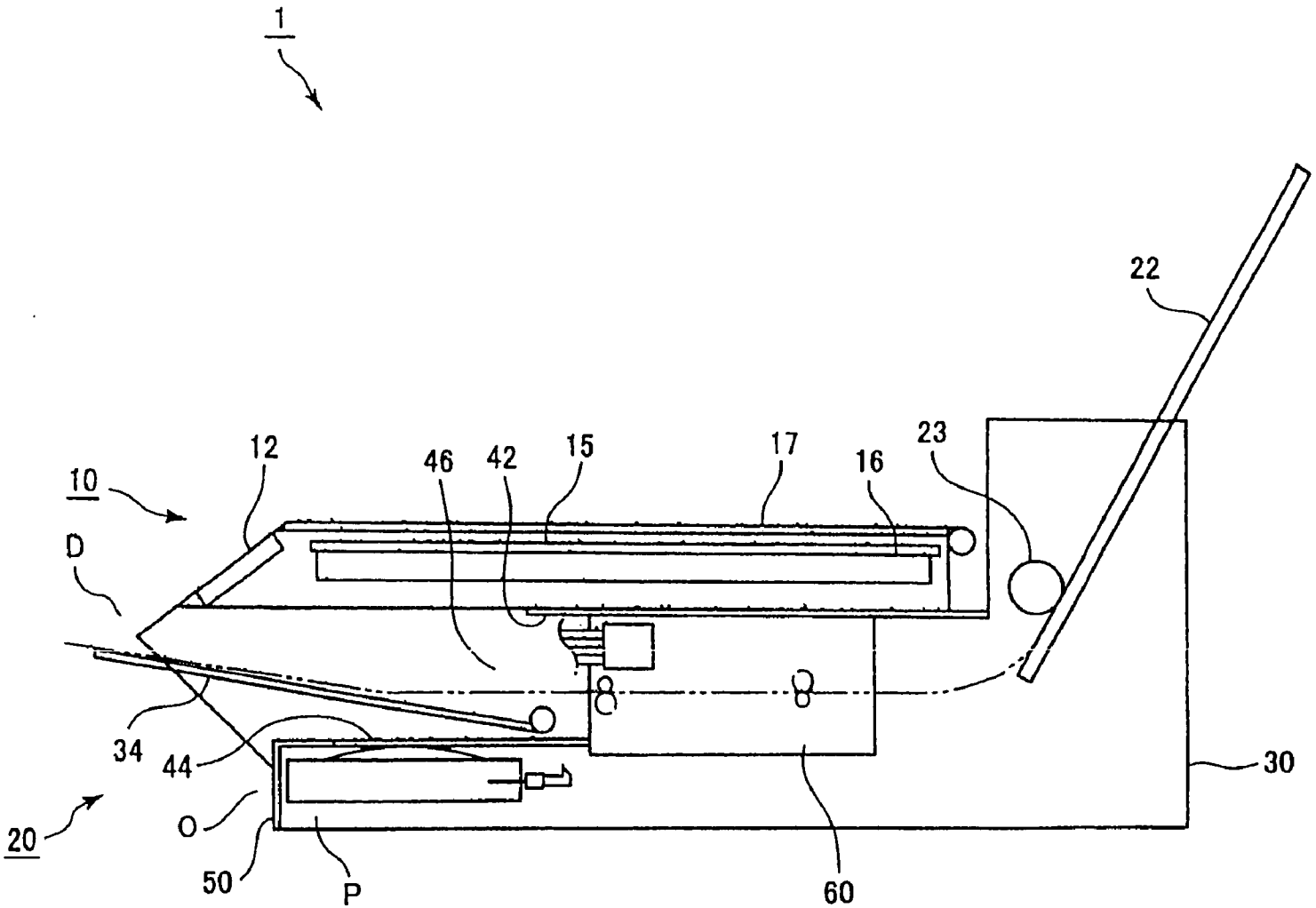
FIG. 3 is a cross-sectional schematic view of the multifunction device in FIG. 1.

As shown in FIG. 3, the ink jet recording unit 20, which is below the retrieval unit 10, includes a housing 30. The sheet-supply tray 22 protrudes from inside the housing 30 to above the rear portion of the housing 30. A sheet-supply roller 23 is provided in the sheet-supply tray 22 so that one sheet at a time can be supplied. A printer engine 60 is provided as a recording portion at a position where sheets are received from the sheet-supply tray 22. A sheet-discharge portion D is provided to the front of the printer engine 60. Sheets recorded on by the printer engine 60 are discharged from the sheet-discharge portion D. It should be noted that a sheet-discharge tray 34 is freely detachably mounted on the sheet-discharge portion D. The sheet-discharge tray 34 serves as a portion of a sheet transport pathway. An ink cartridge holding portion P into which the ink cartridges 200 (FIG. 12) are mounted is disposed between the sheet-discharge portion D and the base of the housing 30. In this way, the ink cartridge holding portion P is disposed at a position lower than the printer engine 60.

Figure 4:
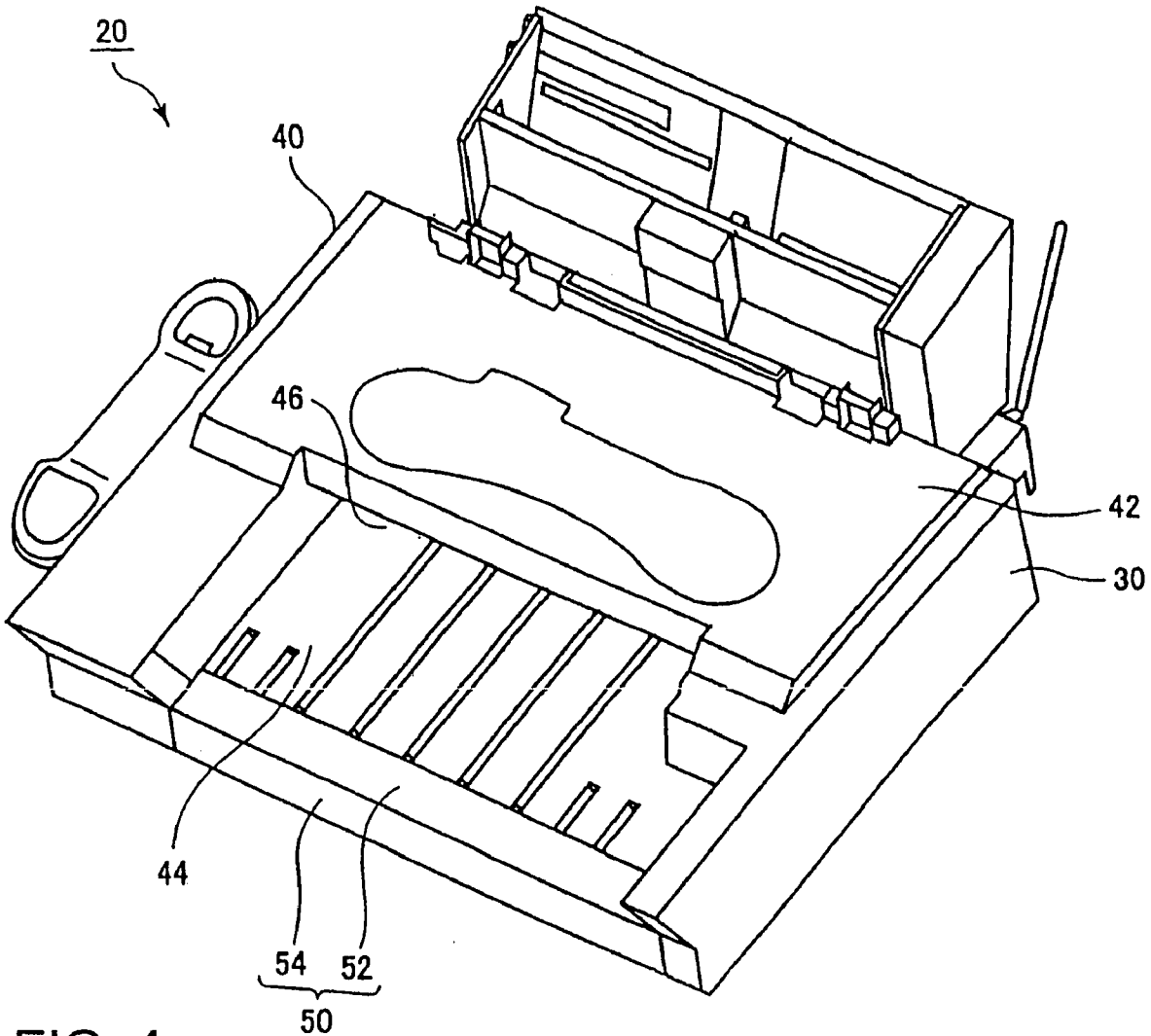
FIG. 4 is a perspective view of the multifunction device in FIG. 1 without a flat bed type retrieval device.

As shown in FIG. 4, the housing 30 is covered from above by a cover 40. The cover 40 has an engine cover portion 42 and a cartridge holding cover portion 44. The engine portion 42 covers the printer engine 60 from above. The cartridge holding cover portion 44 is provided below the sheet-discharge portion D and covers the ink cartridge holding portion P from above. The front surface of the engine cover portion 42 is opened to form a sheet-discharge port 46. The cartridge holding cover portion 44 is positioned below the pathway along which sheets recorded by the printer engine 60 are transported, that is, below the sheet-discharge tray 34.

As shown in FIG. 3, the cartridge holding cover portion 44 functions as a ceiling surface of the ink cartridge holding portion P. As will be described later, the ink cartridge holding portion P is formed between the cartridge holding cover portion 44 and a cartridge holding portion base wall 32 so that the ink cartridges 200 can be inserted to the rear side of the ink cartridge holding portion P from a front surface opening portion O. A front surface cover 50 is provided to selectively cover (FIG. 4) and open (FIG. 6) the front surface opening portion O. The front surface cover 50 includes an upper surface wall 52 and a front surface wall 54. When the front surface cover 50 is closed as shown in FIG. 4, the upper surface wall 52 is aligned on the same imaginary plane as the cartridge holding cover portion 44 and the front surface wall 54 extends vertically downward from the upper surface wall 52.

Figure 5:
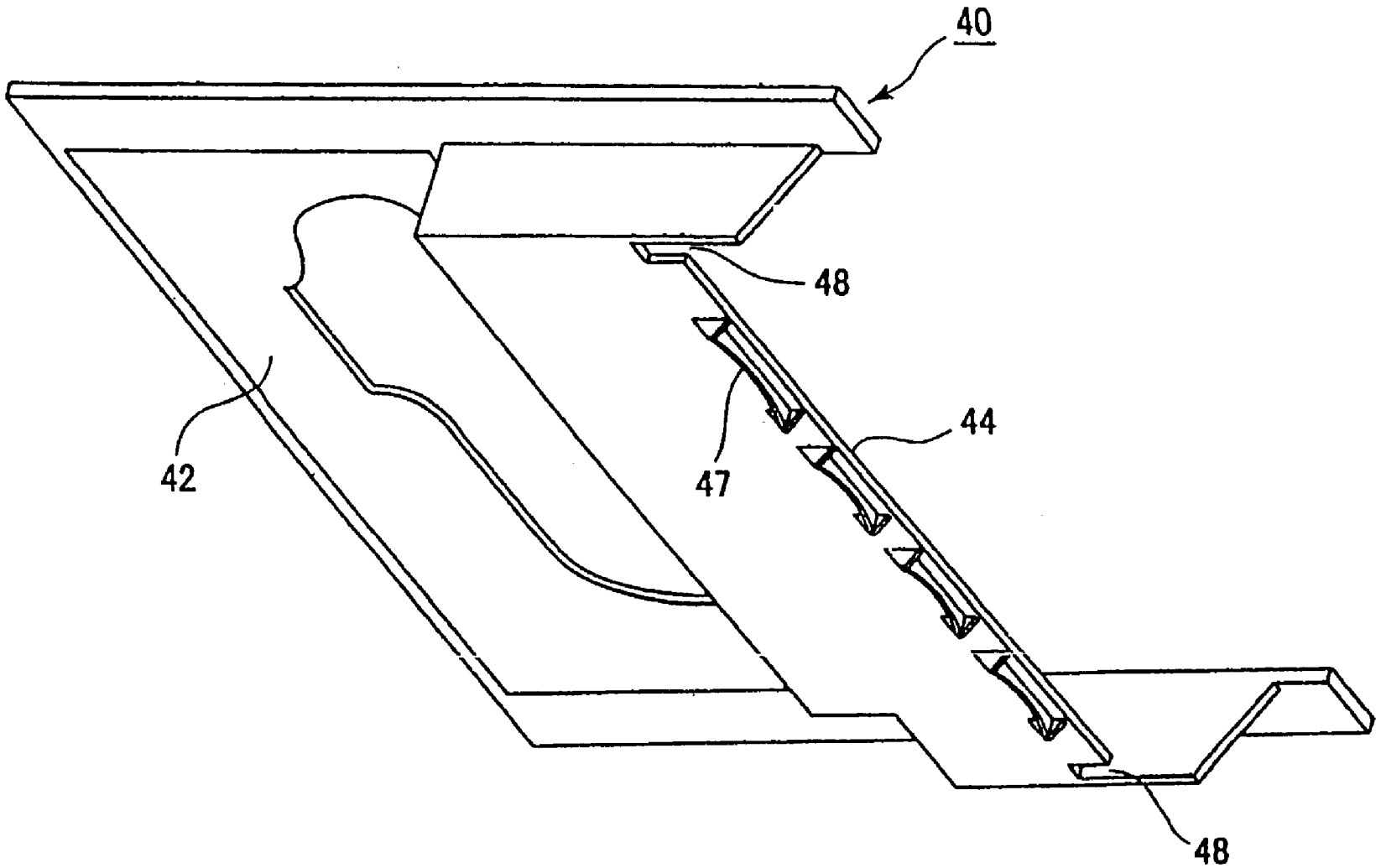
FIG. 5 is a perspective view of a lower surface of a cover body of an exemplary multifunction device.

As shown in FIG. 5, four curve-shaped protruding ribs 47 are formed on the lower surface of the cartridge holding cover portion 44. The curved shape of the curve-shaped protruding ribs 47 is formed to follow the shape of the upper surface of the four ink cartridges 200 mounted in the ink cartridge holding portion P. Also, a pair of notches 48 are formed in left and right ends of the cartridge holding cover portion 44.

Figure 6:
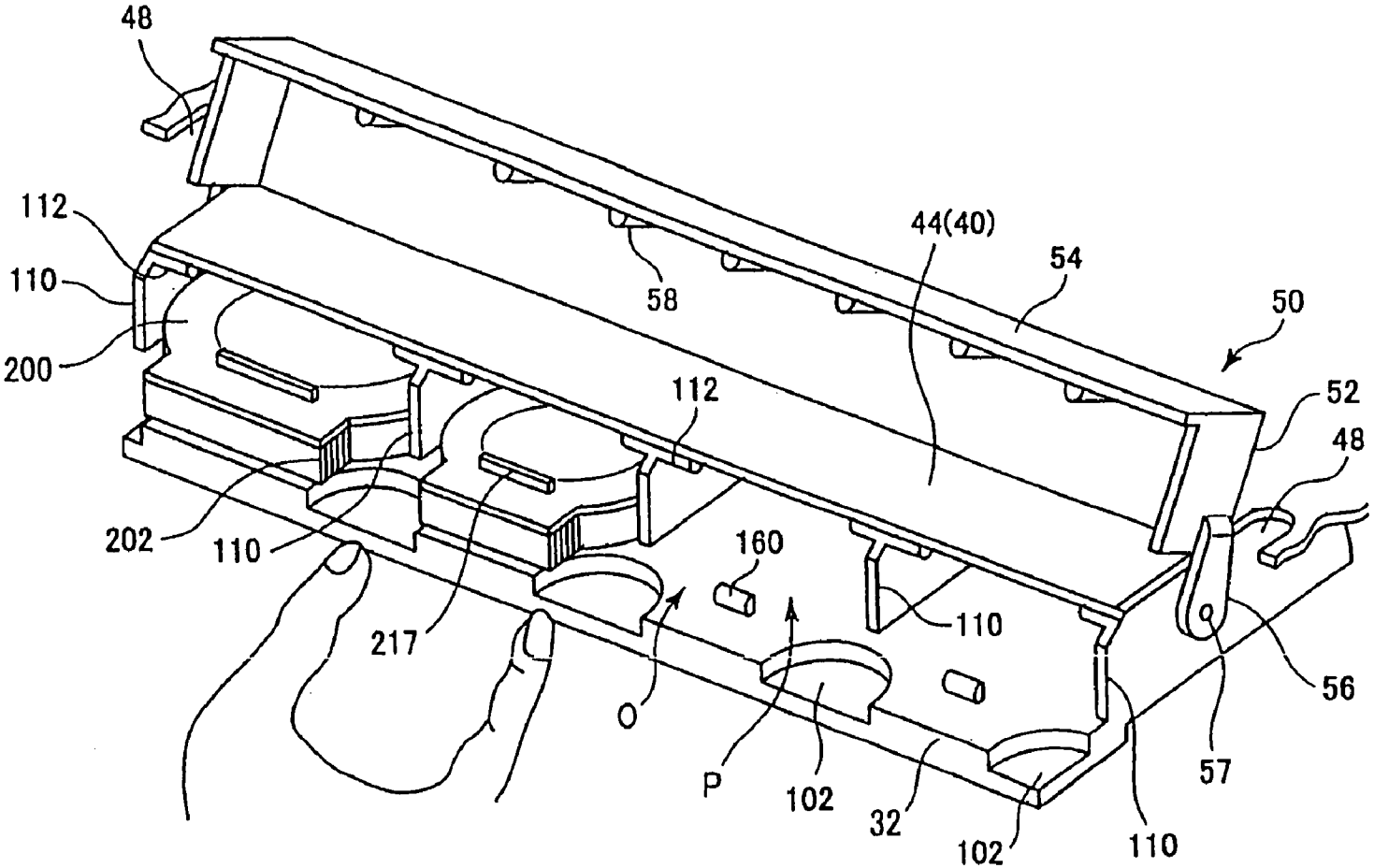
FIG. 6 is a perspective view of a multifunction device with a cover body open.

As shown in FIG. 6, a pair of arms 56 provided to the front surface cover 50 are received by the notches 48 when the front surface cover 50 is opened up. As will be described later, five partition walls 110 are aligned on the base wall 32 in the ink cartridge holding portion P. A pivot shaft 57 protrudes from the two end position partition walls 110. The pair of arms 56 of the front surface cover 50 are pivotably attached to the pivot shaft 57 so that the user can freely open and close the front surface cover 50.

Seven vertical ribs 58 are formed to the rear side of the front surface cover 50 so as to extend vertically when the cover 50 is closed. The vertical ribs 58 extend from the front surface wall 54 of the front surface cover 50 to a portion of the upper surface wall 52. Four of the seven vertical ribs 58 are formed at positions that correspond to the widthwise center of the mounted ink cartridges 200. Accordingly, when the front surface cover 50 is closed from the open condition shown in FIG. 6, the corresponding vertical ribs 58 automatically press any partially inserted ink cartridges 200 deep into the ink cartridge holding portion recording sheet recording sheet P, so that the ink cartridges 200 are accurately inserted even when one of the ink cartridges 200 is incompletely inserted into the ink cartridge holding portion P. Although not shown in the drawings, a plurality of lateral ribs is also formed at the rear surface of the front surface cover 50. The lateral ribs extend in the horizontal direction in intersection with the seven vertical ribs 58 and are for reinforcing the seven vertical ribs 58.

The cartridge holding portion base wall 32 extends further forward than the cartridge holding cover portion 44 in order to guide the ink cartridges 200 into the front surface opening portion O. The portion of the cartridge holding portion base wall 32 that extends further forward than the cartridge holding cover portion 44 is formed with indentations 102 at positions that correspond to the partition walls 110. The indentations 102 have either a quarter or half circle shape when viewed in plan. The indentations 102 have a narrower width than grasping portions 202 of the ink cartridges 200 housed in the ink cartridge holding portion P so that the user can more easily grasp the ink cartridges 200 housed in the ink cartridge holding portion P using his or her fingers.

FIG. 7 shows the multifunction device 1 with the cover 40 and the front surface cover 50 removed from the ink jet recording unit 20. As can be seen in FIG. 7, the housing 30 has an open upper side and the front surface opening portion O of the ink cartridge holding portion P is the front side of the housing 30. The two media board devices 28 are disposed at positions that correspond to the media slots 29. Also, a positive pressure pump 36 to be described later is disposed behind the media board devices 28.

A black (K) ink cartridge-mounting portion Sk, a cyan (C) ink cartridge-mounting portion Sc, a yellow (Y) ink cartridge-mounting portion Sy, and a magenta (M) ink cartridge-mounting portion Sm are aligned in the left-right direction in the ink cartridge holding portion P. The black (K) ink cartridge-mounting portion Sk is for mounting a black (K) ink cartridge 200*k*, the cyan (C) ink cartridge-mounting portion Sc is for mounting a cyan (C) ink cartridge 200*c*, the yellow (Y) ink cartridge-mounting portion Sy is for mounting a yeloow cartridge 200*y*, and the magenta (M) ink cartridge-mounting portion Sm is for mounting a magenta (M) ink cartridge 200*m*.

The black (K) ink cartridge 200*k*, the cyan (C) ink cartridge 200*c*, the yellow (Y) ink cartridge 200*y*, and the magenta (M) ink cartridge 200*m* will be referred to collectively as the ink cartridges 200 hereinafter. Further, the black (K) ink cartridge-mounting portion Sk, the cyan (C) ink cartridge-mounting portion Sc, the yellow (Y) ink cartridge-mounting portion Sy, and the magenta (M) ink cartridge-mounting portion Sm will be referred to collectively as the ink cartridge-mounting portions S hereinafter.

The ink cartridge holding portion P is configured from the ink cartridge-mounting portions S, which are aligned in the left-right direction on the same imaginary plane (on the base wall 32) below the ceiling plate, which configures the cartridge holding cover portion 44 of the cover 40, and below the sheet-discharge tray 34, which serves as a portion of a sheet transport pathway. Accordingly, the ink cartridge holding portion P overall has a flat and substantially parallelepiped shape. Accordingly, the overall configuration of the multifunction device 1 can be formed thin and compact.

Ink supply mechanisms 80, a positive pressure application mechanism 90, and cartridge-mounting mechanisms 100 are provided in the ink cartridge-mounting portions S. Each cartridge-mounting mechanism 100 is for mounting the corresponding ink cartridges 200 as will be described later. The positive pressure application mechanism 90 is for applying a positive pressure from the positive pressure pump 36 to ink in the mounted ink cartridges 200. The ink supply mechanisms 80 are for supplying ink in the mounted ink cartridges 200 to the printer engine 60. Ink-supply tubes T for supplying ink into the printer engine 60 extend from the ink supply mechanisms 80. That is, a black (K) ink-supply tube Tk extends from the black (K) ink cartridge-mounting portion Sk, a cyan (C) ink-supply tube Tc extends from the cyan (C) ink cartridge-mounting portion Sc, a yellow (Y) ink-supply tube Ty extends from the yellow (Y) ink cartridge-mounting portion Sy, and a magenta (M) ink-supply tube Tm extends from the magenta (M) ink cartridge-mounting portion Sm. The black (K) ink-supply tube Tk, the cyan (C) ink-supply tube Tc, the yellow (Y) ink-supply tube Ty, and the magenta (M) ink-supply tube Tm will be referred to collectively as the ink-supply tubes T hereinafter.

Although not shown in the drawings, a waste ink absorbing material is disposed on the housing 30 behind the ink cartridge holding portion P and below the printer engine 60. The printer engine 60 includes an engine housing 62. Although not shown in the drawings, a sheet transport slot is formed in the rear surface of the engine housing 62. The sheet transport slot is for receiving sheets supplied from the sheet-supply tray 22. An engine-side sheet-discharge slot 64 is formed in the front surface of the engine housing 62. The engine-side sheet-discharge slot 64 is for discharging sheets that were recorded on by the printer engine 60 toward the sheet-discharge portion D. The sheet-transport pathway is further defined in the engine housing 62 from the sheet transport slot to the engine-side sheet-discharge slot 64. Printed sheets are discharged onto the sheet-discharge portion D because the engine-side sheet-discharge slot 64 confronts the sheet-discharge port 46 (FIG. 4) while the cover 40 covers the housing 30. A KC tube opening 66 and a YM tube opening 68 are formed in the front surface of the engine housing 62. The KC tube opening 66 is for introducing the black (K) ink-supply tube Tk and the cyan (C) ink-supply tube Tc into the printer engine 60. The YM tube opening 68 is for introducing the yellow (Y) ink-supply tube Ty and the magenta (M) ink-supply tube Tm into the printer engine 60. Although not shown in the drawings, a cable opening for introducing cables connected to the main circuit board into the printer engine 60 is also formed in the front surface of the engine housing 62.

Figure 8:
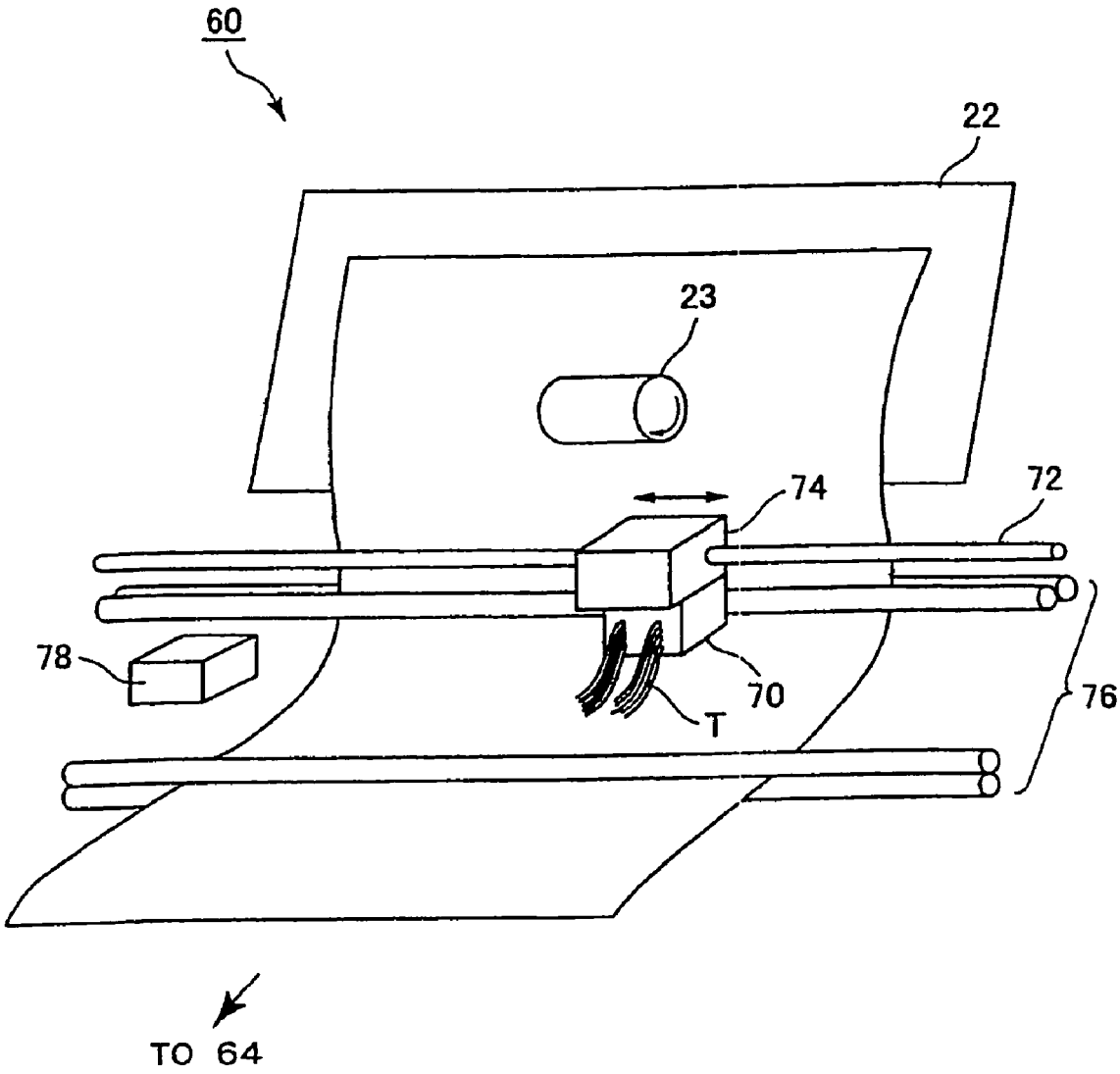
FIG. 8 is a schematic perspective view showing a configuration of a printer engine of an exemplary multifunction device.

As shown in FIG. 8, a sheet-transport mechanism 76 is provided to the inside to the engine housing 62. The sheet-transport mechanism 76 is made from plural pairs of rollers that transport sheets from the sheet-supply roller 23 along the sheet transport pathway to the engine-side sheet-discharge slot 64. A carriage scan shaft 72 extends above and in a direction that intersects with the sheet transport direction. A carriage 74 is provided on the carriage scan shaft 72 so as to be capable of reciprocal movement following the carriage scan shaft 72. A piezoelectric ink jet head 70 is mounted to the under surface of the carriage 74. Although not shown in the drawings, a group of nozzles is formed for each of the above-described plurality of ink colors. Each nozzle faces downward so it ejects ink downward onto the recording sheet. The four ink-supply tubes T (Tk, Tc, Ty, Tm) and cables are connected to the corresponding nozzle groups to supply the four colors of ink (black, cyan, yellow, and magenta) and drive signals to the piezoelectric ink jet head 70. The carriage 74 scans following the carriage scan shaft 72 and the piezoelectric ink jet head 70 and records in bands with a width that corresponds to the width of the nozzle groups. Each time one scan is completed, the sheet-transport mechanism 76 feeds the sheet by a distance that corresponds to the width of the recording band. A purge unit 78 is provided at a position that is above the carriage scan shaft 72 and that is shifted from the sheet transport pathway. Although not shown in the drawings, the purge unit 78 includes a well-known cap and pump. In certain situations, such as when the nozzles of the piezoelectric ink jet head 70 are clogged, the piezoelectric ink jet head 70 is transported to a position in confrontation with the purge unit 78 and a purge operation is performed wherein the cap covers the nozzles and the pump sucks ink from the nozzles through the cap.

Only the piezoelectric ink jet head 70 is mounted on the carriage 74. Ink from the ink cartridges 200 housed in the ink cartridge holding portion P is supplied to the piezoelectric ink jet head 70 through the tubes T. Also, a pressure head difference is developed between the piezoelectric ink jet head 70 and the ink cartridges 200 because the piezoelectric ink jet head 70 is disposed vertically above the ink cartridge holding portion P. Therefore, a negative pressure, that is, a back pressure operates on the ink in the nozzles of the piezoelectric ink jet head 70 that prevents ink (not shown) from dripping out from the nozzle in the piezoelectric ink jet head 70.

Figure 9:
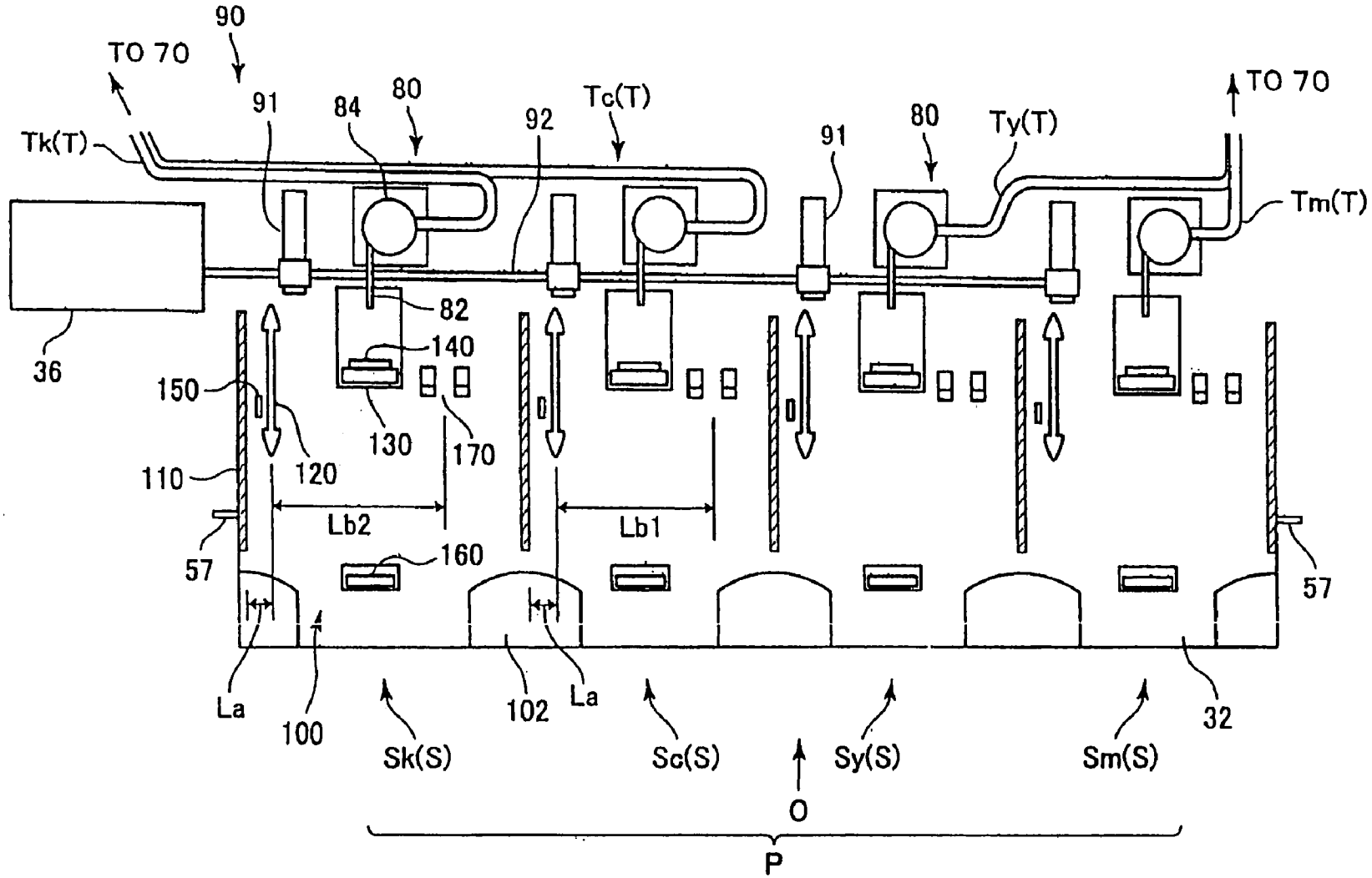
FIG. 9 is a plan view showing a configuration of an ink cartridge accommodation portion of an exemplary multifunction device.

As shown in FIG. 9, the ink supply mechanisms 80, the positive pressure application mechanism 90, and the cartridge-mounting mechanisms 100 have substantially the same configuration for each of the four ink cartridge-mounting portions S.

Figure 10:
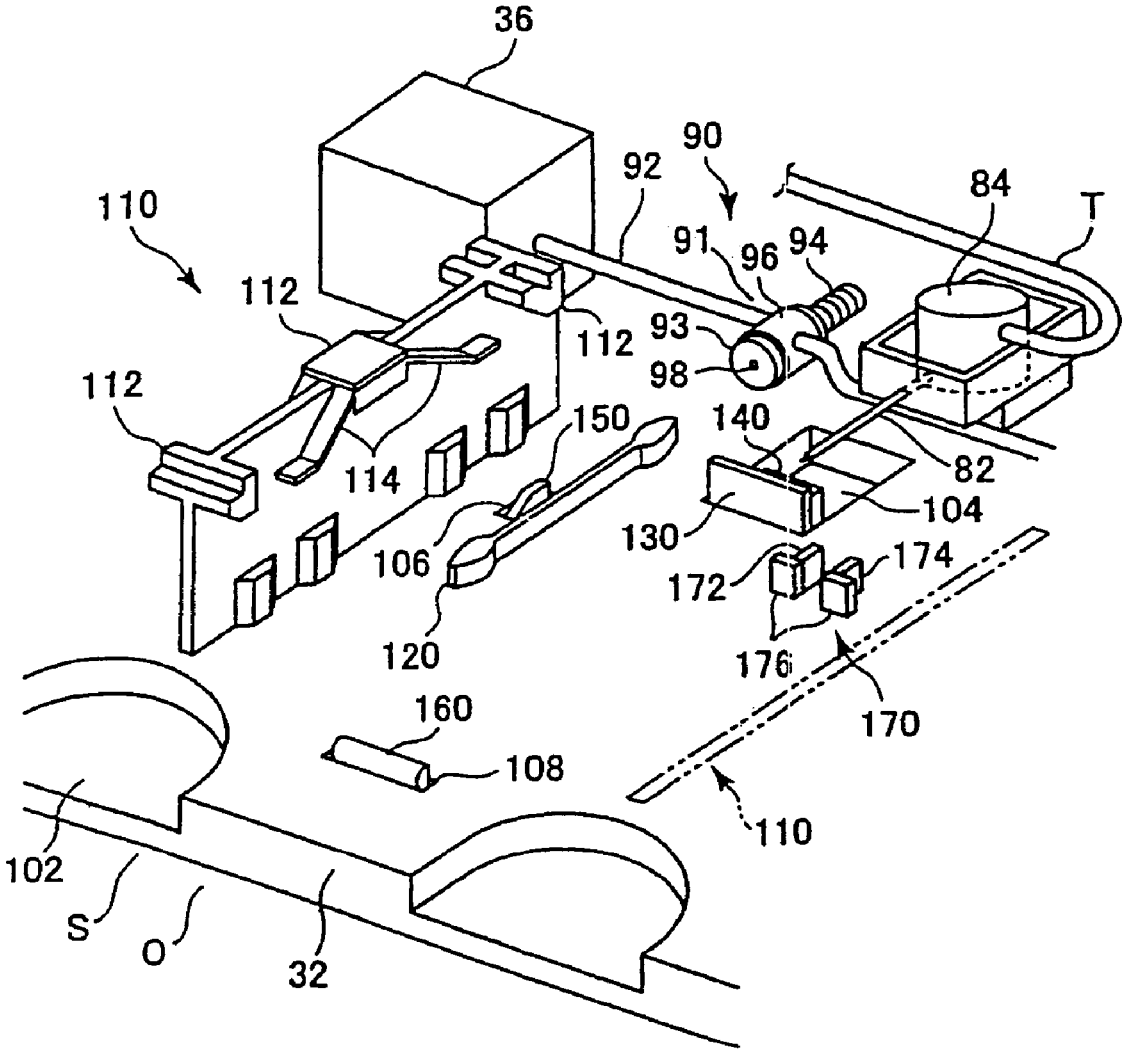
FIG. 10 is a perspective view showing a configuration of an ink cartridge-mounting portion in an ink cartridge accommodation portion of an exemplary multifunction device.

As shown in FIGS. 9 and 10, each of the ink supply mechanisms 80 is configured from a buffer tank 84 connected to an ink introducing hollow needle 82 and the ink-supply tube T. The ink introducing hollow needle 82 extends toward the front surface opening portion O. The hollow needle 82 is hollow and formed on the sides of its tip end with a pair of holes connected to the inside in the manner of a well-known hollow needle. When an ink cartridge 200 is mounted in the corresponding ink cartridge-mounting portion S, the ink introducing hollow needle 82 is inserted into the ink cartridge 200 so that ink is supplied to the buffer tank 84. The buffer tank 84 temporarily holds ink supplied by the ink introducing hollow needle 82 and filters foreign objects out from the ink. Ink that has been filtered in this manner is then supplied to the piezoelectric ink jet head 70 through the corresponding ink-supply tube T.

The positive pressure application mechanism 90 is for applying a positive air pressure to the ink in the ink cartridges 200. The positive pressure application mechanism 90 is configured from positive pressure application members 91 that are connected to the positive pressure pump 36. It should be noted that the total of four positive pressure application members 91 provided to the four ink cartridge-mounting portions S are directly connected to the positive pressure pump 36 through positive pressure application tubes 92. There is a relief valve (not shown) between the positive pressure pump 36 and the positive pressure application tubes 92. Drive of the positive pressure pump 36 forces air flow with substantially equal pressure from the four positive pressure application members 91 toward the ink cartridges 200 through the positive pressure application tubes 92.

As shown in FIG. 10, each of the positive pressure application members 91 is made from a ring-shaped resilient seal member 93 and a support member 96. The support member 96 supports the ring-shaped resilient seal member 93 while a spring 94 urges the ring-shaped resilient seal member 93 toward the front surface opening portion O. The ring-shaped resilient seal member 93 includes a centrally located positive pressure hole 98 in fluid connection with the positive pressure application tubes 92 from the positive pressure pump 36. The positive pressure hole 98 faces the front surface opening portion O.

The cartridge-mounting mechanisms 100 include the partition walls 110, the indentations 102 on the cartridge holding portion base wall 32, guide protrusion walls 120, needle protection plates 130, lock members 180 (FIG. 11) of the needle protection plates 130, lock releasing operation ribs 150, pull-out-lock protrusions 160, and residual ink detecting photo sensors 170.

The partition walls 110 are formed at either side of each ink cartridge-mounting portion S so as to protrude upward from the cartridge holding portion base wall 32 and so as to extend from the front surface opening portion O into the ink cartridge holding portion P. The partition walls 110 define the width of the ink cartridge-mounting portions S. It should be noted that the partition walls 110 positioned in between adjacent ink cartridge-mounting portions S also serve to partition the adjacent ink cartridge-mounting portions S.

The width of each of the ink cartridge-mounting portions S is the size suitable for the width of the corresponding ink cartridge 200 to enable the corresponding ink cartridge 200 to be mounted therein. As will be described later, the widths of the cyan (C) ink cartridge 200*c*, the yellow (Y) ink cartridge 200*y*, and the magenta (M) ink cartridge 200*m* are equivalent. The width of the black (K) ink cartridge 200*k*, the black ink of which is more frequency used during printing, is larger than the widths of the cyan (C) ink cartridge 200*c*, the yellow (Y) ink cartridge 200*y*, and the magenta (M) ink cartridge 200*m* in order to provide the black (K) ink cartridge 200*k* with a larger internal capacity. For this reason, the widths of cyan (C) ink cartridge-mounting portion Sc, the yellow (Y) ink cartridge-mounting portion Sy, and the magenta (M) ink cartridge-mounting portion Sm are equivalent and the width of the black (K) ink cartridge-mounting portion Sk is larger than the width of the other ink cartridge-mounting portions.

The cartridge holding portion base wall 32 of the ink cartridge-mounting portions S extends away from the hollow needle 82 farther forward than the front surface opening portion O. Because the ceiling surface, that is, the cartridge holding cover portion 44, has a length to the position of the front surface opening portion O, the portion of the cartridge holding portion base wall 32 that extends farther forward than the cartridge holding portion base wall 32 is opened from above while the front surface cover 50 is in an open condition and serves to guide the ink cartridges 200 toward the front surface opening portion O while the ink cartridges 200 are being mounted.

All of the cartridge-mounting mechanisms 100 have substantially the same configuration, so configuration of a representative cartridge-mounting mechanism 100 will be described with reference to FIG. 10 in order to facilitate explanation. The needle protection plate 130, the residual ink detecting photo sensor 170, the lock releasing operation rib 150, and the pull-out-lock protrusion 160 are positioned in this order from the side of the ink introducing hollow needle 82 to the front of the ink introducing hollow needle 82 with respect to the lengthwise extending axis of the ink introducing hollow needle 82. The guide protrusion wall 120, the lock releasing operation rib 150, and the residual ink detecting photo sensor 170 sandwich the lengthwise extending axis of the ink introducing hollow needle 82, wherein the guide protrusion wall 120 and the lock releasing operation rib 150 are on one widthwise side and the residual ink detecting photo sensor 170 is on the other widthwise side. The guide protrusion wall 120 extends in the front-rear direction. The lock releasing operation rib 150 is positioned between the front end and the rear end of the guide protrusion wall 120 in the front-rear direction. The needle protection plate 130 is between the front end and the rear end of the guide protrusion wall 120 in the front-rear direction and is positioned further to the rear than the lock releasing operation rib 150. The residual ink detecting photo sensor 170 is also between the front end and the deep end of the guide protrusion walls 120 in the front-rear direction and is positioned deeper in than the lock releasing operation rib 150.

Referring to FIG. 9, the guide protrusion wall 120 and nearest partition wall 110 are separated by same distance La in the left-right direction in all of the cartridge-mounting portions Sc, Sy, Sm, and Sk. Further, the guide protrusion wall 120 and the residual ink detecting photo sensor 170 are separated by the same distance Lb1 in the cyan (C) ink cartridge-mounting portion Sc, the yellow (Y) ink cartridge-mounting portion Sy, and the magenta (M) ink cartridge in the left-right direction. However, the guide protrusion wall 120 and the residual ink detecting photo sensor 170 are separated by a larger distance Lb2 in the black (K) ink cartridge-mounting portion Sk than the guide-sensor intervening distance Lb1 for the other ink cartridge-mounting portions.

Returning to FIG. 6, the partition walls 110 extend upward from the cartridge holding portion base wall 32 to the under surface of the cover 40. As shown more clearly in FIG. 10, three enlarged portions 112 are formed at the upper portion of each partition wall 110. As can be seen in FIG. 112, the enlarged portions 112 protrude away from the cartridge holding cover portion 44 toward the cartridge holding portion base wall 32. The enlarged portions 112 regulate vertical tilt and position of the ink cartridge after the ink cartridge 200 is inserted. The enlarged portion 112 at the front surface opening portion O side end of each partition wall 110 is formed at the lower side with a taper shape for facilitating insertion of the ink cartridge. The enlarged portion 112 formed at the front-rear center of each partition wall 110 includes a spring 114 for urging the ink cartridge 200 downward and regulating vertical movement of the inserted ink cartridge 200.

Again using the representative example of FIG. 10, the guide protrusion wall 120 protrudes upward from the cartridge holding portion base wall 32 at a position adjacent to the lock releasing operation rib 150. The distance La between the guide protrusion walls 120 and the adjacent partition walls 110 is sufficiently smaller than the thickness of the average user's finger to prevent the user from contacting the lock releasing operation rib 150 and releasing the locked condition of the needle protection plates 130. Also, the guide protrusion wall 120 serves to guide the ink cartridge 200 inserted from the front surface opening portion O side to the ink cartridge-mounting portions S in the front-rear direction while positioning the ink cartridge 200 in the left-right direction. The guide protrusion wall 120 is formed with its front- and rear-side ends thicker than its center so that the guide protrusion wall 120 contacts the ink cartridge 200 substantially at two points that correspond to the thick portions. Positioning in the left-right direction can be precisely performed. It should be noted that guiding and positioning of the ink cartridge 200 can also be performed by the partition walls 110 or could be performed by cooperative operation of the partition walls 110 and the guide protrusion wall 120.

The residual ink detecting photo sensor 170 is made from an infrared light emitting portion 172 and an infrared light receiving portion 174 and is for detecting the amount of residual ink in the ink cartridge 200. The residual ink detecting photo sensor 170 is connected to a circuit board disposed beneath the cartridge holding portion base wall 32. The residual ink detecting photo sensor 170 protrudes above the cartridge holding portion base wall 32 from the circuit board. Sensor guards 176, which are for protecting the infrared light emitting portion 172 and the infrared light receiving portion 174 from the ink cartridge 200 when the ink cartridge 200 is inserted, protrude upward from the cartridge holding portion base wall 32 from the sides of the infrared light emitting portion 172 and the infrared light receiving portion 174 that are nearer to the front surface opening portion O. The sensor guards 176 are formed with rounded surfaces at the portion of their confronting faces that are nearest the front surface opening portion O.

Figure 11:
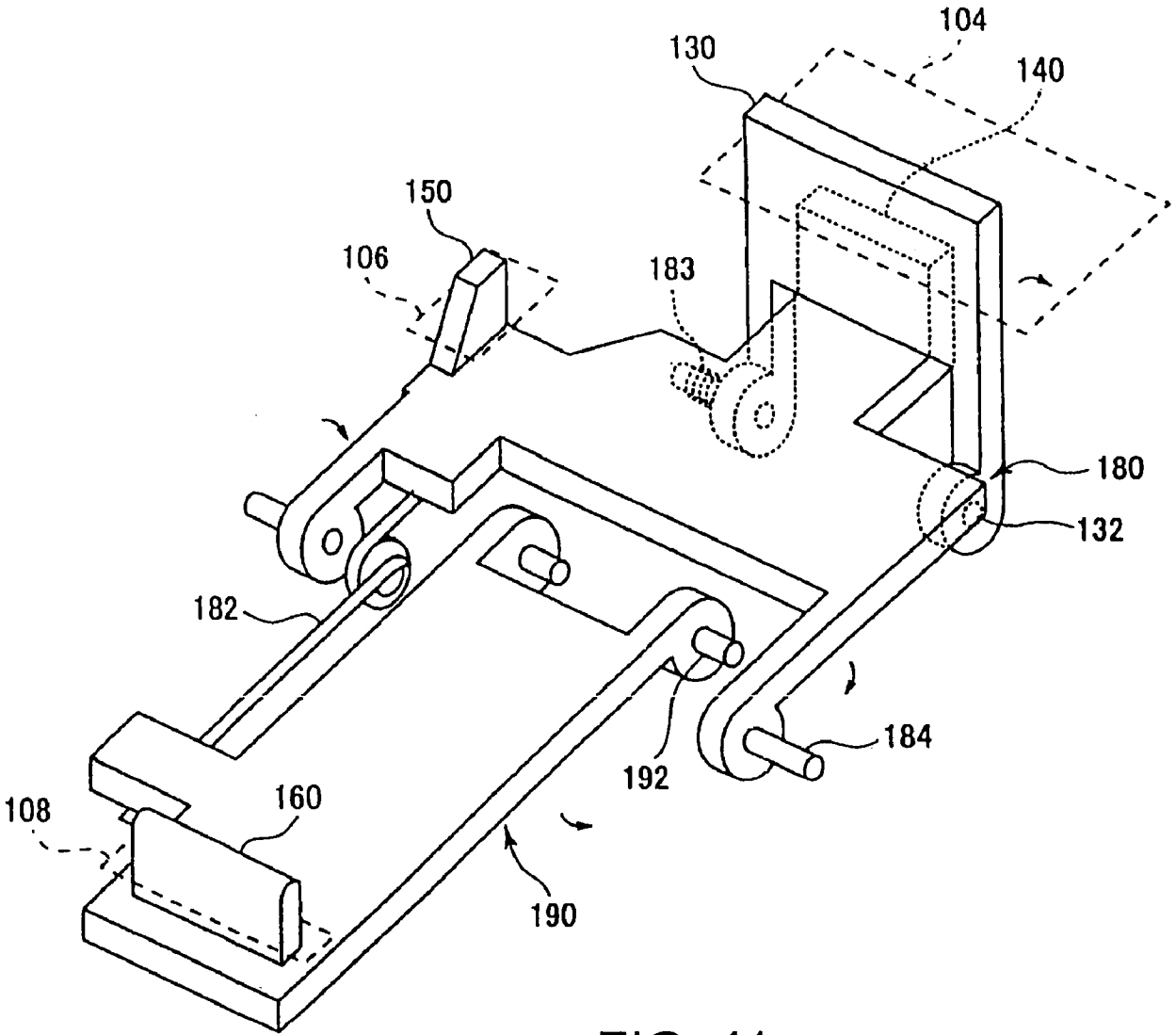
FIG. 11 is a perspective view showing a configuration of a mechanism provided below a floor surface of an ink cartridge-mounting portion of an exemplary multifunction device for protecting needles, maintaining a condition in which needles are protected, and preventing ink cartridges from falling out of the ink cartridge-mounting portion.

The needle protection plate 130 is positioned at the front surface opening portion O side of the ink introducing hollow needle 82 with a space between itself and the ink introducing hollow needle 82. The needle protection plate 130 is for covering the tip of the ink introducing hollow needle 82 from the side confronting the front surface opening portion O. FIG. 11 shows configuration relating to the needle protection plate 130, the lock releasing operation rib 150, and the pull-out-lock protrusion 160 of the representative cartridge-mounting mechanism 100 of FIG. 10. The needle protection plate 130 is supported below the cartridge holding portion base wall 32 so as to be pivotable around a needle protection pivot shaft 132 that intersects the front-rear direction. The needle protection plate 130 is movable between a cover position and a release position. In the cover position, the needle protection plate 130 protrudes from an opening 104 formed in the cartridge holding portion base wall 32 to above the cartridge holding portion base wall 32. In the release position, the needle protection plate 130 is retracted within the opening 104. The needle protection plate 130 is constantly urged by a spring 183 toward the cover position. The lock member 180 is supported pivotable around a shaft 184 below the cartridge holding portion base wall 32. A pressing plate 140 rises up from one end of the lock member 180. Operation of the spring 182 moves the lock member 180 in a direction to move the pressing plate 140 into confrontation with the ink introducing hollow needle 82 side surface of the needle protection plate 130. The lock member 180 integrally includes the lock releasing operation rib 150 in between the shaft 184 and the pressing plate 140. The urging force of the spring 182 protrudes the lock releasing operation rib 150 from an opening 106 formed in the cartridge holding portion base wall 32 between the guide protrusion walls 120 and the partition walls 110.

In this condition, when the ink cartridge 200 is inserted from the front surface opening portion O, as will be described later the lower side of the ink cartridge 200 first presses the lock releasing operation rib 150 so that the lock member 180 pivots and the pressing plate 140 retracts downward from the back surface of the needle protection plate 130. When the ink cartridge 200 is moved further in the front-rear direction of the mounting portion S, the front surface of the ink cartridge 200 presses the needle protection plate 130. However, because the pressing plate 140 was retracted below the back surface of the needle protection plate 130, the needle protection plate 130 is not block from pivoting and so drops into the opening 104 so that the ink cartridge 200 can connect with the ink introducing hollow needle 82.

In the reverse operation, that is, to remove the ink cartridge 200 from the ink cartridge-mounting portion S, the spring 183 moves the needle protection plates 130 upright at the position covering the ink introducing hollow needle 82. Then, the lower surface of the ink cartridge 200 separates away from the lock releasing operation ribs 150 and the spring 182 returns the pressing plate 140 to the back surface of the needle protection plate 130.

Unless the lock releasing operation rib 150 is being pressed down, the back surface of the needle protection plate 130 will abut the pressing plate 140 so the ink introducing hollow needle 82 will not be exposed to the front surface opening portion O, even if an external force is applied from the front surface opening portion O side of the needle protection plate 130.

A leak preventing lock member 190 is provided for applying resistance against the urging force by the spring 94 of the positive pressure application members 91, which urges the mounted ink cartridge 200 in a direction to pull out of the ink cartridge-mounting portion S. The leak preventing lock member 190 includes the pull-out-lock protrusion 160, which is capable of protruding above the cartridge holding portion base wall 32 from an opening 108 formed in the cartridge holding portion base wall 32. The leak preventing lock member 190 is supported pivotable around a shaft 192 below the cartridge holding portion base wall 32. The leak preventing lock member 190 is urged upward by the spring 182. Normally, the protrusion 160 protrudes upward above the cartridge holding portion base wall 32 from the opening 108 and fits in a leak preventing lock indentation 246 (FIG. 18) to be described later of the ink cartridges 200 that is in its mounted position. However, as will be described later, when the ink cartridge 200 abuts the protrusion 160 by force generated when the ink cartridge 200 is attached or detached, the leak preventing lock member 190 pivots around the shaft 192 so that the protrusion 160 retracts downward and the ink cartridge 200 can be attached or detached.

Figure 12:
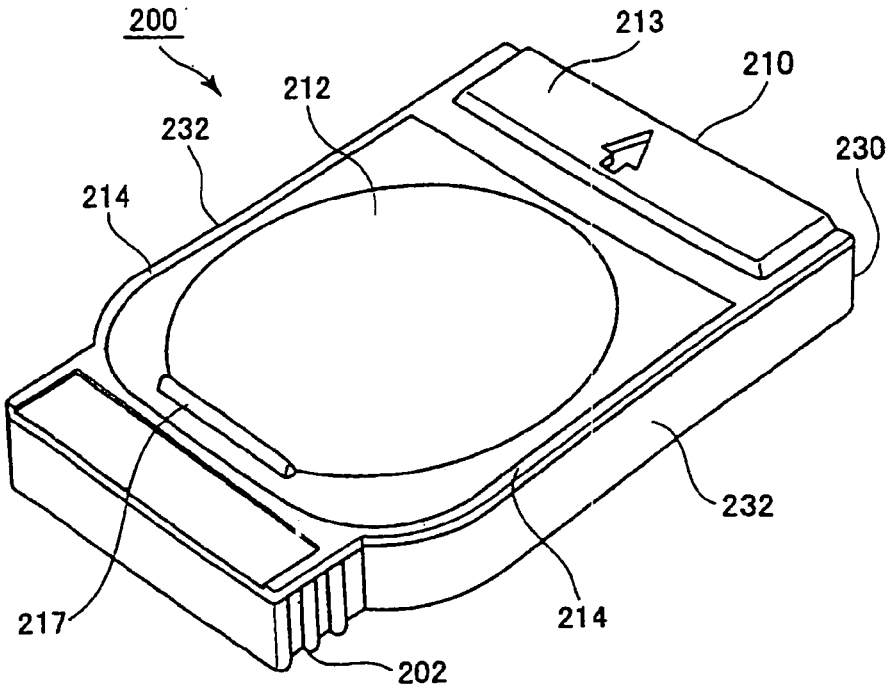
FIG. 12 is a perspective view of an exemplary ink cartridge from a rear end.

The exemplary cyan, yellow, magenta, and black ink cartridges 200 all have the shape shown in FIG. 12. That is, all are made from a main case 230 and a lid 210 made from a substantially transparent resin. Overall the ink cartridge 200 has a flat and substantially parallelepiped shape. It should be noted that the cyan, yellow, and magenta ink cartridges 200 (color ink cartridges) have substantially the same size. The black ink cartridge 200 has substantially the same length as the color ink cartridges 200. However, the width of the black ink cartridge is wider than that of the color ink cartridges.

An exemplary ink cartridge 200 is described, with reference to FIGS. 12 to 36. The main case 230 includes flat side walls 232 on both sides in the left-right direction. The distance between the side walls 232, that is, the width of the main case 230, corresponds to the distance between the partition walls 110 provided to both sides of the ink cartridge-mounting portion S.

The lid 210 has a substantially flat shape with a spherical outward curved portion 212, which is curved outward in a spherical shape, provided at its substantial center portion. A flat-shaped protrusion portion 213 is formed from a raised up front end of the lid 210 except at left and right ends. A flat portion 214 is formed at the left and right sides of the protrusion portion 213 and around the spherical outward curved portion 212 of the lid 210. The portion of the flat portion 214 positioned to the left and right of the protrusion portion 213 and of the spherical outward curved portion 212 extends in the lengthwise (front-rear) direction of the ink cartridges 200. When the ink cartridge 200 is inserted into the ink cartridge-mounting portion S, the front-rear extending portion of the flat portion 214 slides against the spring 114 in confrontation with the underside of the enlarged portions 112. The curved portion 212 and the protrusion portion 213 protrude in the direction of and are closer to the lower surface of the cartridge holding cover portion 44, that is, the ceiling surface, than are the lower surfaces of the enlarged portions 112, which are positioned on either side of the curved portion 212 and the protrusion portion 213. The curved portion 212 and the protrusion portion 213 extend higher toward the cartridge holding cover portion 44 than the flat portion 214. When the ink cartridge 200 is mounted in the recording device, the curved portion 212 and the protrusion portion 213 regulate height wise position of the ink cartridge 200 when the ink cartridge 200 is inserted through the front surface opening portion O.

The ink cartridge 200 is formed sufficiently longer than the length in the front-rear direction of the cartridge holding cover portion 44 so that the rear end portion protrudes from the cartridge holding cover portion 44 when the ink cartridge 200 is in a mounted condition in the mounting portion S. The rear end portion of the ink cartridge 200 is a grasping portion 202 that is slightly narrower width that the other areas. As shown in FIG. 6, a desired single ink cartridge 200 can be easily grasped and taken out when plural ink cartridges 200 are housed in the ink cartridge holding portion P. Contrarily, an ink cartridge 200 can be grasped and easily mounted even when an ink cartridge 200 is housed adjacent thereto in ink cartridge holding portion P. A rib 217 is formed near the rear end of the lid 210 so as to extend linearly in the left-right direction. Accordingly, by snagging his or her finger on the rib 217 and pulling the ink cartridge 200 forward, the user can pull the ink cartridge 200 out of the ink cartridge holding portion P using a single finger.

Figure 13:
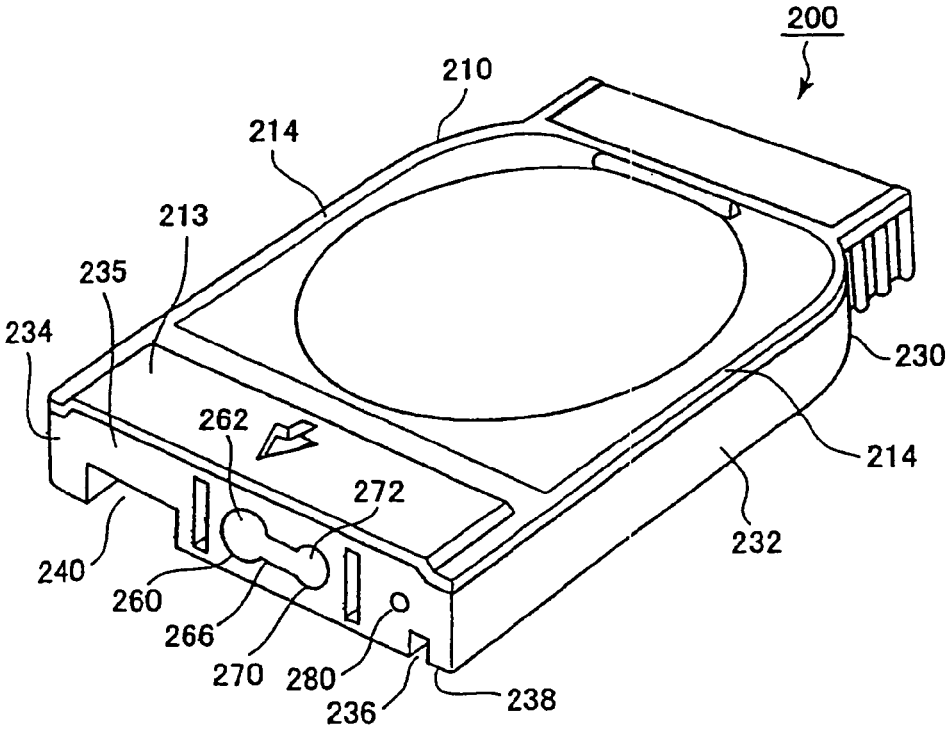
FIG. 13 is a perspective view of an exemplary ink cartridge from a front end.

As shown in FIG. 13, a protrusion portion 235 is formed on a front surface wall 234 of the main case 230. The protrusion portion 235 protrudes upward at the left-right central region of the front surface wall 234. An ink supply hole 260 is formed in the substantial center of the front surface wall 234. The ink supply hole 260 is a hole for supplying ink from an ink accommodation portion 300 (FIG. 14) provided in the main case 230 to outside. An ink supply rubber plug 262 (FIG. 36) is press-fit mounted in the ink supply hole 260. An ink injection hole 270 is opened next to the ink supply hole 260. An ink injection rubber plug 272 (FIG. 36) is press-fit mounted in the ink injection hole 270. Further, an atmosphere connection hole 280 is also opened in the front surface wall 234. The atmosphere connection hole 280 is a small-diameter, long and thin hole that is in fluid communication with the positive pressure hole 98 of the positive pressure application members 91 when the ink cartridge 200 is mounted in the ink cartridge-mounting portion S. Further, a guide groove 236 and a sensor accommodation groove 240 are formed in the front surface wall 234 and across the lower wall of the main case 230 so as to be open in the front surface and the lower surface. The guide groove 236 is an indented portion for engaging with the guide protrusion wall 120 when the ink cartridge 200 is mounted in the ink cartridge-mounting portion S. A lock release portion 238 is defined by the lower rear surface of the ink cartridge 200 that is between the guide groove 236 and the nearby side wall 232. The guide groove 236 and the lock release portion 238 are provided near the portions of the ink cartridge 200 that correspond to the enlarged portions 112 of the recording device. The lock release portion 238 functions to press the lock releasing operation rib 150 when the ink cartridge 200 is mounted in the ink cartridge-mounting portion S. The sensor accommodation groove 240 is an indented portion in a contour of the outer shape of the ink cartridge 200 and accommodates the residual ink detecting photo sensor 170 when the ink cartridge 200 is mounted in the ink cartridge-mounting portion S.

Figure 14:
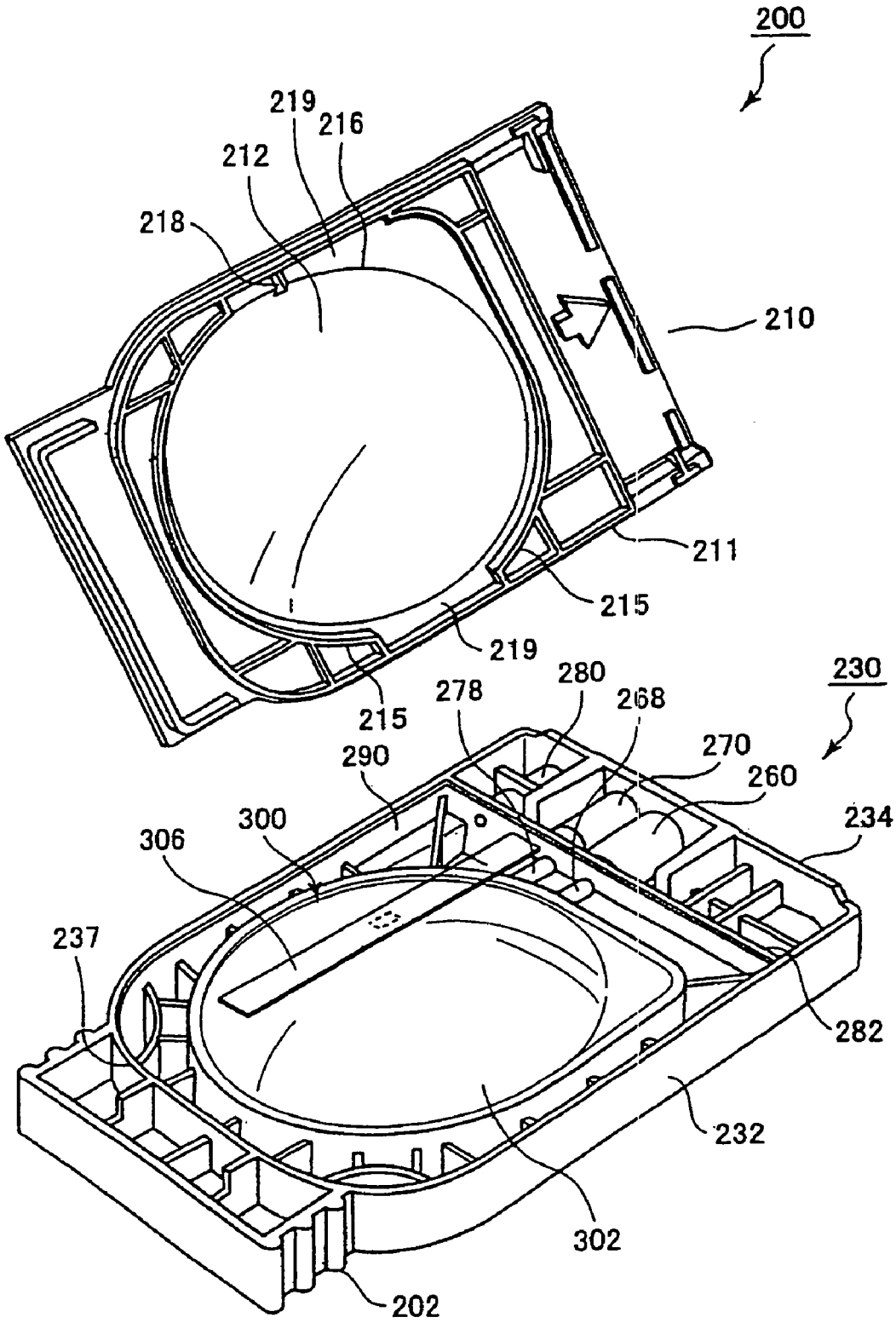
FIG. 14 is a perspective view of an exemplary ink cartridge with its lid separated from its main case.

As shown in FIG. 14, the main case 230 includes an ink accommodation portion 300 at its inside and is open at its upper side. Described in more detail, the main case 230 includes the front surface wall 234, the side walls 232, and a rear surface wall 237. The side walls 232 are on left and right sides of the main case 230. The side walls 232 are connected to the front surface wall 234 and the rear surface wall 237. The grasping portions 202 are formed to the rear of the rear surface wall 237. The ink accommodation portion 300 is surrounded by the front surface wall 234, the side walls 232, and the rear surface wall 237. The ink accommodation portion 300 is configured with a flexible film 302 at an ink-holding portion 310 (FIG. 15) to be described later. The ink-holding portion 310 is formed at the inside of the main case 230. The flexible film 302 is welded onto an opening peripheral edge 312 of the ink-holding portion 310. Ink is held in between the flexible film 302 and the ink-holding portion 310. While the ink cartridge 200 is filled with ink, the flexible film 302 expands upward into a curved surface. The ink supply hole 260 and the ink injection hole 270 are in fluid communication with the inside of the ink accommodation portion 300. Described in more detail, the ink supply hole 260 is in fluid communication with the ink accommodation portion 300 through a small-diameter ink supply connection pathway 268. The ink injection hole 270 is in fluid communication with the ink accommodation portion 300 by the through a small-diameter ink injection connection pathway 278 from the ink injection hole 270.

A substantially rectangular plate shaped tension plate 306 is provided on the flexible film 302 so that its lengthwise direction extends in parallel with the lengthwise (front-rear) direction of the ink cartridge 200. The tension plate 306 is adhered at its lengthwise center portion to the substantial center portion of the flexible film 302 by two-sided adhesive tape.

It should be noted that the lengthwise direction cross sectional shape (FIG. 21) of the case body is the same whether for black or color ink cartridges. Because the tension plate 306 is adhered in the lengthwise direction, an equal tension can be applied by preparing and adhering tension plates 306 with the same length for all color ink cartridges. The length of the tension plate 306 is formed slightly shorter than the dimension of the ink accommodation portion 300 in the lengthwise direction. The material of the tension plate is a film made from resin such as PET film. It should be noted that detailed operation of the tension plate 306 will be described later.

An atmosphere chamber 290 in fluid communication with the atmosphere connection hole 280 is formed in the periphery of the ink accommodation portion 300. Described in more detail, a partition wall 282 is formed at the rear side of the front surface wall 234. The partition wall 282 connects the side walls 232. Also, an outside protrusion wall 211 is formed from the lid 210. The outside protrusion wall 211 is for coupling with the partition wall 282, the side walls 232, and the rear surface wall 237 of the main case 230. When the lid 210 is attached to the main case 230 and the outside protrusion wall 211 is coupled with the partition wall 282, the side walls 232, and the rear surface wall 237, then the atmosphere chamber 290 will be encompassed by the partition wall 282, the side walls 232, and the rear surface wall 237 and moreover defines a region (covered by the lid 210) that surrounds the ink accommodation portion 300. The atmosphere chamber 290 is in a substantially sealed condition in communication with the outside only through the atmosphere connection hole 280. Here, the atmosphere connection hole 280 is a through hole that extends between the front surface wall 234 and the partition wall 282 and that is opened to the front surface wall 234 and the partition wall 282. Also, the ink supply connection pathway 268 and the ink injection connection pathway 278 penetrate through the partition wall 282 and are in fluid communication with the ink accommodation portion 300. When the lid 210 is attached on the main case 230 and covers the opening of the main case 230, the atmosphere chamber 290 is in fluid communication with atmosphere through only the atmosphere connection hole 280. By applying atmospheric or positive pressure to the atmosphere chamber 290, pressure can be applied to the flexible film 302 of the ink accommodation portion 300 from the external side of the ink accommodation portion 300 so that ink in the ink accommodation portion 300 can be supplied to outside of the ink cartridge 200 through the ink supply hole 260.

It should be noted that a plurality of ribs 292 (FIG. 15) are formed in the inside of the atmosphere chamber 290 so that the strength of the main case 230 is increased.

FIG. 14 shows the inner surface of the lid 210 that is attached to the ink cartridge 200. As is clear from the drawing, the lid 210 is substantially flat. The spherical outward curved portion 212 that is formed in the central portion of the lid 210 has a shape that encompasses the bulge of the flexible film 302. An annular portion of the flat portion 214 has a predetermined width that encompasses the spherical outward curved portion 212 and defines an ink accommodation periphery portion 216 to be described later. A groove-shaped notch 218 is formed so as to cut through the ink accommodation periphery portion 216. When the lid 210 is coupled to the main case 230, a space develops between the ink accommodation periphery portion 216 and the flexible film 302 that is adhered to the opening peripheral edge 312. When the ink cartridge is vacuum packaged in a manner to be described later, the lid 210 and the main case 230 flexibly deform toward each other. Even if the lid side of the ink accommodation periphery portion 216 comes into intimate contact with the flexible film 302, the groove-shaped notch 218 and protrusion wall notches 219 to be described later serve to bring the space between the spherical outward curved portion 212 and the flexible film 302 into fluid communication with the atmosphere chamber 290. Also, a protruding wall 215 is formed at the inner side of the outside protrusion wall 211, which is the outer side of the ink accommodation periphery portion 216. The protruding wall 215 extends and protrudes from the lid 210 so as to encompass the ink accommodation periphery portion 216. The protruding wall 215 is located so as to, when the lid 210 is mounted on the main case 230, encompass the outer periphery of the opening peripheral edge 312 to be described later with reference to FIG. 27. The protruding wall 215 is discontinuous at portions that follow the side walls 232 and that approach and connect to the outside protrusion wall 211. These discontinuous portions of the protruding wall 215 define the protrusion wall notches 219. One protrusion wall notch 219 is located adjacent the groove-shaped notch 218 and the other protrusion wall notch 219 is located opposite from the groove-shaped notch 218 in the left-right direction. The protrusion wall notches 219 also function to bring the space between the spherical outward curved portion 212 and the flexible film 302 into fluid communication with the atmosphere chamber 290 and to prevent positive pressure from the atmosphere connection hole 280 from being blocked by the protruding wall 215.

Figure 15:
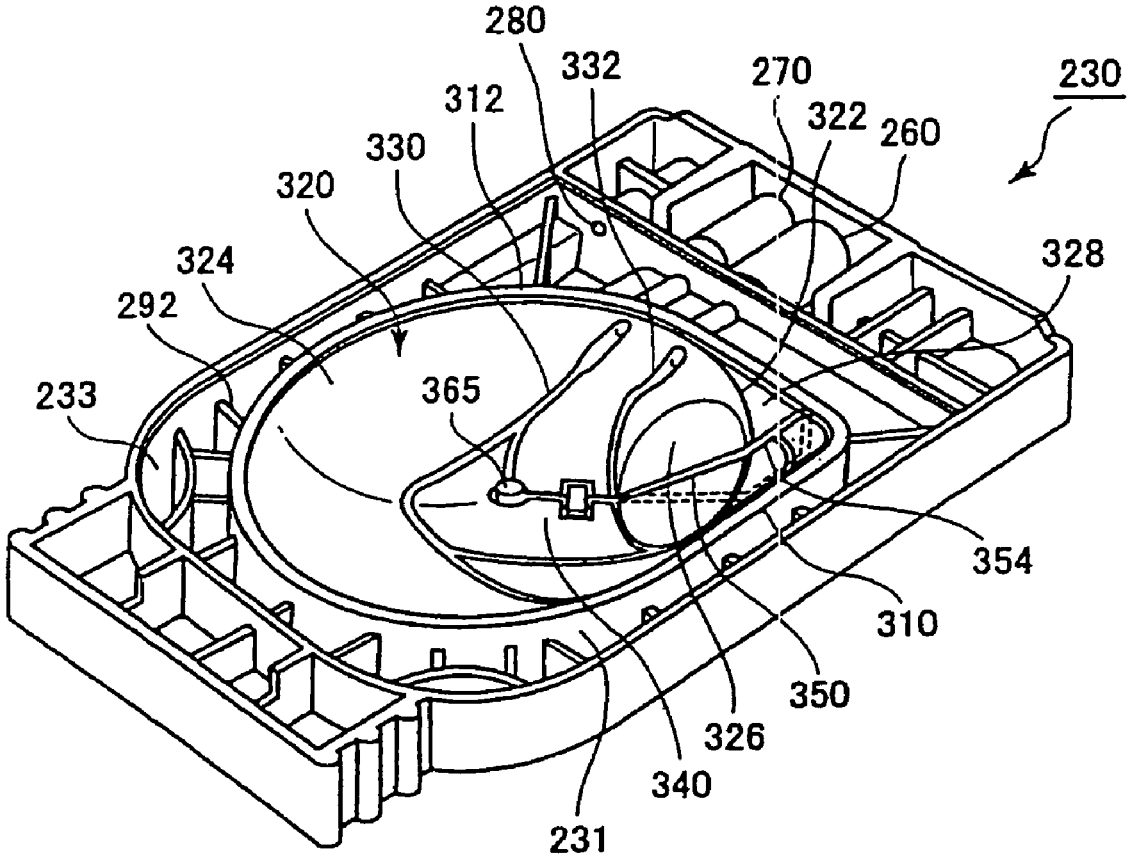
FIG. 15 is a perspective view showing a main case of an exemplary ink cartridge before a flexible film is attached thereto.

As shown in FIG. 15, the ink-holding portion 310 is encompassed by the opening peripheral edge 312 and includes an tub portion 320. The tub portion 320 is open at the upper surface. The opening peripheral edge 312 has a circular or ellipsoidal shape that bulges outward at one portion 328. The tub portion 320 includes a curved surface portion 324 that curves downward in a substantial curved shape from a circular (or ellipsoidal) shaped encompassing edge 322. The encompassing edge 322 is positioned at the same height as the opening peripheral edge 312. The substantial center of the curved surface portion 324 is the lowest position. The curved surface portion 324 includes a slanted surface portion 326 that is flat (not curved). The horizontally-extending flat shoulder portion 328, which bulges to the outside of the opening peripheral edge 312, is formed between the opening peripheral edge 312 and the circular (or ellipsoidal) encompassing edge 322. Because the flexible film 302 is attached to the opening peripheral edge 312 so as to cover the tub portion 320, ink is stored between the flexible film 302, the curved surface portion 324 including the slanted surface portion 326, and the flat shoulder portion 328.

The height of the flat shoulder portion 328 substantially matches the height of the opening peripheral edge 312 so that the flexible film 302 bulges only a small amount above the flat shoulder portion 328. With this configuration, while the lid 210 is mounted on the main case 230 the user can visually confirm the color of the ink from above the lid 210 by viewing the color of the ink accumulated between the flat shoulder portion 328 and the flexible film 302. Said differently, when the tub portion 320 is full of ink, the color of the ink in the tub portion 320 appears substantially black because the layer of ink is thick. However, the actual color of the ink can be viewed at the thin ink layer between the flat shoulder portion 328 and the flexible film 302.

The flexible film 302 is preformed into a curved shape that intimately contacts the inner surface of the ink-holding portion 310 when almost no ink is in the ink-holding portion 310. The method for manufacturing the flexible film 302 in this shape will be described later. Because the flexible film 302 is shaped in this manner, the flexible film can softly and gradually deform following the amount of ink from when ink completely fills between the flexible film 302 and the ink-holding portion 310 to when almost no ink is in the ink-holding portion 310. Almost no pressure operates on the ink from the flexible film itself, for example, by resilient contraction.

An air removing/ink supply groove 332 is formed in the base surface of the tub portion 320. The air removing/ink supply groove 332 is in fluid communication with an ink injection groove 330, which is in fluid communication with the ink injection hole 270 (the ink injection connection pathway 278), and the ink supply hole 260 (the ink supply connection pathway 268). A sensing mechanism 340 is further provided to the base surface of the tub portion 320. The sensing mechanism 340 is for detecting the residual amount of ink remaining on the tub portion 320.

Figure 16:
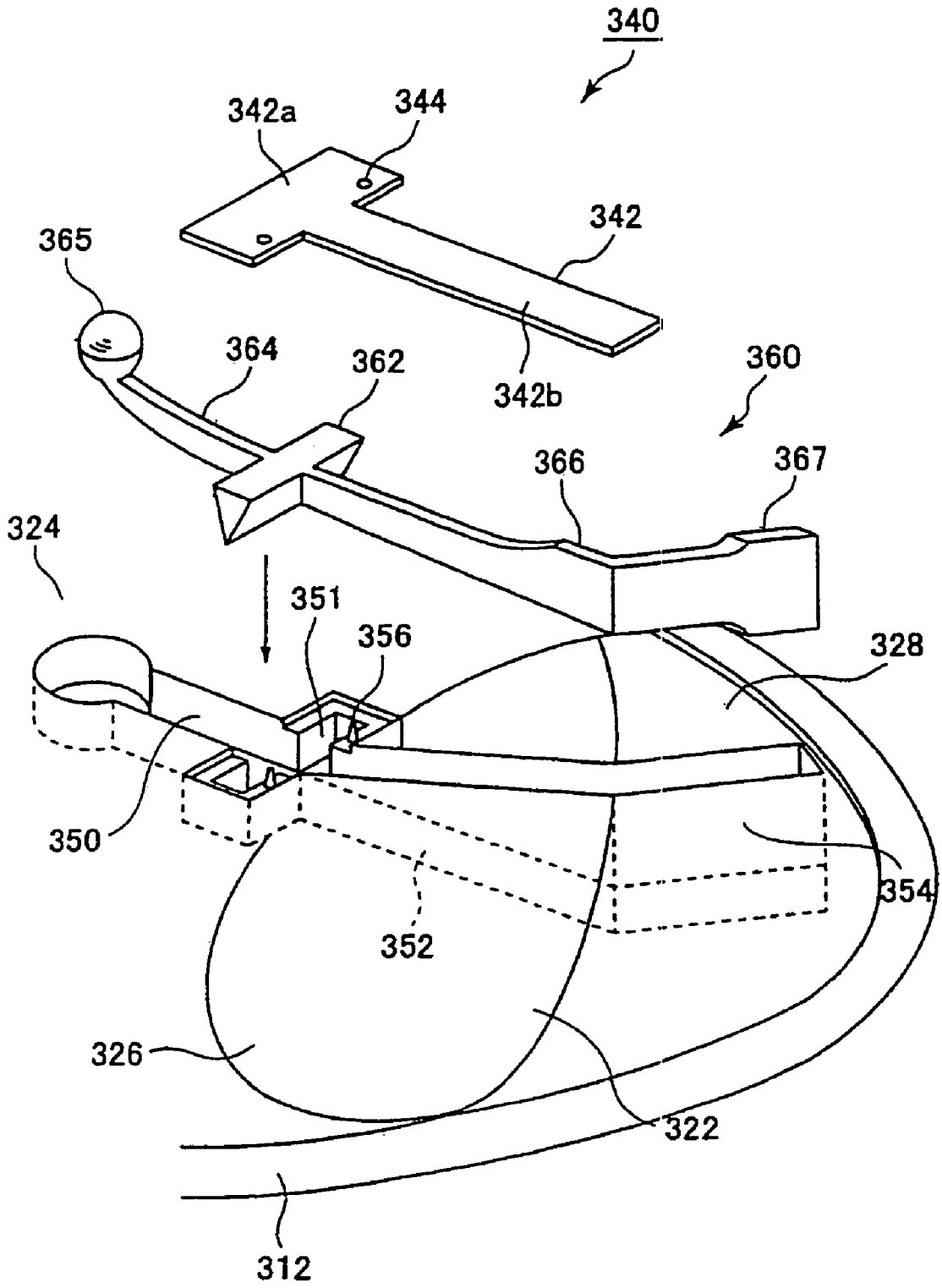
FIG. 16 is an exploded perspective view of a sensing mechanism provided in an indentation portion of a main case of an exemplary ink cartridge.
Figure 17:
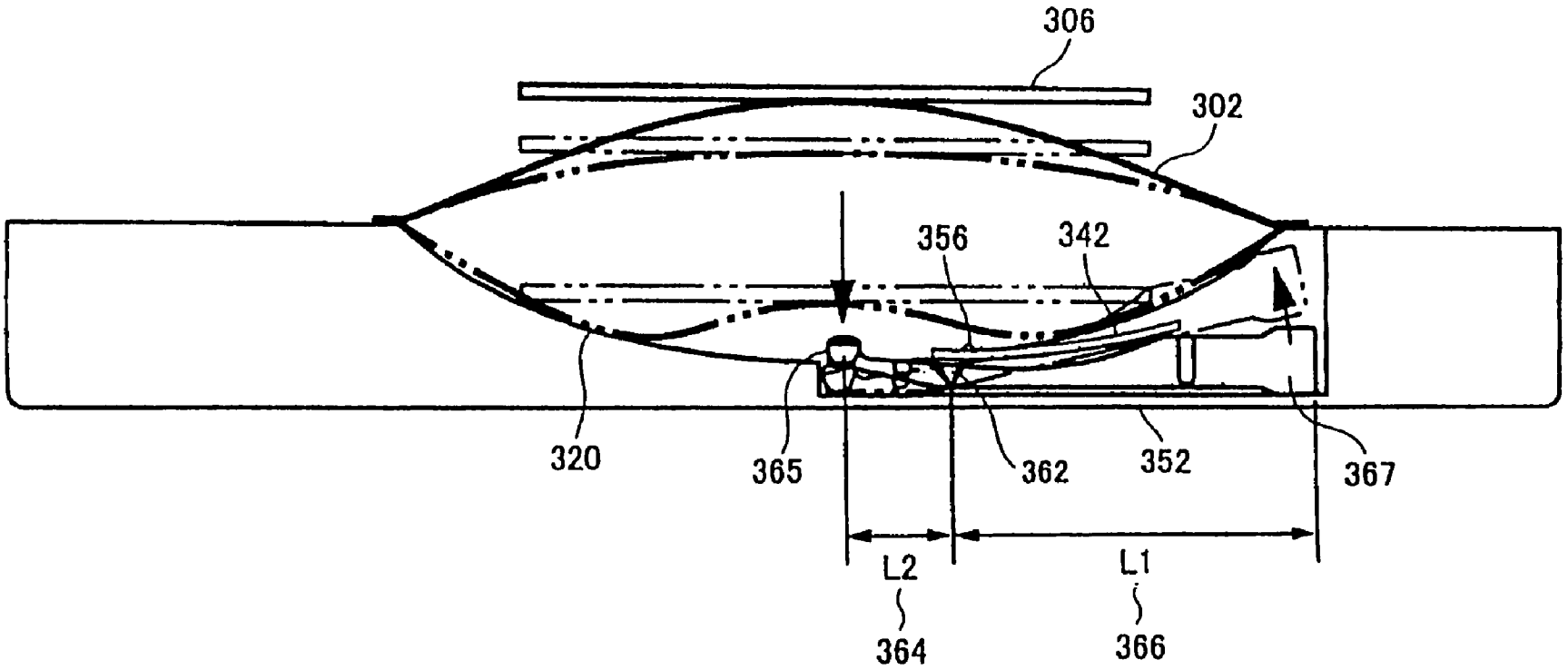
FIG. 17 is an operational diagram showing operation of the sensing mechanism of FIG. 16.

As shown in FIG. 16, the sensing mechanism 340 is made from a sensor lever accommodation groove 350, a sensor lever 360, and a suppressing film 342. The sensor lever 360 is disposed within the sensor lever accommodation groove 350. The suppressing film 342 has a T shape. The sensor lever accommodation groove 350 is opened in the base surface of the tub portion 320. The sensor lever accommodation groove 350 has a base surface 352 that follows the lower surface (FIG. 18) of the main case 230. The sensor lever accommodation groove 350 is formed so as to extend in a direction that is shifted 45 degrees with respect to the lengthwise (front-rear) direction of the case body from the central position of the curved surface portion 324 of the tub portion 320, to bend 45 degrees where it reaches the circular (or ellipsoidal) encompassing edge 322 of the tub portion 320, and then to extend parallel with the lengthwise direction of the case body. The portion of the sensor lever accommodation groove 350 that extends in parallel with the lengthwise direction of the case body is called the groove portion 354 and is open upward at the flat shoulder portion 328. In this way, the sensor lever accommodation groove 350 is open so as to extend in a direction shifted 45 degrees from the lengthwise direction of the case body at positions from the center portion of the curved surface portion 324 of the tub portion 320 to the slanted surface portion 326 and is open so as to extend parallel with the lengthwise direction of the case body at the upper surface of the flat shoulder portion 328. The depth of the sensor lever accommodation groove 350 is substantially fixed at the curved surface portion 324, rapidly increases at the slanted surface portion 326, and again is substantially fixed at the flat shoulder portion 328. The groove portion 354 of the sensor lever accommodation groove 350 extends outside of the tub portion 320, follows the wall that protrudes to the inside of the sensor accommodation groove 240 and reaches the inside of the sensor accommodation groove 240, thereby forming a protrusion portion 372 shown in FIG. 18. Also, the sensor lever accommodation groove 350 has a groove 351 that intersects the lengthwise direction.

The sensor lever 360 has a specific gravity that is higher than the specific gravity of ink and is formed from a black colored resin that can block infrared light. The sensor lever 360 is disposed within the sensor lever accommodation groove 350. The sensor lever 360 is an elongated plate-shaped member having a pivot fulcrum portion 362, an operation arm portion 364, and a sensing arm portion 366. The pivot fulcrum portion 362 has the shape of a triangular prism. The operation arm portion 364 and the sensing arm portion 366 extend from on opposite sides of the pivot fulcrum portion 362. A semispherical pivot 365 (an ink residual amount detection point) is provided at the end portion of the operation arm portion 364. The sensor lever 360 is disposed within the sensor lever accommodation groove 350 so that the semispherical pivot 365 is disposed in the center position of the curved surface portion 324 of the tub portion 320. As a result, the semispherical pivot 365 is disposed at the lowest position of the curved surface portion 324. The sensing arm portion 366 is bent at a 45 degree angle near its end, thereby forming a bent end portion 367, which is positioned in the groove portion 354 of the sensor lever accommodation groove 350 (the portion opened at the flat shoulder portion 328) and functions as a sensing point. The pivot fulcrum portion 362 is disposed inside the intersecting groove 351 of the sensor lever accommodation groove 350. The apex of the triangular cross section of the pivot fulcrum portion 362 sinks in the ink so as to contact the bottom of the intersecting groove 351. As a result, the sensor lever 360 can pivot with the pivot fulcrum portion 362 as a fulcrum. Here, the weight of the sensing arm portion 366 is greater than the weight of the operation arm portion 364. In this example, the weight of the sensing arm portion 366 is five times or greater than the weight of the operation arm portion 364. For this reason, when sufficient ink remains, the sensing point 367 of the sensor lever 360 is positioned on the base surface 352 of the sensor lever accommodation groove 350 as indicated by solid line in FIG. 17. The semispherical pivot 365 (ink residual amount detection point) ink floats up from the base surface 352 and protrudes over the bottom of the tub portion 320. On the other hand, when ink is used up so that the flexible film 302 moves down toward the tub portion 320, the flexible film 302 presses down the semispherical pivot 365 (ink residual amount detection point) as shown by two-dot chain line in FIG. 17 so that the bent end portion 367 (sensing point) rises up. Because the sensor lever 360 is accommodated in this way in the sensor lever accommodation groove 350, which extends out from the tub portion 320 from under the tub portion 320, the sensor lever 360 does not block the flexible film 302 as the flexible film 302 deforms toward the tub portion 320. Therefore, detection of residual ink can be more reliably performed.

Also, the length L1 of the sensing arm portion 366 of the sensor lever 360 is longer than the length L2 of the operation arm portion 364. In this example, the length L1 of the sensing arm portion 366 is about four times the length L2 of the operation arm portion 364. Accordingly, even if the flexible film 302 lowers the semispherical pivot 365 (ink residual amount detection point) only a slight bit, the bent end portion 367 will rise up a great deal so that detection using a residual amount detection sensor 70 to be described later can be reliably performed.

The PET film tension plate 306 insures that the sensor lever 360 will reliably operate when almost no ink remains unused so that ink can be used up to the maximum. That is, if the tension plate 306 were not provided, then wrinkles could develop in one portion of the flexible film 302 as the flexible film 302 lowers down in association with reduction in ink and the flexible film 302 comes into intimate contact with the tub portion 320. In this case, the sensor lever 360 would be activated while ink remains between the wrinkled portion and the tub portion 320 so that ink is not used up.

However, only the center portion of the exemplary tension plate 306, that is, the portion that confronts the semispherical pivot 365 of the sensor lever 360, is connected to the center portion of the flexible film 302. The tension plate 306 rides on top of the bulging flexible film 302 as indicated by solid line in FIG. 17 when there is a great deal of ink in the tub portion 320. The tension plate 306 moves downward in association with reduction in ink. However, when a small amount of ink remains, both ends of the tension plate 306 abut against the inner peripheral surface of the tub portion 320 at a position lower than the opening peripheral edge 312 and higher than the lowest position of the tub portion 320 so that the tension plate 306 is restricted from moving further downward. As a result, although the peripheral portion of the flexible film 302 is in intimate contact following the inner peripheral surface of the tub portion 320, the center portion of the flexible film 302 is raised up because of the tension plate 306. At this time, the center portion of the raised-up flexible film 302 confronts the semispherical pivot 365 of the sensor lever 360 with a spaced opened up therebetween.

When the amount of ink is further reduced, the center portion of the flexible film 302 moves further down against the resilience of the tension plate 306. However, once the amount of ink in the tub portion is reduced to less than a predetermined amount range so that hardly any ink remains, the flexible film 302 overcomes the urging force of the tension plate 306 so that the center portion of the flexible film 302 presses against the semispherical pivot 365 of the sensor lever 360. At this time, the surface area of the peripheral portion of the flexible film 302 that is in intimate contact following the inner peripheral surface of the tub portion 320 gradually increases until the center of the flexible film 302 presses the sensor lever 360. That is, the tension plate 306 prevents wrinkles from being generated in the flexible film 302 along the way. Also, the flexible film 302 moves down while ink is collected in the center portion of the tub portion 320. Therefore, the sensor lever 360 will reliably operate in the condition wherein almost no ink remains unused.

The tension plate 306 need not be formed in the substantial rectangular shape described above, but could be triangular shaped, star shaped, circular shaped, or any optional shape as long as its shape enables opening a space between the flexible film 302 and the semispherical pivot 365 of the sensor lever 360 when downward movement is restricted as described above. Further, the outer peripheral portion of these different shaped members need not abut the inner peripheral surface of the tub portion 320, but could be placed on the opening peripheral edge 312.

It is desirable that the tension plate 306 have resilience and weight that does not apply influence to the pressure in the ink accommodation portion 300. However, pressure in the ink accommodation portion 300 can be adjusted by appropriately setting the resilience and weight. When there is a great deal of ink, the weight of the tension plate 306 applies positive pressure to the inside of the ink accommodation portion 300 because the tension plate 306 contacts only the center of the flexible film 302. When only a little ink remains, then the tension plate 306 functions as a beam to lift up the central portion of the flexible film 302. As a result, a negative pressure is applied to the ink accommodation portion 300. By adjusting the spring force (which relates to negative pressure when little ink remains), weight (which relates to positive pressure when a great deal of ink remains), and length (which relates to timing of the switch from application of positive pressure to the application of negative pressure) of the tension plate 306, a pressure that is appropriate with the consumption condition of ink can be applied to the ink accommodation portion 300.

The exemplary tension plate 306 is connected to the flexible film 302 so as to move following the flexible film 302 until only a slight amount of ink remains. On the other hand, the tension plate 306 is restricted from moving downward by the tub portion 320 when only a little ink remains and has resilience that urges the flexible film 302 in a direction away from the pivot (ink residual amount detection point) 365. The tension plate 306 allows portions of the flexible film 302 other than portions in confrontation with the pivot (ink residual amount detection point) 365 to follow the tub portion 320 at least after a slight amount of ink remains. However, the tension plate 306 urges portions of the flexible film 302 that confront the pivot (ink residual amount detection point) 365 in the direction away from the pivot (ink residual amount detection point) 365. Moreover, in association with reduction in ink after a slight amount of ink remains, the tension plate 306 approaches toward the pivot (ink residual amount detection point) 365 against the urging of the tension plate 306. In this way, ink can be reliably used up.

As shown in FIG. 16, the T-shaped suppressing film 342 is made from PET and is provided to press the sensor lever 360 downward into the sensor lever accommodation groove from above the sensor lever 360. Explained in more detail, the suppressing film 342 has an integral fixed portion 342*a* and resilient plate portion 342*b*. The resilient plate portion 342*b* presses the sensing arm portion 366. Of the sensor lever accommodation groove 350, the groove 351 which accommodates the pivot fulcrum portion 362 is formed with a level difference. A pair of holes 344 are formed in the fixed portion 342*a*. By fitting a pair of protrusions 356 into the pair of holes 344 and crushing the pair of protrusions 356, the fixed portion 342*a* can be fixed to the tub portion 320. By this, the pivot fulcrum portion 362 is supported in the intersecting groove 351 with a space opened between itself and the T-shaped suppressing film 342. The sensor lever 360 can be freely pivoted with the pivot fulcrum portion 362 as a fulcrum. The resilient plate portion 342*b* is disposed inserted inside the sensor lever accommodation groove 350 so as to extend toward to the sensing arm portion 366 from the fixed portion 342*a*. By this, the sensing arm portion 366 moves down by the resilient plate portion 342*b*. That is, because the semispherical pivot 365 is urged to protrude above the bottom surface of the tub portion 320, the semispherical pivot 365 can be reliably protruded above the base surface of the tub portion 320 even if the ink cartridge is turned upside down during transport of the ink cartridge. It should be noted that the resilience of the resilient plate portion 342*b* is large enough to block further rising movement of the sensing arm portion 366 in association with reduction in ink.

It should be noted that the portion of the sensor lever accommodation groove 350 that accommodates the sensing arm portion 366 is formed in the slanted surface portion 326. Because the slant of the slanted surface portion 326 is greater than the slant of the spherical surface portion, the sensing arm portion 366 can move upward by a sufficient amount without contacting and being obstructed by the flexible film 302.

Figure 18:
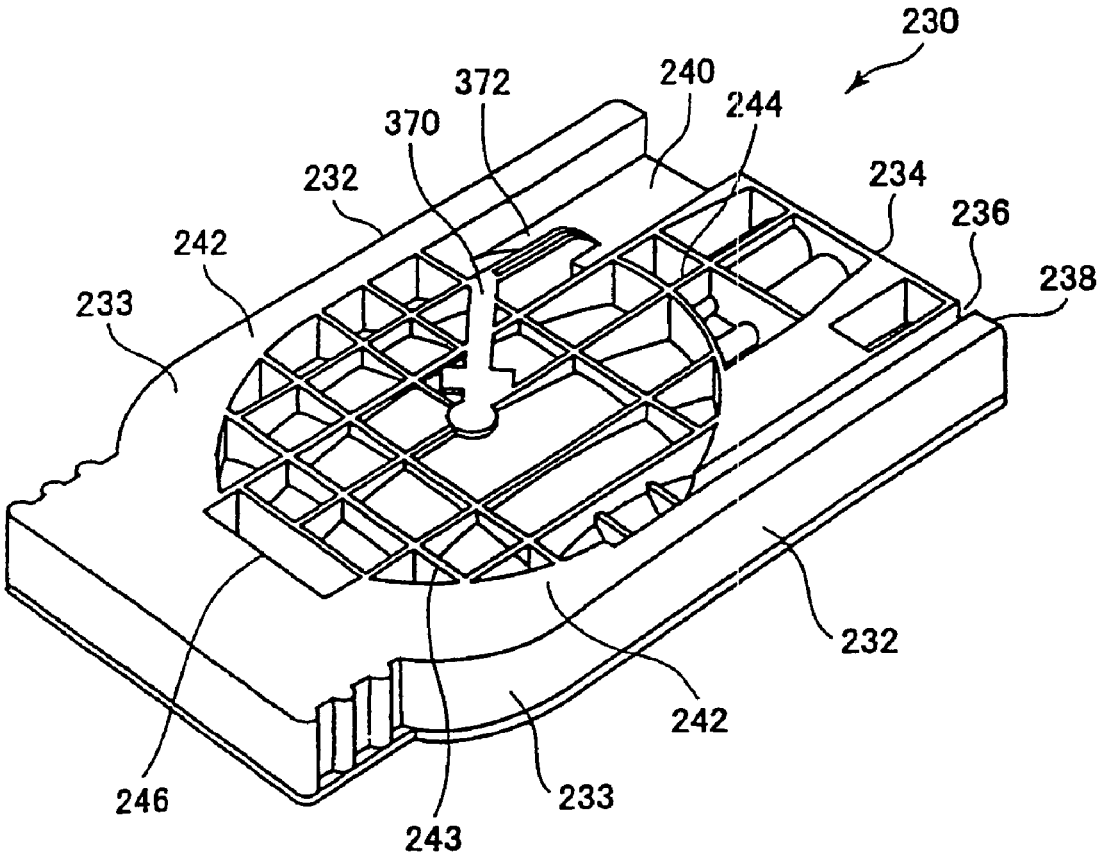
FIG. 18 is an underside view of a main case of an exemplary ink cartridge.
Figure 30:
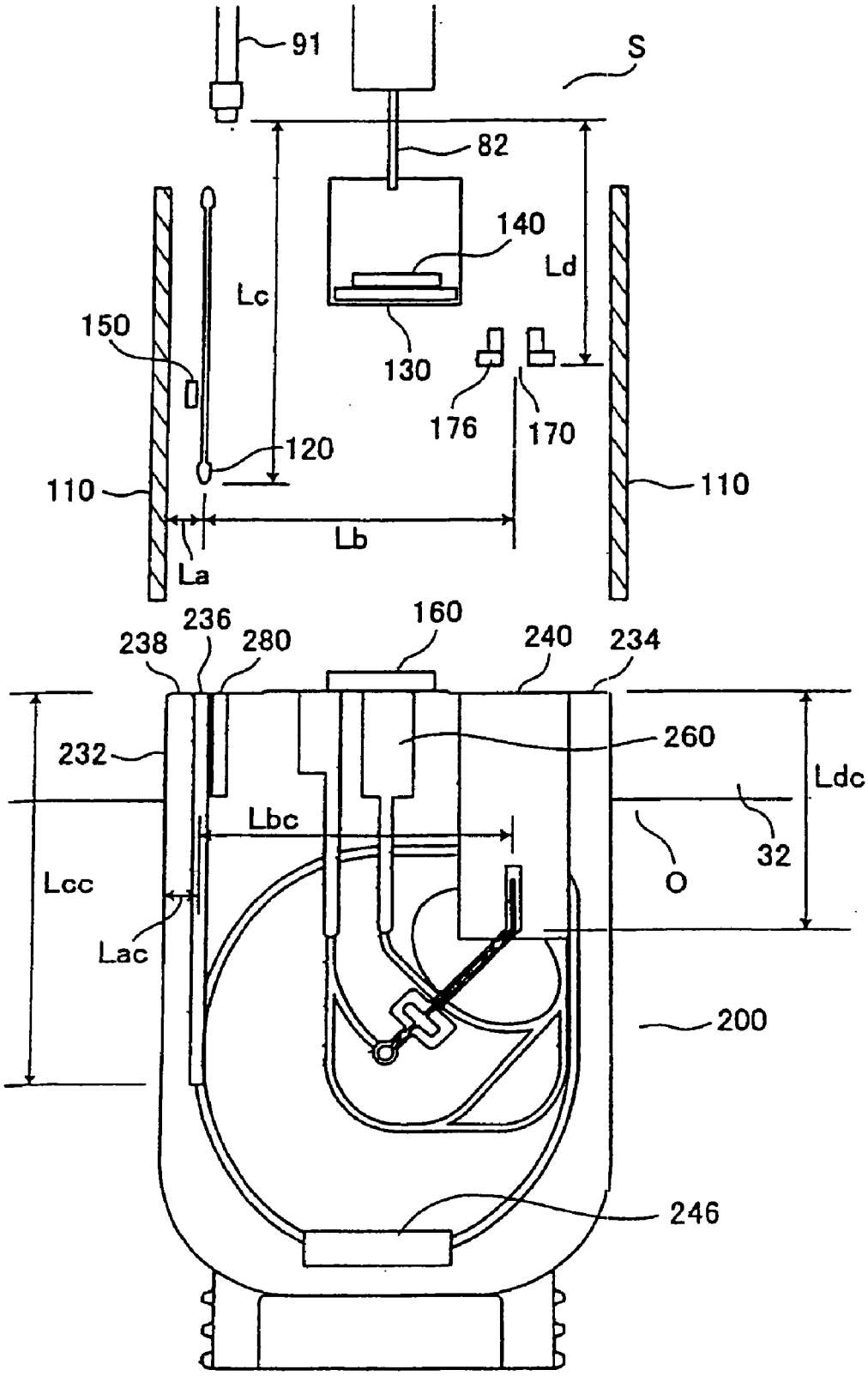
FIG. 30 is a plan view showing a configuration wherein a pull-out lock protusion portion of an ink cartridge-mounting portion of an exemplary multifunction device is retracted by a front surface wall of an exemplary ink cartridge when the ink cartridge is inserted into a mounting portion opening of the ink cartridge-mounting portion.
Figure 35:
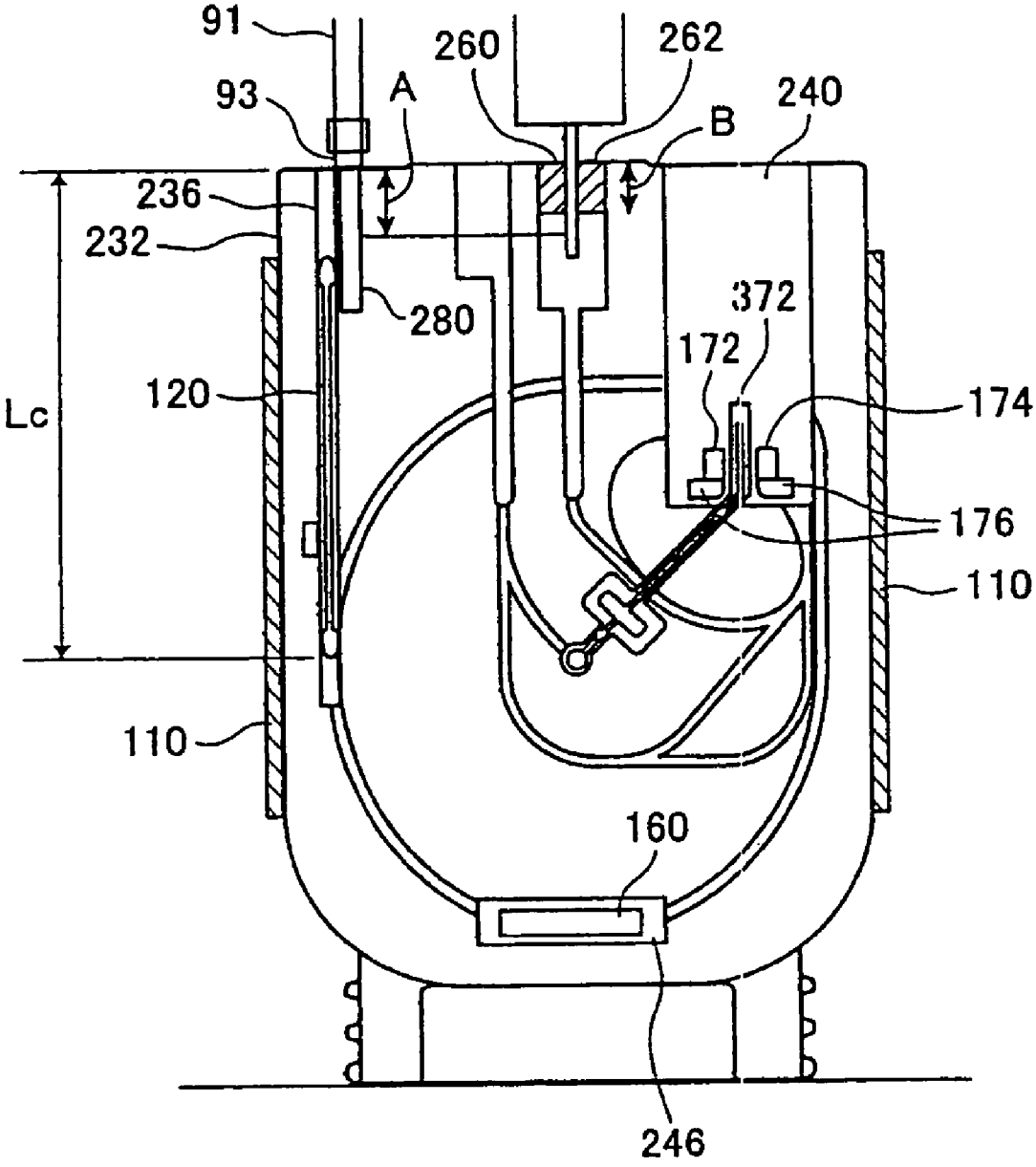
FIG. 35 is a plan view of the configuration shown in FIG. 34.
Figure 36:
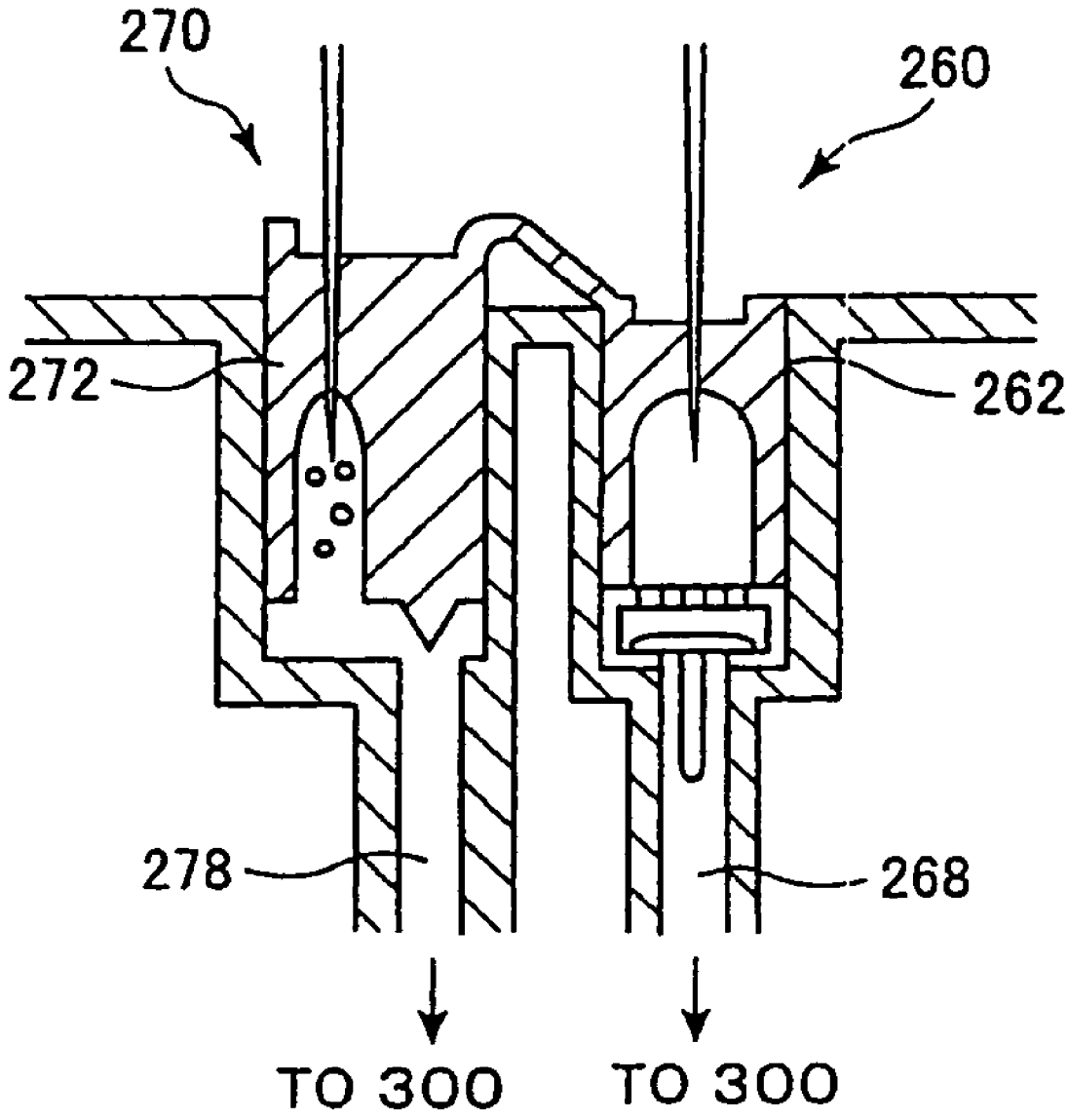
FIG. 36 is a cross-sectional view showing injection of ink into an exemplary ink cartridge.

As shown in FIG. 18, the lower surface of the main case 230 includes a flat smooth surface 242 capable of sliding with respect to the ink cartridge-mounting portions S. The flat smooth surface 242 is connected by the side walls 232 on both sides. The lower surface of the main case 230 is formed with the guide groove 236 and the sensor accommodation groove 240. As shown in FIG. 30, the distance Lac between the guide groove 236 and the side wall 232 that is nearest in the widthwise direction corresponds to the guide-partition wall intervening distance La in the ink cartridge-mounting portions S. As shown in FIG. 35, the guide groove 236 is formed merely with a length Lcc capable of accommodating the guide protrusion walls 120 in the lengthwise direction from the front surface wall 234. More particularly, the guide groove 236 is formed with a length that is at least as long or longer than a length Lc between the positive pressure application members 91 in the ink cartridge-mounting portions S and the side end of the front surface opening portion O of the guide protrusion walls 120. For this reason, the guide groove 236 can accommodate the guide protrusion wall 120 when the ink cartridge 200 is mounted in the ink cartridge-mounting portion S. As shown in FIG. 30, the distance Lbc between the guide groove 236 and the guide protrusion walls 120 corresponds to a guide-sensor interdistance in the ink cartridge-mounting portion S. As shown in FIG. 30, the sensor accommodation groove 240 is formed to merely a length Ldc that corresponds to the distance Ld between the positive pressure application members 91 in the lengthwise direction from the wall and the residual ink detecting photo sensor 170 so that the residual ink detecting photo sensor 170 can be accommodated when the ink cartridge 200 is mounted in the ink cartridge-mounting portion S.

A plurality of ribs 243 are formed in the lower surface of the main case 230. The ribs 243 are for supporting the strength of the tub portion 320 from the under surface of the tub portion 320. It should be noted that a bottom central axis rib 244 is formed in the central position in the widthwise direction of the main case 230 so as to extend in the lengthwise direction of the main case 230. The bottom central axis rib 244 continues to retract the pull-out-lock protrusion 160 (FIG. retrieval unit 10) to below the bottom surface when the ink cartridge 200 slides above the bottom surface of the ink cartridge-mounting portion S. The ink cartridge 200 will not pull out from the ink cartridge-mounting portion S because the pull-out-lock protrusion 160 engages with the leak preventing lock indentation 246 when the ink cartridge 200 is mounted in the ink cartridge-mounting portion S.

A sensor lever accommodation portion 370 forms the inner portion of the sensor lever accommodation groove 350. The sensor lever accommodation portion 370 is formed in the lower surface of the main case 230 so as to protrude out from the tub portion 320. The portion (sensor lever accommodation protrusion portion 372) of the sensor lever accommodation portion 370 that corresponds to the base surface 352 of the sensor lever accommodation groove 350 protrudes in the lengthwise direction at the widthwise center of the sensor accommodation groove 240. The rounded surfaces formed in the confronting faces of the sensor guards 176 facilitate insertion of the protrusion portion 372 in between the sensor guards 176 and the infrared light emitting portion 172 and the infrared light receiving portion 174 of the residual ink detecting photo sensor 170. As shown in FIG. 35, when the ink cartridge 200 is mounted in the ink cartridge-mounting portions S and the residual ink detecting photo sensor 170 is housed in the sensor accommodation groove 240, the sensing accommodation protrusion portion is positioned between the infrared light emitting portion 172 and the infrared light receiving portion 174 of the residual ink detecting photo sensor 170. The sensing arm end portion 367 (sensing point) of the sensor lever 360 positioned in the groove portion 354 in the protrusion portion 372 will as a result be positioned between the infrared light emitting portion 172 and the infrared light receiving portion 174. It should be noted that at least the protrusion portion 372 of the main case is made from a material that is transparent to infrared light.

Figure 19:
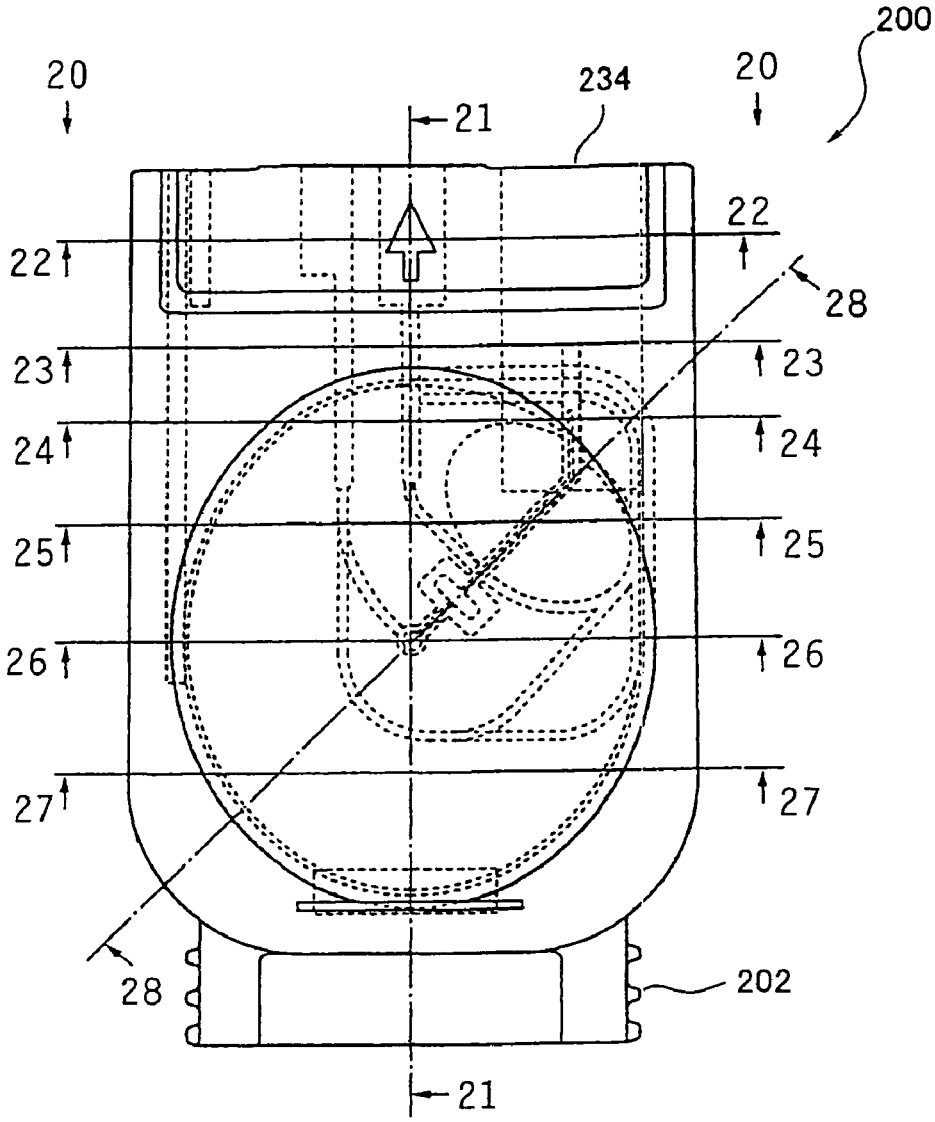
FIG. 19 is a plan view of an exemplary ink cartridge.
Figure 20:
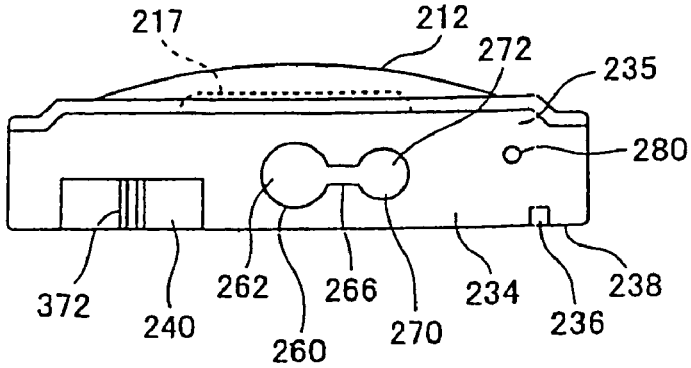
FIG. 20 is an end view of the ink cartridge in FIG. 19.
Figure 21:
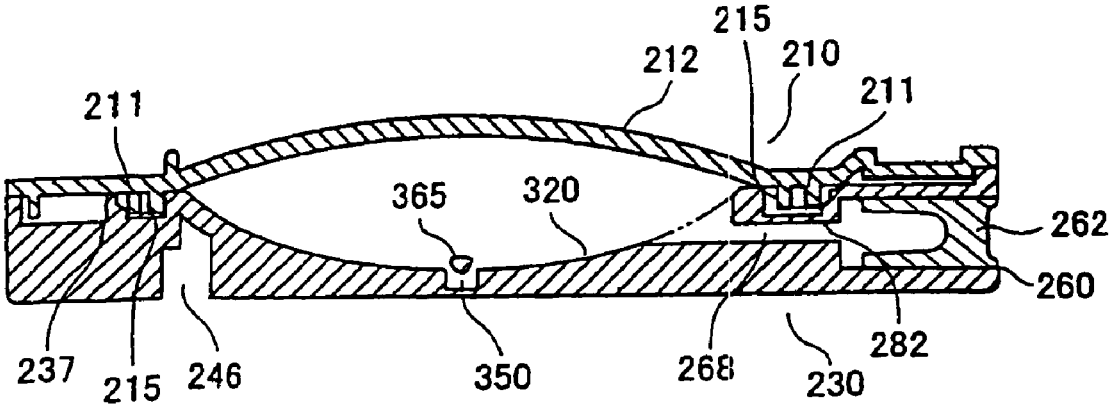
FIG. 21 is a cross-sectional view of the ink cartridge in FIG. 19.
Figure 22:
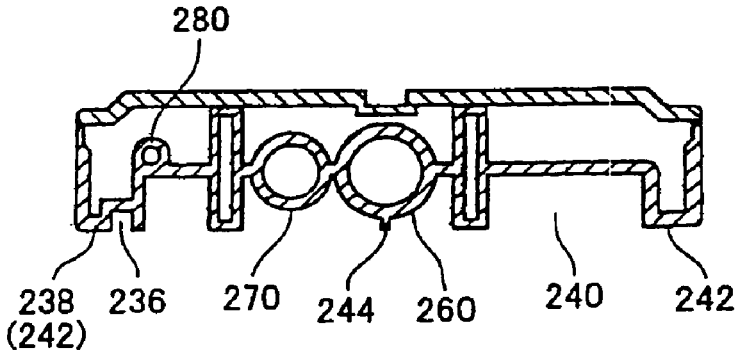
FIG. 22 is a cross-sectional view of the ink cartridge in FIG. 19.
Figure 23:
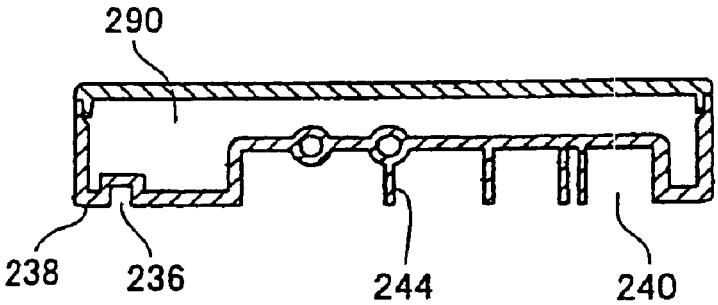
FIG. 23 is a cross-sectional view of the ink cartridge in FIG. 19.
Figure 24:
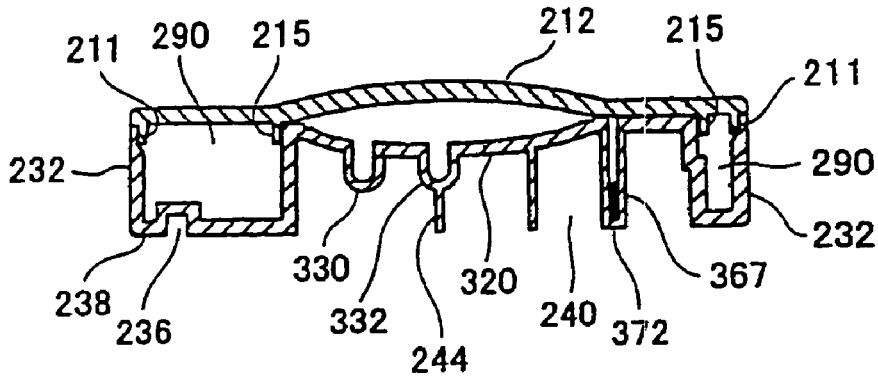
FIG. 24 is a cross-sectional view of the ink cartridge in FIG. 19.
Figure 25:
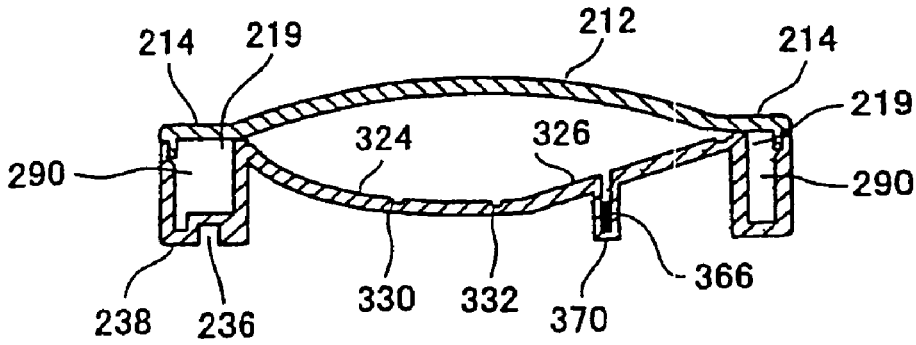
FIG. 25 is a cross-sectional view of the ink cartridge in FIG. 19.
Figure 26:
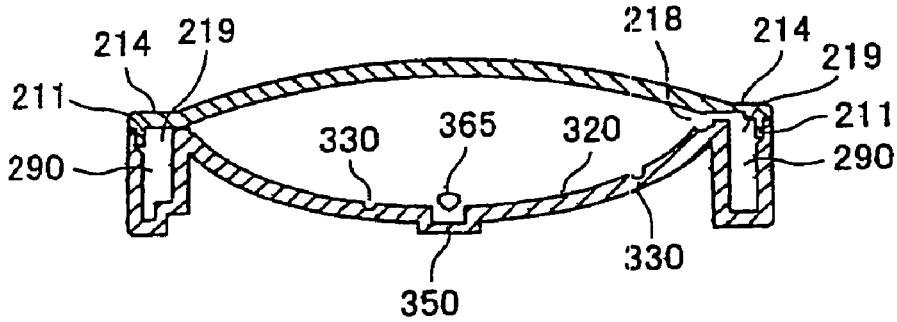
FIG. 26 is a cross-sectional view of the ink cartridge in FIG. 19.

FIG. 19 is a schematic plan view of an exemplary ink cartridge 200 having the configuration described above. FIG. 19 shows the situation wherein the lid 210 is mounted on the main case 230. Internal configuration is indicated by broken line. FIG. 20 is an end view of the ink cartridge 200 shown in FIG. 19, that is, is a frontal view showing the front surface of the ink cartridge 200. FIGS. 21 to 28 are cross-sectional views of the ink cartridge 200 shown in FIG. 19. It should be noted that the flexible film 302 and the ribs (243, 292) are not indicated in the drawings for purposes of clarity. However, the bottom central axis rib 244 is indicated in some of the drawings.

Figure 27:
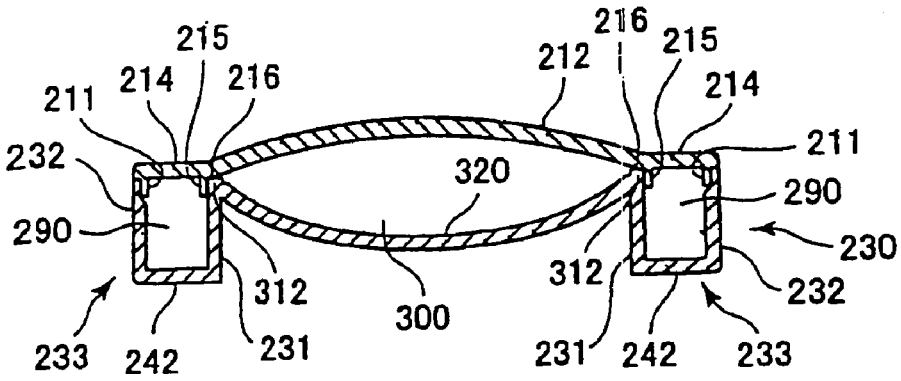
FIG. 27 is a cross-sectional view of the ink cartridge in FIG. 19.
Figure 28:
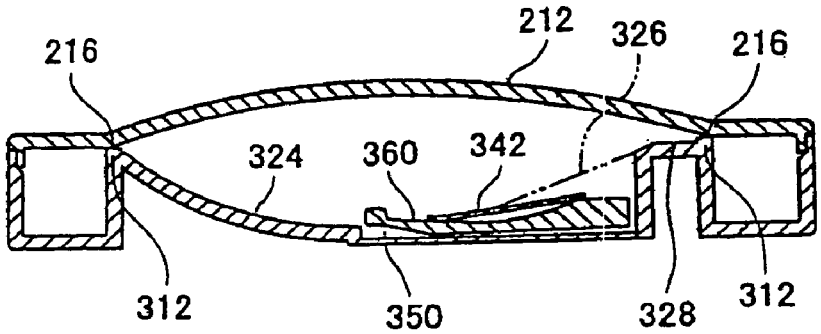
FIG. 28 is a cross-sectional view of the ink cartridge in FIG. 19.

As shown in FIGS. 15 and 27, a peripheral wall 231 is formed in the main case 230. The peripheral wall 231 extends from the opening peripheral edge 312, which defines the opening of the tub portion 320, integrally and continuously to the bottom surface side (in the depth direction of the tub portion 320) of the main case 230. A peripheral wall portion 233 is formed connected to the peripheral wall 231, the side walls 232, and the flat smooth surface 242. The peripheral wall portion 233 supports the tub portion 320 from the periphery of the tub portion 320. The peripheral wall 231 and the side walls 232 are separated by an interposed space and are connected together by a plurality of wall-like ribs 292. The flat portion 214 of the lid is coupled to the upper end of the peripheral wall portion 233 and serves as the outer peripheral portion in confrontation with the peripheral wall portion 233. Accordingly, the lower surface of the ink accommodation portion 300 is stabilized by the flat smooth surface 242 even when substantially spherically shaped. Attachment to and removal from the multifunction device 1 is simple. Because the flexible film 302 is adhered to the opening peripheral edge 312 and the lid 210 is connected to the upper end of the peripheral wall portion 233, ink can be reliably sealed in without the adhered portion of the flexible film 302 interfering with the lid 210. Because the peripheral wall portion 233 has a two-layered configuration made from the peripheral wall 231 and the side walls 232, and uses a configuration wherein the peripheral wall portion 233 and the peripheral wall 231 are connected by a plurality of ribs 292, the peripheral wall portion 233 can be prevented from deforming even though the ink cartridge 200 is subjected to vacuum pack processes to be described later. Further, as is clear from FIG. 18, the plurality of ribs 243 are formed so as to connect the lower surface of the tub portion 320 and the peripheral wall portion 233. For this reason, the ribs 243 prevent the tub portion 320 and peripheral wall portion 233 from deforming even if the ink cartridge 200 is subjected to the vacuum pack processes to be described later.

Figure 29:
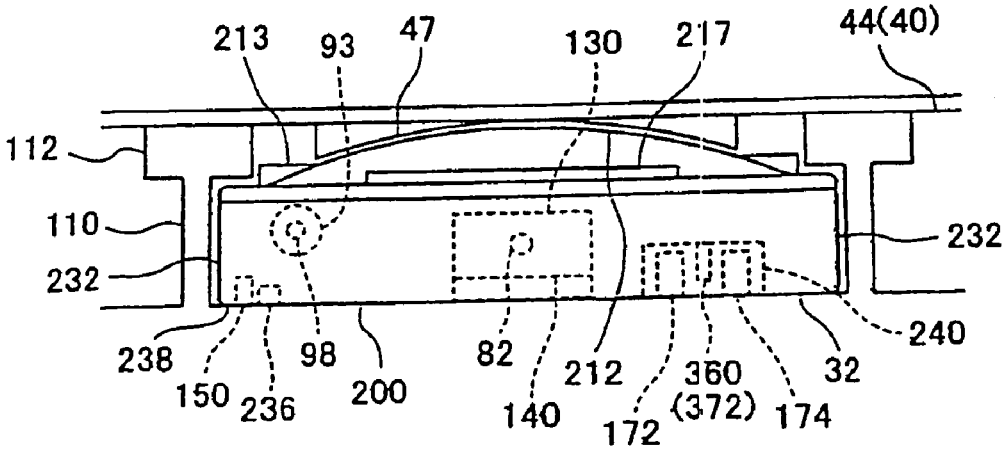
FIG. 29 is a view showing a relationship between bulging portions formed on partition walls of an ink cartridge-mounting portion of an exemplary multifunction device, a height of an exemplary ink cartridge, and a curved convex wall formed on a ceiling surface of the ink cartridge-mounting portion when the ink cartridge is inserted into a mounting portion opening.

The ink cartridge 200 having the above-described configuration has a flat lower surface. As shown in FIG. 29, the upper surface has a curved shape that is higher than the height at both ends (side walls 232) in the widthwise direction. The height at both ends in the widthwise direction (the height from the flat smooth surface 242 to the flat portion 214) is substantially the same as the distance between the base wall 32 and the enlarged portion 112 that is formed on the upper portion of the front surface opening portion O side end of the partition walls 110. Accordingly, the ink cartridge 200 can be inserted into the ink cartridge-mounting portions S. Also, the ink cartridge 200 can be prevented from being inserted upside down because the height of the spherical outward curved portion 212 and the protrusion portion 213 is higher than the height at both sides in the widthwise direction and because the curve-shaped protruding walls 47 of the ceiling surface of the mounting portions S is formed following the spherical outward curved portion 212 of the ink cartridge 200.

Because the lower surface of the main case 230 is smooth and formed with the peripheral wall portion 233, which extends in the lengthwise direction, the ink cartridge 200 can be mounted by merely inserting the ink cartridge 200 in the ink cartridge-mounting portion S and sliding it over the bottom surface while the pull-out-lock protrusion 160 is in a retracted condition. Moreover, the width of the ink cartridge 200 corresponds to the distance between the partition walls 110 of the ink cartridge-mounting portion S, the distance Lac between the guide groove 236 and the side walls 232 nearest in the widthwise direction corresponds to the guide-partition wall intervening distance La in the ink cartridge-mounting portion S, and the distance Lbc between the guide groove 236 and the sensor accommodation groove 240 corresponds to the inter-guide-sensor distance Lb in the ink cartridge-mounting portion S. Accordingly, by sliding the cartridge so that the guide groove 236 is guided by the guide protrusion walls 120 when the ink cartridge 200 is inserted into the ink cartridge-mounting portion S, the residual ink detecting photo sensor 170 is reliably housed in the sensor accommodation groove 240 and the bent end portion 367 in the sensor accommodation groove 240 is inserted between the infrared light emitting portion 172 and the infrared light receiving portion 174.

It should be noted that as indicated in FIGS. 9 and 30, the position of the end portion of the front surface opening portion O side of the guide protrusion walls 120 in the ink cartridge-mounting portion S is positioned at a position nearer the front surface opening portion O than the position of the end portion (sensor guard 176) of the front surface opening portion O side of the residual ink detecting photo sensor 170. The end of the guide groove 236 that is opposite from the front surface wall 234 is positioned farther from the front surface wall 234 than the end of the sensor accommodation groove 240 that is opposite from the front surface wall 234. Accordingly, when the ink cartridge 200 is inserted into the ink cartridge-mounting portion S and slid over the holding portion base wall 32, the sensor accommodation groove 240 reaches the residual ink detecting photo sensor 170 after the guide groove 236 accommodates the guide protrusion walls 120. Because the main case 230 reaches the residual ink detecting photo sensor 170 after being positioned in the widthwise direction of the ink cartridge 200 by engagement between guide protrusion walls 120 and the guide groove 236, the bent end portion 367 in the sensor accommodation groove 240 is inserted between the infrared light emitting portion 172 and the infrared light receiving portion 174.

Because the guide protrusion wall 120 is near the lock releasing operation rib 150 in the widthwise direction of the ink cartridge-mounting portion S and the guide groove 236 is near the lock release portion 238 in the widthwise direction of the ink cartridge 200, the lock release portion 238 reliably abuts against the lock releasing operation rib 150 and retracts it when the ink cartridge 200 is mounted in the ink cartridge-mounting portion S. Moreover, because the spring 114 member presses the ink cartridge 200 downward from above the partition walls 10 in the vicinity of the guide protrusion walls 120, operations for retracting the lock releasing operation rib 150 are more reliable.

As shown in FIGS. 29 and 35, the ink cartridge 200 includes the sensor accommodation groove 240 and the guide groove 236 as openings in the front surface wall 234 and in the underside surface at positions that are disposed on either sides of the ink supply hole 260 as viewed from the front surface wall 234 side. The sensor accommodation groove 240 is for accommodating the residual ink detecting photo sensor 170. The guide groove 236 is for accommodating the guide protrusion walls 120. The sensing arm end portion 367 is inserted between the infrared light emitting portion 172 and the infrared light receiving portion 174 and is movably housed in the protrusion portion 372. Because the protrusion portion 372 protrudes into the sensor accommodation groove 240 and the lock release portion 238 is provided adjacent to the guide groove 236, the ink cartridge 200 can be configured flat and can be smoothly and stably moved across the base wall 32 of the ink cartridge-mounting portion S. The ink cartridge 200 can be easily attached and detached. Moreover, the amount of residual ink can be reliably detected by merely mounting the ink cartridge 200 in the ink cartridge-mounting portion S.

An exemplary ink cartridge 200 mounted in the ink cartridge-mounting portion S is shown in FIGS. 30 to 35.

Figure 31:
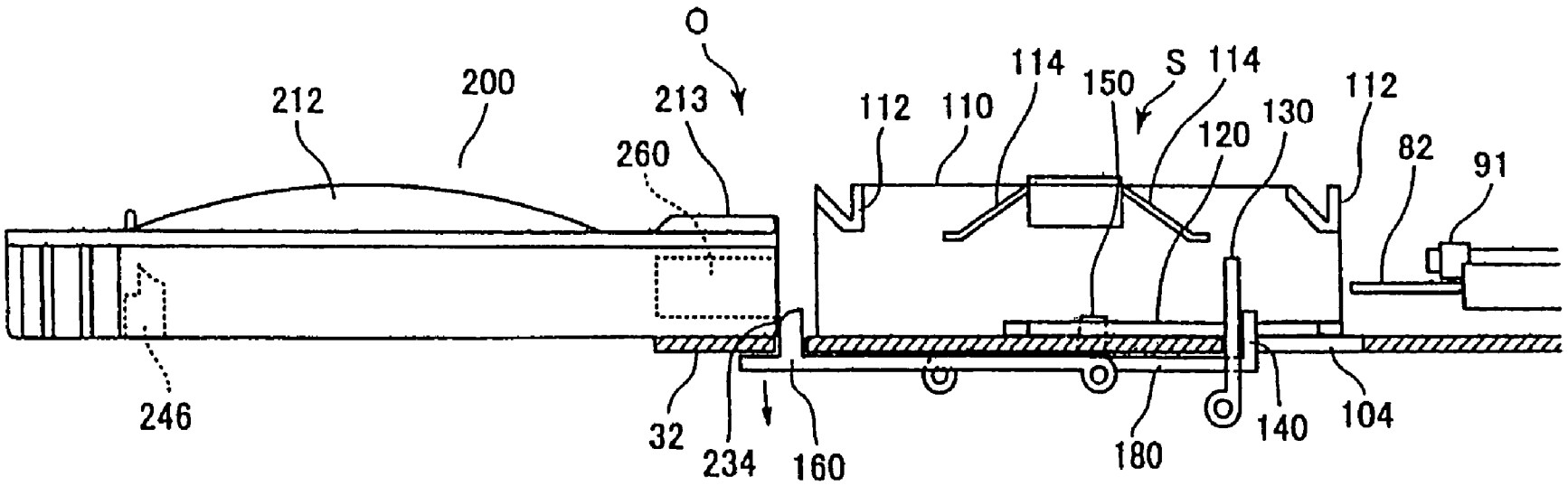
FIG. 31 is a cross-sectional view of the configuration shown in FIG. 30.
Figure 32:
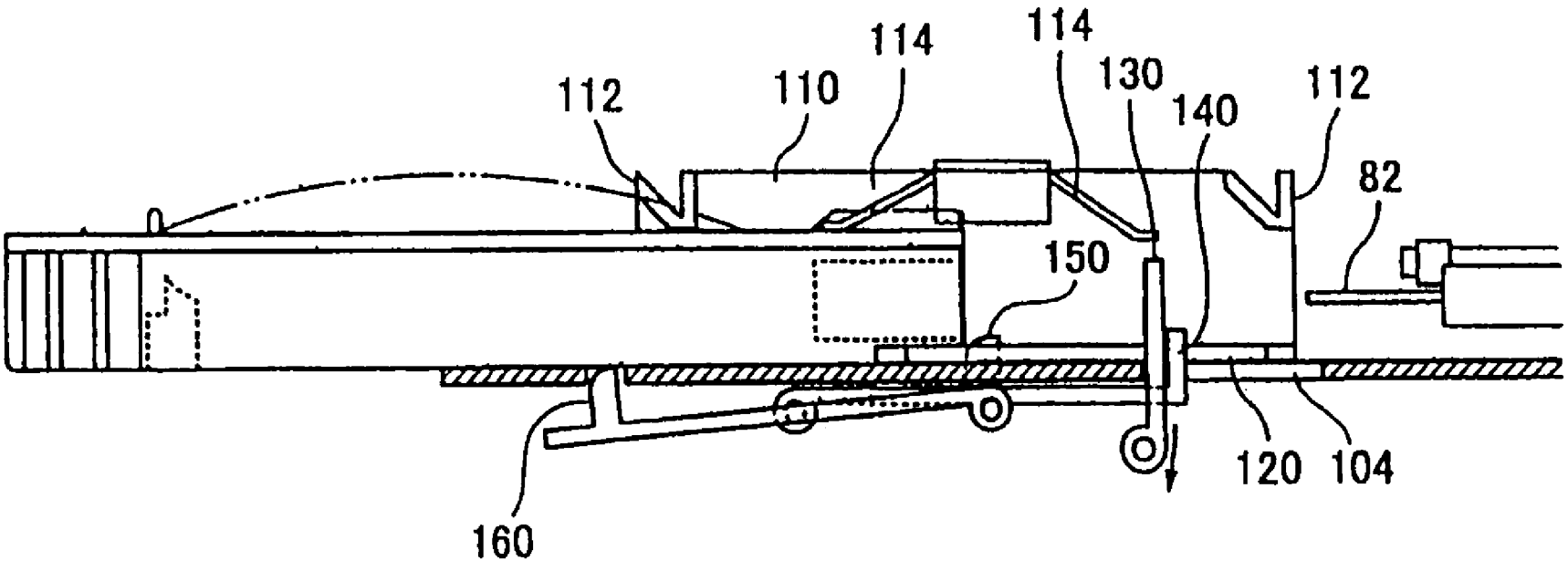
FIG. 32 is a cross-sectional view showing a configuration wherein a needle protection lock member releases a needle protection plate in an exemplary multifunction device when an exemplary ink cartridge is inserted in the multifunction device.
Figure 33:
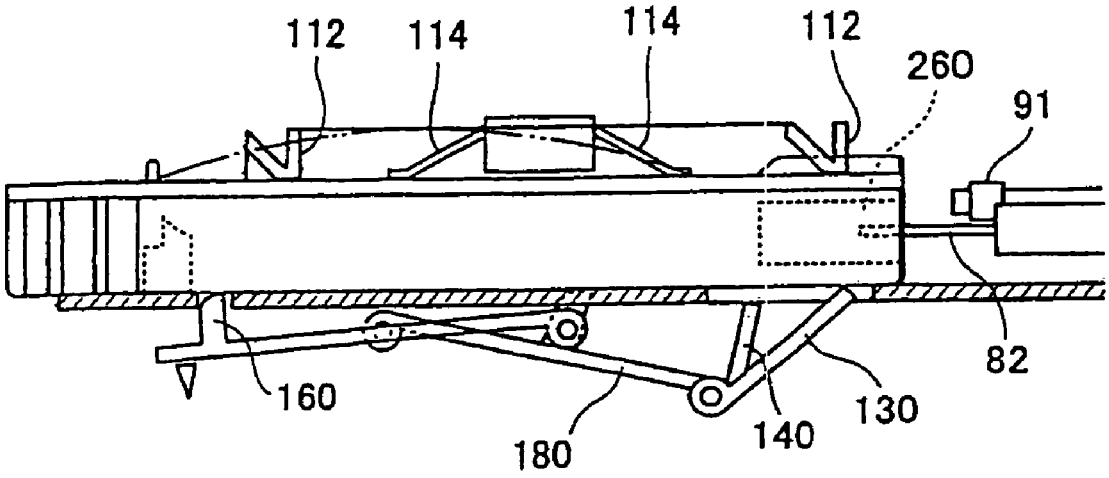
FIG. 33 is a cross-sectional view showing a configuration wherein an ink introduction hollow needle of an exemplary multifunction device is inserted into an ink supply hole of an exemplary ink cartridge when the cartridge is inserted in the device.
Figure 34:
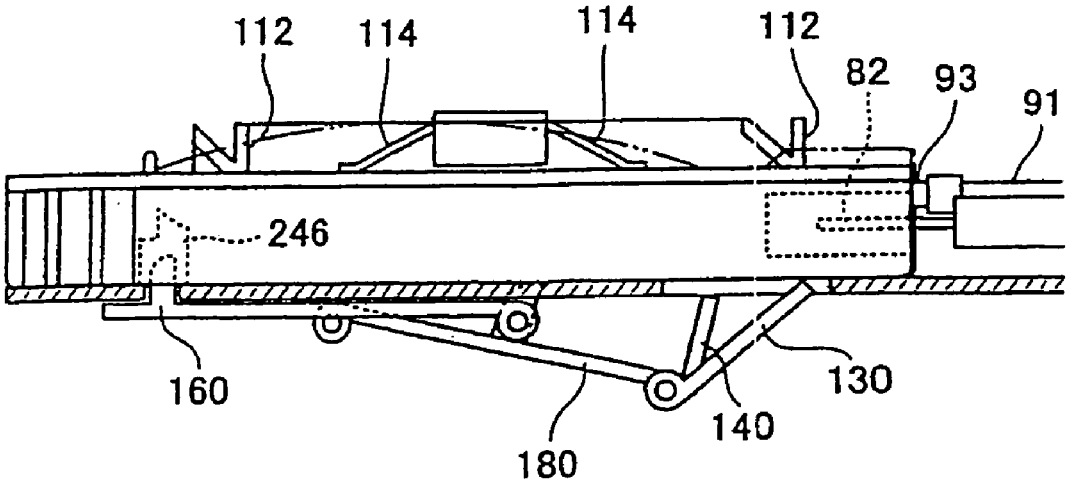
FIG. 34 is a cross-sectional view showing a configuration wherein a front surface of an exemplary ink cartridge abuts a rubber cap of a positive pressure application member of an exemplary multifunction device when the cartridge is inserted in the device.

A user pivots the front surface cover 50 open to expose the ink cartridge holding portion P. Then, the user inserts the ink cartridge 200 into the front surface opening portion O of the ink cartridge-mounting portion S and slides the lower surface of the ink cartridge 200 over the cartridge holding portion base wall 32. As a result, first as shown in FIGS. 30 and 31, the front surface wall 234 retracts the pull-out-lock protrusion 160. Afterward, as shown in FIG. 32, the pull-out-lock protrusion 160 continues to be retracted by the bottom central axis rib 244 while the cartridge slides forward. The guide groove 236 engages with the guide protrusion walls 120 and is slid further. When the lock release portion 238 of the front surface wall 234 hits the lock releasing operation rib 150, the lock member 180 releases the lock of the needle protection plates 130 (lowers the pressing plate 140). Afterward, as shown in FIG. 33, the needle protection plate 130 retracts when the front surface wall 234 of the ink cartridge 200 presses the needle protection plates 130. When the ink cartridge 200 is moved further forward and is completely inserted into the ink cartridge-mounting portion S, the ink introducing hollow needle 82 pierces the ink supply rubber plug 262 (FIG. 36) in the ink supply hole 260. Afterward, as shown in FIGS. 34 and 35, the front surface wall 234 abuts the rubber cap 93 of the positive pressure application members 91. The cartridge is pressed in against the force of the spring 94 of the positive pressure application members 91 until it proceeds a bit further. At this time, it is desirable that the front surface of the cartridge abut against a stopper wall (not shown) so that forward progress of the cartridge is blocked. Afterward, although the cartridge moves back a small bit by the force of the spring 94, the pull-out-lock protrusion 160 engages in the leak preventing lock indentation 246 at the under surface of the cartridge. As a result, the cartridge is locked in place and is prevented from pulling out. In this way, the ink cartridge 200 is mounted in the ink cartridge-mounting portion S. Because the front surface wall 234 of the ink cartridge 200 abuts the ring-shaped resilient seal member 93 with a substantially flat portion thereof, the atmosphere connection hole 280 and the positive pressure hole 98 of the ring-shaped resilient seal member 93 are reliably brought into fluid communication without any air leaks.

Because the black ink cartridge has a wider width than the other color ink cartridges, the black ink cartridge cannot be mistakenly inserted into an ink cartridge-mounting portion S for a color ink cartridge. On the other hand, the other color ink cartridges can conceivably be mistakenly inserted into the mounting portion for black ink cartridges. However, the widthwise direction distance Lbl between the guide groove 236 and the sensor accommodation groove 240 in the color ink cartridges is narrower than the widthwise direction distance Lb2 between the guide protrusion wall 120 and the residual ink detecting photo sensor 170 in the housing portion for the black ink cartridge. Accordingly, the front surface of the cartridge will abut against the sensor guards 176 and not proceed any further forward even if the guide groove 236 engages with the guide protrusion wall 120 and the ink cartridge is slid. Even if the width of the color cartridges were large enough to insert between guide protrusion wall 120 in the housing portion for the black cartridge and the partition wall 110 at the side farther from the guide protrusion wall 120, the lock releasing operation rib 150 cannot be retracted unless the guide groove 236 is engaged with the guide protrusion wall 120. Therefore, the needle protection plate 130 cannot be retracted so the front surface of the cartridge abuts against the needle protection plate 130 and the ink introducing hollow needle 82 cannot be inserted into the ink supply hole 260.

When the ink cartridge 200 is mounted in the ink cartridge-mounting portion S, the ink introducing hollow needle 82 supplies ink from inside the ink accommodation portion 300 to the buffer tank 84. The ink from the buffer tank 84 is supplied to the ink jet head 70 through the ink-supply tube T in association with recording operations.

Although the positive pressure pump 36 is stopped during normal printing operations and during waiting times, the inside of the ink cartridge 200 is applied with atmospheric pressure in the atmosphere chamber 290 inside the ink cartridge 200 through the pump 36, the positive pressure application tubes 92, the positive pressure application members 91, and the atmosphere connection hole 280. For this reason, the flexible film 302 deforms in association with reduction in ink without applying pressure to the ink, and the preformed shape of the flexible film 302 substantially follows the tub portion 320 and comes into intimate contact with the tub portion 320. Therefore, the pressure of the ink supplied to the ink jet head 70 can be maintained fairly fixed and ejection of ink from the ink jet head 70 can be stabilized. The amount of remaining ink can be reduced because the flexible film 302 ends up in intimate contact with the tub portion 320, substantially following the tub portion 320. Furthermore, at least a portion of the tub portion 320 is the curved surface portion 324, whose cross-sectional surface area decreases in association with distance from above (the open side) of the tub portion 320. Therefore, the flexible film 302 can easily follow the tub portion 320 when only a little amount of ink remains. The amount of residual ink can be reduced and pressure of the ink supplied is maintained substantially fixed to the very end.

The ink cartridge-mounting portion S in which the ink cartridge 200 is mounted is positioned lower than the ink jet head 70 in the vertical direction. For this reason, the difference in pressure head constantly applies a negative pressure on the ink in the nozzles of the piezoelectric ink jet head 70 in the same manner as a general ink jet recording device. However, under normal conditions the surface tension of the meniscus of the ink in the nozzles maintains the ink in the nozzle against the negative pressure. After the operation of the well-known purge unit 78, that is, after covering the nozzles with a cap and sucking ink from the nozzles using the pump, the ink with bubbles in the cap when suction operations by the pump are stopped enter the nozzles by the difference in pressure head. There is a chance that defective ejection can occur later when printing operations are performed by the ink jet head 70. The exemplary positive pressure pump 36 is operated after purge operations until the cap is opened up. Operation of the positive pressure pump 36 can be started during purge operations as well. As a result, the positive pressure air flow is supplied into the atmosphere chamber 290 in the cartridge. A positive pressure is applied to the ink through the flexible film 302. As a result, a positive pressure can be applied from the cartridge side to ink in the nozzles of the ink jet head 70 and bubbles can be prevented from being drawn into the nozzles. It should be noted that at this time pressure applied by the positive pressure pump 36 can be a pressure sufficient so that bubbles do not enter the nozzles. Although there is no need to apply a pressure large enough to positively press ink out from the nozzles, such a large pressure can be used.

As the ink cartridge 200 is being mounted in the ink cartridge-mounting portion S, the atmosphere connection hole 280 abuts against the positive pressure application members 91 after the ink introducing hollow needle 82 pierces the ink supply rubber plug 262 in the pull-out-lock protrusion 160. (Explained in more detail, as shown in FIG. 35, the distance A in the ink cartridge-mounting portion S between the needle hole in the ink introducing hollow needle 82 and the front surface of the rubber cap 93 of the positive pressure application member 91 is larger than the distance B that the ink supply rubber plug 262 blocks the inside of the ink supply hole 260 from the front surface of the ink cartridge 200.) When the ink cartridge 200 is pulled out from the ink cartridge-mounting portion S, the ink introducing hollow needle 82 pulls out from the rubber plug 262 inside the ink supply hole ink supply hole 260 after the atmosphere connection hole 280 separates from the positive pressure application members 91. Accordingly, even if the ink cartridge 200 pulls out from the ink cartridge-mounting portion S while the positive pressure pump 36 is applying positive pressure to the ink cartridge 200, the atmosphere connection hole 280 would first separate from the positive pressure application members 91 while the ink introducing hollow needle 82 remains in its pierced condition. Therefore, ink can be prevented from leaking out from the ink cartridge 200.

When the ink cartridge 200 is mounted in the ink cartridge-mounting portion S, then as shown in FIG. 35 the infrared light emitting portion 172 and the infrared light receiving portion 174 of the residual ink detecting photo sensor 170 are accommodated in the sensor accommodation groove 240 so as to sandwich the protrusion portion 372, which accommodates the sensing arm end portion 367 (sensing point) of the sensor lever 360. Accordingly, the sensing arm end portion 367 (sensing point) of the sensor lever 360 is positioned between the infrared light emitting portion 172 and the infrared light receiving portion 174. By doing this, the ink sensing mechanism for detecting the condition of when the ink cartridge 200 runs out of ink is completed. That is, the sensor portion 170 (light emitting portion 172 + light receiving portion 174) of the exemplary ink sensing mechanism is provided in the ink cartridge-mounting portion S. The lever (the black resin sensor lever 360) that senses whether the sensor portion 170 is ON or OFF is provided in the ink cartridge 200 so that the ink sensing mechanism can be completed by mounting the ink cartridge 200 to the ink cartridge-mounting portion S.

As explained previously, the sensor lever 360 moves the sensing arm end portion 367 (sensing point) vertically in accordance with the amount of residual ink. When a sufficient amount of ink remains, the sensing arm end portion 367 is positioned between the infrared light emitting portion 172 and the infrared light receiving portion 174 and blocks the infrared light. When the ink is almost all gone, the sensing arm end portion 367 pulls out from between the infrared light emitting portion 172 and the infrared light receiving portion 174 so that the infrared light receiving portion 174 receives infrared light. As a result, a person skilled in the art can easily convert presence or absence of ink into an electric signal and control operations of the recording device. The sensor 170 can be used to detect whether the ink cartridge is mounted, and not merely detect presence or absence of ink.

Further embodiments of the invention will be described with reference to FIGS. 37-40B. Explanations will be provided using a color ink jet printer 401, as a printing apparatus, that includes four ink cartridges 402 (a black ink cartridge 402*a*, a cyan ink cartridge 402*b*, a magenta ink cartridge 402*c* and an yellow ink cartridge 402*d*), each of which stores a particular color of ink.

Figure 37:
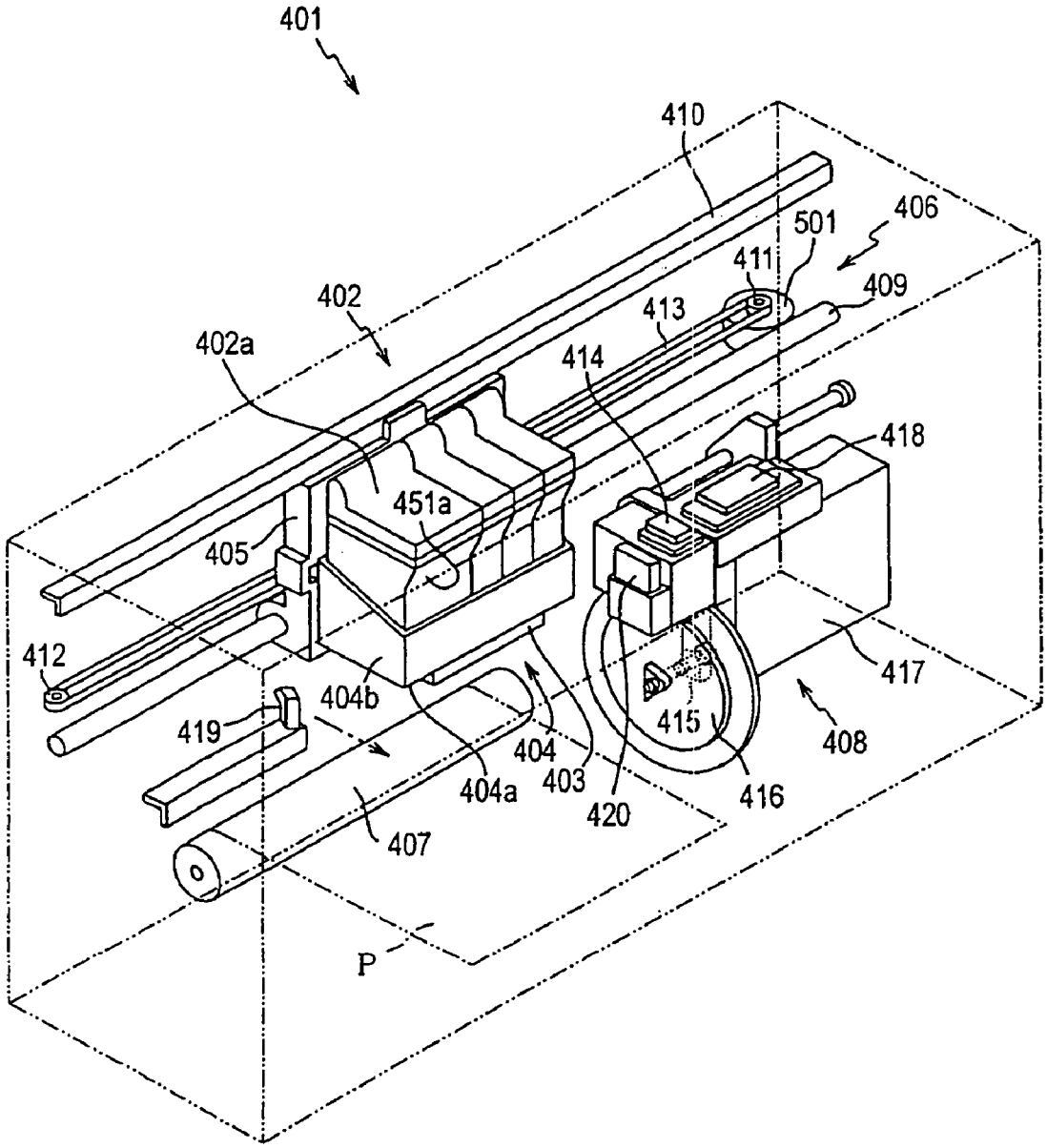
FIG. 37 is a perspective view of a color ink jet printer, to which ink cartridges of a first embodiment of the invention are attached.

As shown in FIG. 37, the color ink jet printer 401 includes an ink sensor 419. The ink sensor 419 is disposed so as to irradiate a surface of the ink cartridge 402 at an angle (the angle of turn of the light-emitting surface of the ink sensor with respect to the ink cartridge is approximately 10 degrees in a horizontal direction) with light in order to reduce noise signals (undesired reflected light) from the irradiated surface of the ink cartridge 402. In the color ink jet printer 401, a controller, that includes a printer control circuit board and a carriage circuit board, detects the presence or absence of ink at a predetermined level in the ink cartridge 402 and that of ink cartridge 402 by comparing an amount of reflected light detected by the ink sensor 419 with first and second threshold values. Further, the controller can precisely detect the amount of the reflected light detected by correcting a detection position of the ink cartridge 402. The first threshold value is a reference value to determine whether the reflected light level is within the ink present level or absent level. The second threshold value is a reference value to determine whether the ink cartridge 402 is present or absent.

The color ink jet printer 401 includes the ink cartridges 402, a print head 403, a head unit 404, a carriage 405, a drive unit 406, a platen roller 407, a purge device 408 and the ink sensor 419. The ink cartridges 402 are each filled with a particular color of ink, such as cyan, magenta, yellow and black. The print head 403 performs printing using the color inks on a recording medium P, such as a recording sheet. The print head 403 is provided on the head unit 404. The ink cartridges 402 and the head unit 404 are mounted on the carriage 405. The drive unit 406 reciprocates the carriage 405 in a straight line. The platen roller 407 extends in a carriage reciprocating direction and faces the print head 403.

A pair of side covers 404*b* are provided on both sides of a mounting portion 404*a*, and three partitions 404*c* (see FIG. 38) stand on and extend from the mounting portion 404*a* of the head unit 404. The mounting portion 404*a* is partitioned off for the separate accommodation of the four ink cartridges 402 by the partitions 404*c*. The black ink cartridge 402*a*, the cyan ink cartridge 402*b*, the magenta ink cartridge 402*c* and the yellow ink cartridge 402*d* are mounted on the respective accommodating portion. The black ink cartridge 402*a* has a capacity that is larger than that of the other ink cartridges 402*b*, 402*c*, 402*d*, because the black ink cartridge 402*a* has a high frequency of use.

The drive unit 406 includes a carriage shaft 409, a guide plate 410, two pulleys 411, 412 and an endless belt 413. The carriage shaft 409 is disposed at a lower end of the carriage 405 and extends in a direction parallel to the platen roller 407. The guide plate 410 is disposed at an upper end of the carriage 405 and extends in a direction parallel to the carriage shaft 409. The pulleys 411, 412 are disposed at both ends of the carriage shaft 409, between the carriage 409 and the guide plate 410. The endless belt 413 is stretched between the pulleys 411, 412.

As the pulley 411 is rotated in normal and reverse directions by a carriage motor (CR motor) 501, the carriage 405 is connected to the endless belt 413 and reciprocates in the straight line, along the carriage shaft 409 and the guide plate 410, according to the rotation in the normal and reverse directions of the pulley 411.

The recording medium P is fed from a sheet cassette (not shown) provided in a side or a lower part of the color ink jet printer 401. The recording medium P, fed from the sheet cassette, is fed between the print head 403 and the platen roller 407 to perform printing on the recording medium P by ink droplets ejected from the print head 403. Then, the recording medium P is discharged out of the color ink jet printer 401. In FIG. 37, a sheet feeding mechanism and a discharging mechanism of the recording medium P are omitted.

The purge device 408 is disposed next to the platen roller 407. When the head unit 404 is placed in a reset position, the purge device 408 is opposed to the print head 403. In the reset position, nozzles formed in the head unit 403 are purged and capped to prevent ink from drying. The purge device 408 includes a purge cap 414, a pump 415, a cam 416 and a waste ink reservoir 417. The purge cap 414 contacts a nozzle surface to cover the nozzles (not shown) formed in the print head 403. When the head unit 404 is located in the reset position, the nozzles in the print head 403 are covered with the purge cap 414 to inhale ink and air bubbles trapped in the print head 403 using the pump 415 by the cam 416, thereby purging the print head 403. The inhaled ink are stored in the waste ink reservoir 417.

A wiper 420 is provided adjacent to the purge device 408 on the side of the platen roller 407. The wiper 420 has a paddle-shape, and wipes the nozzle surface of the print head 403 in accordance with movement of the carriage 405. A cap 418 is provided to cover the nozzles in the print head 403 located in the rest position after printing, in order to prevent ink from drying.

The ink sensor 419 detects the presence or absence of an ink cartridge 402 and ink in the ink cartridge 402. Hereinafter, the presence of ink means that the ink level is higher than a predetermined level in a sub-ink tank 445, and the absence of ink means that the ink level is lower than the predetermined level in the sub-ink tank 445. The ink sensor 419 is disposed near the end of the drive unit 406 (left side in FIG. 37), and includes an infrared light-emitting device and an infrared light receptor. The ink sensor 419 is disposed so that a light-emitting surface of the infrared light-emitting device 419*a* and a light receiving surface of the infrared light receptor 419*b* are inclined the same amount as the inclination of an inclined portion 451*a* (see FIG. 40) of the ink cartridge 402. Further, the ink sensor 419 is disposed with its light-emitting surface turned approximately 10 degrees, with respect to the inclined portion 451*a* of the ink cartridge 402, in a horizontal direction. The inclined portion 451*a* of the ink cartridge 402 is inclined approximately 420 degrees with respect to the vertical direction. Light irradiated from the infrared light-emitting device 419*a* is reflected from the ink cartridge 402, and the reflected light is received by the infrared light receptor 419*b*. In accordance with an amount of the received reflected light, the presence or absence of the ink cartridge 402 and that of the ink in the ink cartridge 402 are detected. The details of these detection will be described later.

Figure 38:
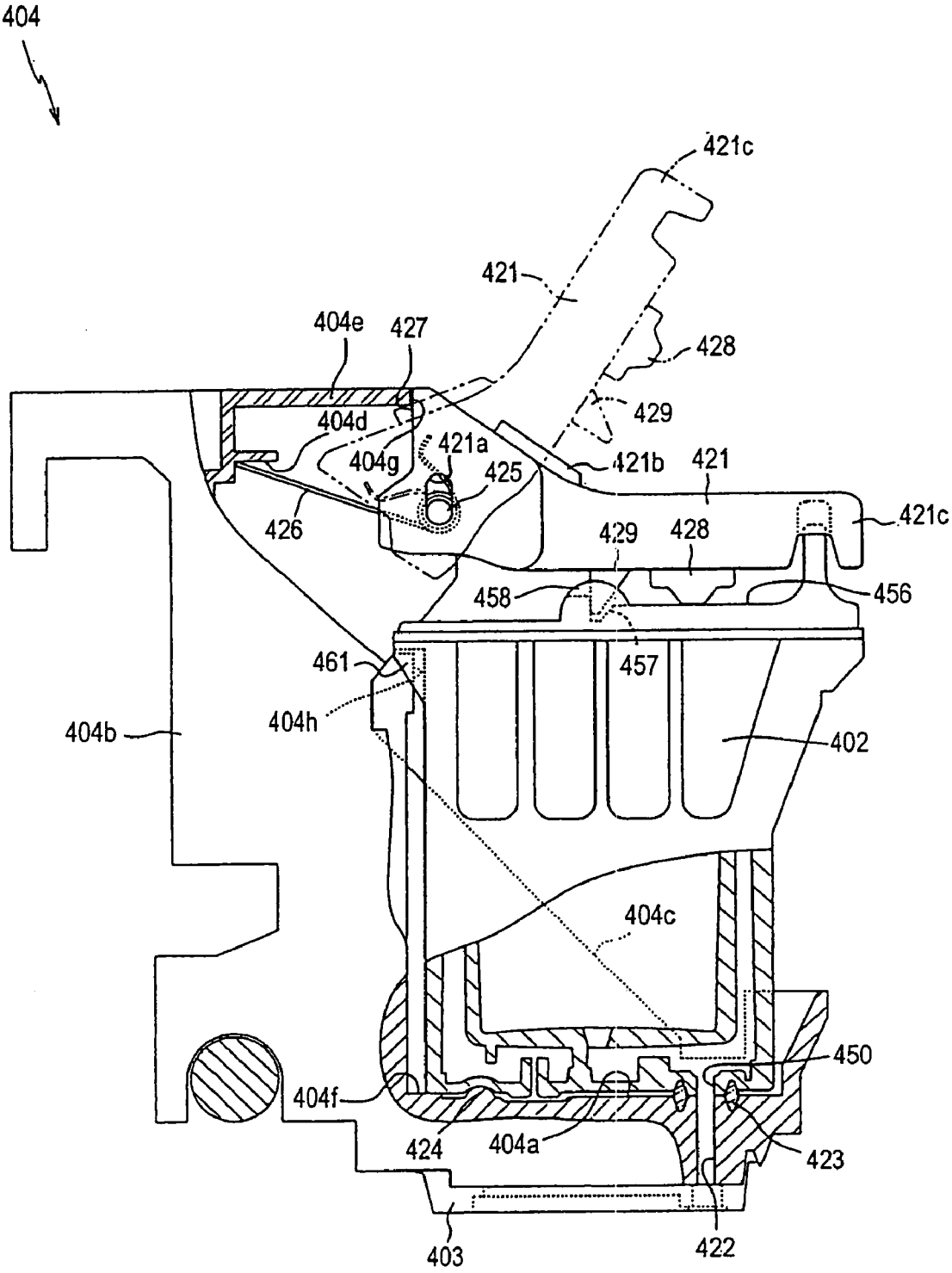
FIG. 38 is a side view showing a state where the ink cartridge is attached to a head unit.

As shown in FIG. 38, the head unit 404 is detachably attached with the ink cartridges 402 to supply ink to the print head 403, as described above. The head unit 404 includes the mounting portion 404*a* and fixing arms 421. The mounting portion 404*a*, having a flat surface, is mounted with the ink cartridges 402 thereon. The mounting portion 404*a* has the pair of side covers 404*b* and is partitioned into four areas by the three partitions 404*c*. The ink cartridges 402 are mounted in the respective areas.

The mounting portion 404*a* has ink supply paths 422, which penetrate the mounting portion 404*a* and communicate with the print head 403. The ink supply paths 422 communicate with respective ink outlets 450. Each connected portion of the ink supply path 422 and the ink outlet 450 is sealed by an O-ring 423. The connection allows ink to flow from the ink cartridges 402 to the print head 403. Engaging protrusions 424 protrude from the mounting portion 404*a*. Each of the engaging protrusions 424 is disposed on the side of the ink supply path 422 (the left of the ink supply path 422 in FIG. 38) to position each ink cartridge 402.

A raised portion 404*f* for regulating up-and-down movements of the ink cartridge 402 is formed behind of each engaging protrusion 424 (the left of the engaging protrusion 424 in FIG. 38) in the head unit 404.

The fixing arms 421, which are swingably supported at the upper portion of the head unit 404 (the upper portion in FIG. 38), press downward and secure the respective ink cartridges 402 on the mounting portion 404*a*, as shown in FIG. 38. Though one of the fixing arms 421 will be described hereinafter, the other three fixing arms 421 have the same structure and operate in a similar manner. The fixing arm 421 is pivotally supported by a swing shaft 425 at one end (the left end in FIG. 38). An auxiliary spring member 426 is wound around a periphery of the swing shaft 425. One end of the auxiliary spring member 426 is engaged with a spring engaging portion 404*d* of the head unit 404 and the other end is fixed to the fixing arm 421, while the auxiliary spring member 426 exerts its urging force on the fixing arm 421 at all times. Therefore, when a stopper portion 427 is not engaged with an end 404*g* of an upper cover 404*e* (described later), the fixing arm 421 is raised by the urging force from the auxiliary spring member 426 and is maintained in this state (the state indicated by the double-dot and dashed line in FIG. 38). Thus, an ink cartridge mounting portion in the head unit 404 is widely opened and operability of an user can be improved when attaching or detaching the ink cartridges 402.

The stopper portion 427, having a triangular shape when viewed from the side, is formed at the one end (the left end in FIG. 38) of the fixing arm 421. The stopper portion 427 is provided to assist the fixing arm 421 in pressing and maintaining the ink cartridge 402 in a fixed state. The fixing arm 421 has a slot 421*a* for guiding the swing shaft 425. The slot 421*a* is long enough to allow the stopper portion 427 to release from the upper cover 404*e*. As a raised portion 421*b* formed on the fixing arm 421 is pressed, the fixing arm 421 moves downward in FIG. 38 along the slot 421*a*. Thus, the engagement of the upper cover 404*e* and the stopper portion 427 is released. When the ink cartridge 402 is to be fixed, a free end 421*c* of the fixing arm 421 in the state indicated with the double-dot and dashed line in FIG. 38 is pressed downward. As a result, the fixing arm 421 rotates downward around the swing shaft 425. After a pressing portion 428 contacts an upper wall 456 of the ink cartridge 402, the fixing arm 421 rotates against the auxiliary spring member 426 about the contact of the pressing portion 428 and the upper wall 456. When the stopper portion 427 moves to the right of the end 404*g* of the upper cover 404*e* from underneath of the upper cover 404*e*, the fixing arm 421 moves upward in FIG. 38 with respect to the swing shaft 425 due to the slot 421*a* formed in the fixing arm 421 and the stopper portion 427 is engaged with the end 404*g* of the upper cover 404*e* because the fixing arm 421 rotates about the contact of the pressing portion 428 and the upper wall 456. Accordingly, a state where the ink cartridge 402 is being urged and fixed by the pressing portion 428 and an engaging pawl 429 can be maintained.

As described above, the pressing portion 428 is disposed on the underside of the fixing arm 421. The pressing portion 428 has a compression spring (not shown) in an elastically compressed state therein and presses the ink cartridge 402 downward in FIG. 38. The pressing portion 428, which can protrude and retract, is normally held in a protruding position by the compression spring. As described above, as the fixing arm 421 is rotated toward the ink cartridge 402, the pressing portion 428 contacts the upper wall 456 of the ink cartridge 402, so that the pressing portion 428 retracts upward in FIG. 38. Accordingly, the pressing portion 428 can exert the urging force on the ink cartridge 402 by the stopper portion 427 and the compression spring, thereby pressing the ink cartridge 402 downward in FIG. 38.

The engaging pawl 429 is fixedly attached to the underside of the fixing arm 421, next to the pressing portion 428 (the left of the pressing portion 428 in FIG. 38). The engaging pawl 429 positions the ink cartridge 402 in a predetermined position. As shown in FIG. 38, while the engaging pawl 429 contacts a wall defining a second engagement recess 457, the engaging pawl 429 is free from the bottom of the second engagement recess 457. A detailed description of the positioning of the ink cartridge 402 will be described later.

Figure 39A:
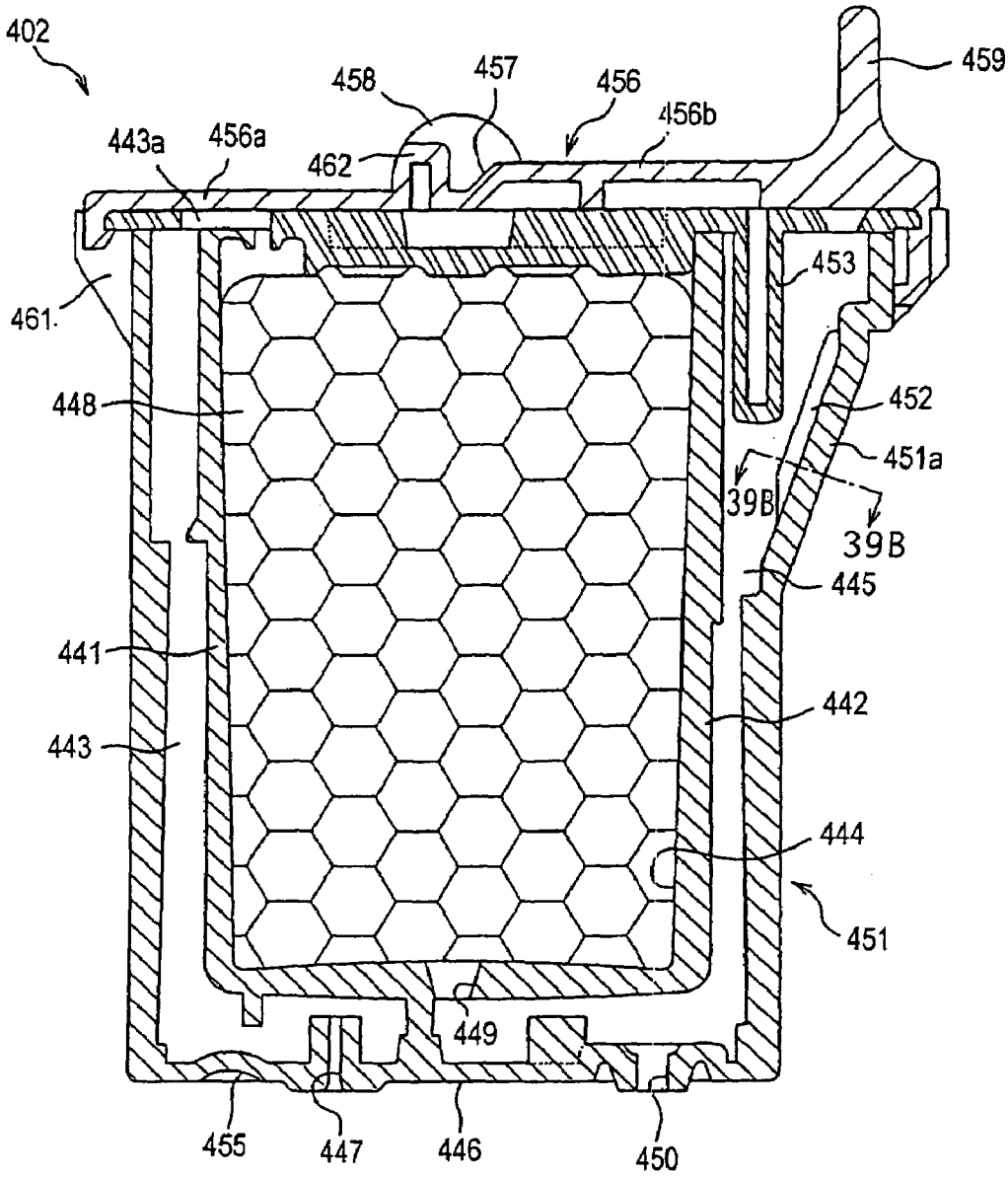
FIG. 39A is a side sectional view of the ink cartridge.

As shown in FIG. 39A, the ink cartridges 402 are formed in a generally hollow box shape. All of the ink cartridges 402 have the same structure. Partition walls 441, 442 are provided in the ink cartridge 402 to partition off the inside of the ink cartridge 402 into three areas, namely, an air trap chamber 443, a main ink tank 444, and the sub-ink tank 445. The air trap chamber 443 is a space for taking air into the main ink tank 444, and communicates with the outside (the air) via an air inlet 447 formed in a bottom wall 446 of the ink cartridge 402. A communication path 443*a* is provided above the air trap chamber 443 (FIG. 39A) and the main ink tank 444 so that they communicate with each other. Accordingly, the air can be taken into the main ink tank 444 from the air trap chamber 443, via the communication path 443*a*.

The main ink tank 444 is substantially enclosed to store ink therein, and accommodates a foam (porous member) 448 that can absorb the ink. An ink flow port 449 is formed in the partition wall 442 at the lower portion of the main ink tank 444. The main ink tank 444 communicates with the sub-ink tank 445 via the ink flow port 449. The foam 448 is made of, for example, a sponge or a fiber, that can retain ink therein using a capillary, and is accommodates in the main ink tank 444 in a compressed state. Therefore, for example, even when the ink cartridge 402 falls down or is dropped and thus ink therein leaks into the air trap chamber 443 from the main ink tank 444, the ink can be prevented from leaking out of the ink cartridge 402 from the air inlet 447.

The sub-ink tank 445 stores ink therein and is irradiated with infrared light from the ink sensor 419 (see FIG. 40). The sub-ink tank 445 provided in the side of the ink cartridge 403 is substantially enclosed. The sub-ink tank 445 communicates with the main ink tank 444 via the ink flow port 449. The ink stored in the main ink tank 444 and the sub-ink tank 445 is supplied to the print head 403 (see FIG. 38) via the ink outlet 450 formed in the bottom wall 446 of the ink cartridge 402.

A side wall 451 of the sub-ink tank 445 has the downwardly inclined portion 451*a* that inclines toward the main ink tank 444. An inner surface (the main ink tank 444 side, the left surface of the inclined portion 451*a* in FIG. 39A) of the inclined portion 451*a* has a plurality of prisms 452. As described above, the inclined portion 451*a* is inclined approximately 20 degrees with respect to the vertical direction.

The prisms 452 are used to detect the presence or absence of ink in the ink cartridge 402. The prisms 452 are integrally formed with the inner surface (the surface that contacts the ink) of the inclined portion 451*a* of the side wall 451 made of transparent or translucent light-permeable material. For the light-permeable material, acrylic resin, polypropylene, polycarbonate, polystyrene, polyethylene, polyamide, methacryl, methylpentene polymer or glass, can be used, for example.

Figure 39B:
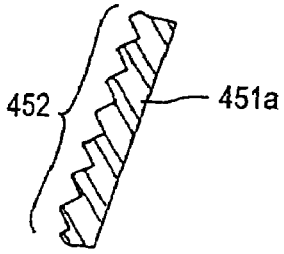
FIG. 39B is a partial sectional view of the ink cartridge in FIG. 39A.

As shown in FIG. 39B, each of the prisms 452 has a plurality of reflecting surfaces, and the plurality of the prisms 452 form crests and troughs alternately. The reflecting surfaces inclinatorily and downwardly extend in a lengthwise direction of the inclined portion 451*a* from one end (an upper end in FIG. 39A) to the other end (a lower end in FIG. 39A), and are aligned in a thickness direction of the ink cartridge 402 (in a direction perpendicular to the plane of the drawing sheet of FIG. 39A). Thus, the ink can run over and fall off the prisms 452. With this structure, a desired amount of reflected light from the prisms 452 can be obtained without ink remaining on the prisms 452.

As described above, with the provision of the prisms 452 on the inner surface of the inclined portion 451*a*, infrared light can be irradiated in a slanting direction (in a direction approximately 10 degrees inclined with respect to the horizontal direction) from the ink sensor 419, from a direction opposed to the inclined portion. As a result, infrared light, that is not related to the detection of the presence or absence of ink, can be prevented from being received by the infrared light receptor 419*b*. Thus, the infrared light receptor 419*b* can mainly receive reflected light necessary for the ink existence detection. This results in improving accuracy of the ink existence detection.

Infrared light to be irradiated from the infrared light-emitting device 419*a* in the ink sensor 419 toward the inclined portion 451*a*, generally has a predetermined beam angle (an angle of the neighborhood of ±10 degrees). Therefore, the luminous existence of the infrared light becomes large with the travel of the infrared light, so that the amount of light per unit area irradiated to the inclined portion 451*a* is decreased. In order to avoid this, the prisms 452 having the plurality of reflecting surfaces are provided to the entire inner surface of the inclined portion 451. Accordingly, the reflecting surfaces effectively reflect the irradiated infrared light and the infrared light receptor 419*b* in the ink sensor 419 can efficiently receive the reflected light. In the embodiment, as shown in FIG. 39B, the prisms 452 formed in the cyan, magenta and yellow ink cartridges 402*b*, 402*c*, 402*d* have sixteen reflecting surfaces, while the prisms 452 formed in the black ink cartridge 402*a* have twenty-four reflecting surfaces. An angle of each ridge, at which the reflecting surfaces intersect each other, is substantially 90 degrees in the prisms 452.

A reflector 453 is provided at the upper portion of the sub-ink tank 445, facing the prisms 452 while a predetermined space is left therebetween. The reflector 453 changes a traveling path of infrared light that passes through the sub-ink tank 445, via the inclined portion 451*a* and the prisms 452. The reflector 453 is disposed at an angle with respect to the prisms 452, and is pouched so as to provide air space 472 therein. In fact, the reflector 453 vertically extends into the ink cartridge 402. Thus, the reflector 453 is inclined with respect to the prisms 452.

According to the ink cartridge 402 structured as described above, when the ink is used by the print head 403, air is taken into the main ink tank 444 from the air trap chamber 443, in accordance with the amount of the ink consumed. As a result, the ink level in the main ink tank 444 is lowered (see FIG. 40A). When the ink in the main ink tank 444 runs out, the ink in the sub-ink tank 445 is supplied to the print head 403. At that time, pressure in the sub-ink tank 445 is reduced. However, the air is taken into the sub-ink tank 445 from the air trap chamber 443 via the main ink tank 444 and the ink flow port 449, so that the reduced pressure is moderated and the ink level is lowered (see FIG. 40B).

Thus, in the ink cartridge 402, first, the ink stored in the main ink tank 444 is consumed and then the ink stored in the sub-ink tank 445 is consumed. Accordingly, a remaining amount of ink in the cartridge 402 can be detected only by detecting the presence or absence of the ink in the sub-ink tank 445 using the ink sensor 419.

Figure 39C:
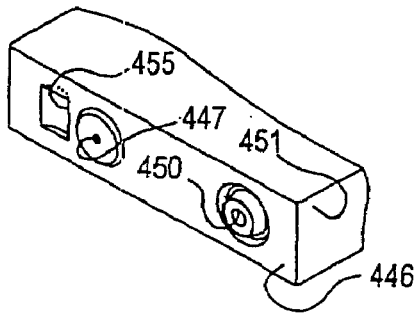
FIG. 39C is a perspective view of the bottom of the ink cartridge.

The bottom wall 446 of the ink cartridge 402 has a first engagement recess 455 in an end (a left end in FIG. 39A) opposed to the ink outlet 450 . The first engagement recess 455 engages the engaging protrusion 424 protruding from the mounting portion 404*a* of the head unit 404 (see FIG. 38), to locate the ink cartridge 402 in position. As shown in FIG. 39C, the first engagement recess 455 is provided at a location that is substantially in the middle of the ink cartridge 402 in the thickness direction (in a direction perpendicular to the plane of the drawing paper of FIG. 39A). An annular groove is provided in both the periphery of the ink outlet 450 of the ink cartridge 402 and the ink supply path 22 of the head unit 404, which are connected to each other via the O-ring 423 disposed in their annular grooves (see FIG. 38). However, the ink cartridge 402 cannot be properly positioned by the O-ring 423 being the only connection because the ink cartridge 402 will turn about the ink outlet 450 (O-ring 423) due to inertia when the carriage 405 moves. Therefore, as described above, the first engagement recess 455, which can engage the engaging protrusion 424 of the head unit 404, is provided in the bottom wall 446 of the ink cartridge 402 (see FIG. 39C). This prevents the ink cartridge 402 from turning and locates the ink cartridge 402 in proper position. As a result, the ink cartridge 402 can be properly fixed to the head unit 404.

The upper wall 456 of the ink cartridge 402 has the second engagement recess 457, which engages the engaging pawl 429 provided on the fixing arm 421 of the head unit 404 (see FIG. 38) when the ink cartridge 402 is fixed to the head unit 404. The second engagement recess 457 prevents the ink cartridge 402 from moving upward and in the width direction of the ink cartridge 402 (in the right and left directions in FIG. 39A). The second engagement recess 457 is provided in a location that is substantially in the middle of the upper wall 456 in the width direction of the ink cartridge 402 (in the right and left directions in FIG. 39A), that is, in a location that is substantially between the ink outlet 450 and the first engagement recess 455, in the width direction of the ink cartridge 402. Thus, the ink cartridge 402 is supported and balanced at three points, the second engagement recess 457, the ink outlet 450 and the first engagement recess 455. That is, the second engagement recess 457, the ink outlet 450, and the first engagement recess 457 form a substantially isosceles triangle and the three points are considered the vertexes. With this structure, the ink cartridge 402 is prevented from lifting and rattling. Accordingly, the ink cartridge 402 can be stably and tightly fixed to the head unit 404.

A pair of side walls 458 are provided on the both sides of the second engagement recess 457 (near and far sides into the drawing paper of FIG. 39A). The side walls 458 are opposed to each other while a predetermined space is left therebetween. The side wall 458 provided on the far side is shown in FIG. 39A, and the side wall 458 provided on the near side is shown in FIG. 38. The side walls 458 prevent the ink cartridge 402 from moving in the thickness direction of the ink cartridge 402 (in the direction perpendicular to the plane of the drawing paper of FIG. 39A). The surfaces of the side walls 458 face each other in the thickness direction of the ink cartridge 402. A distance between the opposed surfaces of the side walls 458 is substantially equal to the width of the engaging pawl 429 (see FIG. 38) of the fixing arm 421 to be engaged with the second engagement recess 457. Accordingly, as the engaging pawl 429 of the fixing arm 421 engages the second engagement recess 457, the engaging pawl 429 is engaged with the side walls 458, so that the side walls 458 prevent the ink cartridge 402 from moving in the width direction of the ink cartridge 402 (the right and left directions in FIG. 39A).

As described above, the head unit 404 performs printing (see FIG. 37) by reciprocating in the thickness direction of the ink cartridge 402 (in the direction perpendicular to the plane of the drawing paper of FIG. 39A). During the printing, the head unit 404 hardly increases and reduces it speed to improve a printing speed. Therefore, if the ink cartridge 402 is displaced in the moving direction of the head unit 404 due to the hard movement of the head unit 404, then vibrations will occur in the head unit 404 traceable to the displacement, thereby degrading the quality of printing. However, the side walls 458, the first engagement recess 457 and the ink outlet 450 prevent the ink cartridge 402 from being displaced in the moving direction of the head unit 404, so that the head unit 404 can smoothly reciprocate without vibrations. As a result, excellent printing quality can be obtained.

The ink cartridge 402 has a pair of ribs 461 at its side (the left side in FIGS. 38 and 39A). One of the ribs 461 is shown in FIG. 39A and the other is shown in FIG. 38. The ribs 461 are opposed to each other while a predetermined distance is left therebetween, like the side walls 458. The head unit 404 has an engagement protrusion 404*h* (see FIG. 38) that protrudes from a position corresponding to the ribs 461. When the ink cartridge 402 is mounted on the head unit 404, the engagement protrusion 404*h* is inserted between the ribs 461, (see FIG. 38). Accordingly, the ribs 461 prevents the ink cartridge 402 from being displaced sideways while printing is performed.

The upper wall 456 includes a first upper wall 456*a* and a second upper wall 456*b*. The first upper wall 456*a* extends from one side of the second engagement recess 457 (the left side in FIG. 39A). The second upper wall 456*b* extends from another side of the second engagement recess 457 (the right side in FIG. 39A). The first upper wall 456*a* is provided at a level lower than the second upper wall 456*b*, from the bottom wall 446. A handle 459 is provided to an end opposed to the side of the first upper wall 456*a*. The handle 459 protrudes upward from the second upper wall 456*b* so that the user can easily pinch the handle 459 when attaching or removing the ink cartridge 402 to or from the head unit 404. Therefore, when the user desires to remove one of the ink cartridges 402 from the head unit 404, such as for replacing the ink cartridge 402, the user can pinch the handle 459 to pull out the ink cartridge 402 from the head unit 404. Thus, the ink cartridge 402 can be removed without interference by the other ink cartridges 402. When the user desires to mount the ink cartridge 402 on the head unit 404, the user can also easily attach the ink cartridge 402 to the head unit 404 by pinching the handle 459.

When the ink cartridge 402 is attached to the head unit 404, the ink cartridge 402 is inserted into a predetermined position on the head unit 404 from the side of the first upper wall 456*a*. As described above, the first upper wall 456*a* is provided at the level lower than the second upper wall 456*a* from the bottom wall 446, so that the first upper wall 456*a* does not interfere with the raising of the fixing arm 421. Accordingly, the ink cartridge 402 can be easily attached to the head unit 404 without being caught by the head unit 404 (see FIG. 38).

The upper wall 456 should not be made thinner than the rest of the ink cartridge 402 in order to maintain rigidity to bear the pressure from the pressing portion 428 of the fixing arm 421.

A first protrusion 462 protrudes upward from one side of the first upper wall 456*a* (the right side in FIG. 39). One of the walls forming the second engagement recess 457 is a part of the first protrusion 462. Therefore, when the engaging pawl 429 of the fixing arm 421 engages the second engagement recess 457, the first protrusion 462 prevents the ink cartridge 402 from moving upward and being displaced in the width direction of the ink cartridge 402 (in the right direction in FIG. 39A).

Figure 40A:
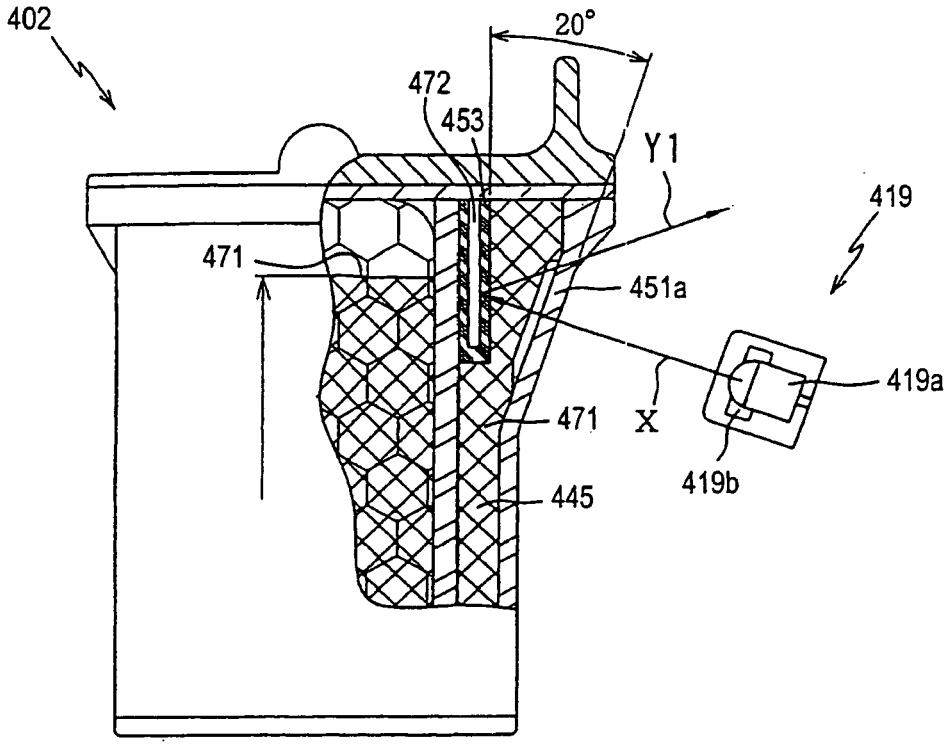
FIGS. 40A and 40B are side views of the ink cartridge and an ink sensor.
Figure 40B:
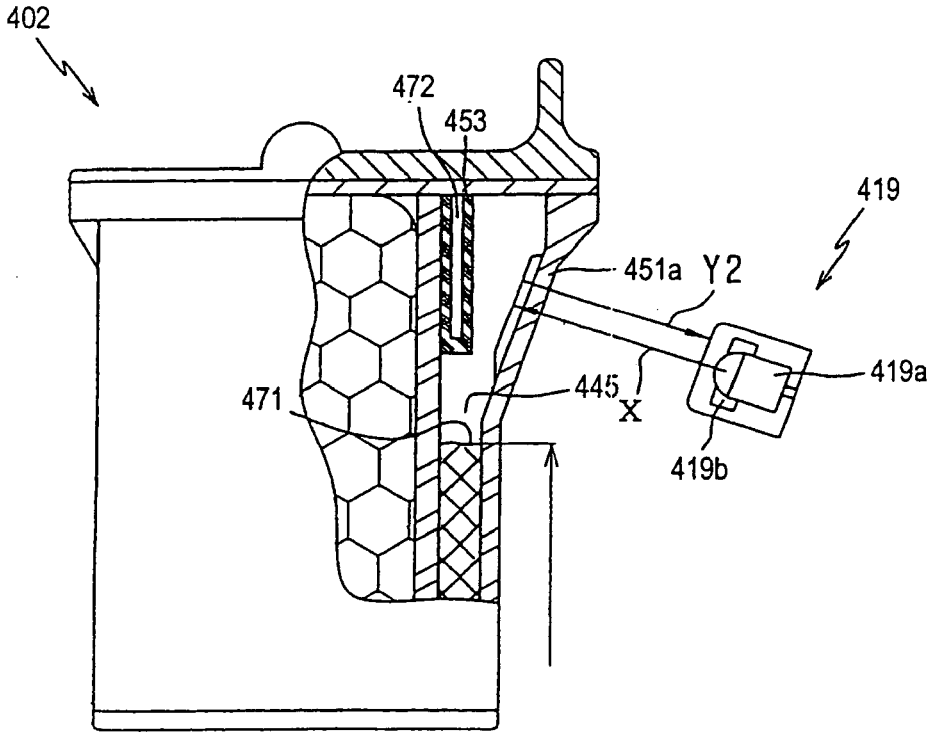

A principle of the detection of ink level will be described with reference to FIGS. 40A and 40B. In FIGS. 40A and 40B, the head unit 404 and a mounting member for the ink sensor 419 are omitted from the drawings.

As shown in FIG. 40A, when the ink cartridge 402 contains enough ink 471 for printing (when at least the sub-ink tank 445 is full of the ink 471), infrared light (optical path X) irradiated from the infrared light-emitting device 419*a* in the ink sensor 419 passes through the ink 471 and travels in the sub-ink tank 445 of the ink cartridge 402. This occurs because a refractive index of the material forming the ink cartridge 402 is close to a refractive index of the ink 471. Then, the infrared light reaches the reflector 453 disposed in the sub-ink tank 445. The infrared light reaching the reflector 453 is reflected at a phase boundary between an internal surface of the reflector 453 and air space 472 (optical path Y1) due to the difference of the refractive index between the material forming the reflector 453 and the air space 472.

The inclined portion 451*a* of the ink cartridge 402 is inclined approximately 20 degrees with respect to the reflector 453, in other words, with respect to the vertical direction, so that an incident angle of the infrared light with respect to the reflector 453 is different from that of the infrared light, irradiated from the infrared light-emitting device 419*a*, with respect to the inclined portion 451*a*. Therefore, the infrared light irradiated into the reflector 453 is reflected at the reflector 453 at an angle (the optical path Y1) different from the incident angle with respect to the inclined portion 451*a*. Thus, most of the reflected infrared light does not travel toward the infrared light receptor 419*b*, so that an extremely small amount of the light is reflected back to the infrared light receptor 419*b*.

As shown in FIG. 40B, when the ink 471 in the main ink tank 444 runs out and the ink level in the sub-ink tank 445 of the ink cartridge 402 is not up to the lower portion of the reflector 453, the infrared light (optical path X) irradiated from the infrared light-emitting device 419*a* in the ink sensor 419 is reflected at a phase boundary between an internal surface of the outer wall of the sub-ink tank 445 and air located in the sub-ink tank 445 (optical path Y2). This occurs because the refractive index of the material forming the ink cartridge 402 is different from that of the air. As a result, a large amount of the light is reflected back to the infrared light receptor 419*b*.

The amount of the light (optical path Y2), which is to be reflected from the inside of the ink cartridge 402 and is to travel toward the infrared light receptor 419*b*, changes in accordance with the presence or absence of the ink 471. Thus, the presence or absence of the ink 471 in the ink cartridge 402 can be precisely detected by the amount of the reflected light detected using the infrared light receptor 419*b* in the ink sensor 419.

The inclined portion 451*a* and the reflector 453 are disposed at the upper portion of the sub-ink tank 445. Therefore, low ink can be detected at the point of the absence of the ink 471 at the upper portion of the sub-ink tank 445, that is, a near-empty state can be detected that indicates the ink 471 will run out in the near future, before the ink cartridge 402 becomes completely empty of the ink 471.

In this embodiment, the inclined portion 451*a* is inclined approximately 20 degrees with respect to the reflector 453. However, it is not limited to the angle described above. The inclined portion 451*a* is preferably inclined between approximately 15 degrees and 25 degrees with respect to the reflector 453. That is, when the inclined portion 451*a* is inclined approximately 15 degrees or greater with respect to the reflector 453, the amount of light to be reflected from the reflector 453 toward the infrared light receptor 419*b* can be restricted. Further, when the angle of the inclination is approximately 25 degrees or smaller, the ink 471 can be prevented from always collecting on the inclined portion 451*a*.

An exemplary ink cartridge 603 and an exemplary multifunction device 601 that uses the ink cartridge 603 will be described with reference to FIGS. 41 to 51.

Figure 41:
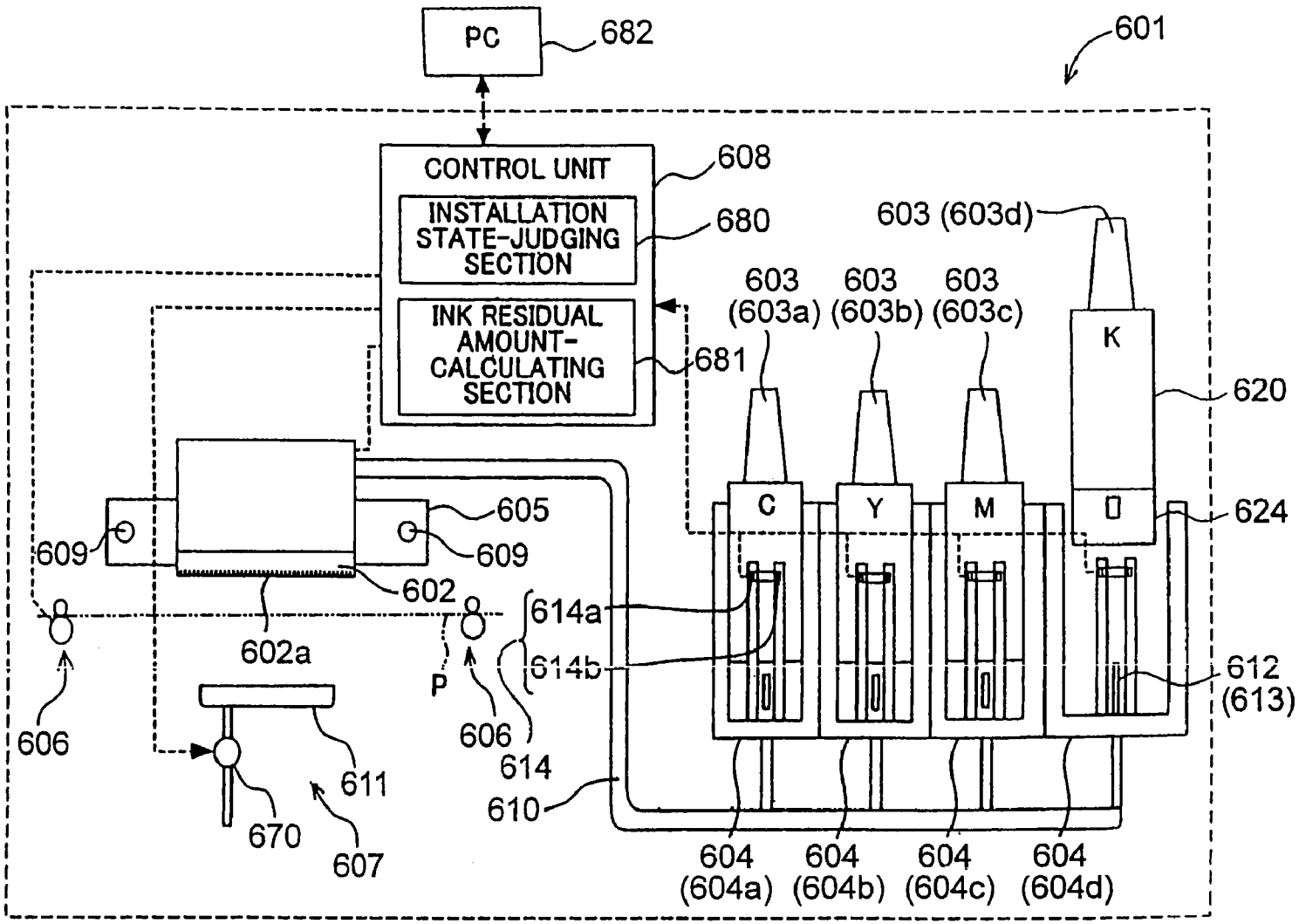
FIG. 41 is a schematic depiction of an exemplary multifunction device.

As shown in FIG. 41, the multifunction device 601 includes, for example, an ink-jet head 602 which is provided with nozzles 602*a* for discharging the four color inks of cyan (C), yellow (Y), magenta (M), and black (K) to the recording paper P, four holders 604 (604*a*, 604*b*, 604*c*, 604*d*) which serve as cartridge-installing sections for installing four ink cartridges 603 (603*a*, 603*b*, 603*c*, 603*d*) for storing the four color inks respectively, a carriage 605 which linearly reciprocates and moves the ink-jet head 602 along a guide 609 in a certain direction (direction perpendicular to the paper surface), a transport mechanism 606 which transports the recording paper P in the direction perpendicular to the direction of movement of the ink-jet head 602 in parallel to the ink discharge surface of the ink-jet head 602, a purge unit 607 which sucks the ink having any high viscosity and the air contained in the ink-jet head 602, and a control unit 608 which manages the control of the entire multifunction device 601.

In the multifunction device 601, the recording paper P is transported by the transport mechanism 606 in the rightward and leftward directions in FIG. 41, while driving and reciprocating the ink-jet head 602 by the carriage 605 in the direction perpendicular to the paper surface in FIG. 41. In cooperation thereto, the ink is supplied to the nozzles 602*a* of the ink-jet head 602 through the supply tube 610 from the holder 604 installed with the ink cartridge 603. Further, the ink is discharged from the nozzles 602*a* to the recording paper P, and the recording paper P is subjected to the printing.

As shown in FIG. 41, the purge unit 607 includes a purge cap 611 which can be installed to the ink-jet head 602 so that the ink discharge surface is covered therewith, and a suction pump 670 which sucks the ink from the nozzles 602*a*. The purge unit 607 is arranged at the position opposed to the ink-jet head 602 with the recording paper P intervening therebetween. The purge unit 607 is movable in the direction to make approach or separation with respect to the ink discharge surface of the ink-jet head 602. When the ink-jet head 602 is out of a printing range in which the recording paper P can be subjected to the printing, the suction pump 670 can be used to suck the air mixed into the ink-jet head 602 and/or the ink having any high viscosity as a result of the evaporation of water from the nozzles 602*a*.

As shown in FIG. 41, the four holders 604*a* to 604*d* are provided in the multifunction device 601 while being aligned in one array in the multifunction device 601. The four ink cartridges 603*a* to 603*d*, which store the inks of cyan, yellow, magenta, and black, are installed to the four holders 604*a* to 604*d* respectively. The black ink of the four color inks is used more frequently than the other three color inks in many cases. In such a case, it is preferable that the volume of the ink cartridge for the black ink is larger than those of the ink cartridges 603*a* to 603*c* for the color inks.

An ink supply pipe (communicating pipe) 612 and an atmospheric air-introducing pipe 613 are provided upstandingly respectively at positions corresponding to an ink supply valve 621 and an atmospheric air-introducing valve 622 of the ink cartridge 603 respectively at the bottom of the holder 604 as described later on. An optical type sensor 614 (light-transmissive type optical sensor) is provided for the holder 604 in order to detect the ink residual amount in the ink cartridge 603. The sensor 614 has a light-emitting section 614*a* and a light-receiving section 614*b* which are arranged at an identical height position and which are opposed to one another so that the ink cartridge 603 is interposed between the both sides. It is detected whether or not the light from the light-emitting section 614*a* is blocked by a shutter mechanism 623 provided in the ink cartridge 603 as described later on. An obtained detection result is outputted to the control unit 608.

Next, the ink cartridge 603 will be explained in detail. Exemplary ink cartridges 603*a* to 603*c*, which store the three types of color inks respectively, have the same structure as that of the ink cartridge 603*d* which stores the black ink. Therefore, one of the ink cartridges 603 will be explained.

Figure 42A:
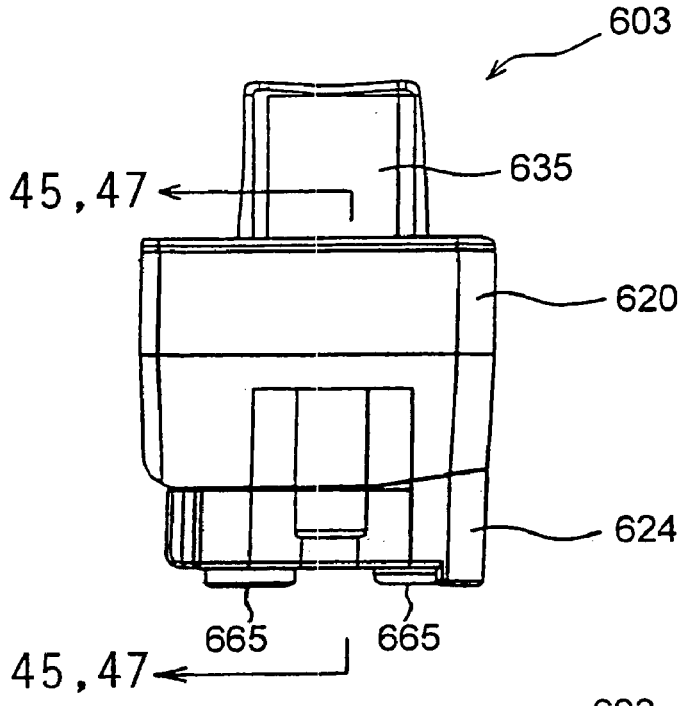
FIG. 42A is a plan view.
Figure 42B:
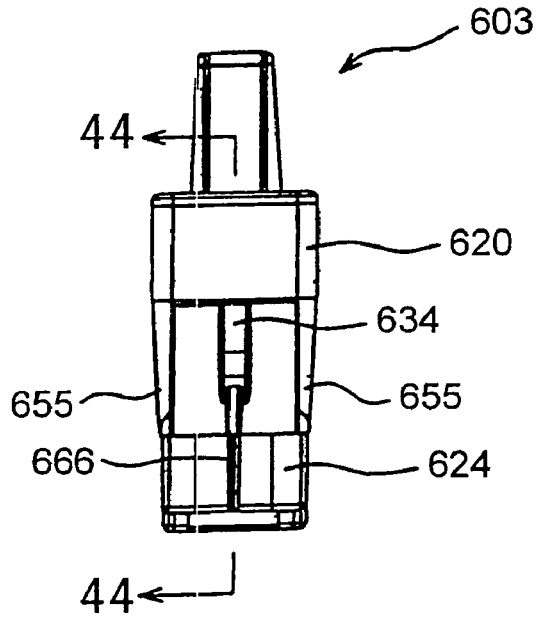
FIG. 42B is a left side view.
Figure 42C:
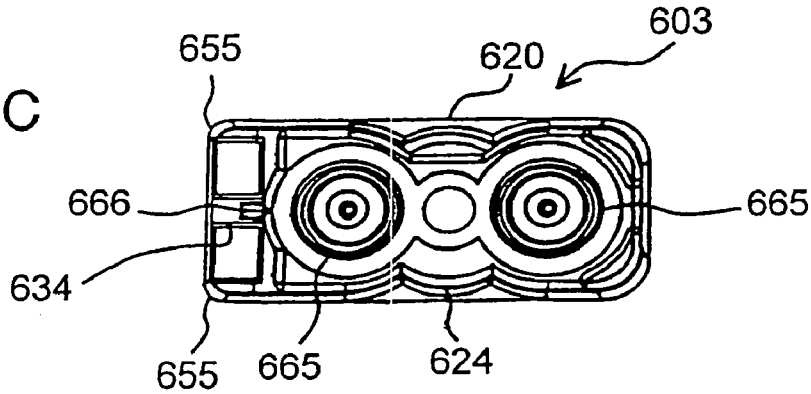
FIG. 42C is a bottom view.
Figure 43:
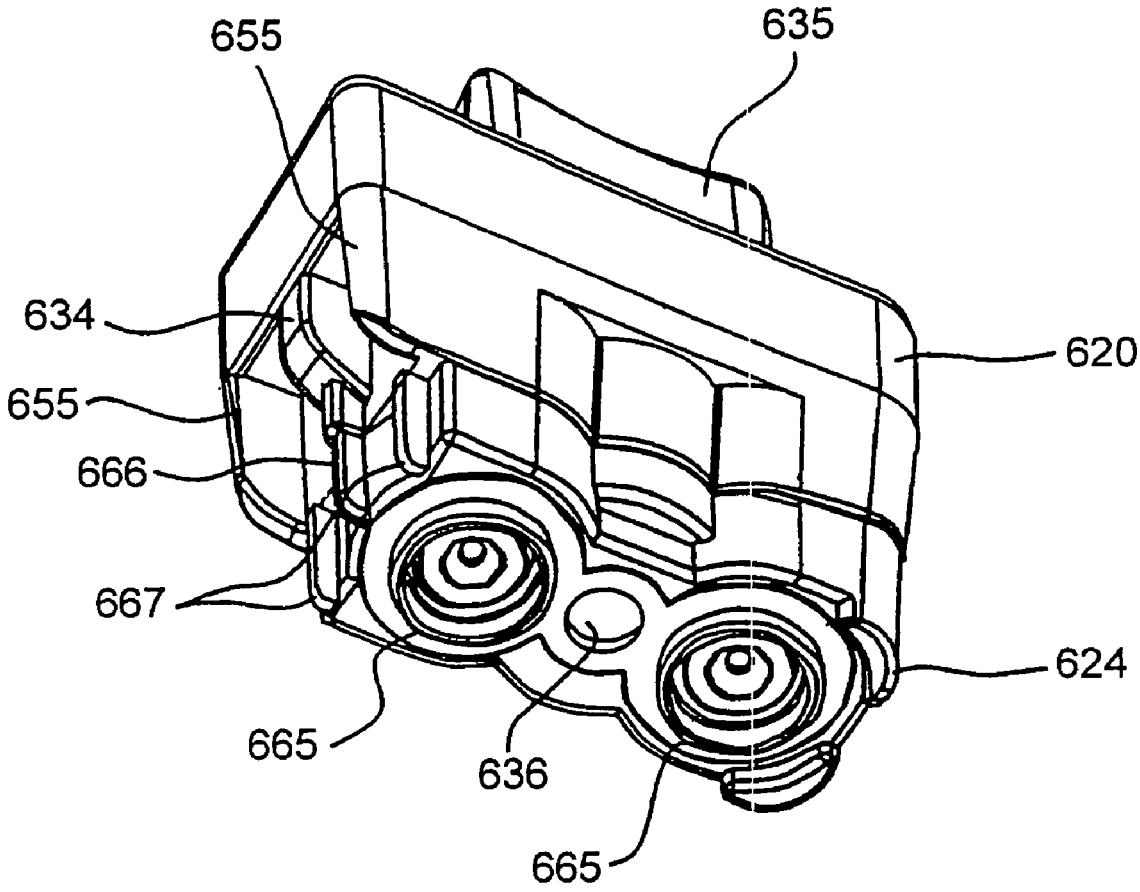
FIG. 43 is a perspective view of the ink cartridge depicted in FIG. 41 viewed from a downward position.
Figure 44:
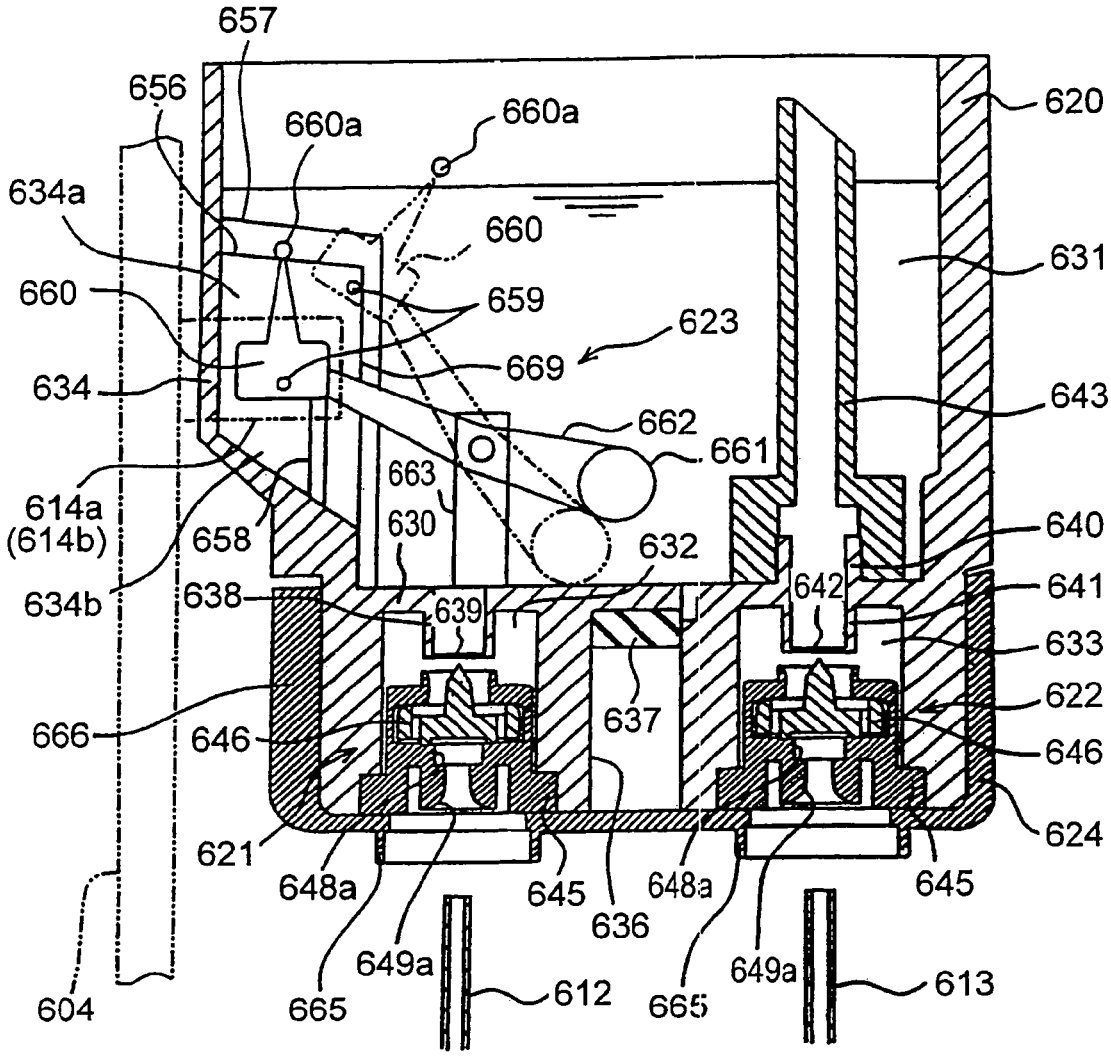
FIG. 44 is a sectional view of the ink cartridge in FIG. 42B.

As shown in FIGS. 42 to 44, the ink cartridge 603 includes a cartridge main body 620 which stores the ink, an ink supply valve 621 which is capable of opening/closing the ink supply passage to supply the ink contained in the cartridge main body 620 to the ink-jet head 602, an atmospheric air-introducing valve 622 which is capable of opening/closing the atmospheric air-introducing passage to introduce the atmospheric air into the cartridge main body 620 from the outside, a shutter mechanism 623 which blocks the light emitted from the light-emitting section 614*a* of the sensor 614 for detecting the ink residual amount in the ink cartridge 603, and a cap 624 which covers the lower end of the cartridge main body 620.

The cartridge main body 620 is formed of a light-transmissive synthetic resin. As shown in FIG. 44, a comparting wall 630, which extends horizontally, is integrally formed in the cartridge main body 620. The inner space of the cartridge main body 620 is comparted by the comparting wall 630 into an ink chamber (ink tank) 631 which is disposed on the upper side, and two valve-accommodating chambers 632, 633 which disposed on the lower side. The ink chamber 631 is charged with each of the color inks. The ink supply valve 621 and the atmospheric air-introducing valve 622 are accommodated in the two valve-accommodating chambers 632, 633 respectively. In this arrangement, the ink supply passage, which is used to introduce the ink charged in the ink chamber 631 to the outside, is constructed in the valve-accommodating chamber 632. As described later on, the ink flow, which is directed downwardly from the side of the ink chamber 631, is formed in the ink supply passage (see FIG. 49B). As shown in FIGS. 42B and 42C, a projection 634, which slightly protrudes outwardly and which extends in the downward direction, is formed at a substantially central position in the height direction of the side wall of the cartridge main body 620. The light-emitting section 614*a* and the light-receiving section 614*b* of the sensor 614 provided for the holder 604 are positioned at a height approximately equal to that of the projection 634 formed on the side wall of the cartridge main body 620 in a state in which the ink cartridge 603 is installed to the holder 604.

Figure 45:
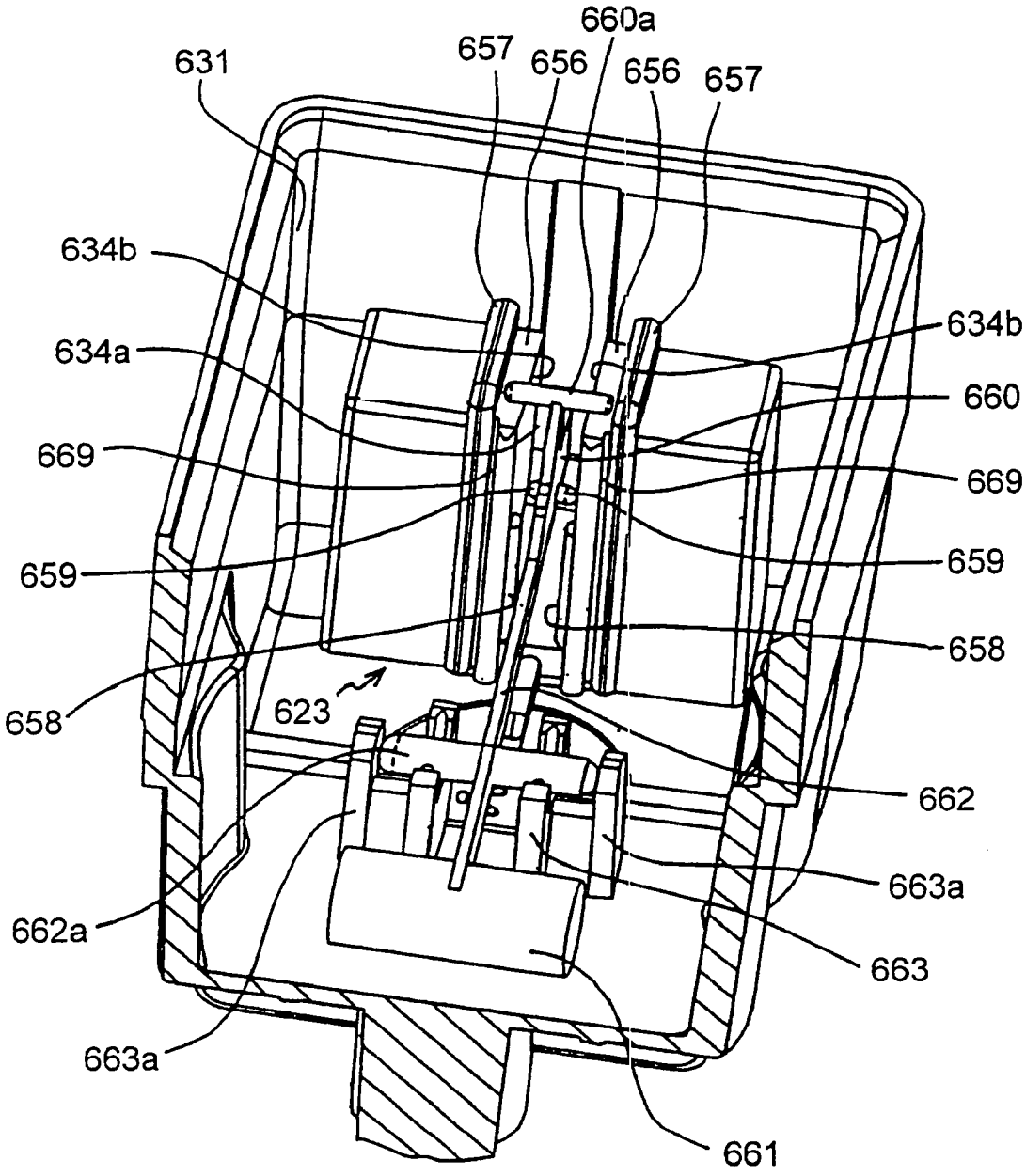
FIG. 45 is a perspective view of a cross section of the ink cartridge in FIG. 42A.
Figure 46:
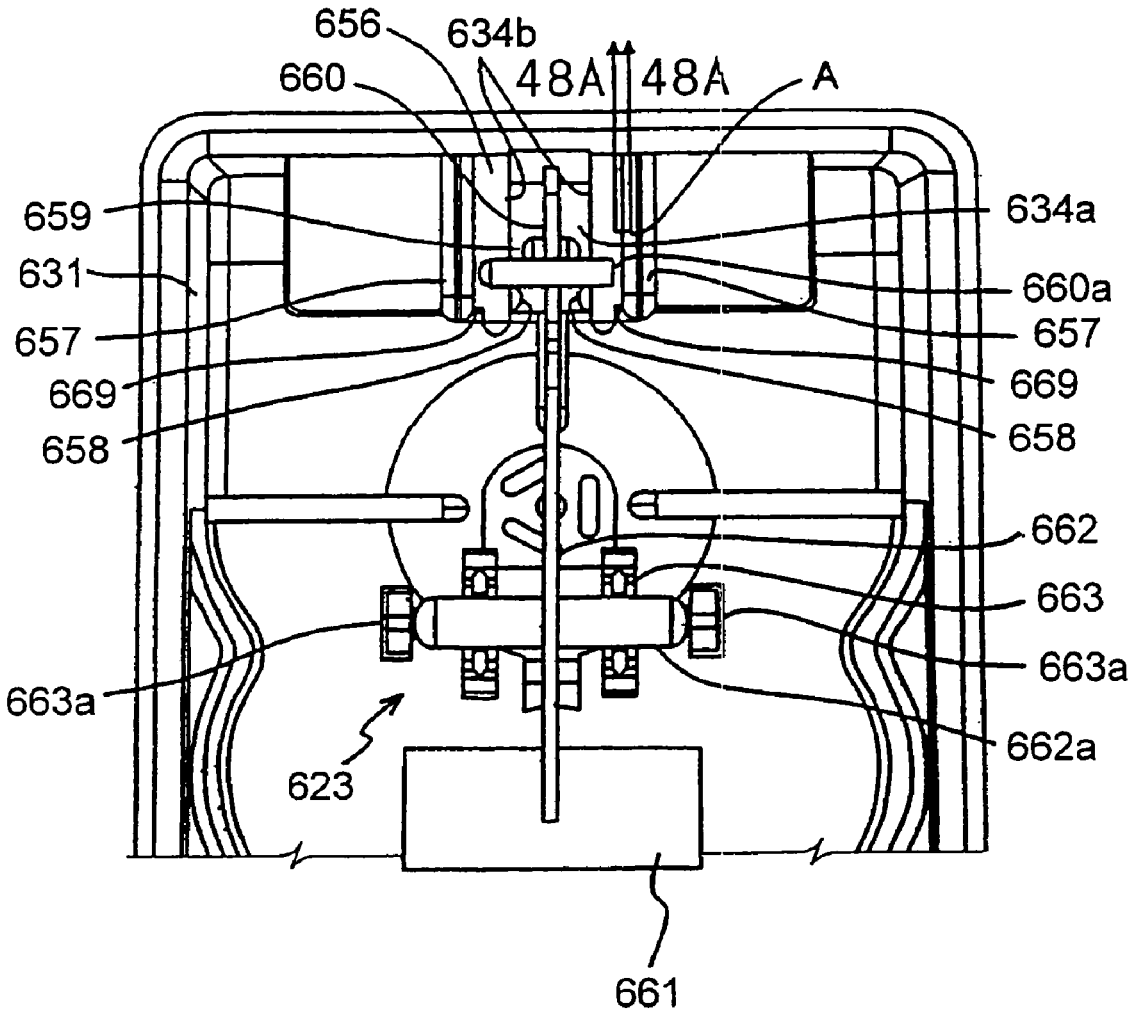
FIG. 46 is a partial top view of the ink cartridge in FIG. 45.
Figure 47:
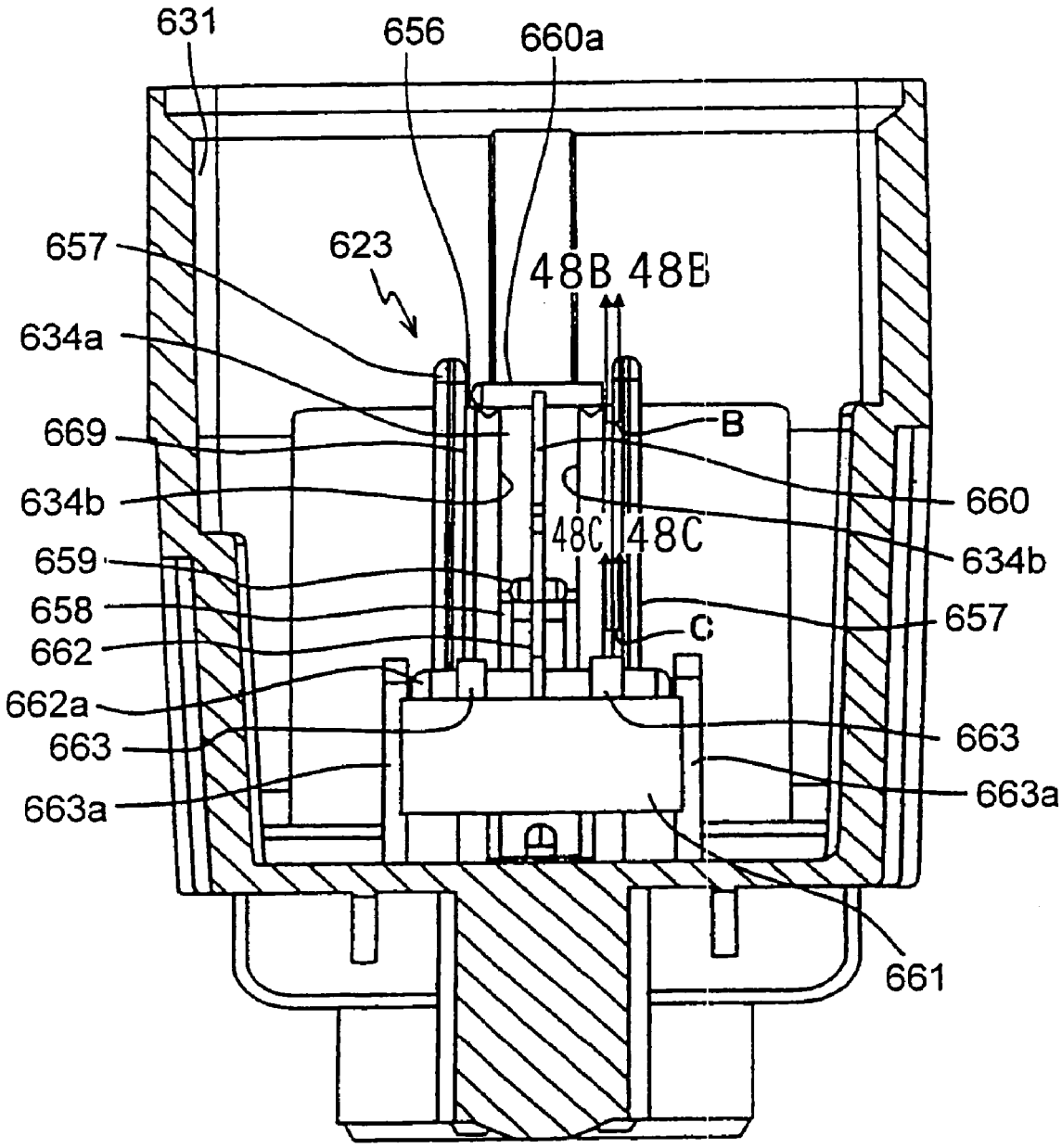
FIG. 47 is a cross section of the ink cartridge in FIG. 42A.
Figure 48A:
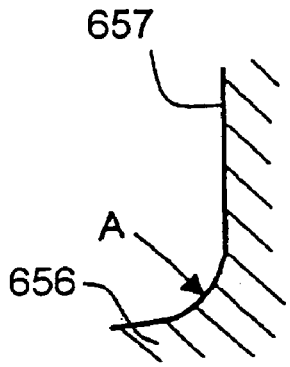
FIG. 48A is a sectional view of the ink cartridge in FIG. 46.
Figure 48B:
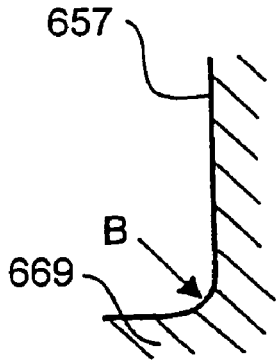
FIG. 48B is a sectional view of the ink cartridge in FIG. 47.
Figure 48C:
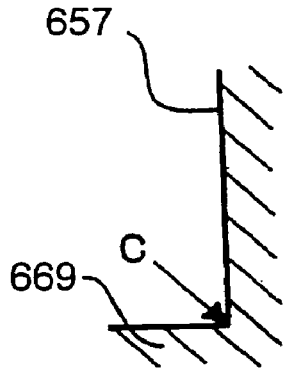
FIG. 48C is a sectional view of the ink cartridge in FIG. 47.

As shown in FIGS. 45 to 47, a recess 634*a* is formed at the inside of the projection 634 in the ink chamber 631. As shown in FIGS. 45 to 47, the recess 634*a* extends in the direction (direction inclined downwardly) perpendicular to the ink surface, and the recess 634*a* has two inner wall surfaces (downwardly inclined inner surfaces) 634*b* which are opposed to one another. As shown in FIGS. 45 to 47, a shield plate (detection objective section) 660 of the shutter mechanism 623 described later on is arranged in the recess 634*a* so that the shield plate 660 is interposed between the two inner wall surfaces 634*b* of the recess 634*a*. As shown in FIGS. 45 to 47, a rib 658, which protrudes toward the shield plate 660 arranged in the recess 634*a* and which extends in the perpendicular direction, is formed on each of the inner wall surfaces 634*b*. As shown in FIGS. 45 to 47, two abutment objective surfaces (regulating surfaces) 656, which extend in directions to make separation from each other in an identical plane from the upper ends of the respective inner wall surfaces 634*b*, are formed in the ink chamber 631. The abutment objective surfaces 656 are surfaces to make abutment against abutment sections 660*a* formed at the upper end of the shield plate 660 as described later on. The abutment objective surfaces 656 are inclined surfaces each of which is inclined by a predetermined angle toward the bottom surface of the ink chamber 631 (to make intersection with the ink surface) (see FIG. 44). As shown in FIGS. 45 to 47, perpendicular wall surfaces 669, each of which is connected to the end of the inner wall surface 634*b* disposed on the side opposite to the side of connection to the inner wall of the ink chamber 631 and the end of the abutment objective surface 656 disposed on the side opposite to the side of connection to the inner wall of the ink chamber 631, are formed in the ink chamber 631. As shown in FIGS. 45 to 47, ribs 657 are formed so that each of them extends over the abutment objective surface 656 and the perpendicular wall surface 669 and each of them is disposed perpendicularly to the extending direction of the abutment section 660*a* which makes abutment against the abutment objective surface 656. In a state in which the abutment section 660*a* abuts against the abutment objective surfaces 656, as shown in FIG. 45, the tips of the abutment section 660*a* are disposed adjacently and opposingly to the side surfaces of the ribs 657. As shown in FIGS. 45 to 47, the rib 657 is formed continuously over the range from the end of the abutment objective surface 656 on the side of the inner wall of the ink chamber 631 to the end opposed thereto and over the range from the end of the perpendicular wall surface 669 on the side of the abutment objective surface 656 to the end opposed thereto. FIG. 48 shows cross sections of the boundaries between the rib 657 and the abutment objective surface 656 and the perpendicular wall surface 669. In the case of an exemplary as shown in FIG. 48, the radius of curvature of the boundary differs depending on the position of connection between the rib 657 and the abutment objective surface 656 and the perpendicular wall surface 669. FIG. 48A shows the cross section illustrating the boundary between the rib 657 and the abutment objective surface 656. FIG. 48B shows the cross section illustrating the boundary between the rib 657 and the upper end area of the perpendicular wall surface 669. FIG. 48C shows the cross section illustrating the boundary between the rib 657 and the lower end area of the perpendicular wall surface 669. As shown in FIGS. 48A to 48C, the curvature of the curved section (A in FIG. 48A) formed at the boundary between the rib 657 and the abutment objective surface 656 is smaller than the curvatures of the curved sections (B and C in FIGS. 48B and 48C) formed at the boundaries between the rib 657 and the perpendicular wall surface 669. The curvature of the curved section (B in FIG. 48B) formed at the boundary between the rib 657 and the upper end area of the perpendicular wall surface 669 is smaller than the curvature of the curved section (C in FIG. 48C) formed at the boundary between the rib 657 and the lower end area of the perpendicular wall surface 669.

As shown in FIGS. 44 to 47, the shutter mechanism 623 which is provided in the lower space of the ink chamber 631 includes a shield plate 660 (detection objective section) which is nontransparent with respect to the light, a hollow float 661 (balance member), a connecting member 662 which connects the shield plate 660 and the float 661, and a support stand 663 which is provided on the upper side of the comparting wall 630 and which rotatably supports the connecting member 662. The displacement member (swinging member) is constructed by the shield plate 660, the float 661, and the connecting member 662. The float 661 is a cylindrical member having a tightly closed space filled with the air therein. The specific gravity of the entire float 661 is smaller than the specific gravity of the ink to be changed in the ink chamber 631. The shield plate 660 and the float 661 are provided at both ends of the connecting member 662 respectively. A columnar rotational shaft 662*a*, which protrudes in directions perpendicular to the both side surfaces of the connecting member 662, is formed in the vicinity of the center in the extending direction of the connecting member 662. The connecting member 662 is supported on the support stand 663 rotatably in the vertical plane (in the plane parallel to the sheet surface of the drawing) about the center of the rotational shaft 662*a*.

As shown in FIGS. 44 to 47, the rotational shaft 662*a*, which is formed on the connecting member 662, protrudes from the flat surfaces on both sides of the connecting member 662 in the direction perpendicular to the direction of displacement of the ink surface. In order to smoothen the rotation of the connecting member 662, the rotational shaft 662*a* is supported on the support stand 663 such that the rotational shaft 662*a* is also rotatable to some extent in the plane parallel to the sheet surface of FIG. 46. That is, the support stand 663 supports, at the lower position, the swinging member so that the motion other than the rotation of the connecting member 662 about the center of the rotational shaft 662*a* is also allowable. The tips of the rotational shaft 662*a* in the protruding directions, which protrude from the both side surfaces of the connecting member 662, abut against side wall surfaces on the mutually opposing sides of a pair of support plates 663*a* provided upstandingly from the bottom surface (comparting wall 630 as described later on) of the ink chamber 631. Accordingly, the displacement of the entire swinging member is regulated in the rightward and leftward directions on the sheet surface of FIG. 46.

The shield plate 660 is a thin plate-shaped member which is parallel to the vertical plane (plane parallel to the sheet surface of FIG. 44) and which has a predetermined area. As shown in FIG. 44, the shield plate 660 has a rectangular area, and a triangular protruding area which is formed to further extend upwardly from the upper end of the rectangular area. The abutment section 660*a*, which has a columnar shape extending from the shield plate 660 toward the two ribs 657 (in the direction along the ink surface), is formed at the upper end of the protruding area. The abutment section 660*a* makes abutment against the abutment objective surface 656 in the ink chamber 631. Accordingly, the rotation of the connecting member 662 in the certain direction (first direction) is regulated to arrange the shield plate 660 at a predetermined position. Specifically, as shown in FIG. 44, when the abutment section 660*a* abuts against the abutment objective surface 656, the shield plate 660 is arranged at the detecting position between the light-emitting section 614*a* and the light-receiving section 614*b* of the recess 634*a*. In this situation, the light, which has transmitted from the light-emitting section 614*a* of the sensor 614 through the wall of the light-transmissive cartridge main body 620 and the ink in the ink chamber 631, is blocked by the shield plate 660. On the other hand, when the abutment section 660*a* is separated from the abutment objective surface 656 (when the swinging member is in a state indicated by two-dot chain lines in FIG. 44), the shield plate 660 is arranged at any position other than the detecting position. In this situation, the light transmitted from the light-emitting section 614*a* arrives at the light-receiving section 614*b* without being blocked.

Therefore, in a state in which the ink residual amount in the ink chamber 631 is large, and the entire float 661, which is provided at one end of the connecting member 662, is positioned in the ink (in a situation in which the swinging member is in a state illustrated by solid lines in FIG. 44), the float 661 floats in accordance with the buoyancy acting on the float 661, and the connecting member 662 is rotated. However, the abutment section 660*a* of the shield plate 660 abuts against the abutment objective surface 656, and the rotation of the connecting member 662 is regulated. Therefore, the shield plate 660, which is provided at the other end of the connecting member 662, is arranged at the detecting position, i.e., at the position at which the light emitted from the light-emitting section 614*a* in the projection is blocked. However, when the ink residual amount in the ink chamber 631 is decreased, and a part of the float 661 protrudes from the ink liquid surface, then the buoyancy acting on the float 661 is decreased, and the float 661 is moved downwardly in response to the drop of the ink liquid surface, that is, in response to the decrease in the residual amount of ink in the ink chamber 31 (in a state in which the swinging member is indicated by two-dot chain lines in FIG. 44). Accordingly, the shield plate 660 is moved to the position (non-detecting position) which is disposed upwardly as compared with the interior of the projection 634 so that the direct light emitted from the light-emitting section 614*a* is not blocked by the shield plate 660. Therefore, the direct light emitted from the light-emitting section 614*a* is transmitted through the light-transmissive projection 634 along the linear optical path, and the light is directly received by the light-receiving section 614*b*. Accordingly, the state, in which the ink residual amount in the ink chamber 631 is decreased, is detected by the sensor 614.

As shown in FIGS. 44 to 47, columnar pins (projections) 659, which protrude from the shield plate 660 toward the inner wall surfaces 634*b* of the recess 634*a*, are formed on the both side surfaces of the rectangular area of the shield plate 660 (in the vicinity of the end of the swinging member) respectively. The tip of the pin 659 is constructed to form a curved surface. As shown in FIG. 44, the tips of the pins 659 are always in a state of being opposed to the inner wall surfaces 634*b* of the recess 634*a* within a range of movement of the abutment section 660*a* between the position at which the abutment section 660*a* abuts against the abutment objective surfaces 656 and the position at which the abutment section 660*a* is separated from the abutment objective surfaces 656. The pin 659 has an amount of projection to form a gap of such an extent that no capillary phenomenon is caused by at least the surface tension of the ink between the shield plate 660 and the inner wall surface 634*b* even when the tip of the pin 659 abuts against the inner wall surface 634*b* of the recess 634*a*, and the shield plate 660 makes approach most closely to the inner wall surface 634*b*.

In this structure, in a state in which the ink cartridge 603 is installed to the holder 604, the projection 634 of the ink cartridge main body 620 is interposed between the light-emitting section 614*a* and the light-receiving section 614*b* of the sensor 614. In this situation, the width of the projection 634 is narrower than the distance between the light-emitting section 614*a* and the light-receiving section 614*b*. Therefore, a predetermined spacing distance is maintained between the light-emitting section 614*a* and the light-receiving section 614*b* and the projection 634. As shown in FIGS. 42 and 43, a pair of ribs 655, which extend in the same direction as the extending direction of the projection 634 so that the projection 634 is interposed therebetween, are provided for the cartridge main body 620 at the both ends in the horizontal direction (leftward/rightward direction of the sheet surface in FIG. 42B) on the outer wall surface on which the projection 634 is formed. A lid member 635, including a holding part, is welded to the upper end of the cartridge main body 620. The ink chamber 631 in the cartridge main body 620 is closed by the lid member 635.

As shown in FIG. 44, an injecting hole 636 is formed between the two valve-accommodating chambers 632, 633 in order to inject the ink into the ink chamber 631 of the empty ink cartridge 603. A plug member 637 made of synthetic rubber is forcibly inserted into the injecting hole 636. As shown in FIG. 44, an opening, which makes communication with the ink chamber 631 in the cartridge main body 620, is formed through a part of the injecting hole 636 in the vicinity of the upper end of the side wall. When the ink is charged, the plug member 637 in the injecting hole 636 is pierced by an injection needle (not shown), and the injection needle is penetrated through the opening which is formed through the part of the injecting hole 636 in the vicinity of the upper end of the side wall so that the ink is charged into the ink chamber 631 via the injection needle.

As shown in FIG. 44, a cylindrical section 638, which protrudes downwardly, is integrally formed at a portion of the comparting wall 630 which constitutes the ceiling of the valve-accommodating chamber 632 for accommodating the ink supply valve 621 therein. A thin film section 639, which closes the communication passage formed in the cylindrical section 638, is provided at the lower end of the cylindrical section 638. On the other hand, two cylindrical sections 640, 641, which protrude upwardly and downwardly respectively, are integrally formed at a portion of the comparting wall 630 which constitutes the ceiling of the valve-accommodating chamber 633 for accommodating the atmospheric air-introducing valve 622 therein. A thin film section 642, which closes the communication passage formed in the cylindrical sections 640, 641, is provided at the lower end of the cylindrical section 641 disposed on the lower side. Further, as shown in FIG. 44, a cylindrical member 643, which extends up to the upper end of the ink chamber 631, is provided on the upper side of the cylindrical section 640.

As shown in FIG. 44, the ink supply valve 621 includes a valve main body 645 which is formed to have a substantially cylindrical shape with synthetic rubber or the like and which has elasticity, and a valve plug 646 which is accommodated in the valve main body 645 and which is made of synthetic resin. As shown in FIG. 49, the valve main body 645 includes an urging section 647, a valve seat section 648, and a fitting section 649 which are integrally formed and which are aligned in this order from the upper side (side of the ink chamber 631).

In this structure, the lower surface of the valve plug 646 abuts against the upper surface of the valve seat section 648 (end surface on the side facing the ink chamber 631). A through-hole 648*a*, which extends in the vertical direction, is formed through a portion of the axial center of the valve seat section 648. A guide hole 649*a*, which is communicated with the through-hole 648*a* of the valve seat section 648 and which extends downwardly, is formed for the fitting section 649. The guide hole 649*a* is formed to have a shape widening toward the end in which the diameter is increased at lower positions. An annular groove 649*b* is formed around the guide hole 649*a*. In this structure, the wall for forming the guide hole 649*a* is elastically deformable with ease in the direction in which the diameter of the guide hole 649*a* is expanded. Therefore, when the ink supply pipe 612 is inserted into the guide hole 649*a*, it is possible to avoid the leakage of the ink as far as possible by improving the tight contact performance between the guide hole 649*a* and the ink supply pipe 612. Even when the ink supply pipe 612 is inserted into the guide hole 649*a* in a state in which the ink supply pipe 612 is inclined with respect to the guide hole 649*a* or in a state in which the central axis of the guide hole 649*a* is deviated from the central axis of the ink supply pipe 612, the ink supply pipe 612 is reliably inserted into the guide hole 649*a*, because the wall section is elastically deformed in the direction in which the diameter of the guide hole 649*a* is expanded.

As shown in FIG. 49, the urging section 647 includes a cylindrical side wall section 647*a* which extends from the outer circumferential side portion of the valve seat section 648 toward the side of the ink chamber 631, and a projecting section 647 which integrally protrudes inwardly in the radial direction of the side wall section 647*a* from the upper end of the side wall section 647*a*. The lower surface of the projecting section 647*b* abuts against the valve plug 646. The valve plug 646 is urged downwardly by the elastic forces of the side wall section 647*a* and the projecting section 647*b*. An opening 647*c* is formed at the inside of the projecting section 647*b*. In this construction, the side wall section 647*a* and the projecting section 647*b*, which are formed in an integrated manner, are elastically deformable with ease.

Figure 49A:
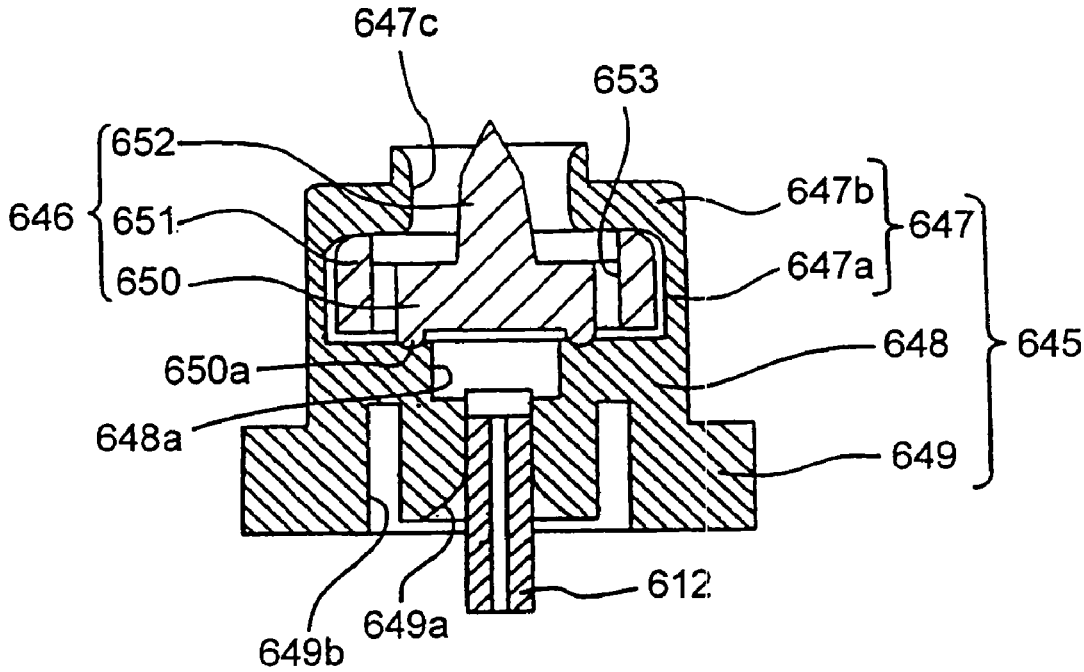
Figure 49B:
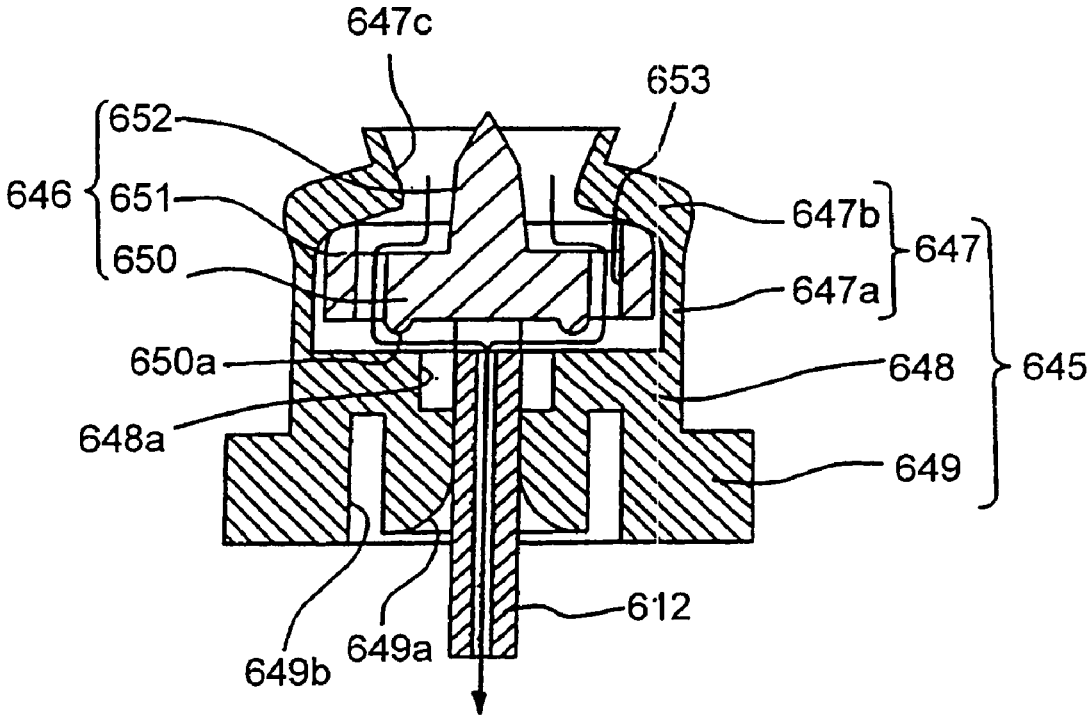
Figure 50:
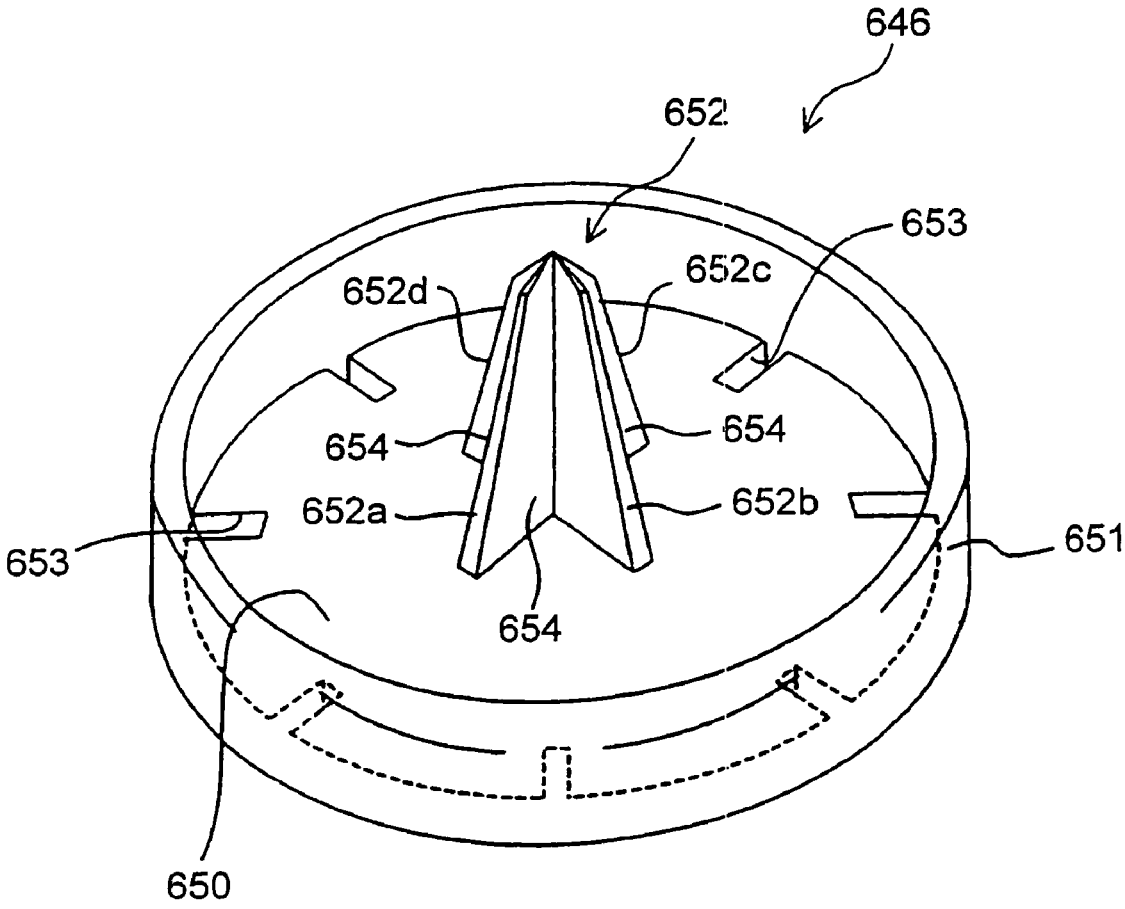
FIG. 50 is a perspective view of the valve plug in FIG. 45.

As shown in FIGS. 49 and 50, the valve plug 646 includes a bottom section 650 which makes abutment against the valve seat section 648 of the valve main body 645, a cylindrical valve side wall section 651 which extends from the outer circumferential side portion of the bottom section 650 toward the ink chamber 631, and a breaking section 652 which protrudes from the center of the bottom section 650 excessively toward the ink chamber 631 as compared with the valve side wall section 651.

An annular projection 650*a*, which protrudes toward the valve seat section 648, is formed on the lower surface of the bottom section 650 of the valve plug 646 (end surface opposed to the valve seat section 648). The valve plug 646 is urged toward the valve seat section 648 by the urging section 647 of the valve main body 645. In a state (state shown in FIG. 49A) in which the annular projection 650*a* makes tight contact with the upper surface of the valve seat section 648, the through-hole 648*a* of the valve seat section 648 is closed by the valve plug 646, and the ink supply passage is closed. Further, a plurality of (for example, eight) communication passages 653, which make communication between the upper space and the lower space of the valve plug 646, are formed at equally divided positions in the circumferential direction of the portion of the bottom section 650 of the valve plug 646, the portion being disposed on the outer circumferential side as compared with the annular projection 650*a* and on the inner circumferential side as compared with the valve side wall section 651.

As shown in FIGS. 49 and 50, the breaking section 652 of the valve plug 646 is constructed by four plate members 652*a*, 652*b*, 652*c*, 652*d* combined in a cross form as viewed in a plan view. The breaking section 652 is provided upstandingly at a substantially central portion of the bottom section 650. As shown in FIG. 50, grooves 654, which extend in the vertical direction, are formed respectively between the plate members (for example, between the plate members 652*a*, 652*b*) which are combined perpendicularly to one another. The breaking section 652 passes through the opening 647*c* at the inside of the projecting section 647*b* of the valve main body 645 so that the breaking section 652 protrudes upwardly. As shown in FIG. 44, the tip of the breaking section 652 is arranged at the position slightly lower than the thin film section 639 of the cylindrical section 638 before the ink cartridge 603 is installed to the holder 604.

When the ink cartridge 603 is installed to the holder 604, the ink supply pipe 612, which is provided for the holder 604, is inserted into the guide hole 649*a* of the valve main body 645. Accordingly, the valve plug 646 is pushed upwardly by the tip of the ink supply pipe 612 against the urging force of the urging section 647 of the valve main body 645. The valve plug 646 is moved upwardly while deforming the urging section 647. The annular projection 650*a*, which is provided on the bottom surface of the valve plug 646, is separated from the valve seat section 648 (see FIG. 49B). In this situation, the thin film section 639 of the cylindrical section 638 is broken by the tip of the breaking section 652 of the valve plug 646 having been moved upwardly. Accordingly, as shown in FIGS. 44 and 49B, the ink contained in the ink chamber 631 flows into the valve-accommodating chamber 632 through the communication passage in the cylindrical section 638. Further, the ink is supplied through the communication passages 653 of the valve plug 646 from the ink supply pipe 612 to the ink-jet head 602. In this situation, the valve-accommodating chamber 632 functions as the ink supply passage. The flow of the ink (arrow in FIG. 49B) is formed, which is directed downwardly from the side of the ink chamber 631.

As shown in FIG. 44, the atmospheric air-introducing valve 622 is provided with the valve main body 645 and the valve plug 646 which is accommodated in the valve main body 645. The atmospheric air-introducing valve 622 is constructed in the same manner as the ink supply valve 621. That is, the atmospheric air-introducing valve 622 is constructed such that the valve plug 646, which is urged downwardly by the urging section 647, makes tight contact with the valve seat section 648 of the valve main body 645 so that the valve plug 646 closes the through-hole 648*a*. When the ink cartridge 603 is installed to the holder 604, the atmospheric air-introducing pipe 613 is inserted into the guide hole 649*a* formed in the valve main body 645. Similarly to the ink supply valve 621, the valve plug 646 is moved upwardly, and the thin film section 642 of the cylindrical section 641 is broken by the breaking section 652 of the valve plug 646. Accordingly, the outside atmospheric air flows from the atmospheric air-introducing pipe 613 via the communication passages 653 of the valve plug 646 into the valve-accommodating chamber 633. Further, the atmospheric air is introduced into the upper portion of the ink chamber 631 via the inner passage of the cylindrical member 643 and the cylindrical sections 640, 641.

The cap 624 is formed of the nontransparent material through which no light is transmitted unlike the cartridge main body 620. As shown in FIGS. 42 to 44, the cap 624 is secured to the cartridge main body 620, for example, by the ultrasonic welding in a state in which the lower end of the cartridge main body 620 is covered therewith. Two annular projections 665, which protrude downwardly, are formed respectively at the positions of the bottom of the cap 624 corresponding to the ink supply valve 621 and the atmospheric air-introducing valve 622 respectively. In this structure, for example, when the ink cartridge 603 is placed on a desk, the ink, which is adhered to those in the vicinity of the inlets of the ink supply valve 621 and the atmospheric air-introducing valve 622, is hardly adhered, for example, to the desk surface.

As shown in FIGS. 42 to 44, a rib 666, which extends in the vertical direction, is formed on the side wall portion of the cap 624 on the same side as that of the projection 634 formed on the outer wall of the cartridge main body 620. The rib 666 is formed under the projection 634. As shown in FIGS. 42B and 44, the rib 666 and the shield plate 660 in the projection 634 of the cartridge main body 620 are arranged at the positions separated from each other by a predetermined distance in the vertical direction. The rib 666 is positioned at the position lower than the shield plate 660. Therefore, the rib 666 is positioned at the position lower than the light-emitting section 614*a* and the light-receiving section 614*b* of the sensor 614 in a state in which the ink cartridge 603 is installed to the holder 604. Further, the rib 666 is located at the position interposed between the light-emitting section 614*a* and the light-receiving section 614*b* of the sensor 614 as viewed in a plan view in which the ink cartridge 603 is viewed in the direction of installation. The width of the rib 666 is narrower than the width of the projection 634, and the protruding distance of the rib 666 is shorter than the protruding distance of the projection 634.

The rib 666 is detected such that the rib 666 passes between the light-emitting section 614*a* and the light-receiving section 614*b* of the sensor 614 to instantaneously shut off the light from the light-emitting section 614*a* of the sensor 614 only when the ink cartridge 603 is installed to the holder 604 or when the ink cartridge 603 is detached from the holder 604. On the other hand, the rib 666 exists at the position lower than the sensor 614 in the state of installation of the ink cartridge 603. Therefore, the rib 666 is not detected by the sensor 614. Only the shield plate 660, which is arranged in the ink chamber 631, can be detected by the sensor 614. That is, the rib 666 can be detected by the sensor 614 only when the ink cartridge 603 is attached/detached. Therefore, it is possible to recognize whether or not the ink cartridge 603 is installed, by using the control unit 608 as described later on, on the basis of the result of detection of the rib 666. A structure is provided such that the rib 666 is detected by the sensor 614 only by attaching/detaching the ink cartridge 603 in a certain direction. Therefore, it is unnecessary to perform any complicated operation, which would be otherwise performed in order to detect the rib 666 with the sensor 614. Further, it is possible to extremely avoid the breakage of the rib 666, which would be otherwise caused, for example, by any contact with the holder 604, the rib 666 being exposed to the outside and being weak in view of the strength.

Next, the control unit 608 will be explained. The control unit 608 manages the control of various operations to be performed by the multifunction device 601 including, for example, the discharge of the ink from the nozzles 602*a* of the ink-jet head 602, the supply of the paper to the ink-jet head 602, and the discharge of the printing paper having been subjected to the printing by the ink-jet head 602. The control unit 608 includes, for example, CPU (Central Processing Unit) which serves as a computing processing unit, ROM (Read-Only Memory) in which programs to be executed by CPU and data to be used for the programs are stored, RAM (Random Access Memory) which temporarily stores data during the execution of the program, a nonvolatile memory such as rewritable EEPROM (Electrically Erasable Programmable Read-Only Memory), an input/output interface, and a bus. As shown in FIG. 41, the control unit 608 controls a variety of devices for constructing the multifunction device 601 including, for example, the ink-jet head 602, the motor of the transport mechanism 106 for driving the carriage 605, and the suction pump 670 of the purge unit 607, on the basis of various signals inputted from an external personal computer (PC) 682.

As shown in FIG. 41, the control unit 608 further includes an installation state-judging section 680 which judges the installation state of the ink cartridge 603 in the holder 604 on the basis of the output signal from the sensor 614, and an ink residual amount-calculating section 681 which calculates the residual amount of the ink contained in the ink chamber 631.

Figure 51:
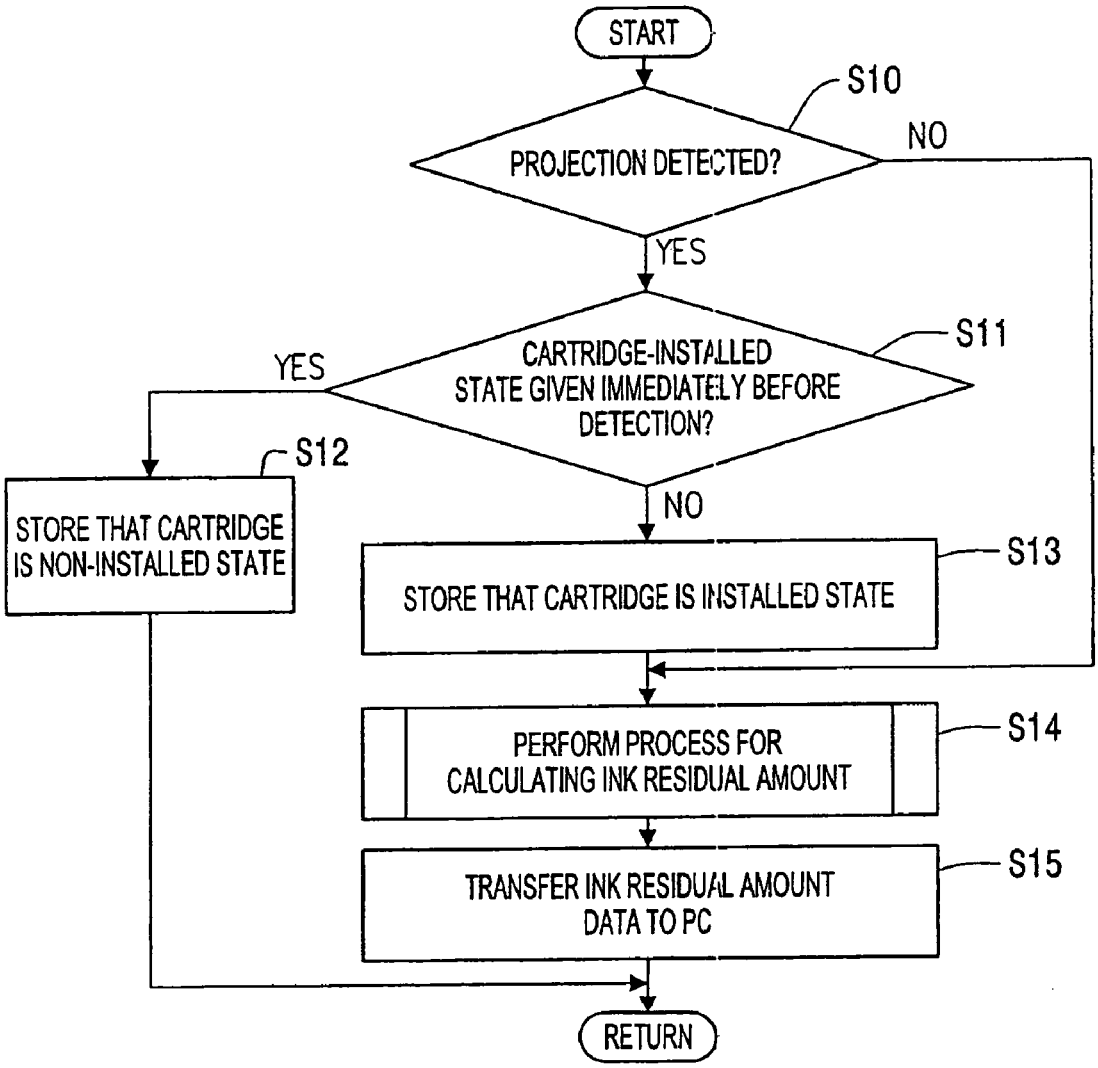
FIG. 51 is a flow chart illustrating an installation state-judging process upon attachement/detachment of the ink cartridge in FIG. 41.

An explanation will be made below about the processing steps of the installation state-judging section 680 and the ink residual amount-calculating section 681 with reference to a flow chart for the installation state-judging process shown in FIG. 51. In FIG. 51, Si (i=10, 11, 12, . . . ) indicates each of the steps of the processing operation. This flow chart illustrates, by way of example, the processing steps to be applied when the ink cartridge 603*d* for storing the black ink is installed to the holder 604*d*.

At first, if it is judged that the rib 666 provided for the cap 624 is not detected by the sensor 614 in the judging process of S10 (in the case of "No" of the judgment result of S10) in a state in which the power source is applied to the multifunction device 601, the routine proceeds to the ink residual amount-calculating process of S14. On the other hand, if it is judged that the rib 666 is detected by the sensor 614 in the judging process of S10 (in the case of "Yes" of the judgment result of S10), the routine proceeds to the judging process of S11. In the judging process of S11, it is judged whether or not the cartridge has been installed immediately before the detection of the rib 666. If the ink cartridge 603*d* has been installed to the holder 604*d* immediately before the detection of the rib 666 (in the case of "Yes" of the judgment result of S11), then it is judged that the ink cartridge 603*d* has been detached from the holder 604*d*, and the information, which corresponds to the fact that the ink cartridge 603*d* is in the non-installed state, is stored (S12). In this case, it is unnecessary to calculate the ink residual amount. Therefore, the routine is subjected to the return as it is.

If the ink cartridge 603*d* has not been installed immediately before the detection of the rib 666 in the judging process of S11 (in the case of "No" of the judgment result of S11), the rib 666 of the ink cartridge 603*d* shown in FIG. 43 is consequently detected by installing the ink cartridge 603*d* to the holder 604*d*. Therefore, the information, which corresponds to the fact that the ink cartridge 603*d* is in the installed state, is stored (S13). After that, the routine proceeds to the ink residual amount-calculating process of S14.

In the ink residual amount-calculating process of S14, if the shield plate 660 of the shutter mechanism 623 is detected (if the ink residual amount is sufficient), the ink residual amount is approximately calculated from the maximum capacity of the ink cartridge 603*d* and the accumulated value of the number of liquid droplets of the ink having been discharged after the point of time of installation of the ink cartridge 603*d*. On the other hand, if the shield plate 660 of the shutter mechanism 623 is not detected (if the ink residual amount is decreased), the ink residual amount is calculated more correctly from the ink residual amount obtained in a state in which the shield plate 660 is not detected and the accumulated value of the number of liquid droplets of the ink having been discharged after the arrival at the state described above. The ink residual amount, which is calculated in S14, is transferred to PC 682 (S15), and the routine is subjected to the return.

The information, which includes, for example, the installation state of the ink cartridge 603 and the accumulated value of the discharged ink, is stored in the nonvolatile memory such as EEPROM in order that the information is retained even in a state in which the power source of the multifunction device 601 is turned OFF.

The distance between the shield plate 660 and the inner wall surface 634*b* of the recess 634*a* formed in the exemplary ink chamber 631 is maintained by the pins 659 which are formed on the side surfaces of the shield plate 660 of the swinging member. In this situation, the distance, which is in such an extent that no capillary phenomenon is caused by the surface tension of the ink, is secured between the shield plate 660 and the inner wall surface 634*b*. It is possible to avoid the adhesion between the shield plate 660 and the inner wall surface 634*b* by the surface tension of the ink and the deterioration of the smooth motion of the displacement of the shield plate 660. That is, the ink surface, which intervenes between the shield plate 660 and the inner wall surface 634*b*, can be similarly lowered as well, as the ink surface is lowered in accordance with the consumption of the ink. No ink, which prohibits the displacement of the shield plate 660 by the surface tension of the ink, remains between the shield plate 660 and the inner wall surface 634*b*. Therefore, the exemplary shield plate 660 can be smoothly operated in accordance with the change of the ink residual amount. Therefore, it is possible to detect, with any small error, the fact that the ink residual amount in the ink chamber 631 arrives at the predetermined amount.

The swinging member (displaceable member) is supported so that the rotation can be made to some extent in the plane parallel to the sheet surface of FIG. 46. Therefore, it is feared that the shield plate 660, which is provided at the position separated from the point of support by the support stand 663, may approach the inner wall surface 634*b* too closely depending on the spacing distance between the shield plate 660 and the inner wall surface 634*b*. In order to solve this problem, the operation of the shield plate 660 can be smoothened without being affected by the surface tension of the ink by widening the spacing distance between the shield plate 660 and the inner wall surface 634*b*. However, in this case, it is necessary that the spacing distance between the light-emitting section 614*a* and the light-receiving section 614*b* of the sensor 614 is widened as well, which is any unsatisfactory countermeasure in view of the sensitivity of the sensor 614. It is necessary to use an expensive sensor having higher sensitivity depending on the spacing distance between the light-emitting section 614*a* and the light-receiving section 614*b*. However, the spacing distance between the shield plate 660 and the inner wall surface 634*b* is regulated to such an extent that the smooth motion of the shield plate 660 is not deteriorated by the surface tension of the ink, by the aid of the pins 659 which are formed on the side surfaces of the shield plate 660 of the swinging member. Therefore, it is possible to further shorten the distance between the shield plate 660 and the inner wall surface 634*b*. Simultaneously, it is also possible to narrow the width of the projection 634. Further, it is possible to further narrow the width of the projection 634, because the shield plate 660 is the thin plate-shaped member. Accordingly, the cheap light-transmissive type optical sensor having low sensitivity can be utilized as the sensor 614.

Additionally, the ribs 658, which extend in the vertical direction of the inner wall surfaces 634*b*, are formed on the inner wall surfaces 634*b* of the recess 634*a* in the exemplary ink chamber 631. Therefore, the ink, which is pooled between the shield plate 660 and the inner wall surface 634*b*, is successfully allowed to fall downwardly along the ribs 658. Accordingly, it is possible to further avoid the adhesion between the shield plate 660 and the inner wall surfaces 634*b* by the surface tension of the ink.

Further, the tips of the pins 659 formed on the side surfaces of the shield plate 660 of the exemplary swinging member are constructed by the curved surfaces. Therefore, the pins 659 make the point-to-point contact with the inner wall surfaces 634*b* of the recess 634*a* in the ink chamber 631. Therefore, even when any ink remains between the pins 659 and the inner wall surfaces 634*b*, it is possible to suppress the remaining amount minimally. That is, the pins 659 and the inner wall surfaces 634*b* are hardly adhered by the surface tension of the ink. As a result, it is possible to smoothly operate the shield plate 660 as the ink residual amount is changed. It is possible to detect, with any small error, the fact that the ink residual amount in the ink chamber 631 arrives at the predetermined amount.

The abutment section 660*a*, which is formed at the upper portion of the exemplary shield plate 660, is the columnar member. Therefore, the abutment section 660*a* and the abutment objective surfaces 656 in the ink chamber 631 make the line-to-line contact. Accordingly, the contact area between the abutment section 660*a* and the abutment objective surfaces 656 is decreased. Therefore, the abutment section 660*a* and the abutment objective surfaces 656 are hardly adhered by the surface tension of the ink. Therefore, it is possible to smoothly operate the shield plate 660 in accordance with the change of the ink residual amount. It is possible to detect, with any small error, the fact that the ink residual amount in the ink chamber 631 arrives at the predetermined amount.

The ink, which is pooled on the abutment objective surfaces 656 formed in the ink chamber 631, is sucked by the capillary force of the curved section formed at the boundary between the abutment objective surface 656 and the rib 657 formed over the abutment objective surface 656 and the perpendicular wall surface 669, and the ink falls downwardly along the rib 657. Therefore, the abutment section 660*a* and the abutment objective surface 656 are hardly adhered by the surface tension of the ink. Simultaneously, in a state in which the abutment section 660*a* abuts against the abutment objective surface 656, the tip of the abutment section 660*a* makes contact with the side surface of the rib 657. Therefore, the ink, which is retained between the abutment section 660*a* and the abutment objective surface 656, is also sucked by the capillary force of the curved section formed at the boundary between the abutment objective surface 656 and the rib 657. Therefore, the abutment section 660*a* can be easily separated from the abutment objective surface 656 at an appropriate timing depending on the lowering of the ink surface.

As shown in FIG. 48, an exemplary structure is provided, in which the curvatures are decreased in the order of the curvature of the curved section (C in FIG. 48C) formed at the boundary between the rib 657 and the lower end area of the perpendicular wall surface 669, the curvature of the curved section (B in FIG. 48B) formed at the boundary between the rib 657 and the upper end area of the perpendicular wall surface 669, and the curvature of the curved section (A in FIG. 48A) formed at the boundary between the rib 657 and the abutment objective surface 656. Accordingly, the capillary forces of the curved sections formed at the boundaries between the rib 657 and the abutment objective surface 656 and the perpendicular wall surface 669 are increased at the lower portions of the rib 657 positioned downwardly. The action is effected to move the ink more downwardly as a whole. That is, the ink, which is pooled in the vicinity of the boundary between the abutment objective surface 656 and the rib 657, tends to fall downwardly along the rib 657 with ease.

Additionally, the abutment objective surface 656 formed in the exemplary ink chamber 631 is the inclined surface. The ink, which is pooled on the abutment objective surface 656, falls and flows downwardly along the inclined surface. Therefore, the ink is more hardly pooled on the abutment objective surface 656.

Further, the connecting member 662 having the shield plate 660 is rotated, and thus the shield plate 660 is displaced. Therefore, the shield plate 660 can be displaced stably along the predetermined orbit. Therefore, the shield plate 660 is hardly adhered to the inner wall surface 634*b* which is disposed outside the predetermined orbit.

FIGS. 52-56 depict an exemplary multifunction device 701 and an exemplary ink cartridge 703 used therewith.

Figure 52:
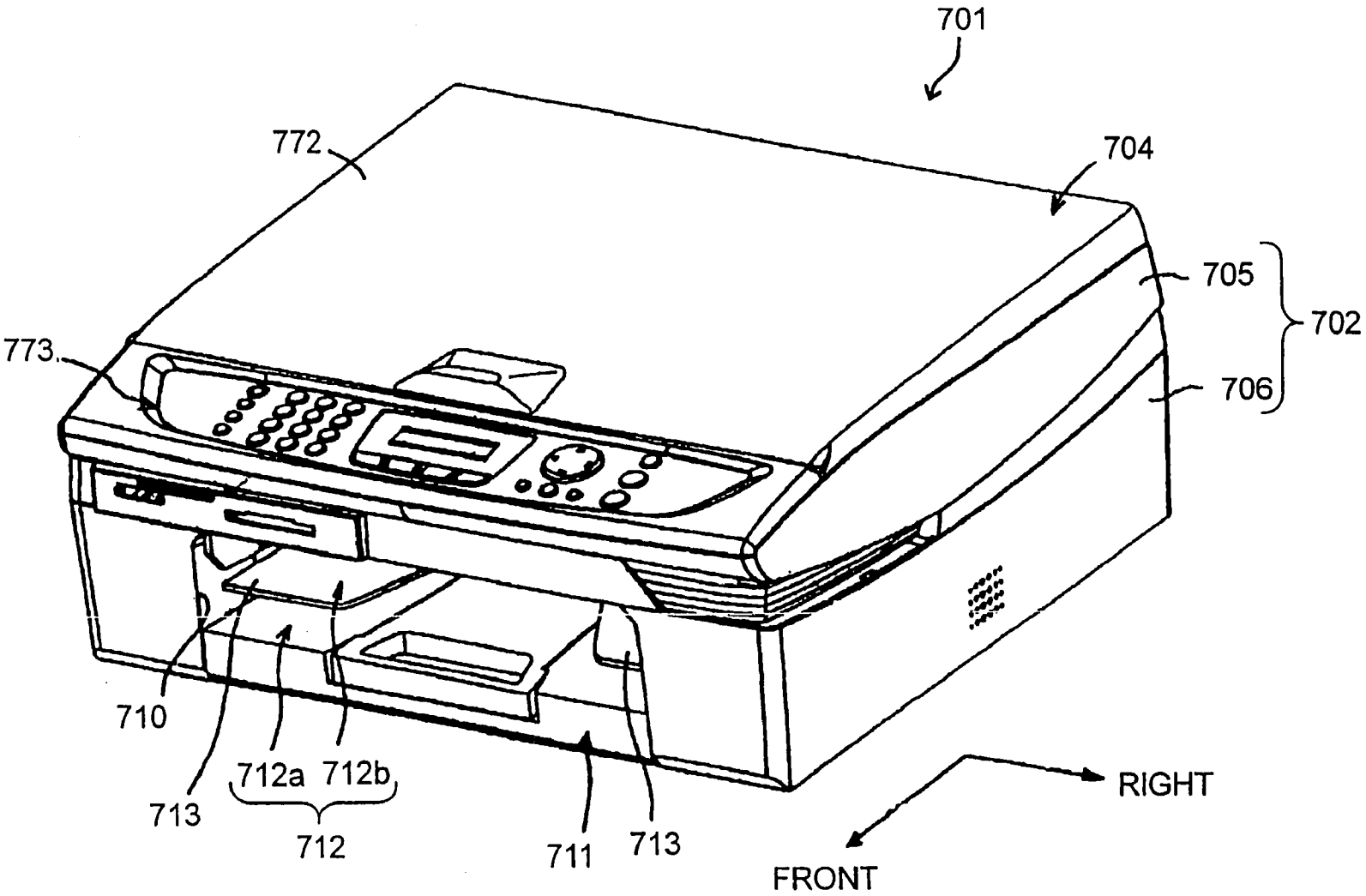
FIG. 52 is a perspective view of an exemplary multifunction device capable of being mounted with an exemplary ink cartridge.
Figure 53:
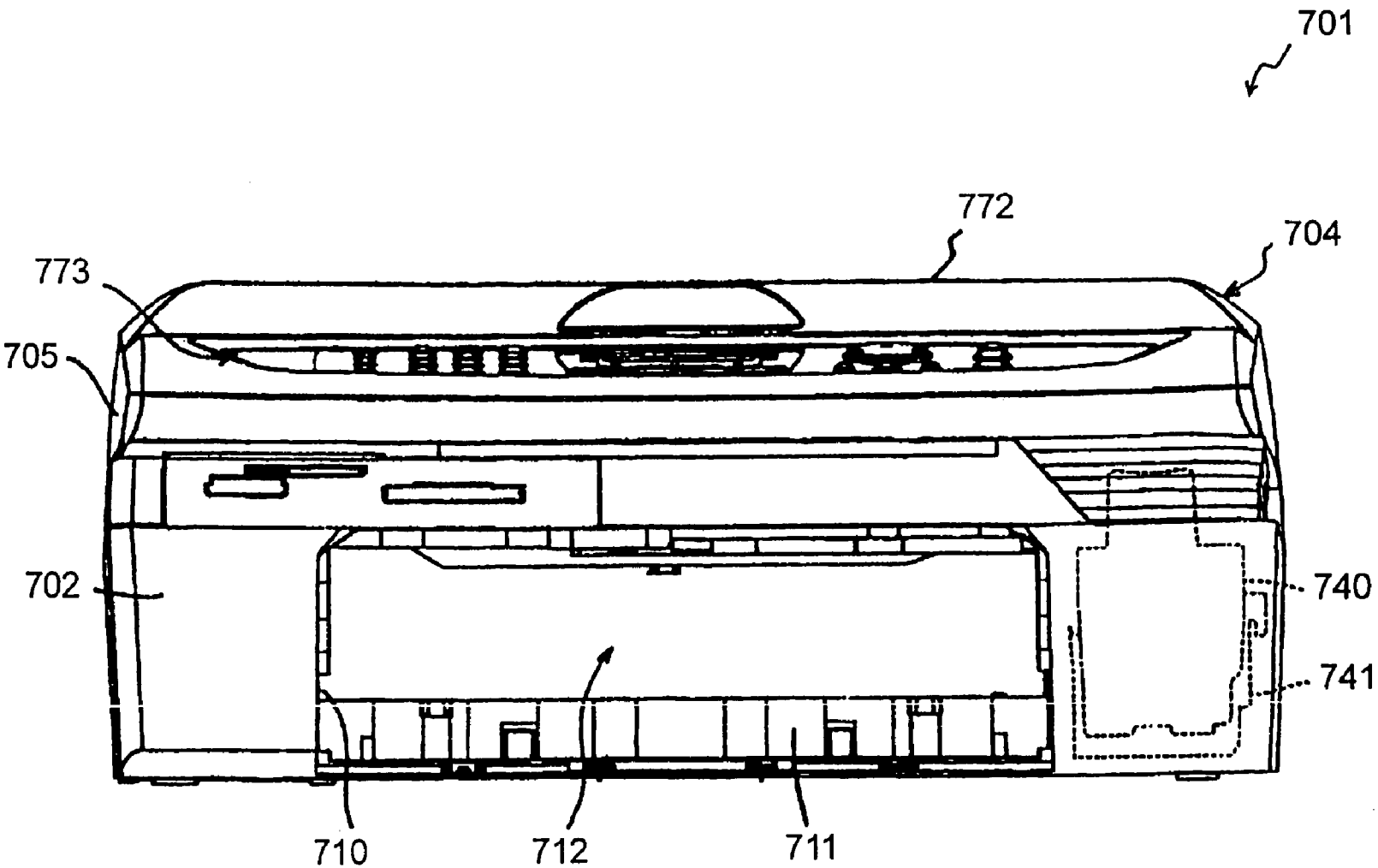
FIG. 53 is a front view of an exemplary multifunction device capable of being mounted with an exemplary ink cartridge.

As shown in FIGS. 52 and 53, the multifunction device 701 includes a main casing 702 having an upper frame 705, including a cover 772, and a lower frame 706. The lower frame 706 is formed in a substantially square shape in a plan view. A sheet accommodating section 710 is formed as a recess in the front bottom portion of the lower frame 706 and centered left-to-right, providing an arc-like front appearance to the lower frame 706. A conveying space 712 is defined inside the sheet accommodating section 710 for conveying a recording sheet P (e.g., paper) in the front-to-rear direction.

A sheet supply tray 711 for holding recording sheets P is detachably inserted into the sheet accommodating section 710 and is capable of moving in the front-to-rear direction within the conveying space 712. When accommodated in the sheet accommodating section 710, the sheet supply tray 711 blocks the bottom of the sheet accommodating section 710. In other words, by eliminating a bottom surface of the sheet accommodating section 710 and by configuring the sheet supply tray to serve as the bottom surface, it is possible to reduce the height of the lower frame 706. This construction also facilitates maintenance work for paper jams and the like since the bottom of the lower frame 706 can be opened simply by removing the sheet supply tray from the sheet accommodating section 710.

Guide pieces 713 formed in arch shapes are disposed near the front part of the sheet supply tray 711 to extend from the left and right edges of the sheet accommodating section 710 to cover the top of the recording sheet P loaded in the sheet supply tray 711. The guide pieces 713 determine the left-to-right position of the recording sheet P on the sheet supply tray 711. The guide pieces 713 also function as a discharge tray. After an image is formed on the recording sheet P in a recording unit 21, the recording sheet P is discharged forward onto the top surfaces of the guide pieces 713. Hence, the guide pieces 713 divide the conveying space 712 into a lower supply space 712*a* for supplying the recording sheet P and an upper discharge space 712*b* for discharging the recording sheet P. Note that the guide pieces have been omitted from FIGS. 53-55.

Figure 54:
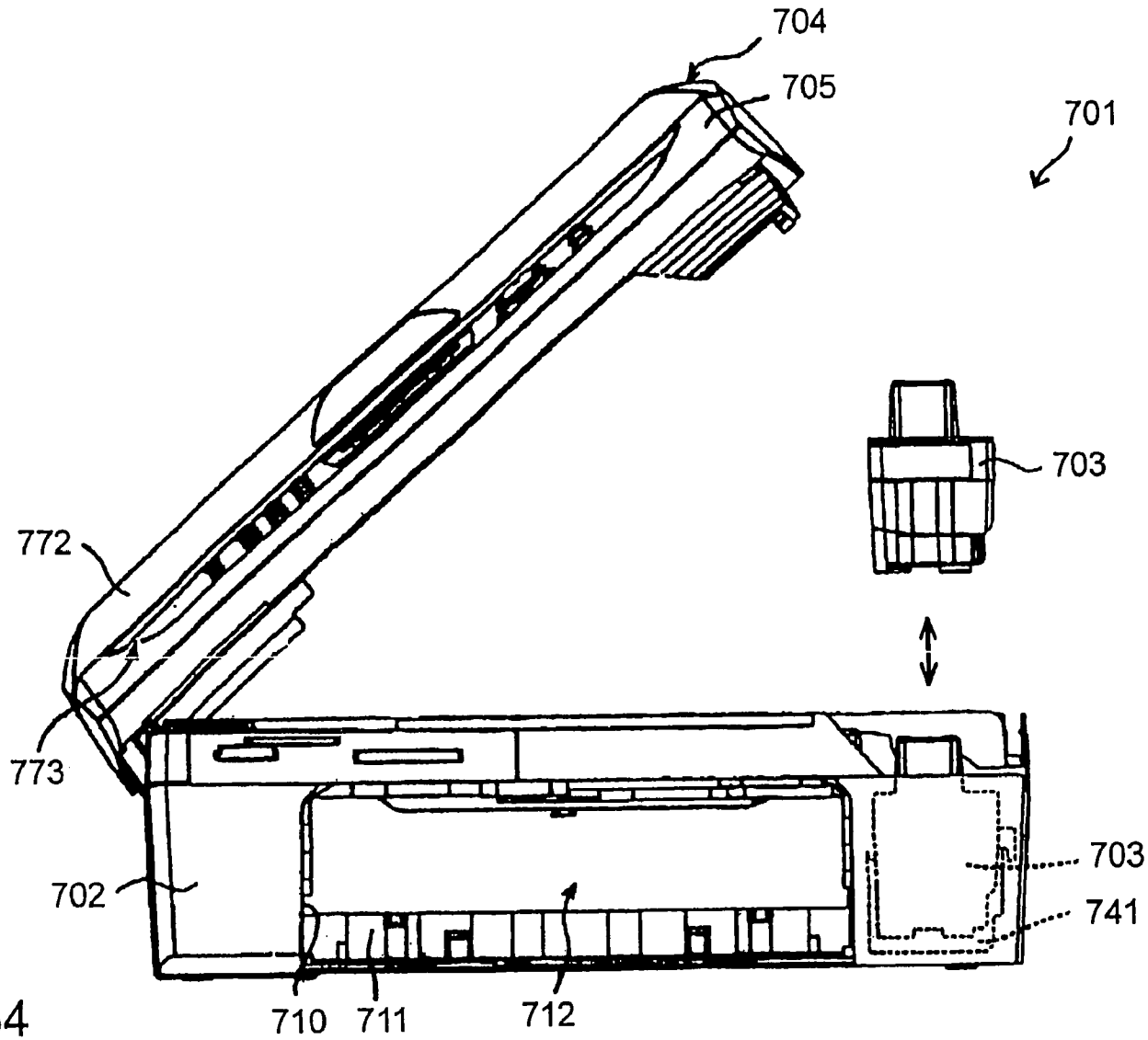
FIG. 54 is a front view of an exemplary multifunction device with cover open and an emplary ink cartridge.
Figure 55:
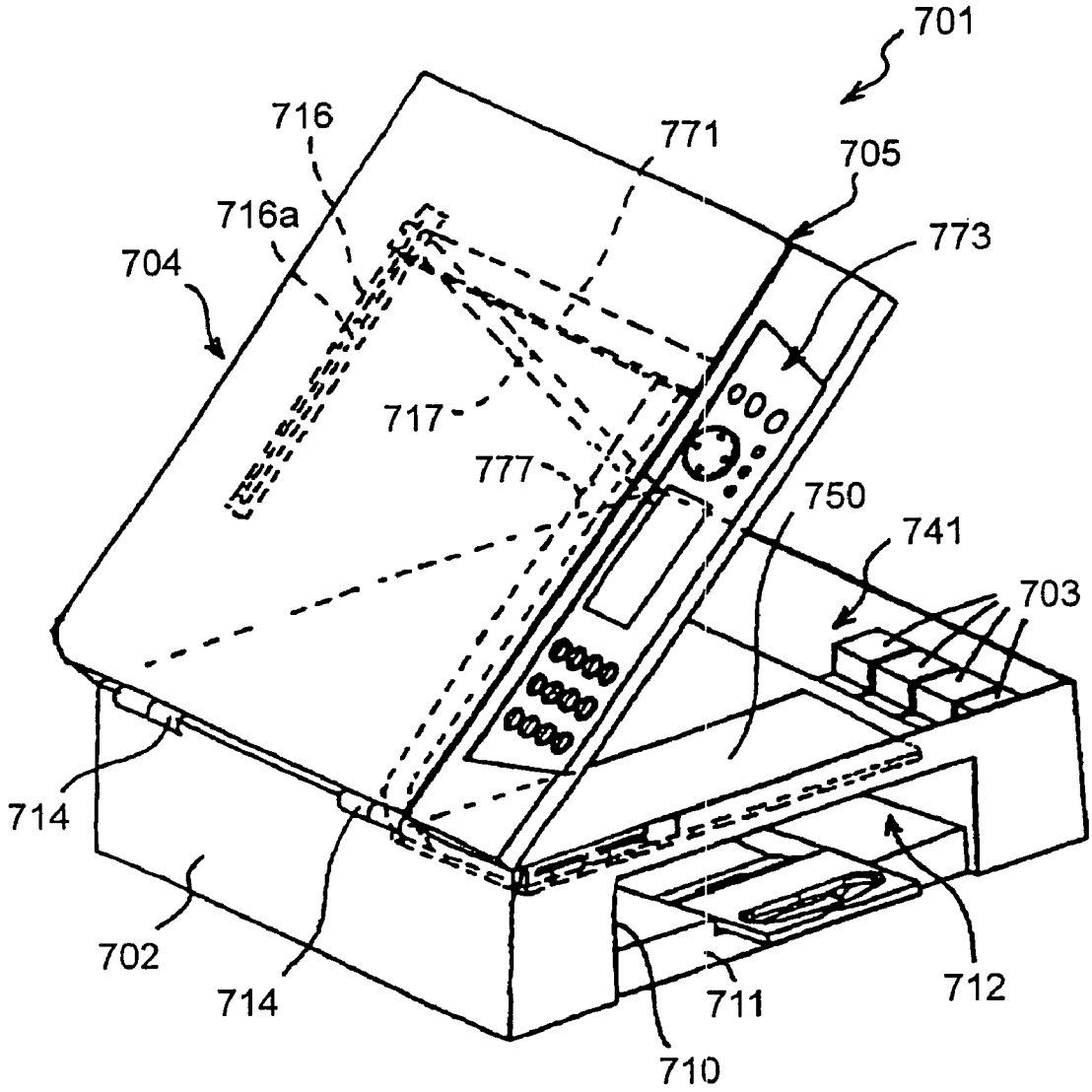
FIG. 55 is a perspective view of an exemplary multifunction device with cover open mounted with exemplary ink cartridges.

As illustrated in FIGS. 54 and 55, four ink cartridges 703, each accommodating one of four colors (e.g., yellow, magenta, cyan and black), are inserted into a cartridge holder 741 in the multifunction device 701 from above and are aligned in the multifunction device 701 in a front-to-rear direction. The ink cartridges 703 are connected to and supply ink to an inkjet head (not shown), e.g., via flexible tubes. While the ink cartridges 703 in this embodiment accommodate the four colors black, cyan, magenta and yellow, the ink cartridges 703, of course, may accommodate ink for more or different colors.

As shown in FIG. 55, the upper frame 705 is pivotably supported on the left edge of the lower frame 706 via shafts 714, such as hinges. In other words, when viewed from the front of the multifunction device 701, the upper frame 705 can pivot open sideways about the side edge opposite the position of the cartridge holder 741. Pivoting the upper frame 705 in this way reliably reveals the top of the cartridge holder 741, enabling ink cartridges 703 to be easily mounted into the cartridge holder 741 from above.

A guide rail 716 extending in the left-to-right direction is fixed to the bottom surface of the upper frame 705 in the rear portion of the upper frame 705. The guide rail 716 is formed with a guide groove 716*a* extending left-to-right. A support rod 717 is pivotably attached to the lower frame 706 so as to be able to pivot about its lower right end. A guide pin 717*a* is provided on the free end of the support rod 717. The guide pin 717*a* is slidably engaged with the guide groove 716*a*. By sliding the guide pin 717*a* in the guide groove 716*a* until the guide pin 717*a* is fitted into an engaging part (not shown) formed in the right end of the guide groove 716*a* (the end opposite the pivotal axis of the upper frame 705, which extends in the front-to-rear direction), the support rod 717 supports the upper frame 705 in an open state. With this construction, the upper frame 705 can be maintained in an open state with respect to the lower frame 706.

The means for holding the upper frame 705 open with respect to the lower frame 706 may include arcuate guard rails disposed near the shafts 714 and guide pins that are guided by these rails. In addition to this, urging means may be provided for urging the upper frame 705 upward in order to maintain the upper frame 705 in the open state.

With this construction, the top surface of the lower frame 706 can be opened wide, improving visibility and facilitating such operations as maintenance of an inkjet head and the like, clearing of paper jams along the conveying path, and replacing the ink cartridges 703.

As shown in FIG. 55, a control panel 773 is disposed in the front area on top of the upper frame 705, and a scanner 704 is disposed in the area behind the control panel 773. The control panel 773 includes various buttons, such as the numerical buttons 0-9, a start button, and function buttons that can be pressed to perform various operations. The control panel 773 may also be provided with a display portion, such as a liquid crystal display, for displaying settings for the multifunctional device 701, messages, or the like according to need. A scanner 704 functions to scan images from a facsimile original to be transmitted to another facsimile device when using the facsimile function, or images of an original to be copied when using the copier function.

As shown in FIG. 55, a flexible wiring member 777, such as a flexible flat cable, connects the scanning unit 771 to the main control board 750. Here, the main control board 750 extends to a point near the pivotal axis of the upper frame 705 (the left edge of the lower frame 706), while the wiring member 777 extends from a portion of the main control board 750 near the pivotal axis of the upper frame to the scanning unit 771.

Figure 56A:
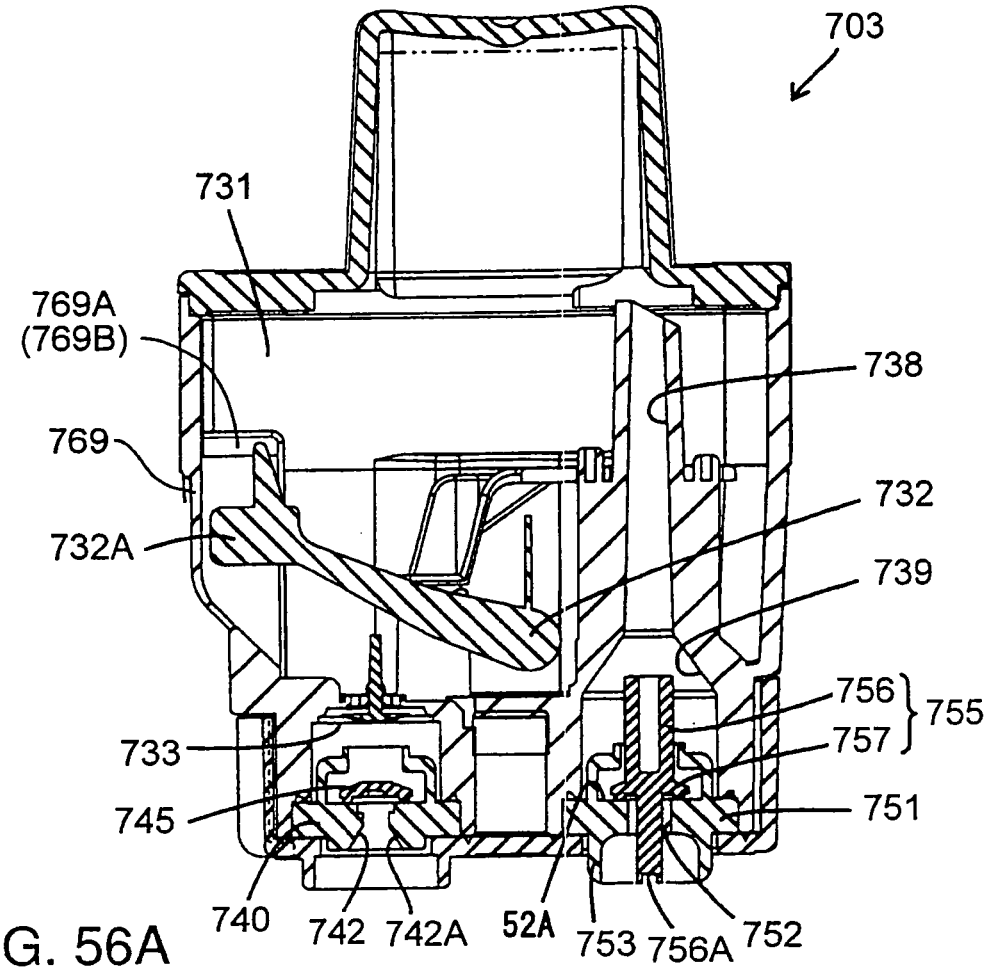
FIG. 56 is a cross-sectional view of an exemplary ink cartridge separated cartridge mounting portion of an exemplary multifunction device.
Figure 56B:
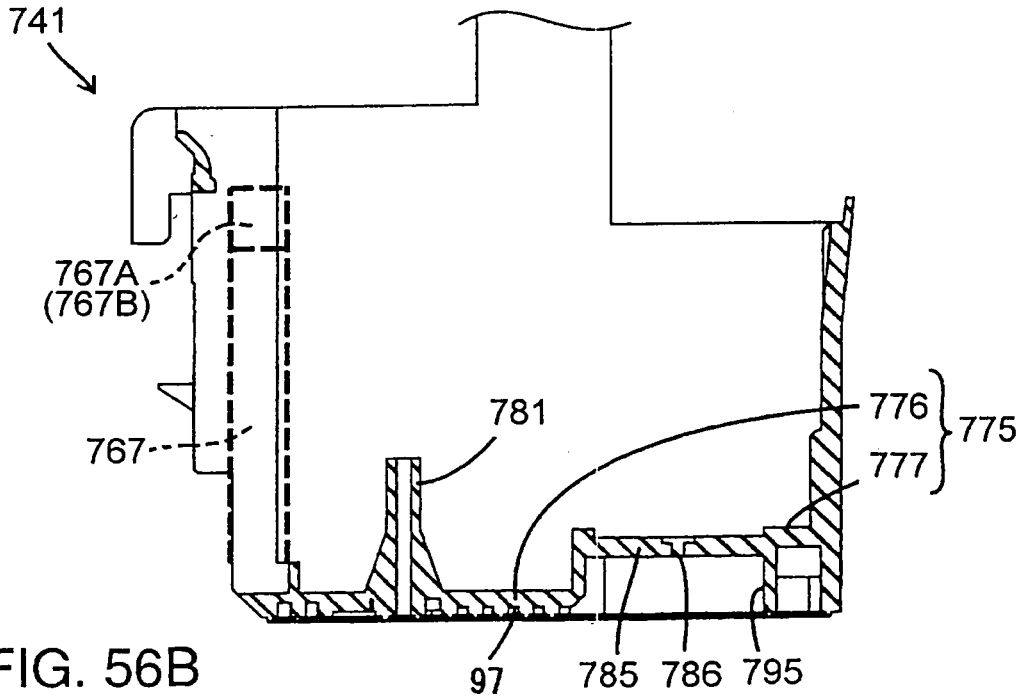

FIG. 56 shows the ink cartridge 703 and the cartridge holder 741 prior to installation of the ink cartridge 703 into the cartridge holder 741 of the multifunction device 701. Various exemplary structural features of the ink cartridge 703 and cartridge holder 741 are shown, though it should be appreciated that a functional combination of ink cartridge 703 and cartridge holder 741 can be achieved with fewer than all of the features depicted in FIG. 56.

The ink cartridge 703 generally includes an ink chamber 731 for storing ink, an ink supply valve assembly 740 through which ink is provided to an inkjet head of the multifunction device 701, and an air intake valve assembly 751 through which atmospheric air is provided to the ink chamber 731. The ink supply valve assembly 740 includes a supply valve seat 742, a supply valve member 745 and a check valve 733. The supply valve seat 742 includes a receiving portion 742A. The air intake valve assembly 751 includes an intake valve seat 752 and an intake valve member 755. The intake valve member 755 includes an intake valve 757, a cylindrical part 756 and an operating member 756A. The intake valve seat 752 further includes a sealing lip 753.

The ink chamber 731 includes an air intake pipe 738 and a shutter mechanism 732. The air intake pipe 738 includes a tapered portion 739, where the air intake valve assembly 751 interfaces with the air intake pipe 738. The shutter mechanism 732 includes a shield plate 732A. Operation of an exemplary shutter mechanism is described above, with reference to FIGS. 44-47. When the ink chamber 731 is at least partially full of ink, the shield plate 732A of the shutter mechanism 732 is positioned in a recess of the ink chamber 731 defined by a protruding portion 769 of the body of the ink cartridge 703. Though partially unviewable in the cross section view of FIGS. 56 and 57, the protruding portion includes opposing protrusion walls 769A and 769B in front and behind the shield plate 732A, as shown in FIGS. 56 and 57.

The cartridge holder 741 includes a bottom wall 775 having a lower portion 776 and an upper portion 777. The lower portion 776 is provided with an ink extraction tube 781. The upper portion 777 is provided with receiving surface 785 and an air aperture 786. The upper portion 777 is situated above an atmospheric air chamber 795. The cartridge holder 741 is further provided with a recess 767, shown in dotted lines in FIGS. 56 and 57 as the defining surfaces of the recess 767 are provided slightly in front and slightly behind the cross section shown in FIGS. 56 and 57. The recess 767 includes a light-emitting section 767A opposed to a light receiving section 767B constituting a sensor. Operation of an exemplary sensor is described above, for example with reference to FIG. 44.

Figure 57:
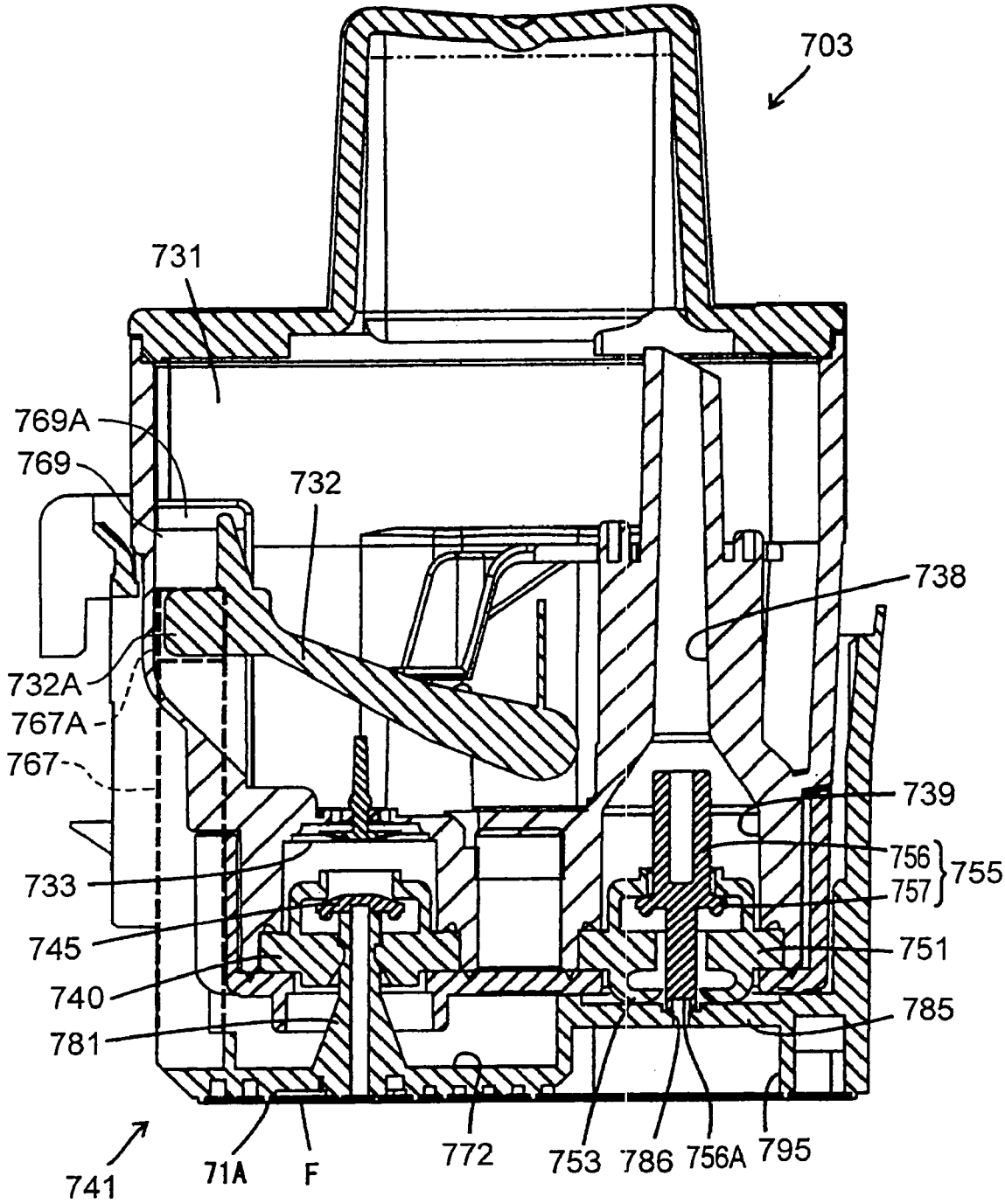
FIG. 57 is a cross-sectional view of an exemplary ink cartridge mounted in a cartridge mounting portion of an exemplary multifunction device.

Engagement of the ink cartridge 703 and cartridge holder 741 is shown in FIG. 57. When the ink cartridge 703 is inserted into the cartridge holder 741, several respective portions of the ink cartridge 703 and the cartridge holder 741 are engaged. As the ink cartridge 703 is pressed into the cartridge holder 741, the ink extraction tube 781 contacts the receiving portion 742A of the supply valve seat 742. This contact causes the supply valve member 745 to open, allowing ink to flow from the ink chamber 731 into the extraction tube 781 and toward an inkjet head. The operating member 756A contacts the air aperture 786, causing the intake valve member 755 to open, allowing atmospheric air to flow from the atmospheric air chamber 795 to the ink chamber 731. Simultaneously, the sealing lip 753 contacts the receiving surface 785, forming a seal around the engaged operating member 756A and air aperture 786. Upon insertion of the ink cartridge 703 into the cartridge holder 741, the protruding portion 769 of the ink cartridge 703 is positioned in the recess 767, such that the light-emitting section 767A and the light receiving section 767B can operate to detect the presence or absence of the shield plate 732A in the protruding portion 769.

It should be appreciated that the ink cartridge 703 can include any type of opening (e.g., in an elastic member) that can sealingly grip the ink extraction tube 781, instead of the more complex ink supply valve member 740, described herein. Moreover, the air intake valve assembly 731 can be replaced by a mere opening in the ink cartridge 703 (e.g., at the top) that permits entry of atmospheric air when ink is discharged. The cartridge holder 741 can further include means for holding the ink cartridge 703 in place. For example, the cartridge holder 741 can include an arm that grips a portion (e.g., an indentation) in a surface, such as the top surface, of the ink cartridge 703.

The presence and position of the protruding portion 769 on the ink cartridge 703 provide several advantages. As the opening (including the ink supply valve assembly 740), through which ink is provided from the cartridge 703 to the multifunction device 701, is situated at one side of the bottom surface of the ink cartridge 703, and the ink extraction tube 781, through which ink is provided to an inkjet head, is provided at one side of the bottom wall 775 the cartridge holder 741, it is essential to operation of the multifunction device 701 that the ink cartridge 701 be installed so that the ink supply valve assembly 740 opposes the ink extraction tube 781. The engagement of the protruding portion 769 with the recess 767 prevents improper installation because the protruding portion 769 cannot be inserted into the cartridge holder 741 unless the protruding portion 769 is in a position corresponding to the recess 767. A similar benefit is achieved with respect to the correspondence between the protrusion portion 372 and the infrared light emitting portion 172 in the embodiment shown, for example, in FIG. 35.

Further, because upon engagement of the ink cartridge 703 and cartridge holder 741, the protruding portion 769 of the ink cartridge 703 is positioned in the recess 767, such that the light-emitting section 767A and the light receiving section 767B operate to detect the presence or absence of the shield plate 732A in the protruding portion 769, it is possible to manufacture a multifunction device 701 of slimmer profile. That is, if the light-emitting section 767A and the light receiving section 767B could not be positioned in opposition on opposite sides of the protruding portion 769, those parts would have to be positioned on opposite sides of the ink cartridge 703. Such positioning would require greater space for each ink cartridge 703 in the multifunction device 701, and further would prevent the positioning of multiple ink cartridges 703 in close proximity. Each of these considerations would prohibit design of a compact multifunction device 701.

It is preferable that the ink cartridge 703 include a shutter mechanism 732 having a shield plate 732A that is positioned in a recess of the ink chamber 731 defined by protruding portion 769 of the ink cartridge 703 when the ink chamber 731 is at least partially full of ink. Such an arrangement allows operation of the sensor (the light-emitting section 767A and the light receiving section 767B) to ensure that ink is present in the ink cartridge 703 for printing. However, for certain reasons (e.g., cost, ease of manufacture, etc.) it may be desirable to manufacture an ink cartridge that does not include a shutter mechanism.

The shutter mechanism 732 in the cartridge 703 shown, for example, in FIGS. 56 and 57, is effective because the shield plate 732A, when positioned in the protruding portion 769, prevents light emitted by the light-emitting section 767A from being detected by the light receiving section 767B. It is possible, however, to alter the ink cartridge 703 so that the cartridge does not include a shutter mechanism 732, but light emitted by the light emitting section 767A is prevented from being detected by the light receiving section 767B.

FIG. 58 shows several cartridge designs including portions that are capable of at least partially preventing light from passing therethrough. Ink cartridges including such "light blocking" portions can be used in image forming devices such as the image forming devices described above. In particular, such ink cartridges may be used in image forming devices having sensors for detecting one or more attributes of the ink cartridge (e.g., presence, ink level, ink color, etc.). An exemplary sensor, including a light emitting section 767A and a light receiving section 767B is described above with respect to, for example, FIG. 56. The "light blocking" portions described below, when situated in an image forming device between a light emitting section of a sensor and a light receiving section of a sensor, at least partially prevent light emitted by the light emitting section from reaching the light receiving section.

Figure 58C:
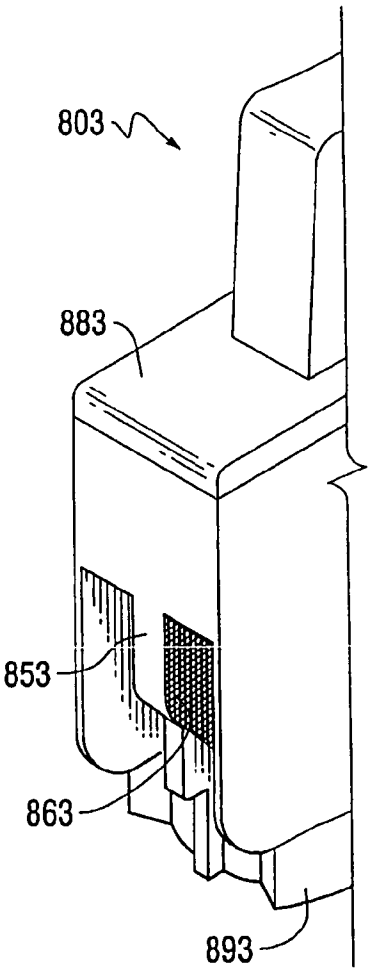
FIGS. 58B and 58C are partial perspective views of exemplary ink cartridges.
Figure 58B:
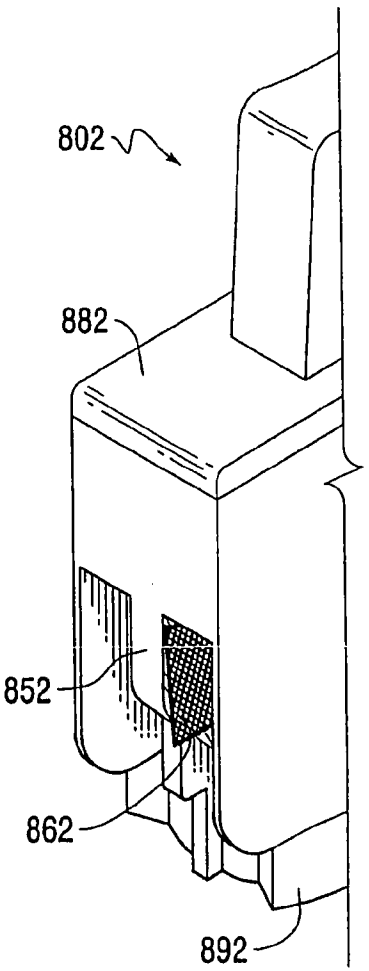
Figure 58A:
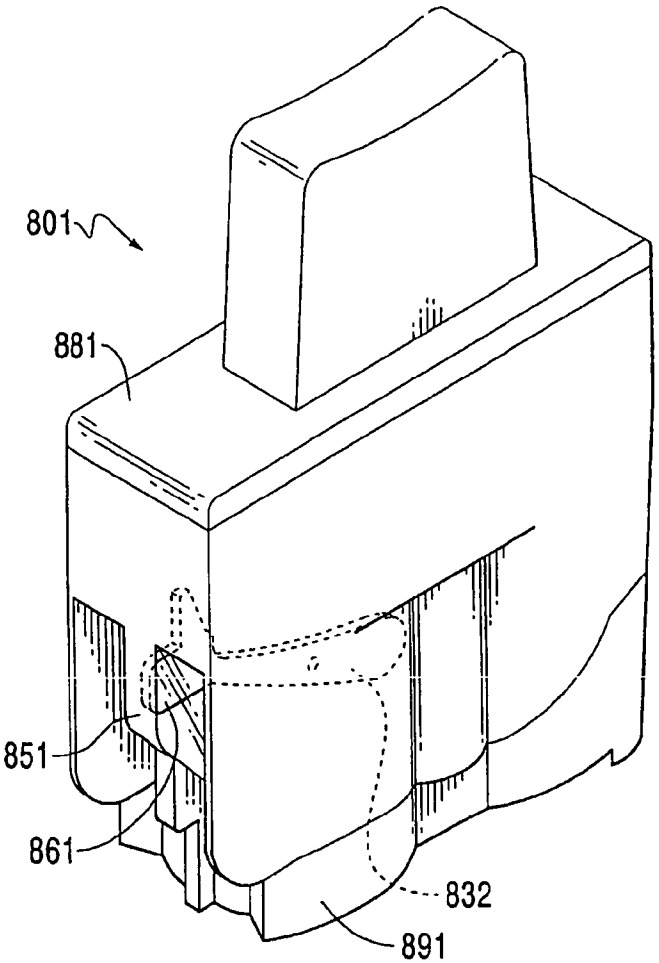
FIGS. 58A is a perspective view of an exemplary ink cartridge.

In FIG. 58A, an ink cartridge 801 having a top cover 881 and a bottom cover 891 is provided with a shutter mechanism 832 having a shield plate 861. The cartridge further includes a protruding portion 851 formed of a material that is transmissive of light. The shield plate 861 is not transmissive of light and, though movable, is positioned inside of the protruding portion 851. Accordingly, if the ink cartridge 801 is installed in an image forming device including a sensor having a light emitting section and a light receiving section so that the protruding portion 851 is situated between the light emitting section and the light receiving section, light emitted by the light emitting section directed toward the light receiving section will be blocked by the shield plate 861, and thus will not received by the light receiving section. The configuration shown in FIG. 58A is preferred, and corresponds to the configuration shown, for example, in FIGS. 56 and 57.

In FIG. 58B, an ink cartridge 802 having a top cover 882 and a bottom cover 892 is provided with a protruding portion 852 including a light-blocking member 862 on an exterior surface of the protruding portion 852. The light-blocking member 862 is positioned on the protruding portion 852 so that, when the ink cartridge 802 is installed in an image forming device including a sensor having a light emitting section and a light receiving section so that the protruding portion 852 is situated between the light emitting section and the light receiving section, light emitted by the light emitting section directed toward the light receiving section is blocked by the light-blocking member 862. The form of the light-blocking member 862 is not particularly limited. For example, the light blocking member 862 can be a sticker formed of a light-blocking material that is adhered to the protruding portion 852. Such a sticker could be affixed to one or more sides of the protruding portion 852, so long as it is positioned in a manner that will prevent light emitted by a light emitting section from reaching a light receiving section when the ink cartridge 802 is installed in an image forming device including such features. The light-blocking member 862 should be of a profile, however, that does not obstruct insertion of the ink cartridge 802 into a cartridge holder of an image forming device.

In FIG. 58C, an ink cartridge 803 having a top cover 883 and a bottom cover 893 is provided with a protruding portion 853 having an integral light-blocking portion 863. The light-blocking portion 863 is a contiguous part of the protruding portion 853 that has light-blocking properties. For example, at least a portion of the protruding portion 853 can be formed of a light-blocking resin, that part being the light-blocking portion 863. The material forming the light-blocking portion 863 is not particularly limited, so long as the material can at least partially block light. The light-blocking portion 863 should be positioned, however, in a manner that, when the ink cartridge 803 is installed in an image forming device including a sensor having a light emitting section and a light receiving section so that the protruding portion 853 is situated between the light emitting section and the light receiving section, light emitted by the light emitting section directed toward the light receiving section is blocked by the light-blocking portion 863. In alternative embodiments, the entire protruding portion 853 or the entire cartridge 803 can constitute the light-blocking portion 863—that is, some or all of the cartridge 803 can be formed of a material that at least partially prevents transmission of light.

Figure 58E:
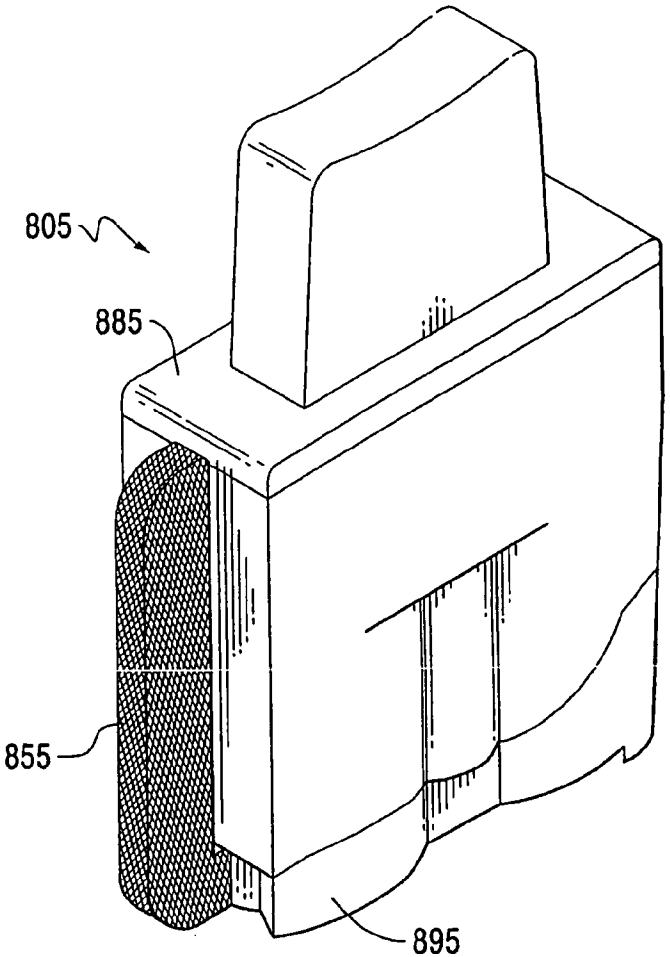
FIGS. 58D and 58E are perspective views of exemplary ink cartridges.
Figure 58D:
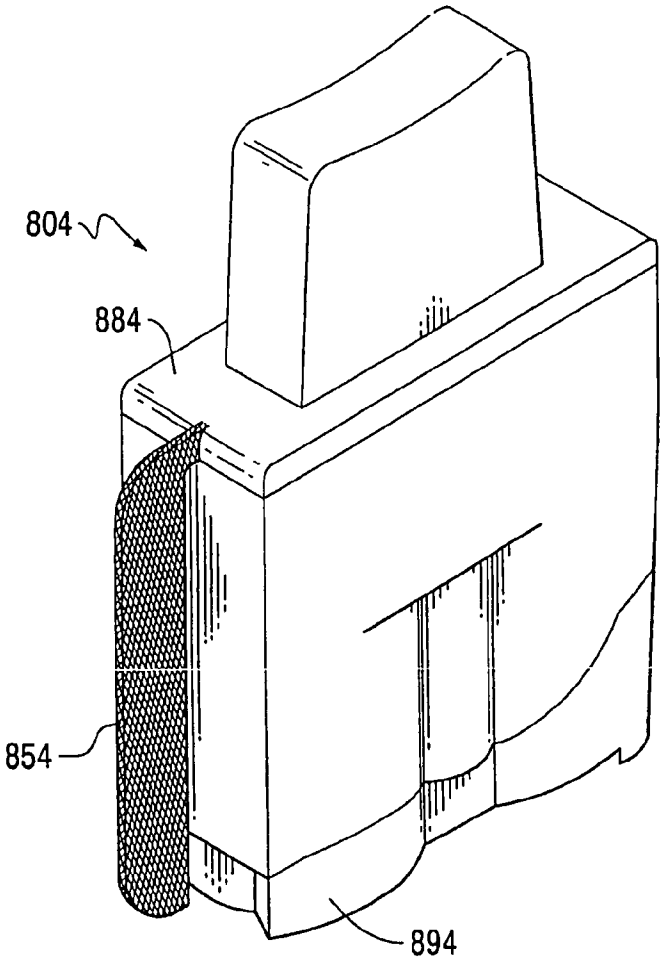

An ink cartridge need not include a protruding portion shaped or configured as shown in FIGS. 58A-58C, so long as at least some light-blocking feature extends from the cartridge into a position that will prevent light emitted by a light emitting section from reaching a light receiving section, when the ink cartridge is installed in an image forming device including such features. FIGS. 58D and 58E show ink cartridges that do not include protruding portions of the type shown in FIGS. 58A-58C. In FIG. 58D, an ink cartridge 804 having a top cover 884 and a bottom cover 894 is provided with a light-blocking protrusion 854 that extends from the top cover 884. The light-blocking protrusion 854 extends from the top cover 884 in a configuration, so that when the ink cartridge 804 is installed in an image forming device including a sensor having a light emitting section and a light receiving section so that the light blocking protrusion 854 is situated between the light emitting section and the light receiving section, light emitted by the light emitting section directed toward the light receiving section is blocked by the light-blocking protrusion 854. In FIG. 58E, an ink cartridge 805 having a top cover 885 and a bottom cover 895 is provided with a light-blocking protrusion 855 that extends from the bottom cover 895. As with the light-blocking protrusion 854 in FIG. 58D, the light-blocking protrusion 855 of FIG. 58E extends from the bottom cover 895 in a configuration, so that when the ink cartridge 805 is installed in an image forming device including a sensor having a light emitting section and a light receiving section so that the light blocking protrusion 855 is situated between the light emitting section and the light receiving section, light emitted by the light emitting section directed toward the light receiving section is blocked by the light-blocking protrusion 855.

The light-blocking protrusion 854 in FIG. 58D is substantially planar—that is, it has a slim profile. By contrast, the light-blocking protrusion 855 in FIG. 58E has a thicker profile, similar in width to the protruding portions 851, 852, 853 shown in FIGS. 58A-58C. It should be appreciated that the light-blocking protrusions 854 and 855 can have any suitable size or configuration, so long as at least a part of each of the light-blocking protrusions 854 and 855 is positioned between a light emitting section and a light receiving section of an image forming device, when the ink cartridges 804, 805, respectively, are installed in an image forming device including such features. Moreover, in the embodiments shown in FIGS. 58A-58E, the light blocking means are provided as a contiguous part of an ink cartridge. It should be appreciated that an ink cartridge can be provided with a separate piece or pieces that function as light blocking means. The light blocking means shown in FIGS. 58A-58E appear as solid, apparently rigid members. It is also possible that light blocking means could be provided that are flexible and/or an assembly of a plurality of elements.

Figure 59:
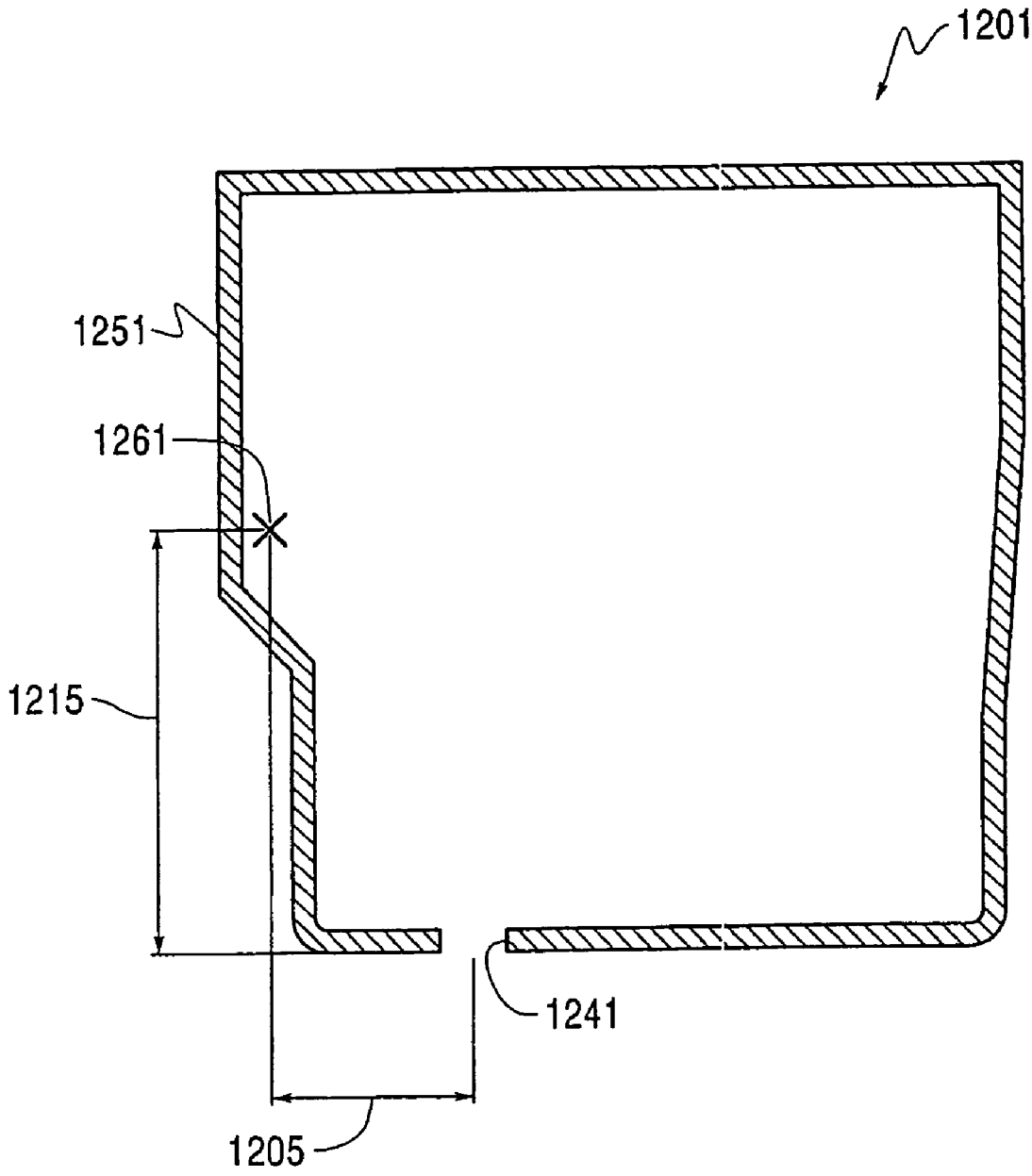
FIG. 59 is a cross-sectional view of an exemplary ink cartridge showing a distance relation between a light-blocking portion and an ink supply opening.

As discussed above, the location of light-blocking means, such as shown in FIG. 58, must be positioned so that the light-blocking means prevent light emitted by a light emitting section from reaching a light receiving section. FIG. 59 illustrates this position with reference to the position at which ink is dispensed from a cartridge. FIG. 59 shows an ink cartridge 1201 including an ink supply opening 1241 and a protruding portion 1251. A light-blocking portion 1261 is provided on or in the protruding portion 1251 in a position that prevents light emitted by a light emitting section from reaching a light receiving section. The protruding portion 1251 and the light-blocking portion 1261 can be in any suitable configuration, such as for example, any of the configurations shown in FIG. 58. A lateral distance 1205 between the ink supply opening 1241 and the light-blocking mechanism 1261 is fixed, because the locations of sensors and ink interfaces in image forming devices are fixed. The lateral distance 1205 can be from about 10.2 mm to about 13.2 mm, from about 11.2 to about 12.2 mm, about 11.7 mm, or 11.7 mm. The ranges and specific values provided for the lateral distance 1205 are particularly desirable because they allow for compact design of both the ink cartridge 1201 and the printer or multifunction device in which the ink cartridge 1201 is employed. The vertical distance 1215 can be from about 23.7 mm to about 26.7 mm, from about 24.7 mm to about 25.7 mm, about 25.2 mm or 25.2 mm.

It should be appreciated that many of the features shown in FIGS. 58 and 59 are equally applicable to cartridges of different design. These configurations can be applied, for example, to cartridges, such as shown in FIGS. 12, 13, 39A, 40A, 40B, etc. Also, while this invention contemplates the use of configurations as shown in FIG. 58 and 59, several of these configurations undermine the various purposes of the ink detection systems described herein by preventing light emitted by a light emitting section of a sensor from reaching a light receiving section of the sensor without regard for the state of the cartridge (e.g., ink level), so manual monitoring of state (e.g., ink level) is necessary when using such configurations. For example, if an empty cartridge (a cartridge with little or no ink) including the light-blocking means shown in FIGS. 58B-58E is used in a printer or multifunction device with an ink detection sensor, operation could result in introduction of air into a printhead, temporarily or permanently stopping function of the printer or multifunction device.

Figure 60:
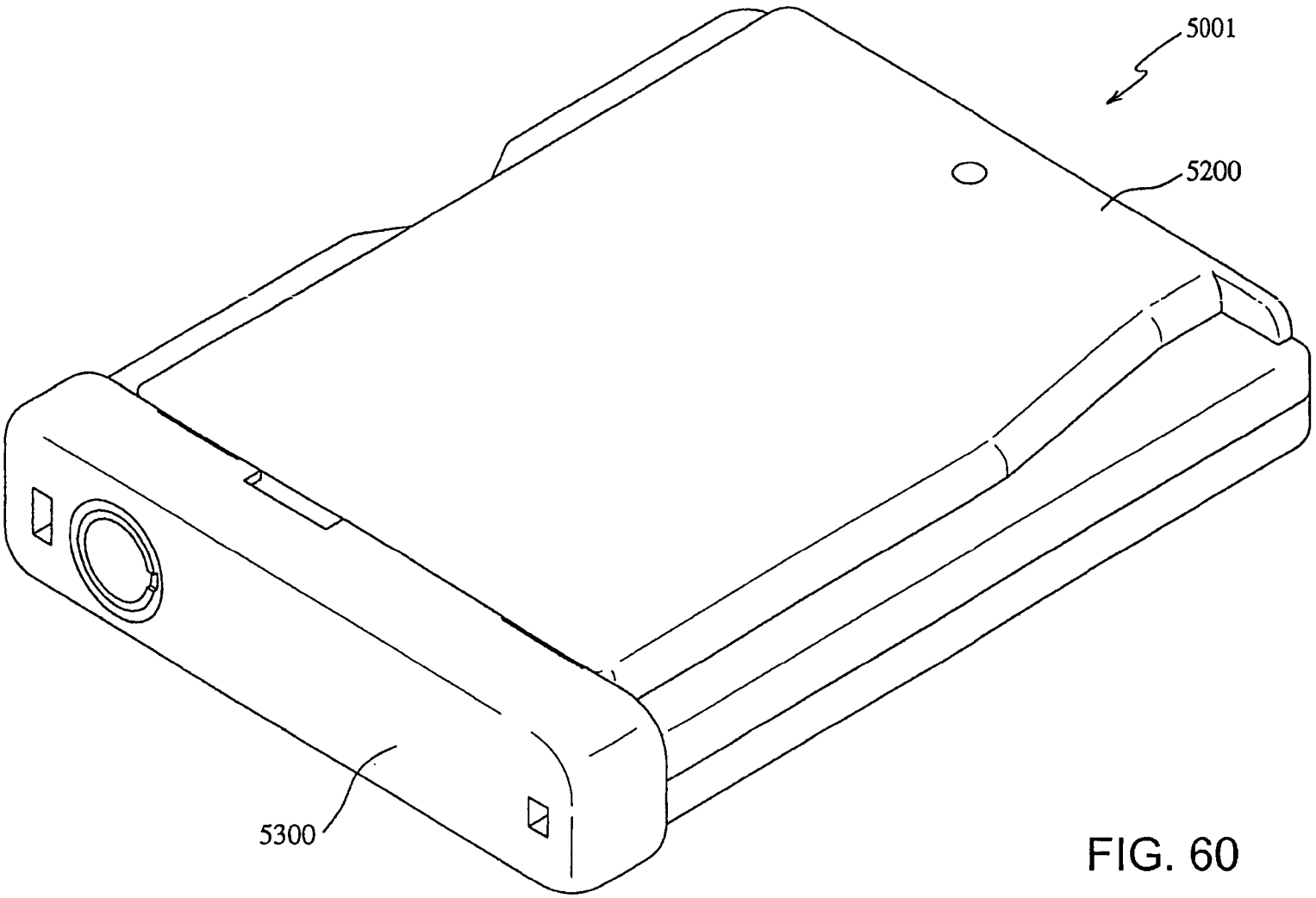
FIG. 60 is a perspective view of an exemplary ink cartridge according to the present invention.
Figure 64:
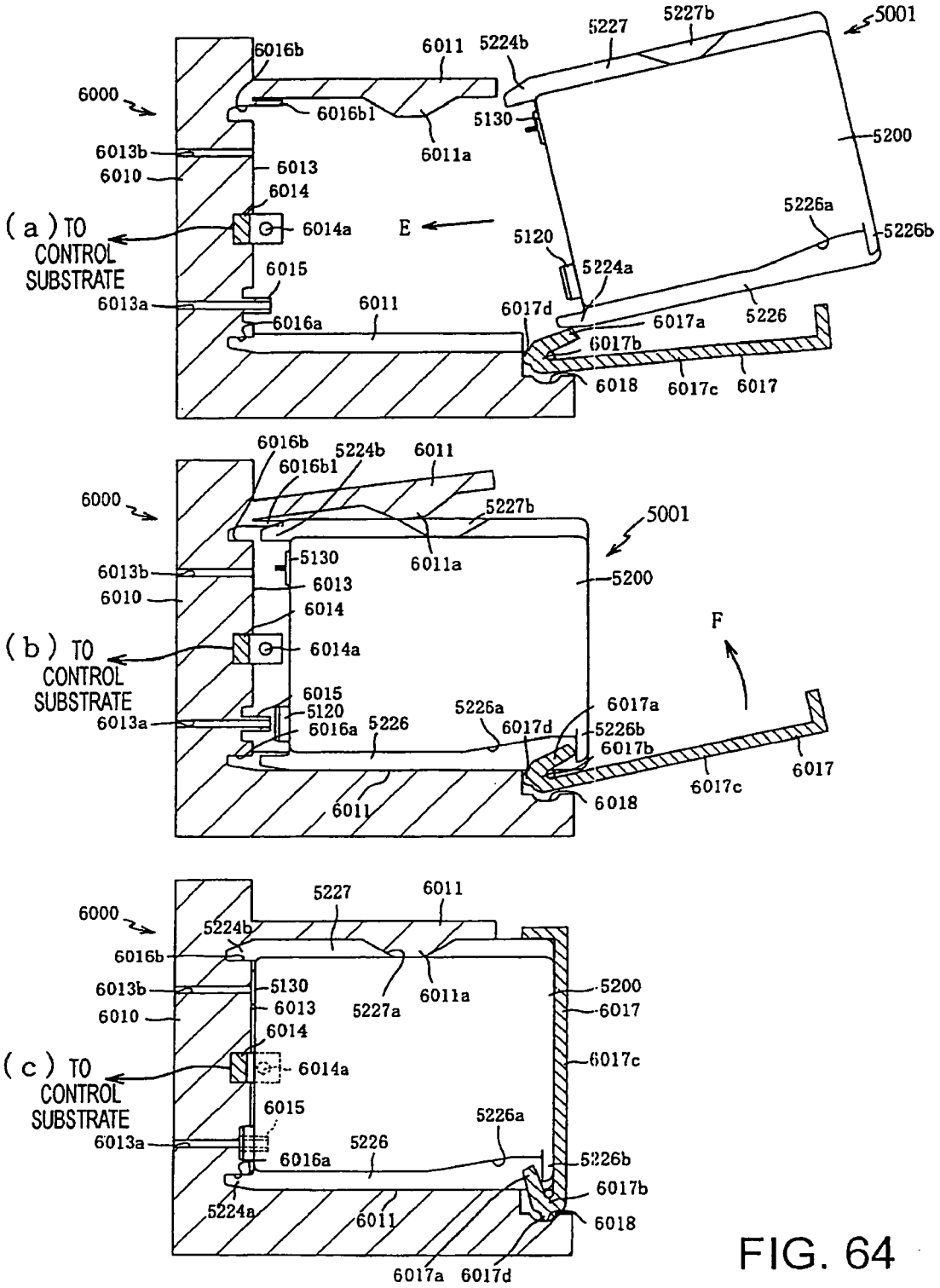
FIG. 64(*a*) is a cross sectional view of an exemplary ink cartridge and an exemplary inkjet printer according to the present invention prior to mounting of the ink cartridge.

FIG. 60 is a perspective view of an exemplary ink cartridge 5001 according to the present invention for supplying ink to an inkjet printer 6000 (see FIG. 64). As shown in FIG. 60, the ink cartridge 5001 is provided with a case 5200 and a cap 5300, which enclose a frame 5100 (see FIG. 61). The case 5200 and the cap 5300 form a casing of the ink cartridge 5001.

Figure 61:
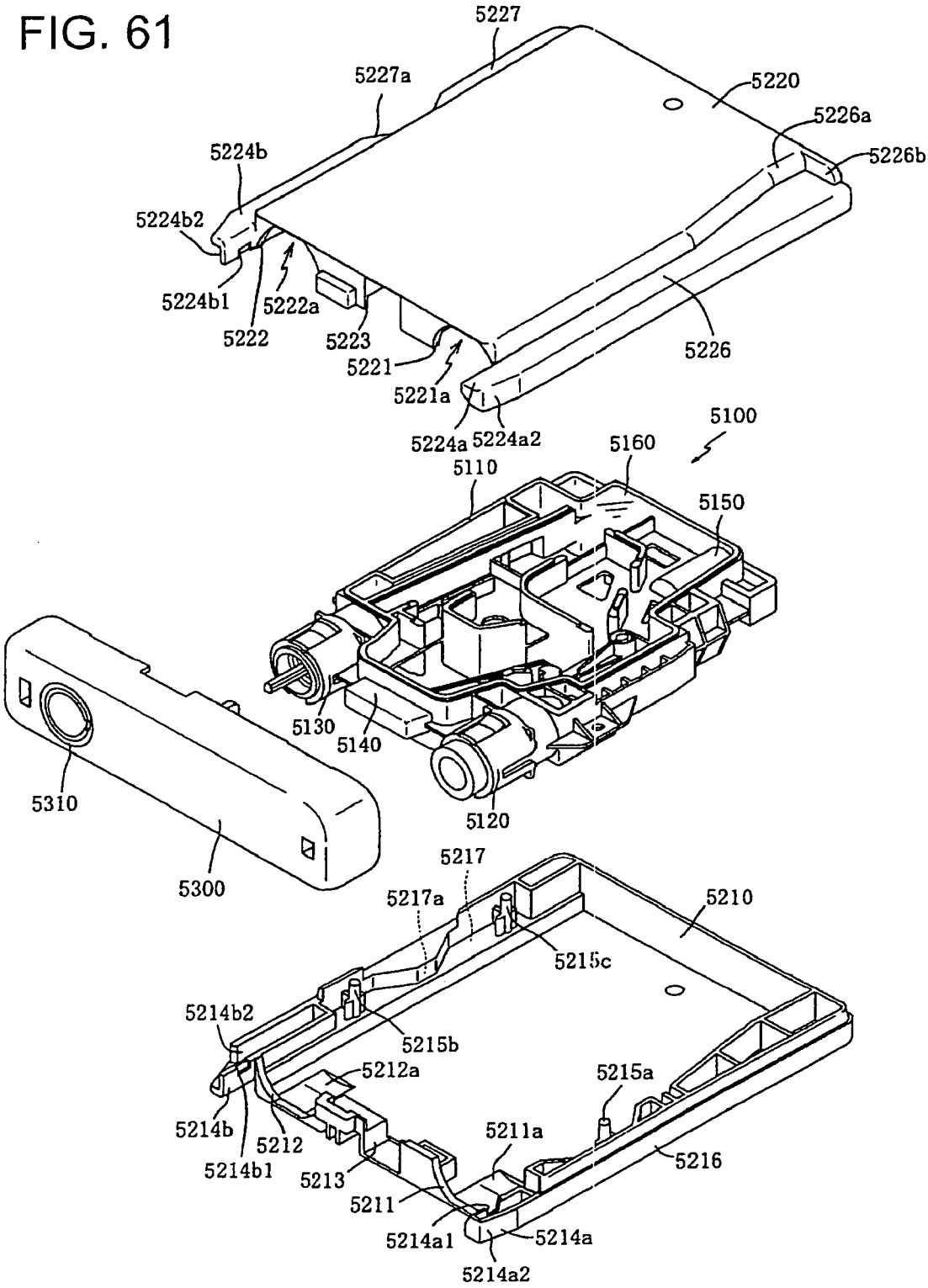
FIG. 61 is a perspective view of an exemplary ink cartridge according to the present invention in a disassembled state.

FIG. 61 is a perspective view of the ink cartridge 5001 in a disassembled state showing the case 5200 the cap 5300 and the frame 5100. As shown in FIG. 61, the case 5200 includes a front case portion 5220 and a rear case portion 5210. The front case portion 5220 and the rear case portion 5210, when assembled, enclose the frame 5100. When the ink cartridge 5001 is assembled, the cap 5300 covers one end of the assembled front case portion 5220 and rear case portion 5210.

The frame 5100 includes a frame body 5110, an ink supply port 5120, an air intake port 5130, an ink detection projection 5140, an ink filling chamber 5150 and a film 5160. The film 5160 is adhered to upper edges of sidewalls of the frame body 5110 so that, together, the film 5160 and the frame sidewalls enclose an ink storage space. The ink supply port 5120 is configured to permit supply of ink from the ink cartridge 5001 to the inkjet printer 6000 via an ink supply valve mechanism provided in the ink supply port 5120. The air intake port 5130 is configured to permit air to enter from an exterior of the ink cartridge 5001 into the ink storage space via an air intake valve mechanism provided in the air intake port 5130, as ink is discharged from the ink cartridge 5001 via the ink supply port 5120. The ink detection projection 5140 is configured so as to communicate with a detection device 6014 (see FIG. 64) when the ink cartridge 5001 is installed in the inkjet printer 6000, so that the presence, absence and/or amount of ink in the ink storage space can be detected by the inkjet printer 6000. The ink filling chamber 5150 is configured to permit introduction of ink into the ink storage space of the ink cartridge 5001.

As indicated above, the case 5200 includes a front case portion 5220 and a rear case portion 5210. The front case portion 5220 and the rear case portion 5210 include various features for accommodating the frame 5100 and permitting communication between the frame 5100 and the exterior of the ink cartridge 5001 when the front case portion 5220 and the rear case portion 5210 are assembled. A front supply aperture portion 5221 of the front case portion 5220 and a rear supply aperture portion 5211 of the rear case portion 5210 form a supply aperture 5221*a* through which the ink supply port 5120 communicates with the exterior of the ink cartridge 5001. The rear case portion 5210 also includes an ink supply port seat 5211*a* for receiving the ink supply port 5120. A front air intake aperture portion 5222 of the front case portion 5220 and a rear air intake aperture portion 5212 of the rear case portion 5210 form an air intake aperture 5222*a* through which the air intake port 5130 communicates with the exterior of the ink cartridge 5001. The rear case portion 5210 also includes an air intake port seat 5212*a* for receiving the air intake port 5130. A front ink detector aperture portion 5223 of the front case portion 5220 and a rear ink detector aperture portion 5213 of the rear case portion 5210 form an accommodating space through which the ink detection projection 5140 can communicate with the detection device 6014.

A front supply side projection portion 5224*a* and a corresponding structure 5214*a*2 on the rear case portion 5210 form a supply side projection for positioning the ink cartridge 5001 with respect to the inkjet printer 6000 and for positioning the case 5200 with respect to the cap 5300. Likewise, a front intake side projection portion 5224*b* and a rear intake side projection portion 5214*b* form an intake side projection for positioning the ink cartridge 5001 with respect to the inkjet printer 6000 and for positioning the case 5200 with respect to the cap 5300. The front supply side projection portion 5224*a* includes a front supply side projection outer surface 5224*a*2 for positioning the ink cartridge 5001 with respect to the inkjet printer 6000. The rear supply side projection portion 5214*a* includes a rear supply side projection outer surface 5214*a*2 for positioning the ink cartridge 5001 with respect to the inkjet printer 6000 and a rear supply side projection aperture 5214*a*1 for positioning the case 5200 with respect to the cap 5300. The front intake side projection portion 5224*b* includes a front intake side projection receiving portion 5224*b*2 for positioning the ink cartridge 5001 with respect to the inkjet printer 6000 and a front intake side projection aperture 5224*b*1 for positioning the case 5200 with respect to the cap 5300. The rear intake side projection portion 5214*b* includes a rear intake side projection receiving portion 5214*b*2 for positioning the ink cartridge 5001 with respect to the inkjet printer 6000 and a rear intake side projection aperture 5214*b*1 for positioning the case 5200 with respect to the cap 5300.

The rear case portion 5210 further includes positioning pins 5215*a*, 5215*b*, 5215*c* for positioning the frame 5100. When the ink cartridge 5001 is assembled, the positioning pins 5215*a*, 5215*b*, 5215*c* communicate with respective positioning apertures of the frame 5100.

The front case portion 5220 includes a front supply side outer surface 5226 and the rear case portion 5210 includes a rear supply side outer surface 5216. The front supply side outer surface 5226 and the rear supply side outer surface 5216 assist in positioning the ink cartridge 5001 during mounting of the ink cartridge 5001 to the inkjet printer 6000.

The front case portion 5220 includes a front intake side outer surface 5227 and the rear case portion 5210 includes a rear intake side inner surface 5217. The front intake side outer surface 5227 and the rear intake side inner surface 5217 assist in positioning the ink cartridge 5001 during mounting of the ink cartridge 5001 to the inkjet printer 6000. The front intake side outer surface 5227 includes an intake side inclined outer surface 5227*a* and the rear intake side inner surface 5217 includes an intake side inclined inner surface 5217*a*, which, in cooperation, guide the ink cartridge 5001 during installation and prevent the ink cartridge 5001 from being pressed too deeply into the inkjet printer 6000.

The cap 5300, as discussed above, along with the assembled front case portion 5220 and rear case portion 5210, enclose the frame 5100. The cap 5300 includes an air intake structure 5310 for accommodating a protruding portion of the air intake port 5130 of the frame 5100.

Figure 62:
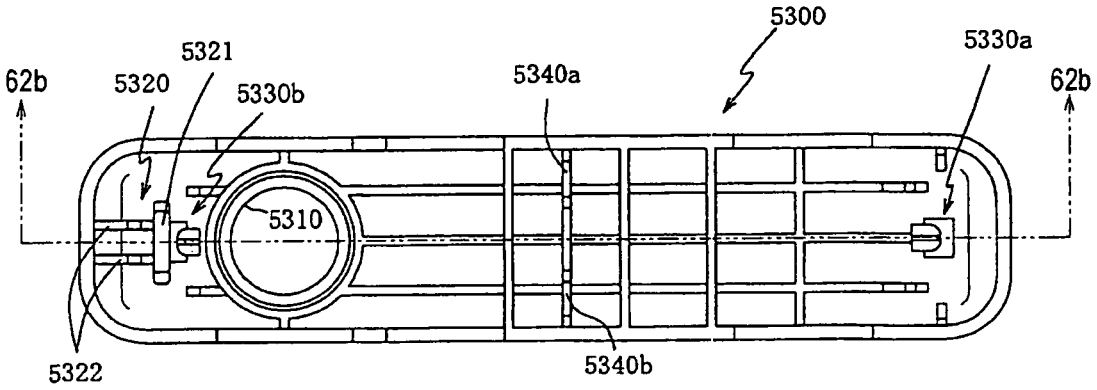
FIG. 62(*a*) is a top view of a cap of an exemplary ink cartridge according to the present invention.
Figure 62:
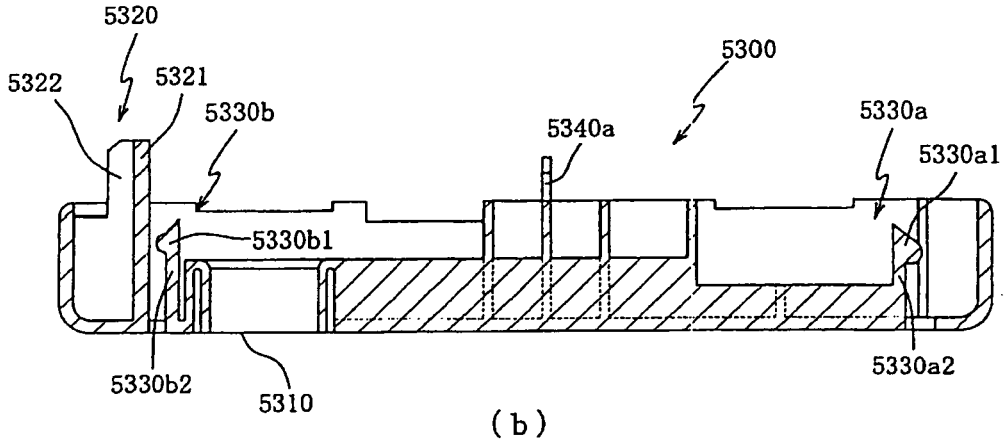

FIG. 62 shows the cap 5300. FIG. 62(*a*) is a top view of the cap, and FIG. 62(*b*) is a cross sectional view of the cap. As discussed above, the cap 5300 includes an air intake structure 5310, which is positioned opposite from an air intake valve mechanism when the ink structure 5001 is assembled. FIGS. 62(*a*) and (*b*) show, in particular, internal structures of the cap 5300 that are used to fix the cap 5300 to the case 5200. The cap includes edge walls 5322 which define a space for receiving the intake side projection of the case 5200 when the cap 5300 is placed on the case 5200. The cap 5300 also includes engaging projections 5300*a*, 5330*b* for engaging with the projection apertures on the case 5200. Each of the engaging projections 5330*a*, 5330*b* includes an extension member 5330*a*2, 5330*b*2 which extends from the inner surface of the cap 5300 and an engaging tab 5330*a*1, 5330*b*1 provided on the end of the extension member 5330*a*2, 5330*b*2. The inner surface also includes positioning walls 5340*a*, 5340*b* that are located on either side of the ink detection projection 5140 when the ink cartridge 5001 is assembled.

Figure 63:
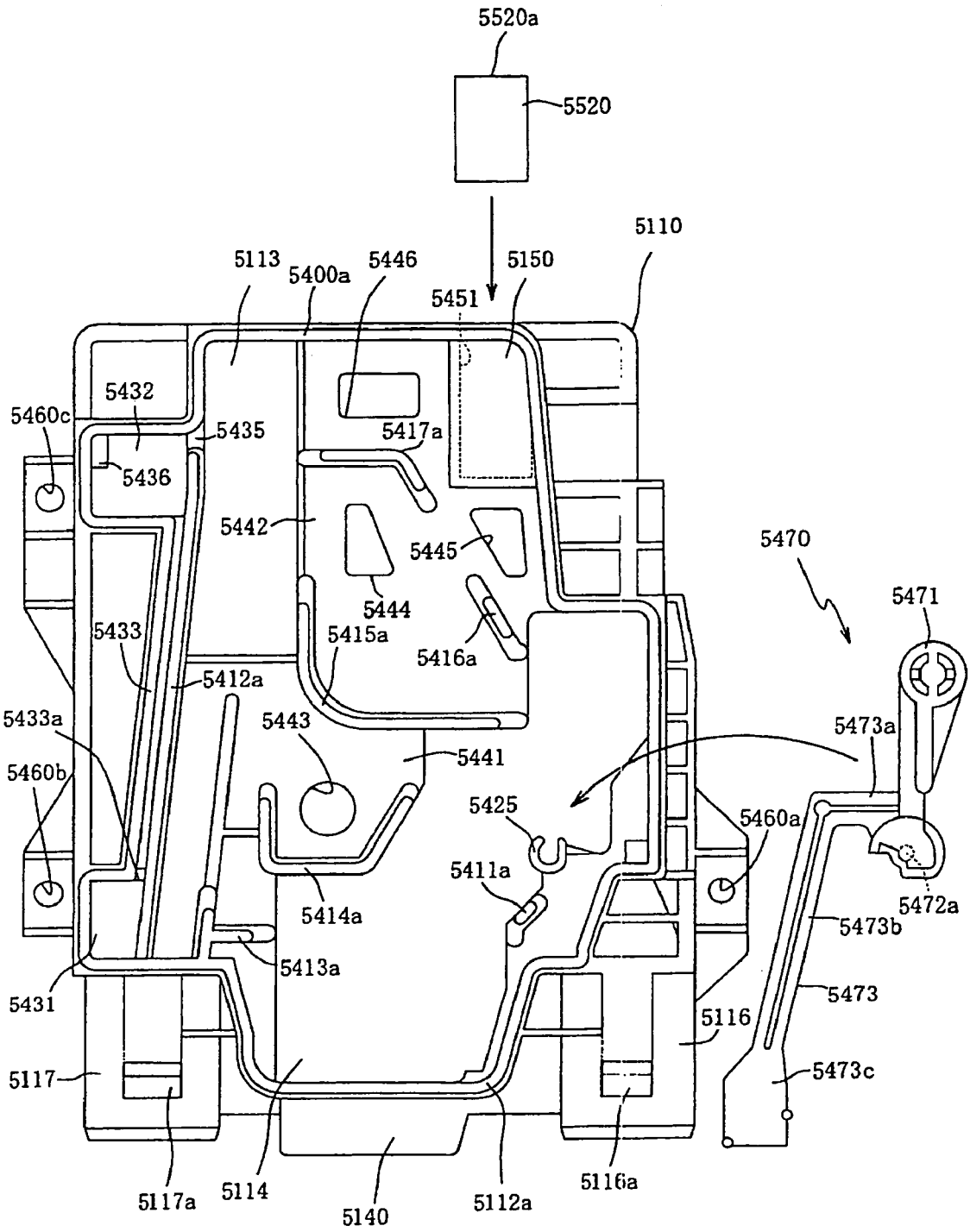
FIG. 63 is a front view of a disassembled frame of an exemplary ink cartridge according to the present invention.

FIG. 63 is a front view of the frame body 5110 disassembled to show its various structures. As can be seen in FIG. 63, the frame body 5110 includes an ink supply chamber 5116 forming the ink supply port 5120 and accommodating the ink supply valve mechanism, and an air intake chamber 5117 forming the air intake port 5130 and accommodating the air intake valve mechanism. In addition, the frame body 5110 includes an ink filling chamber 5150, a detector 5470, and an ink storage space defined by various structures discussed below.

The ink supply chamber 5116 is provided with an ink supply valve fastening rib, 5116*a*, and the air intake chamber 5117 is provided with an air intake valve fastening rib 5117*a*. The ink supply valve fastening rib 5116*a* and the air intake valve fastening rib 5117*a* are used to secure an ink supply valve mechanism and an air intake valve mechanism to the frame body 5110.

The frame body 5110 includes an ink storage space bounded by sidewalls 5400*a* that extend perpendicularly with respect to the plane of FIG. 63. The sidewalls 5400*a* are provided with film contact surfaces (outer film contact surface 5112*a* and inner film contact surfaces 5411*a*, 5412*a*, 5413*a*, 5414*a*, 5415*a*, 5416*a*, 5417*a*). The film 5160 is adhered to the frame body 5110 at the film contact surfaces. The film 5160 and the sidewalls 5400*a* enclose the ink storage space.

Structures similar to the structures shown in FIG. 63 are provided on the rear side of the body 5110 (not shown in FIG. 63). The front and rear sides of the frame body 5100 are separated by partition walls, including a lower central partition wall 5441 and an upper central partition wall 5442. Ink and/or air are permitted to pass through the partition walls to occupy ink storage spaces on both the front and rear sides of the frame body 5110. Such passage is made possible by a lower air intake aperture 5433*a*, an upper air intake through hole 5436 and partition through holes 5443, 5444, 5445, 5446. Also, open areas 5113 and 5114 permit passage between front and rear sides of the frame body 5110.

The frame body 5110 includes an air intake structure to prevent outflow of ink through the air intake chamber 5117 and to ensure controlled introduction of air into the ink storage space. After air enters the frame body 5110 through the air intake chamber 5117, the air enters the lower air intake chamber 5431. The air then passes through a narrow central air intake passage 5433 to an upper air intake chamber 5432. The air can then pass to a remainder of the ink storage space through the upper air intake aperture 5435.

The frame body 5110 includes an ink filling chamber 5150 including an ink filling chamber wall 5451. The ink filling chamber 5150 is fitted with a stopper 5520 having a top surface 5520*a*. When the stopper 5520 is partially inserted into the ink filling chamber 5150, it is possible to introduce ink into the ink storage space by inserting an ink insertion needle (not shown) through the top surface 5520*a* of the stopper 5520 and into a space below the stopper 5520 in the ink filling portion 5150.

The frame body 5110 further includes a detector 5470 for detecting the presence, absence and/or amount of ink in the ink cartridge 5001. The detector 5470 includes a detector float 5471, a detector mounting pin 5472*a*, and a detector arm 5473. The detector float 5471 is buoyant in ink, permitting the detector 5470 to move in response to a level of ink in the ink storage space. The detector mounting pin 5472*a* is seated on the detector mount 5425 in the ink storage space when the ink cartridge 5001 is assembled. The detector mounting pin 5472*a* and the detector mount 5425 are configured so that the detector 5470 rotates about the detector mount 5425 in response to an amount of ink in the ink storage space. The detector arm 5473 includes a float arm portion 5473*a* adjacent to the detector float 5471, a detector plate 5473*c* at an end of the detector 5470 opposite from the detector float 5471, and a plate arm portion 5473*b* extending between the float arm portion 5473*a* and the detector plate 5473*c*. The detector plate 5473*c* is capable of obstructing a beam of light, and is configured to move into and out of the ink detection projection 5140 in response to the amount of ink in the ink storage space.

Outside of the ink storage space of the frame body 5110, positioning apertures 5460*a*, 5460*b*, 5460*c* are provided. The positioning apertures 5460*a*, 5460*b*, 5460*c* ensure the position of the frame body 5110, when the frame is fitted in the case 5200. In particular, the positioning apertures 5460*a*, 5460*b*, 5460*c* engage the positioning pins 5215*a*, 5215*b*, 5215*c* of the case 5200.

FIG. 64 shows the operation of mounting the ink cartridge 5001 to the inkjet printer 6000. FIG. 64(*a*) is a cross sectional view of the ink cartridge 5001 and the inkjet printer 6000 prior to mounting, FIG. 64(*b*) is a cross sectional view of the ink cartridge 5001 and the inkjet printer 6000 during mounting, and FIG. 64(*c*) is a cross sectional view of the ink cartridge 5001 and the inkjet printer 6000 after mounting.

As shown in FIG. 64(*a*), the inkjet printer 6000 includes a cartridge mounting assembly 6010 for mounting the ink cartridge 5001. The cartridge mounting assembly 6010 includes receiving walls 6011 for receiving the sides of the ink cartridge 5001. The receiving wall 6011 on the side of the cartridge mounting assembly 6010 corresponding to the intake side of the ink cartridge 5001 includes an intake side engaging protrusion 6011*a*. The ink cartridge mounting assembly 6010 also includes a mounting base 6013 for receiving a bottom portion of the ink cartridge 5001. The mounting base 6013 includes an ink passage 6013*a* for supplying ink to a print head (not shown). An ink extraction tube 6015 is connected to the ink passage 6013*a* and extends away from the mounting base 6013 (extends to the left in FIG.64). The mounting base 6013 further includes an air passage 6013*b* through which air can be provided to the ink cartridge 5001.

A detection device 6014 is provided on the mounting base 6013. The detection device includes a light emitting portion 6014*a* and a light receiving portion (not shown). The detection device 6014 is configured to receive the ink detection projection 5140 between the light emitting portion 6014*a* and the light receiving portion.

At the locations where the mounting base 6013 intersects with the receiving walls 6011, a supply side recess 6016*a* and an intake side recess 6016*b* are provided. An intake side displacement projection 6016*b*1 is provided along the intake side receiving wall 6011 adjacent to the intake side recess 6016*b*.

A cover 6017 is provided at an edge (right-side edge in FIG. 64) of the supply side receiving wall 6011. The cover includes a cover hinge projection 6017*a*, a cover hinge 6017*b* and a cover upper surface 6017*c*. The cover 6017 is further provided with a cover end projection 6017*d* that engages a cover receiving recess 6018 of the cartridge mounting assembly 6010.

As shown in FIG. 64(*a*), prior to mounting, the cover 6017 of the cartridge mounting assembly 6010 is opened, and the ink cartridge 5001 is positioned so that a bottom surface of the ink cartridge 5001 (after the cap 5300 is removed) will be inserted first into the inkjet printer 6000. The mounting procedure begins by moving the ink cartridge 5001 in the direction shown by the arrow E. As shown in FIG. 64(*b*), the ink cartridge 5001 is inserted into the space defined by the mounting base 6013 and the receiving walls 6011. As the ink cartridge 5001 is inserted into the space, the front intake side projection portion 5224*b* of the ink cartridge 5001 contacts the intake side displacement projection 6016*b*1, causing the intake side receiving wall 6011 to be moved outwardly away from front intake side outer surface 5227 of the ink cartridge 5001.

When the ink cartridge 5001 is fully inserted into the cartridge mounting assembly 6010, the intake side receiving wall 6011 returns toward the intake side outer surface 5227 of the ink cartridge 5001, and the intake side engaging protrusion 6011*a* engages the intake side recess 5227*b* of the ink cartridge 5001. The supply side restrictor plate 5226*b* engages the cover hinge projection 6017*a*, and the cover 6017 is closed over the top surface of the ink cartridge 5001 in the direction of the arrow F. The ink extraction tube 6015 is inserted into the ink supply port 5120, the air intake port 5130 is moved into proximity with the air passage 6013*b*, and the ink detection projection 5140 is located between the light emitting portion 6014*a* and the light receiving portion. When the ink cartridge 5001 is positioned as shown in FIG. 64(*c*), the inkjet printer 6000 can perform printing operations.

Figure 65:
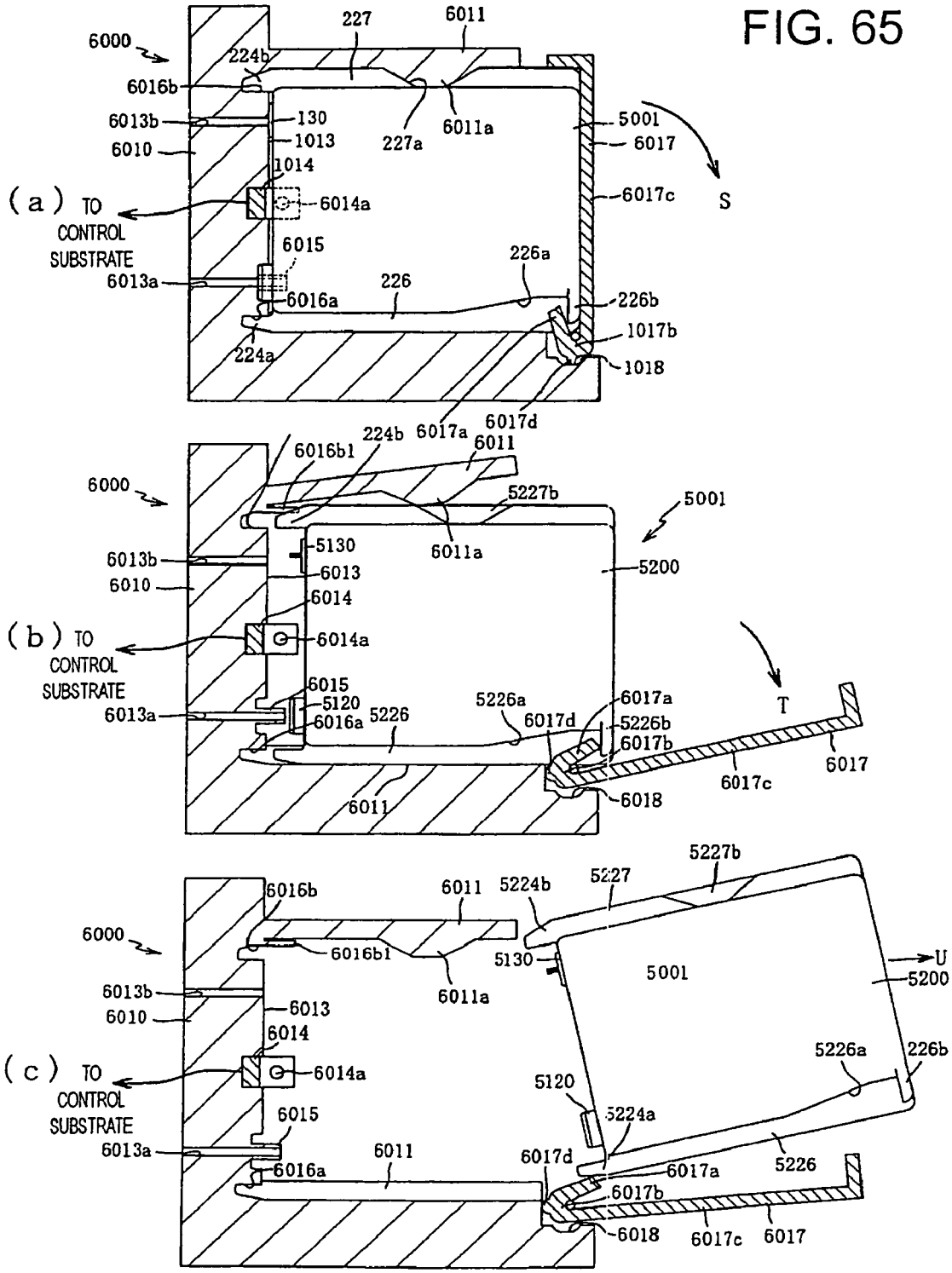
FIG. 65(*a*) is a cross sectional view of an exemplary ink cartridge and an exemplary inkjet printer according to the present invention prior to dismounting of the ink cartridge.

FIG. 65 shows the operation of dismounting the ink cartridge 5001 from the inkjet printer 6000. FIG. 65(*a*) is a cross sectional view of the ink cartridge 5001 and the inkjet printer 6000 prior to dismounting, FIG. 65(*b*) is a cross sectional view of the ink cartridge 5001 and the inkjet printer 6000 during dismounting, and FIG. 65(*c*) is a cross sectional view of the ink cartridge 5001 and the inkjet printer 6000 after dismounting.

In FIG. 65(*a*), the ink cartridge 5001 is positioned as shown in FIG. 64(*c*). The dismounting procedure begins by lifting the cover 6017 in the direction shown with the arrow S. As the cover 6017 is further lifted as shown by the arrow T, the cover hinge projection 6017*a* engages and moves the supply side restrictor plate 5226*b* of the ink cartridge 5001. The force created by the engagement of the cover hinge projection 6017*a* and the supply side restrictor plate 5226*b* causes disengagement of other portions of the ink cartridge 5001 and the cartridge mounting assembly 6010. The intake side engaging protrusion 6011*a* disengages from the intake side recess 5227*b*. The front supply side projection portion 5224*a* and the front intake side projection portion 5224*b* disengage from the supply side recess 6016*a* and the intake side recess 6016*b*, respectively. The ink supply port 5120 disengages from the ink extraction tube 6015, and the ink detection projection 5140 disengages from the detection device 6014.

After the various features of the ink cartridge 5001 disengage from the various features of the cartridge mounting assembly 6010, as discussed above, dismounting is completed by completely removing the ink cartridge 5001, as shown by the arrow U.

Figure 66:
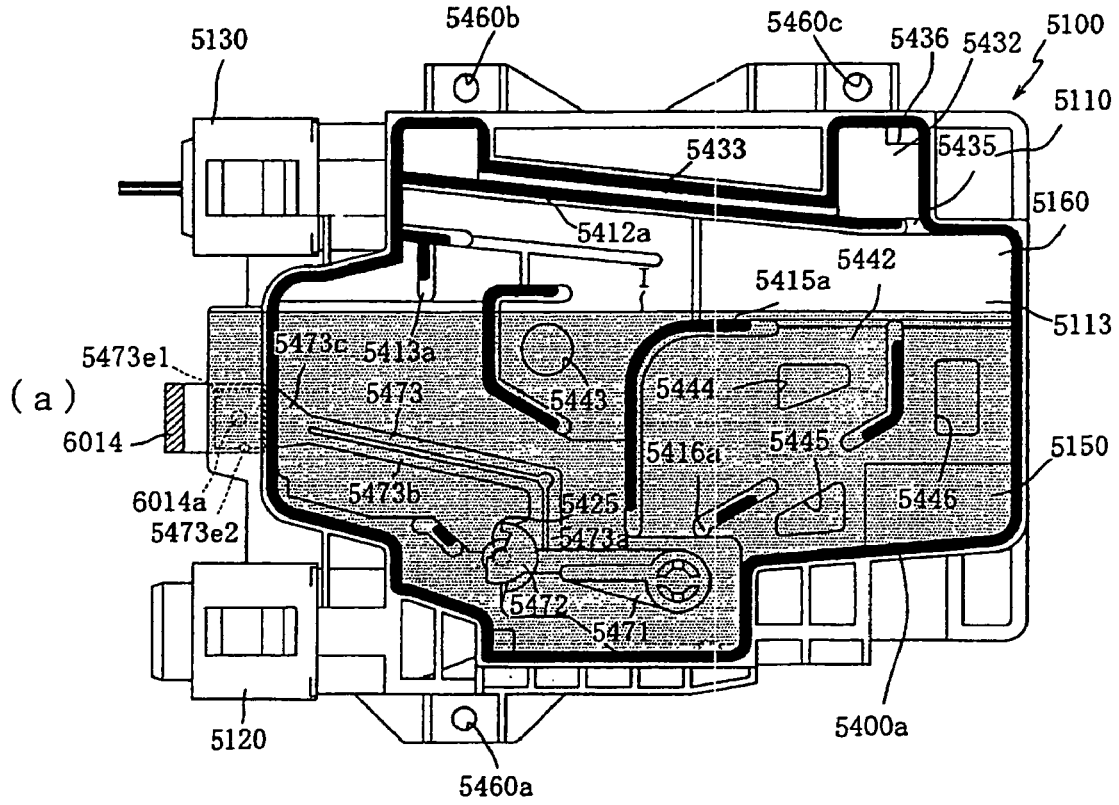
FIG. 66(*a*) is a front view of a frame of an exemplary ink cartridge according to the present invention filled with ink.
Figure 66:
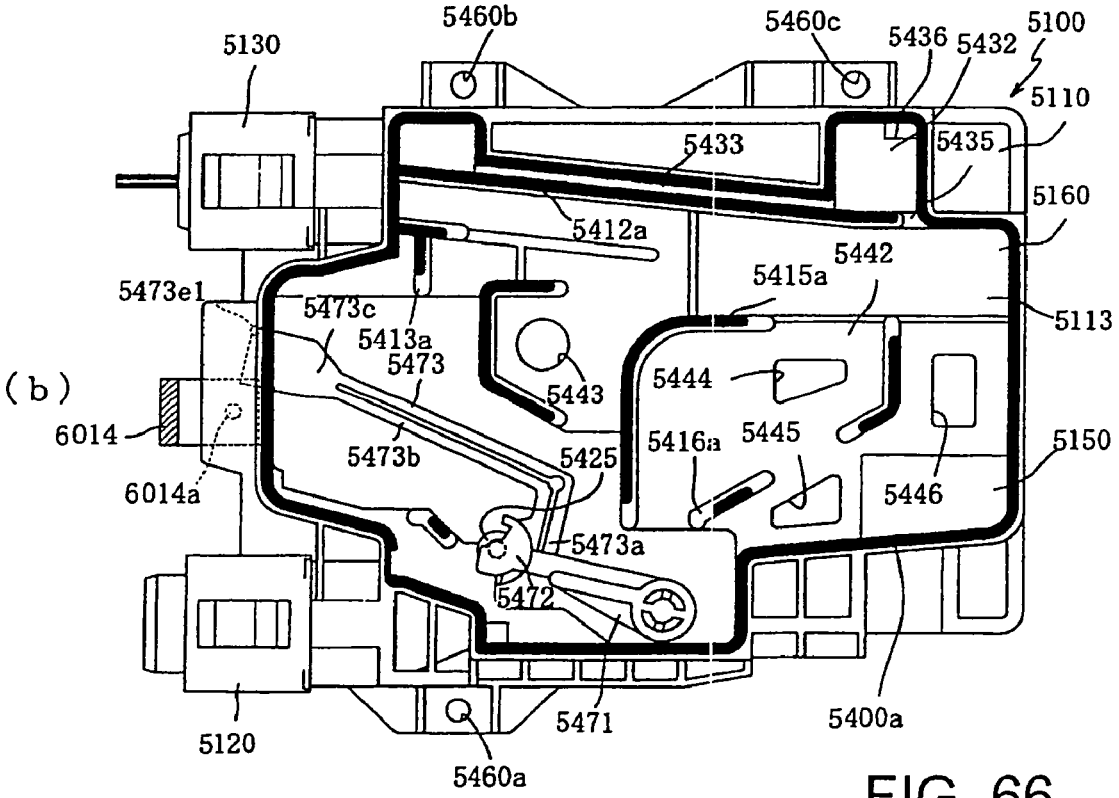

FIG. 66 shows operation of the detector 5470. FIG. 66(*a*) is a front view of the frame body 5110 filled with ink, and FIG. 66(*b*) is a front view of the frame body 5110 emptied of ink. As shown FIG. 66(*a*), when the frame body 5110 is filled with ink, the detector plate 5473*c* of the detector 5470 is located within the ink detection projection 5140 at a location between the light emitting portion 6014*a* and the light receiving portion of the detection device 6014 of the inkjet printer 6000. In this state, the detector plate 5473*c* prevents light emitted by the light emitting portion 6014*a* from reaching the light receiving portion. When this obstruction takes place, the detection device 6014 determines that there is sufficient ink in the frame body 5110 to conduct printing operations. As shown in FIG. 66(*b*), when the frame body 5110 is emptied of ink, the detector plate 5473*c* has moved out of the location between the light emitting portion 6014*a* and the light receiving portion of the detection device 6014. In this state, light emitted by the light emitting portion 6014*a* reaches the light receiving portion, and the detection device 6014 determines that there is sufficient ink in the frame body 5110 to conduct printing operations.

The detector 5470 (and thus the detector plate 5473*c*) moves in response to changes in an amount of ink in the frame body 5110. In particular, the detector float 5471 is buoyant in ink. Accordingly, as the level of ink rises, the detector float 5471 rises also. The detector 5470 is rotatably mounted to the frame body 5110, and the detector plate 5473*c* is located on an opposite end of the detector 5470 from the detector float 5471. Accordingly, as the detector float 5471 rises with the level of ink, the detector plate 5473*c* is rotated downwardly into the location between the light emitting portion 6014*a* and the light receiving portion of the detection device 6014. Likewise, as the detector float 5471 sinks with the level of ink, the detector plate 5473*c* is rotated upwardly out of the location between the light emitting portion 6014*a* and the light receiving portion of the detection device 6014. Thus, movement of the detector plate 5473*c* with the level of ink in the frame body 5110 allows detection of the presence, absence and/or amount of ink in the frame body 5110, when the ink cartridge 5001 is installed in the inkjet printer 6000.

Figure 67:
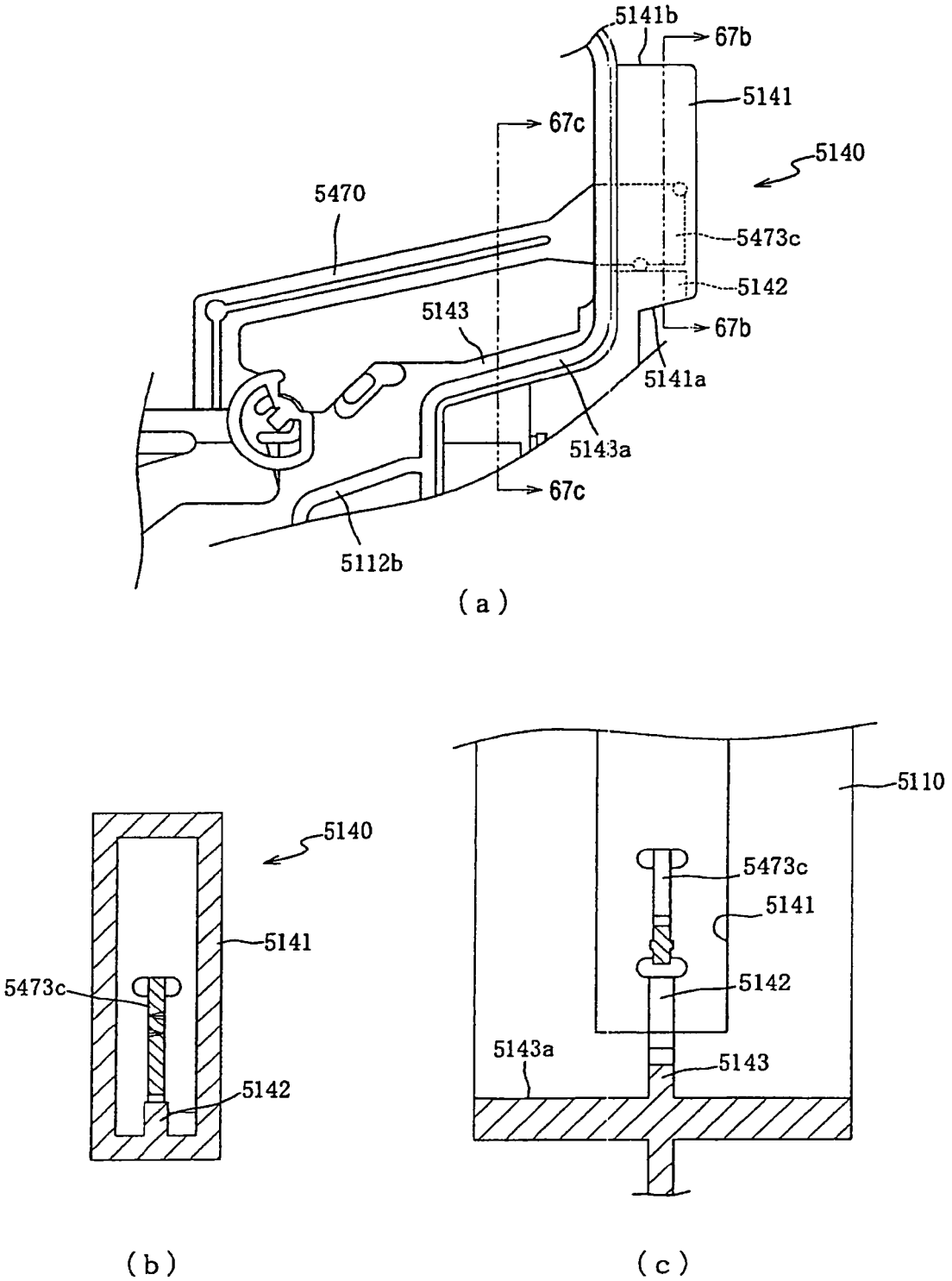
FIG. 67(*a*) is a front view of an ink detection projection of an exemplary ink cartridge according to the present invention.

FIG. 67 shows the ink detection projection 5140 of the frame body 5110. FIG. 67(*a*) is a front view of the ink detection projection 5140, and FIGS. 67(*b*) and (*c*) are cross sectional views of the ink detection projection 5140.

As shown in FIG. 67(*a*), the ink detection projection 5140 includes an ink detection recess 5141 bounded by an ink detection supply wall 5141*a* and an ink detection intake sidewall 5141*b*. Within the ink detection recess 5141, ink detection restricting wall 5142 is provided. In proximity to the ink detection projection, a detector area sidewall 5143*a* and a detector area partition 5143 are provided.

As can be seen in FIGS. 67(*b*) and (*c*), when the ink cartridge 5001 is sufficiently full of ink, the detector plate 5473*c* of the detector 5470 is positioned within the ink detection recess 5141. The detector plate 5473*c* is seated on the ink detection restricting wall 5142. These structures ensure that, when the ink cartridge 5001 is sufficiently full of ink, the detector plate 5473*c* is positioned such that the detector plate 5473*c* is positioned between the light emitting portion 6014*a* and the light receiving portion of the detection device 6014 of the inkjet printer 6000.

Figure 68:
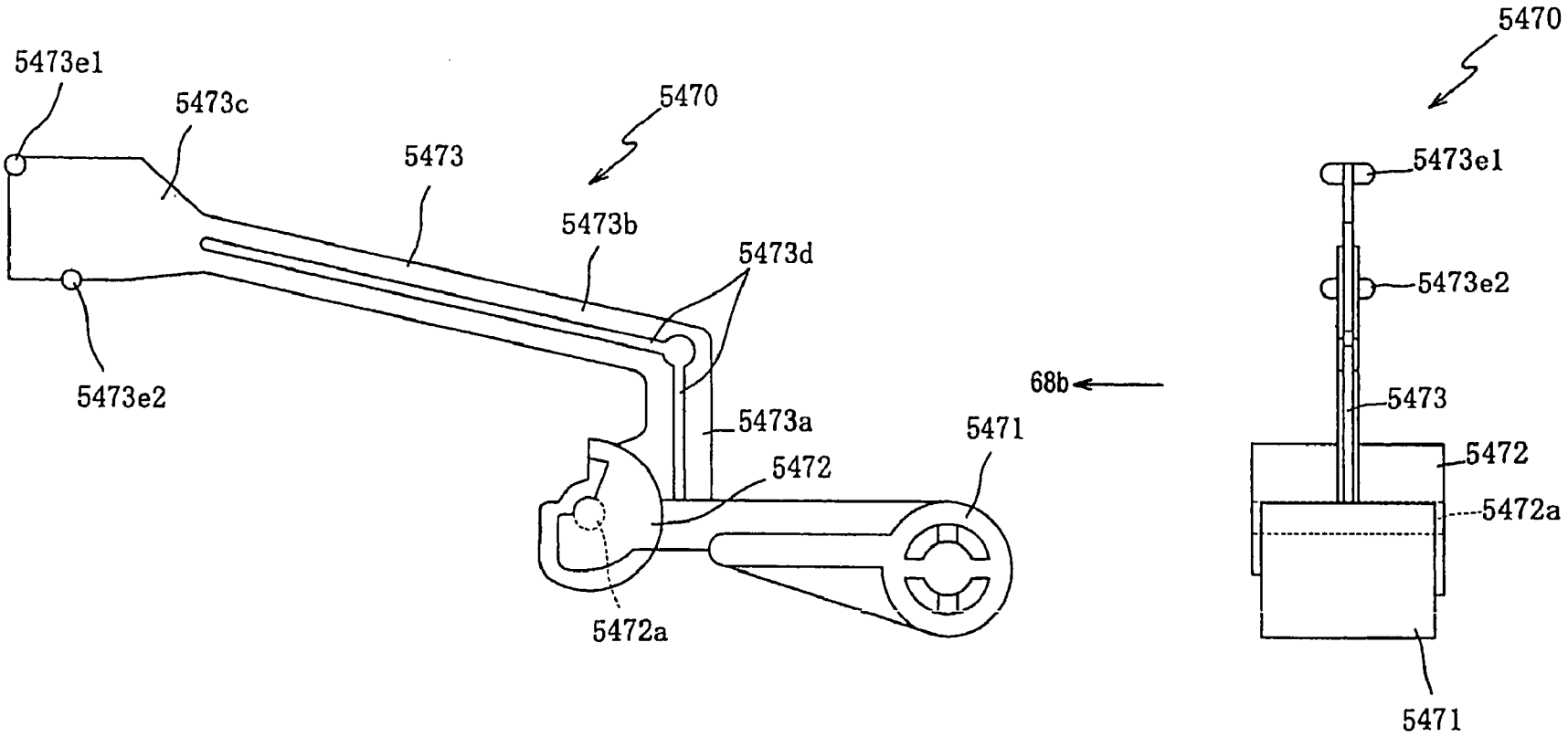
FIG. 68(*a*) is a side view of a detector of an exemplary ink cartridge according to the present invention.

FIG. 68 shows the detector 5470. FIG. 68(*a*) is a side view of the detector 5470, and FIG. 68(*b*) is an end view of the detector 5470. The various features of the detector 5470, discussed above, are shown in FIG. 68. In particular, the detector 5470 includes the detector float 5471, a detector mounting portion 5472 including the detector mounting pin 5472*a*, and the detector arm 5473. The detector arm 5473 includes the float arm portion 5473*a* adjacent to the detector float 5471, the detector plate 5473*c* at an end of the detector 5470 opposite from the detector float 5471, and the plate arm portion 5473*b* extending between the float arm portion 5473*a* and the detector plate 5473*c*. The detector arm 5473 is further provided with detector ribs 5473*d* protruding from lateral surfaces of the detector arm 5473 to improve the structural stability of the detector arm 5473.

FIG. 68 further shows the detector plate pins 5473*e*1, 5473*e*2. The detector plate pins 5473*e*1, 5473*e*2 extend outwardly from each face of the detector plate 5473*c*, and thus prevent the relatively large flat surface of the detector plate 5473*c* from "sticking" to similarly flat surfaces of the inner surface of the ink detection recess 5141 due to the presence of ink between the flat surfaces. The pins 5473*e*1, 5473*e*2 thus prevent the potential erroneous ink detection that could result if the detector plate 5473*c* adheres to an inner surface of the ink detection recess 5141 as the ink level in the ink cartridge 5001 declines.

While this invention has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. An ink cartridge, comprising:

a cartridge case;

an ink chamber situated within the cartridge case;

an ink supply opening formed in the cartridge case for supplying ink from the ink chamber to an exterior of the cartridge;

an elastic member positioned within the ink supply opening; and a lever mechanism provided in the ink chamber, the lever mechanism including a light blocking member at a first end of the lever mechanism, the lever mechanism being rotatable about a rotation point on the lever mechanism, the rotation point being located between the first end and a second end of the lever mechanism, and the light blocking member being movable in association with rotation of the lever mechanism;

wherein:

the cartridge case includes at least a first side wall, a second side wall and a third side wall, the first side wall being opposite from the second side wall and the third side wall extending from the first side wall to the second side wall;

the ink chamber is situated within at least the first side wall, the second side wall and the third side wall;

the cartridge case comprises a protrusion extending away from the ink chamber, the protrusion including an interior space that opens into the ink chamber;

the light blocking member is movable between a first position and a second position in association with rotation of the lever mechanism;

at least the first position is located in the interior space of the protrusion;

the cartridge case has a first width from the first side wall to the second side wall and a second width from a first side wall-side of the protrusion to a second side wall-side of the protrusion;

the first width is greater than the second width; and at least a portion of the first side wall-side of the protrusion and at least a portion of the second side wall-side of the protrusion are translucent.

2. The ink cartridge of claim 1, wherein a groove is formed in the third wall, and the protrusion is positioned within the groove and divides at least a part of the groove into a first space and a second space.

3. The ink cartridge of claim 1, wherein:

at least a portion of the first side wall extends beyond the third side wall in a direction that the protrusion extends away from the ink chamber; and at least a portion of the second side wall extends beyond the third side wall in the direction that the protrusion extends away from the ink chamber.

4. The ink cartridge of claim 1, wherein:

the cartridge case comprises an inner cartridge case and an outer cartridge case;

the inner cartridge case comprises the first side wall, the second side wall and the third side wall;

the outer case comprises a first case wall outside of and adjacent to the first side wall and a second case wall outside of and adjacent to the second side wall;

at least a portion of the first case wall extends beyond the third side wall in a direction that the protrusion extends away from the ink chamber; and at least a portion of the second case wall extends beyond the third side wall in the direction that the protrusion extends away from the ink chamber.

5. The ink cartridge of claim 1, wherein the lever mechanism further comprises a float at the second end of the lever mechanism.

6. The ink cartridge of claim 5, wherein the rotation point is located closer to the second end of the lever mechanism than to the first end of the lever mechanism.

7. The ink cartridge of claim 5, wherein:

the cartridge case further comprising a fifth side wall;

the fifth side wall contacts each of the first side wall, the second side wall and the third side wall;

the ink supply opening is formed through the fifth side wall; and a distance between the float and the fifth side wall is less than a distance between the protrusion and the fifth side wall.

8. The ink cartridge of claim 5, wherein:

the cartridge case further comprising a fifth side wall;

the fifth side wall contacts each of the first side wall, the second side wall and the third side wall;

the ink supply opening is formed through the third side wall;

a distance between the ink supply opening and the fifth side wall is less than a distance between the protrusion and the fifth side wall; and a distance between the float and the fifth side wall is less than the distance between the protrusion and the fifth side wall.

9. The ink cartridge of claim 1, wherein the cartridge case further comprises a fourth side wall opposite from the third side wall;

wherein:

at least a portion of the fourth side wall comprises a flexible film; and the second end of the lever mechanism is configured to be actuated by the flexible film when an amount of ink in the ink chamber is reduced.

10. The ink cartridge of claim 1, wherein the elastic member is rubber.

11. The ink cartridge of claim 1, further comprising an air introduction portion configured to introduce air into the ink chamber from the exterior of the ink cartridge.

12. The ink cartridge of claim 11, further comprising a valve situated within the ink supply opening and configured to move between a first position to shut off communication between the ink chamber and the exterior of the ink cartridge, and a second position to permit the communication between the ink chamber and the exterior of the ink cartridge.

13. The ink cartridge of claim 12, wherein the protrusion is located between the ink supply opening and the air introduction portion.

14. The ink cartridge of claim 1, wherein:

the cartridge case further comprises a grasping portion configured to be grasped by a user;

the cartridge case has a third width from a first side wall-side of the grasping portion to a second side wall-side of the grasping portion; and the first width is greater than the third width.

15. The ink cartridge of claim 14, wherein:

the cartridge case further comprises a fifth side wall and a sixth side wall;

the fifth side wall contacts each of the first side wall, the second side wall and the third side wall;

the sixth side wall is opposite to the fifth side wall;

the ink supply opening is formed through the fifth side wall; and the griping portion is formed on the sixth side wall.

16. The ink cartridge of claim 1, wherein:

the cartridge case further comprising a fourth side wall, a fifth side wall and a sixth side wall;

the fourth side wall is opposite from the third side wall and contacts each of the first side wall, the second side wall, the fifth side wall and the sixth side wall;

the fifth side wall contacts each of the first side wall, the second side wall, the third side wall and the fourth side wall;

the sixth side wall is opposite from the fifth side wall and contacts each of the first side wall, the second side wall, the third side wall and the fourth side wall; and an area of each of the first side wall and the second side wall is greater than an area of each of the third side wall, the fourth side wall, the fifth side wall and the sixth side wall.

17. The ink cartridge of claim 16, wherein:

the light blocking member comprises a plate; and the plate is substantially parallel with the first side wall and the second side wall.

* * * * *

UNITED STATES PATENT AND TRADEMARK OFFICE

CERTIFICATE OF CORRECTION

PATENT NO. : 7,300,144 B2
APPLICATION NO. : 11/605954
DATED : November 27, 2007
INVENTOR(S) : Naoki Katayama et al.

It is certified that error appears in the above-identified patent and that said Letters Patent is hereby corrected as shown below:

Title page, in item [63], change:

"Continuation of application No. 11/391,644, filed on Mar. 29, 2006, now Pat. No. 7,178,911, which is a continuation-in-part of application No. 11/024,624, filed on Dec. 30, 2004, and a continuation-in-part of application No. 10/938,840, filed on Sep. 13, 2004, which is a continuation-in-part of application No. 10/255,604, filed on Sep. 27, 2002, now Pat. No. 7,137,689, said application No. 11/391,644 is a continuation-in-part of application No. 11/101,447, filed on Apr. 8, 2005, now Pat. No. 7,033,011, which is a continuation of application No. 10/614,126, filed on Jul. 8, 2003, now Pat. No. 6,893,118, which is a continuation of application No. 10/108,394, filed on Mar. 29, 2002, now Pat. No. 6,616,255."

to read:

--Continuation of U.S. patent application Ser. No. 11/391,644, filed Mar. 29, 2006 which is a continuation-in-part of: U.S. patent application Ser. No. 11/024,624, filed on Dec. 30, 2004 (which is a continuation-in-part of U.S. patent application Ser. No. 10/255,604, filed Sep. 27, 2002 now U.S. Pat. No. 7,137,689 and U.S. patent application Ser. No. 10/938,840, filed on Sep. 13, 2004) and U.S. patent application Ser. No. 11/101,447, filed Apr. 8, 2005 now U.S. Pat. No. 7,033,011 (which is a continuation of U.S. patent application Ser. No. 10,614,126, filed Jul. 8, 2003, now U.S. Pat. No. 6,893,118 which, in turn, is a continuation of U.S. patent application Ser. No. 10/108,394, filed Mar. 29, 2002) now U.S. Pat. No. 6,616,255.--

Column 1, lines 23-35, change:

"This application is a continuation-in-part: U.S. patent application Ser. No. 11/024,624, filed Dec. 30, 2004 (which is a continuation-in-part of U.S. patent application Ser. No. 10/255,604, filed Sep. 27, 2002 now U.S. Pat. No. 7,137,689 and U.S. patent application Ser. No. 10/938,840, filed Sep. 13, 2004) and U.S. patent application Ser. No. 11/101,447, filed Apr. 8, 2005 now U.S. Pat. No. 7,033,011 (which is a continuation of U.S. patent application Ser. No. 10/614,126, filed Jul. 8, 2003, now U.S. Pat. No. 6,893,118 which, in turn, is a continuation of U.S. patent application Ser. No. 10/108,394, filed Mar. 29, 2002) now U.S. Pat. 6,616,255, the disclosures of which are incorporated herein by reference in their entireties."

UNITED STATES PATENT AND TRADEMARK OFFICE

CERTIFICATE OF CORRECTION

PATENT NO. : 7,300,144 B2
APPLICATION NO. : 11/605954
DATED : November 27, 2007
INVENTOR(S) : Naoki Katayama et al.

It is certified that error appears in the above-identified patent and that said Letters Patent is hereby corrected as shown below:

to read:

--This application is a continuation of U.S. patent application Ser. No. 11/391,644, filed Mar. 29, 2006 which is a continuation-in-part of: U.S. patent application Ser. No. 11/024,624, filed on Dec. 30, 2004 (which is a continuation-in-part of U.S. patent application Ser. No. 10/255,604, filed Sep. 27, 2002 now U.S. Pat. No. 7,137,689 and U.S. patent application Ser. No. 10/938,840, filed on Sep. 13, 2004) and U.S. patent application Ser. No. 11/101,447, filed Apr. 8, 2005 now U.S. Pat. No. 7,033,011 (which is a continuation of U.S. patent application Ser. No. 10,614,126, filed Jul. 8, 2003, now U.S. Pat. No. 6,893,118 which, in turn, is a continuation of U.S. patent application Ser. No. 10/108,394, filed Mar. 29, 2002) now U.S. Pat. No. 6,616,255, the disclosures of which are incorporated herein by reference in their entireties.--

Column 3, line 23, change “of FIG. 16” to --in FIG. 16--.

Column 4, line 49, change “attachement/detachment” to --attachment/detachment--.

Column 5, line 1, change “FIGS. 58A” to --FIG. 58A--.

Column 7, lines 50-51, change “recording sheet recording sheet” to --recording sheet--.

Column 9, line 30, change “to the inside to the engine housing 62.” to --to the inside of the engine housing 62--.

Column 12, lines 15-16, change “FIG. 112” to --FIG. 10--.

Column 13, line 40, change “later” to --later,--.

Column 13, line 49, change “is not block” to --is not blocked--.

Column 16, line 18, change “by the through a small-diameter” to --through a small-diameter--.

Column 19, line 28, change “extend from on opposite sides” to --extend from opposite sides--.

Column 21, lines 62-63, change “disposed inserted” to --inserted--.

Column 21, line 64, change “toward to” to --toward--.

Column 22, line 58, change “FIG. retrieval unit 10” to --FIG. 10--.

UNITED STATES PATENT AND TRADEMARK OFFICE

CERTIFICATE OF CORRECTION

PATENT NO. : 7,300,144 B2
APPLICATION NO. : 11/605954
DATED : November 27, 2007
INVENTOR(S) : Naoki Katayama et al.

It is certified that error appears in the above-identified patent and that said Letters Patent is hereby corrected as shown below:

Column 25, line 19, change "partition walls 10" to --partition walls 110--.

Column 27, line 57, change "ink supply hole ink supply hole" to --ink supply hole--.

Column 31, line 9, change "of an user" to --of a user--.

Column 32, line 19, change "accommodates" to --accommodated--.

Column 34, line 62, change "reduces it" to --reduces its--.

Column 39, line 39, change "of an exemplary as shown" to --of an exemplary embodiment as shown--.

Column 53, line 33, change "will not received" to --will not be received--.

Column 57, line 43, change "projections 5300a, 5330b" to --projections 5330a, 5330b--.

Signed and Sealed this

Twenty-third Day of September, 2008

JON W. DUDAS
*Director of the United States Patent and Trademark Office*